US006027108A

United States Patent [19]

Johdai et al.

[11] Patent Number: 6,027,108

[45] Date of Patent: Feb. 22, 2000

[54] SHEET CONVEYING APPARATUS

[75] Inventors: Akiyoshi Johdai; Masao Kondo, both of Toyokawa; Koji Higashikawa, Kumamoto, all of Japan

[73] Assignee: Minolta Co., Ltd., Osaka, Japan

[21] Appl. No.: 09/017,503

[22] Filed: Feb. 2, 1998

[30] Foreign Application Priority Data

Feb. 3, 1997 [JP] Japan ..... 9-035481
Feb. 3, 1997 [JP] Japan ..... 9-035492

[51] Int. Cl.[7] ..... B65H 5/22

[52] U.S. Cl. ..... 271/3.02; 271/3.05; 271/3.13; 271/259; 271/258.04; 399/370; 399/371; 399/373

[58] Field of Search ..... 271/3.02, 3.05, 271/3.13, 3.04, 259, 258.04, 265.02; 399/370, 371, 372, 373

[56] References Cited

U.S. PATENT DOCUMENTS

| | | | |
|---|---|---|---|
| 3,944,794 | 3/1976 | Rechil et al. . | |
| 4,739,369 | 4/1988 | Yoshiura et al. . | |
| 4,896,876 | 1/1990 | Yamada et al. | 271/258.03 |
| 4,905,044 | 2/1990 | Hamano . | |
| 4,908,673 | 3/1990 | Muramatsu . | |
| 4,956,651 | 9/1990 | Emori . | |
| 4,957,285 | 9/1990 | Yamada | 271/126 |
| 5,008,709 | 4/1991 | Shinada et al. . | |
| 5,031,003 | 7/1991 | Hamano . | |
| 5,084,741 | 1/1992 | Takemura et al. . | |
| 5,327,206 | 7/1994 | Ueda et al. . | |
| 5,460,360 | 10/1995 | Kotani et al. | 271/3.13 |
| 5,559,594 | 9/1996 | Ohhata et al. . | |
| 5,754,934 | 5/1998 | Kamezaki et al. | 271/3.05 |
| 5,822,673 | 10/1998 | Tanjo | 271/3.01 |

FOREIGN PATENT DOCUMENTS

| | | |
|---|---|---|
| 06138737 | 5/1994 | Japan . |
| 06148976 | 5/1994 | Japan . |
| 06148977 | 5/1994 | Japan . |
| 06148978 | 5/1994 | Japan . |
| 06148979 | 5/1994 | Japan . |

*Primary Examiner*—H. Grant Skaggs
*Attorney, Agent, or Firm*—McDermott, Will & Emery

[57] ABSTRACT

The present invention relates to a sheet conveying apparatus for conveying a sheet in recirculation. The apparatus comprises a feed tray, a feed mechanism, a recirculation conveying mechanism for conveying the sheet fed by the feed mechanism to return it to the feed tray. The recirculation conveying mechanism includes a discharge tray on which the plurality of sheets are temporally discharged and accumulated and a moving mechanism for moving the sheets accumulated on the discharge tray to the feed tray. The apparatus further comprises a feed sensor detecting whether or not any sheets present on the feed tray. The sheets discharged on the discharge tray are moved to the feed tray by the moving mechanism when all sheets on the feed tray are fed and the feed sensor detects none of the sheet.

12 Claims, 112 Drawing Sheets

SS3
OPEN / CLOSE CHECK
SS3-1
ADF CLOSE ?
NO
YES
SS3-7
JAM RESET
SS3-2
F-SIDE COVER CLOSE ?
NO
YES
SS3-3
D-SIDE COVER CLOSE ?
NO
YES
SS3-4
K≠2 ?
NO
YES
SS3-5
HOME POSITION CHECK
SS3-8
MODE
S STATUS
H STATUS
DCNT1～3
SIZCNT1
SIZE
←OOH
SS3-9
T101～301 RESET
SS3-12
NOT UNDER COPYING ?
NO
YES
SS3-10
EACH FLAG RESET
SS3-6
DOCUMENT-LEFT CHECK
SS3-11
M1～4 OFF
SL1 OFF
RTS

SS5-3
START CHECK
SS5-3-1
SE1 ON ?
NO
YES
SS5-3-3
DCNT1←01H
SS5-3-2
DCNT1←00H
SS5-3-3.1
STOPPER TROUBLE2 =1?
NO
YES
SS5-3-2.1
ALARM FLAG=1 ?
NO
YES
SS5-3-4
DCHG=1?
NO
YES
SS5-3-3.2
ALARM FLAG←1
SS5-3-2.2
ALARM FLAG←0
SS5-3-4.1
REFEED LEVER OUT OF OPE.?
NO
YES
RTS
RTS
SS5-3-5
DCHG←0
SS5-3-6
K←3
SS5-3-7
DOC.MODE?
PRESTEP
2 IN 1
BOTH SIDE
COUNT
IDLE FEED
SWEEP OUT
SS5-3-8
SS5-3-9
SS5-3-10
SS5-3-11
SS5-3-14
SS5-3-15
MODE ←01H
MODE ←02H
MODE ←04H
MODE ←03H
MODE ←05H
MODE ←06H
SS5-3-12
DCNT1 DECREMENT
SS5-3-13
FEED AMOUNT SET
RTS

SHEET CONVEYING APPARATUS

This application is based on applications Nos. 9-35492 and 9-35481 in Japan, the contents of which is hereby incorporated by reference.

BACKGROUND OF THE INVENTION

The present invention relates to a recirculation type sheet conveying apparatus equipped with a sheet tray which couples proximities of the feed port and discharge port to each other in a continuous surface. More specifically, the invention relates to a refeed member which moves discharged sheets to the feed port.

Conventionally, there has been proposed a variety of recirculation type sheet conveying apparatus in which a plurality of sheets set on a feed try are fed one after another to convey them to a glass platen, subsequently the sheets are discharged to a discharge tray, and then the sheets are moved from the discharged tray to the feed tray to refeed them.

In this type of recirculation type sheet conveying apparatus, there are disadvantages as follows.

That is, after the completion of the first round of circulation, because there are no sheets on the feed tray until the second round of circulation is commenced, an operator is likely to carelessly set the next sheets on the feed tray. In this case, if the discharged sheets are moved to the feed tray from the discharge tray for the second round of circulation, then the discharged sheets are mixed into the next sheets carelessly set by the operator, or the discharged sheets are damaged.

Moreover, since a mechanism for discharging the sheets is positioned adjacent to the discharge tray, there is a little space necessary for the operator to take out the discharged sheets after completion of the final round of circulation, which makes movement of the operator difficult.

In addition, in the case that a different size of sheet is included in the sheets to be fed, even if such sheets are moved to the feed tray from the discharge tray, the front end of the sheets are not aligned, resulting in miss feeding.

SUMMARY OF THE INVENTION

The present invention has been accomplished in view of these and other problems.

It is an object of the invention is to provide a sheet conveying apparatus in which the discharged sheets are not mixed into the next sheets carelessly set by the operator, or the discharged sheets are not damaged.

It is an another object of the invention to provide a sheet conveying apparatus in which the operator can easily take out the discharged sheets after completion of the final round of circulation.

It is an another object of the invention to provide a sheet conveying apparatus in which movement of the sheets to the feed tray from the discharge tray is prohibited in the case that a different size of sheet is included in the sheets to be fed.

In order to achieve the above object, according to the present invention, there is provided a sheet conveying apparatus for conveying a sheet in recirculation, comprising:

a feed tray on which a plurality of sheets are set;

a feed mechanism for feeding the plurality of sheets set on the feed tray one by one;

a recirculation conveying mechanism for conveying the sheet fed by the feed mechanism to return it to the feed tray, the recirculation conveying mechanism including a discharge tray on which the plurality of sheets are temporally discharged and accumulated and a moving mechanism for moving the sheets accumulated on the discharge tray to the feed tray;

a feed sensor detecting whether or not any sheets present on the feed tray; and a controller which moves the sheets discharged on the discharge tray to the feed tray by the moving mechanism when all sheets on the feed tray are fed and the feed sensor detects none of the sheet.

It is preferable that the moving mechanism includes a refeed lever. The refeed lever protrudes from the discharge tray and is movable in the sheet conveying direction and opposite direction thereof, whereby the sheets discharged on the discharge tray are moved to the feed tray with the refeed lever moved in the sheet conveying direction.

It is preferable that the feed tray and discharge tray have a continuous common surface, and in the case of allowing the sheets to recirculate, the sheets discharged on the discharge tray are pushed by the refeed lever and moved to the feed tray along the common surface.

It is preferable that, in the case of allowing the sheets not to recirculate, the sheets discharged on the discharged tray are pushed by the refeed lever and moved to an intermediate position on the common surface between the discharge tray and the feed tray.

It is preferable that the apparatus further comprises an aligning mechanism which restricts the front end of the sheets discharged on the discharge tray to align the sheets on the discharge tray at different positions along the sheet conveying direction correspondingly to the sheet size.

It is preferable that the aligning mechanism includes a plurality of stoppers disposed at different positions along the sheet conveying direction correspondingly to the sheet size. Each of the plurality of stoppers is moveable between an operation position and a withdrawal position and restricts the front end of the sheet discharged on the discharge tray to align the sheet in the operation position.

It is preferable that the appratus further comprises a discharge sensor detecting whether or not any sheets present on the discharge tray, and that the controller prohibits the movement of the sheets by the moving mechanism in the case where the discharge sensor detects none of the sheet even if the feed sensor detects none of the sheet.

It is preferable that the controller stops the movement of the refeed lever in the sheet conveying direction to return it in the opposite direction in the case where the feed sensor detects presence of the sheets during the movement of the discharged sheets by the moving mechanism.

It is preferable that the controller moves the discharged sheets in a further predetermined distance in the case where the feed sensor does not detect presence of the sheets even if the discharged sheets are moved in a predetermined distance corresponding to the sheet size by the refeed lever.

It is preferable that the controller stops the movement of the sheets by the refeed lever in the case where the feed sensor does not detect presence of the sheets even if the discharged sheets are moved in the further predetermined distance by the refeed lever.

The present invention is also directed to a copying machine for executing copying process of document, comprising a document conveying apparatus for conveying the document to a copying position and circulating it and an image forming apparatus for copying the document conveyed to the copying position by the document conveying apparatus. In this case, the document conveying apparatus has features as described hereinbefore.

The present invention is also directed to a method for conveying sheet in recirculation, comprising the steps of:

feeding a plurality of sheets set on a feed tray one by one;

discharging the plurality of sheets fed through the step of feeding to a discharge try to temporary stock the sheets on the discharge tray;

detecting whether or not any sheets present on the feed tray;

moving the plurality of sheets stocked on the discharge tray through the step of discharging to the feed tray by pushing the rear end of the plurality of documents by means of a refeed lever; and refeeding the plurality of sheets moved through the step of moving to the feed tray by executing the step of feeding.

It is preferable that the method further comprises the step of aligning the plurality of sheets discharged through the step of discharge on the discharge tray.

The present invention is also directed to a sheet conveying apparatus for conveying a sheet in recirculation, comprising:

a feed tray on which a plurality of sheets are set;

a feed mechanism for feeding the plurality of sheets set on the feed tray one by one;

a recirculation conveying mechanism for conveying the sheet fed by the feed mechanism to return it to the feed tray, the recirculation conveying mechanism including a discharge tray on which the plurality of sheets are temporally discharged and accumulated and a moving mechanism for moving the sheets accumulated on the discharge tray to the feed tray; and a controller which decides whether or not all of the plurality of sheets fed by the feed mechanism are same size, and which, if same size, moves the plurality of sheets to the feed tray by the moving mechanism, and if not same size, prohibits the movement of the sheets of the feed tray by the moving mechanism.

It is preferable that the apparatus further comprises a warning means which gives a warning in the case where all of the plurality of sheets fed by the feed mechanism are not same size. In this case, preferably, the controller cancels the warning condition to put the sheet conveying apparatus in a standby condition in the case where all of the plurality of sheets are fed.

BRIEF DESCRIPTION OF THE DRAWINGS

FIG. 120 is a flow chart showing a subroutine for M6 move;

FIG. 121 is a flow chart showing a subroutine for count-up of T1, T2, T3; and FIG. 122 is a flow chart showing a subroutine for document move prevent control in the CPU 2.

DETAILED DESCRIPTION OF THE PREFERRED EMBODIMENTS

Hereinbelow, embodiments of the present invention are described with reference to the accompanying drawings.

Figure 1:
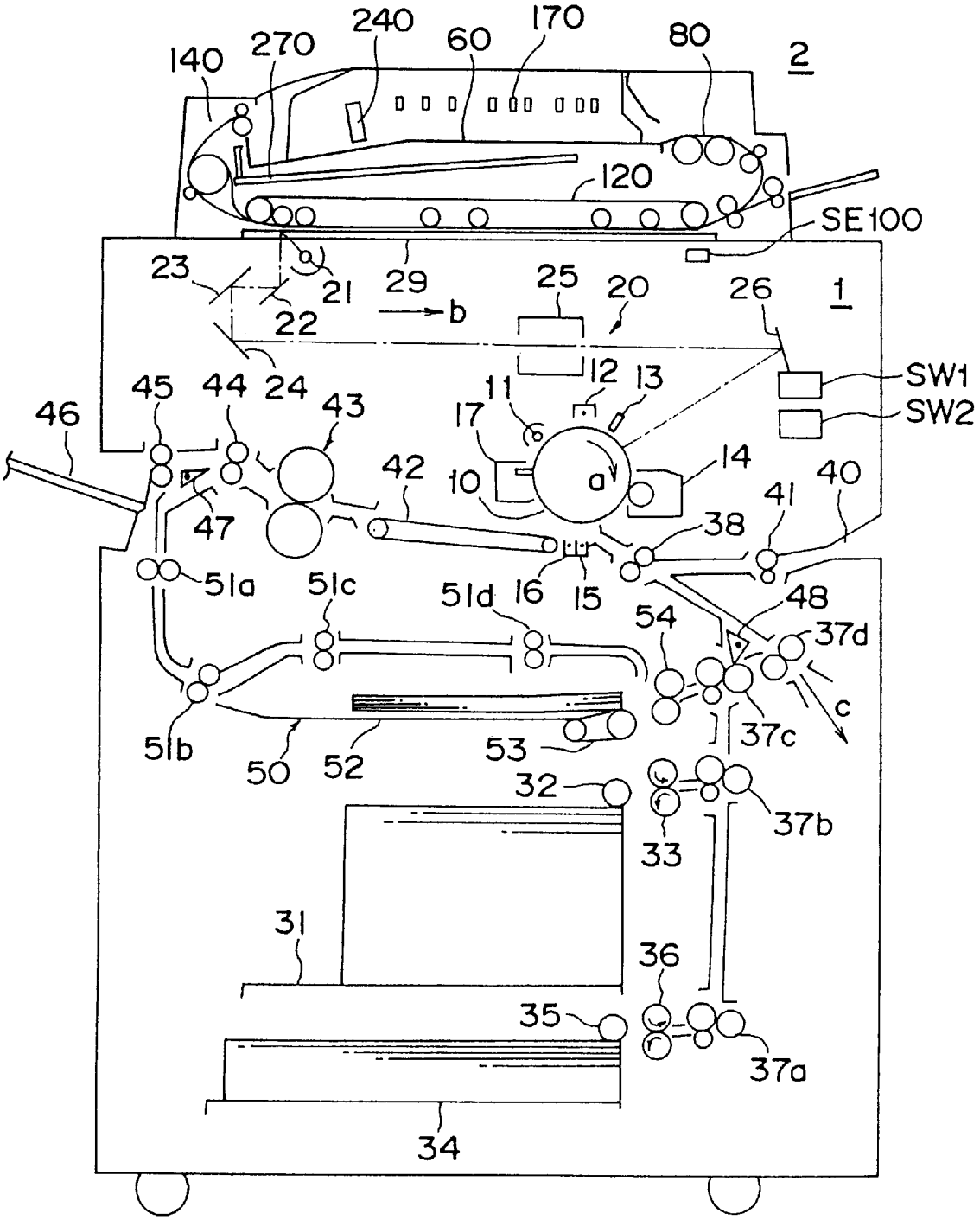
FIG. 1 is a sectional view of a copying machine equipped with a document conveying apparatus according to the present invention.

FIG. 1 shows a general construction of a copying machine. This copying machine comprises a copying machine main body 1 and an automatic document feeder (hereinafter, referred to as ADF) 2.

<Construction and Operation of the Copying Machine Main Body>

First, schematic construction and operation of the copying machine main body are described.

At a generally center portion of a copying machine main body generally denoted by numeral 1, a photosensitive drum 10 having a photosensitive layer on its outer circumference is installed so as to be rotatable in a direction of arrow "a" at a constant peripheral speed v. Around the photosensitive drum 10, there are provided, in its rotating direction, a main eraser 11, a corona charger 12, a sub-eraser 13, a developing unit 14 of the magnetic brush type, a transfer charger 15, a paper-separating charger 16, and a cleaner 17 of the blade type. Also, an optical system 20 is disposed above the photosensitive drum 10.

The photosensitive drum 10 rotates in the direction of arrow "a", whereupon the main eraser 11, the corona charger 12, and the sub-eraser 13 perform the processes of erasing, charging, and inter-image and end-of-image erasing, respectively, and thereafter the image of a document set on a document glass 29 is exposed to light by the optical system 20. An electrostatic latent image formed on the photosensitive drum 10 by the exposure is visualized as a toner image by the developing unit 14.

The optical system 20, disposed just under the document glass 29, concurrently scans and illuminates the image of the document set with its one end coincident with an exposure reference or standard position SP, so that the photosensitive drum 10 is exposed to the resulting reflected light. During the image scanning operation, an exposure lamp 21 and a first mirror 22 move in a direction of arrow "b" at a speed v/m (m: copying magnification) with respect to the peripheral speed v (constant regardless of copying magnification) of the photosensitive drum 10. Further, at the same time, a second mirror 23 and a third mirror 24 move in the direction of arrow "b" at a speed v/2m. Also, with a change in the copying scale factor involved, a projection lens 25 moves on the optical axis, while a fourth mirror 26 swings or rotates so that the optical length is corrected.

Copying sheets, i.e. copying paper, are accommodated in an upper-stage paper feed unit 31 of the elevator type and a lower-stage paper feed unit 34 of the tray type, and fed one by one from either one of them based on the selection by the operator. The paper feed units 31, 34 are provided with feed rollers 32, 35, and separating rollers 33, 36 each composed of a forward roller and a reverse roller. A sheet of paper fed from the upper-stage paper feed unit 31 is fed through conveyor rollers 37*b*, 37*c* to a timing roller 38 provided immediately before an image transfer unit. A sheet of paper fed from the lower-stage paper feed unit 34 is fed through conveyor rollers 37*a*, 37*b*, 37*c* to the timing roller 38.

This copying machine also allows paper feed by manual operation, in which case a sheet of copying paper inserted from a manual feed port 40 is fed through a feed roller 41 to the timing roller 38. The sheet of paper fed to the timing roller 38 temporarily stands by here until it is sent out to a transfer section when the timing roller 38 is turned on in synchronization with an image formed on the photosensitive drum 10. The sheet is brought into close contact with the photosensitive drum 10 in the transfer section, where a toner image is transferred by corona discharge from the transfer charger 15, and then the sheet is separated from the photosensitive drum 10 by the a.c. corona discharge from the paper-separating charger 16 and by the sturdiness of the sheet itself. Thereafter, the sheet is fed through a conveyor belt 42 to a fixing unit 43, where toner is fixed, and then the sheet is discharged through a conveyor roller 44 and a discharge roller 45 onto a discharge tray 46. Meanwhile, the photosensitive drum 10 continues rotating in the direction of arrow "a" even after the transfer process, under which the photosensitive drum 10 has residual toner removed therefrom by the cleaner 17 and residual charges erased by the main eraser 11, thus being ready for the next copying process.

Within the copying machine 1, there are provided a paper refeed unit 50 and paper-path switching claws 47, 48 for processing double-side or combined copy. The switching claw 47 is set normally to a solid-line position, and guides the sheet to the discharge tray 46. In the mode of double-side copy or combined copy, a sheet onto the first surface (front surface) of which the image of the document has been transferred is discharged through conveyor rollers 51*a*, 51*b*, 51*c*, 51*d* to an intermediate tray 52, by the switching claw 47 being set to a position which is slightly rotated counter-clockwise. Then the sheet is accommodated on the intermediate tray 52 with its image surface upward. After a specified number of sheets have been accommodated on the intermediate tray 52, with a refeed signal issued, the sheets are fed one by one, beginning to be fed with the lowest-layer of the sheets, by the rotation of a refeed belt 53 and a separating roller 54 to the conveyor roller 37*c*.

In the double-side copy mode, the refed sheet is fed to the timing roller 38 while being guided upward by the switching claw 48 set to a solid-line position. Then, the image is transferred onto the second surface (rear surface) of the sheet, fixed, and then discharged to the discharge tray 46. In the combined copy mode, the refed sheet is conveyed in a direction of arrow "c", by a conveyor roller 37*d* by the switching claw 48 being set to a position which is slightly rotated clockwise. Immediately before the rear end of the sheet passes a nip portion of the conveyor roller 37*d,* the conveyor roller 37*d* is switched to the reverse rotation, whereby the sheet is reversed upward down and frontward back and sent out as such to the timing roller 38. Thereafter, the image is overlappingly transferred onto the first surface (front surface), fixed, and discharged onto the discharge tray 46.

<Construction and Operation of ADF 2>

The construction and operation of the ADF 2 is now described in detail.

The ADF 2 generally comprises a document tray 60, a document feed section 80, a document conveying section 120, a document discharge section 140, a document restricting section 170, a document move preventing section 240, and a document refeed moving section 270.

This ADF 2 is installed on the top of the copying machine 1 so that the document conveying section 120 is positioned on the document glass 29 of the copying machine 1. The ADF 2 is openable to the top surface of the document glass 29 by an unshown hinge fitting provided on the rear surface side.

Before the description of the individual sections of the ADF 2 proceeds, the document conveyance operation is outlined. To set the document manually onto the document glass 29, the operator lifts the ADF 2 upward to make the top surface of the document glass 29 opened. The opening of the ADF 2 is detected by a magnet sensor SE100 as shown in FIG. 1. The ADF 2 will not be operable until the magnet sensor SE100 detects that the ADF 2 is properly closed.

The document feed section 80 feeds document sheets placed on the document tray 60, beginning with the lowermost sheet, so that the sheets are separated one by one so as to be fed to the document conveying section 120. The document conveying section 120 conveys the document sheet fed from the document feed section 80 to a specified position on the document glass 29 of the copying machine 1. The document sheet scanned by the optical system 20 is discharged by the document discharge section 140. The discharged document sheet is restricted at its front end by the document restricting section 170 and placed on the document tray 60. With the document recirculation mode selected, when all the document sheets have been discharged, the sheets are moved to the document feed section 80 by the document refeed moving section 270, thus refed.

Now the individual sections of the ADF 2 are explained.

<Document Tray>

The document tray 60, as shown in FIG. 3, has a continuous surface that couples a feed port 61 and a discharge port 62 together at their lower portions. This continuous surface comprises a first surface 63 for placing thereon the fed document sheet extending from the feed port 61 toward the discharge port 62, and a second surface 64 for placing thereon the document sheet extending from below the discharge port 62 toward the feed port 61. The first surface 63 is provided horizontal, and the second surface 64 is tilted up toward the feed port 61 so that the front end of the discharged sheet discharged from the discharge port 62 is positioned upper than its rear end. A tilt angle $\alpha$ of this second surface 64 is 5 to 30E, preferably 10E. The first surface 63 and the second surface 64 are coupled to each other at a bent portion 65.

Figures 3A, 3B:
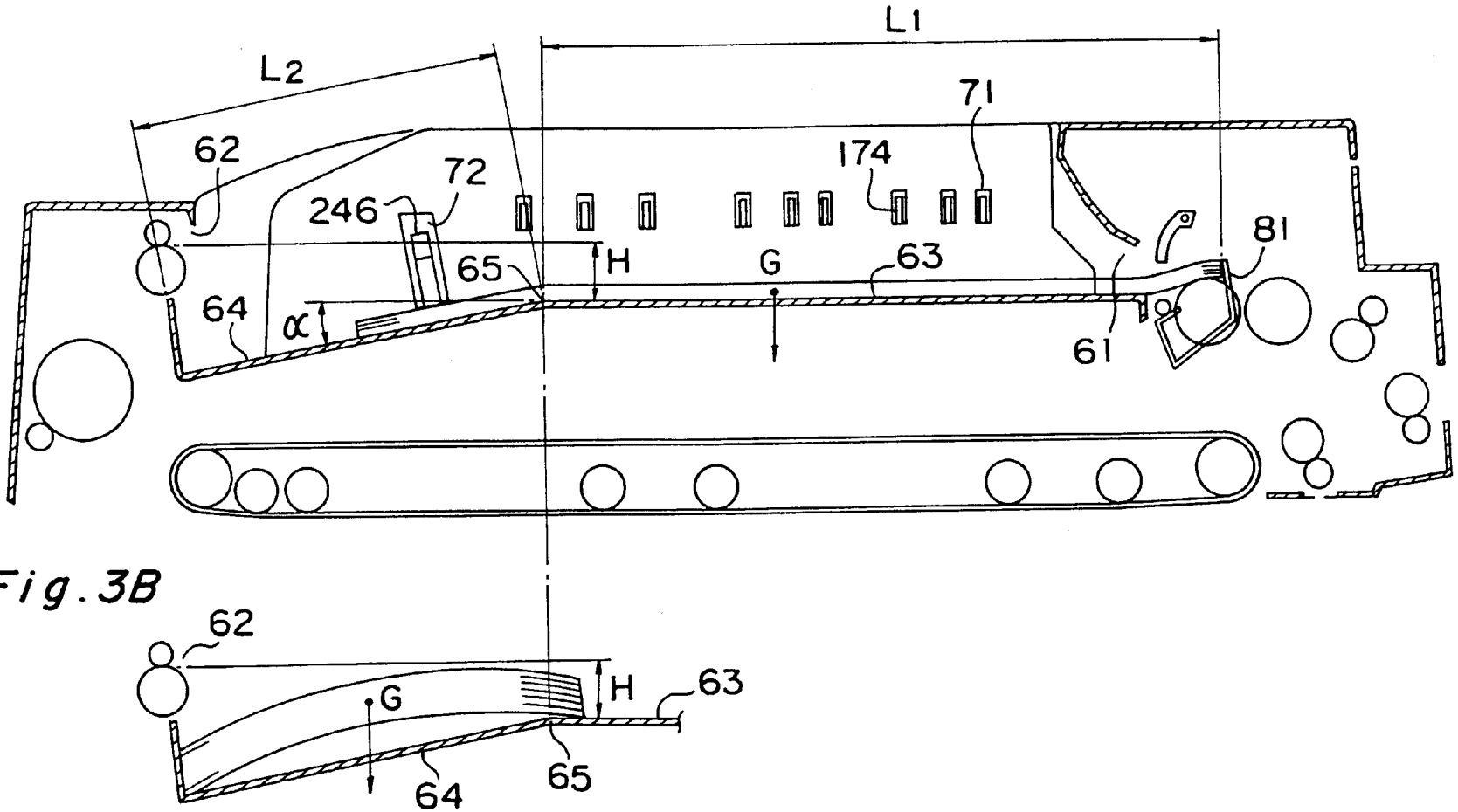
FIG. 3 is a sectional view for explaining a configuration of the document tray.

A length L1 of the first surface 63 ranging from an end restricting plate 81 of the feed port 61 to the bent portion 65 in the document feed direction is larger than one half of the length of a feedable maximum-size document sheet in the document feed direction. As a result, as shown in FIG. 3A, document sheets of not only the maximum size but also smaller sizes have a center of gravity G on the feed side of the bent portion 65. Therefore, when the document sheet is set on the first surface 63 or when the discharged document sheet is moved from the second surface 64 to the first surface 63 for refeed and reset as such, the set document sheet is prevented from slidingly moving toward the discharge port 62 or shifting toward the discharge port 62 due to vibrations of the machine during the sheet feed operation. Also, even such document sheets as the discharged sheets are overlapping on fed sheets can be prevented from misalignment of discharged sheets because the rear end side of the fed document is directed downward at a boundary of the bent portion 65 so that the front end of the discharged sheet will never contact the rear end of the fed sheet.

A length L2 of the second surface 64 ranging from the discharge port 62 to the bent portion 65 in the document feed direction is larger than one half of the length of a feedable minimum document sheet in the document feed direction. As a result, as shown in FIG. 3B, a document sheet of the minimum size discharged to the second surface 64 has a center of gravity G on the discharge side of the bent portion 65. Therefore, discharged document sheets of the minimum size will never be stacked beyond the bent portion 65 but will slide down toward the discharge port 62 so as to be stacked with their rear ends aligned.

A height H of the document tray 60 from the bent portion 65 to the discharge port 62 in the direction of gravity is set equal to, preferably larger than, the height of document sheets of the maximum load. As a result, the height from the second surface 64 to the discharge port 62 increases over the height of the document sheets of the maximum load as it gets increasingly farther from the bent portion 65 toward the discharge port 62. Therefore, as shown in FIG. 3B, even if the document sheets discharged from the discharge port 62 are curled upward in placement on the second surface 64, the top surface of the document sheets will never be beyond the discharge port 62, so that the discharge of the succeeding document sheets will never be hindered.

Figure 4:
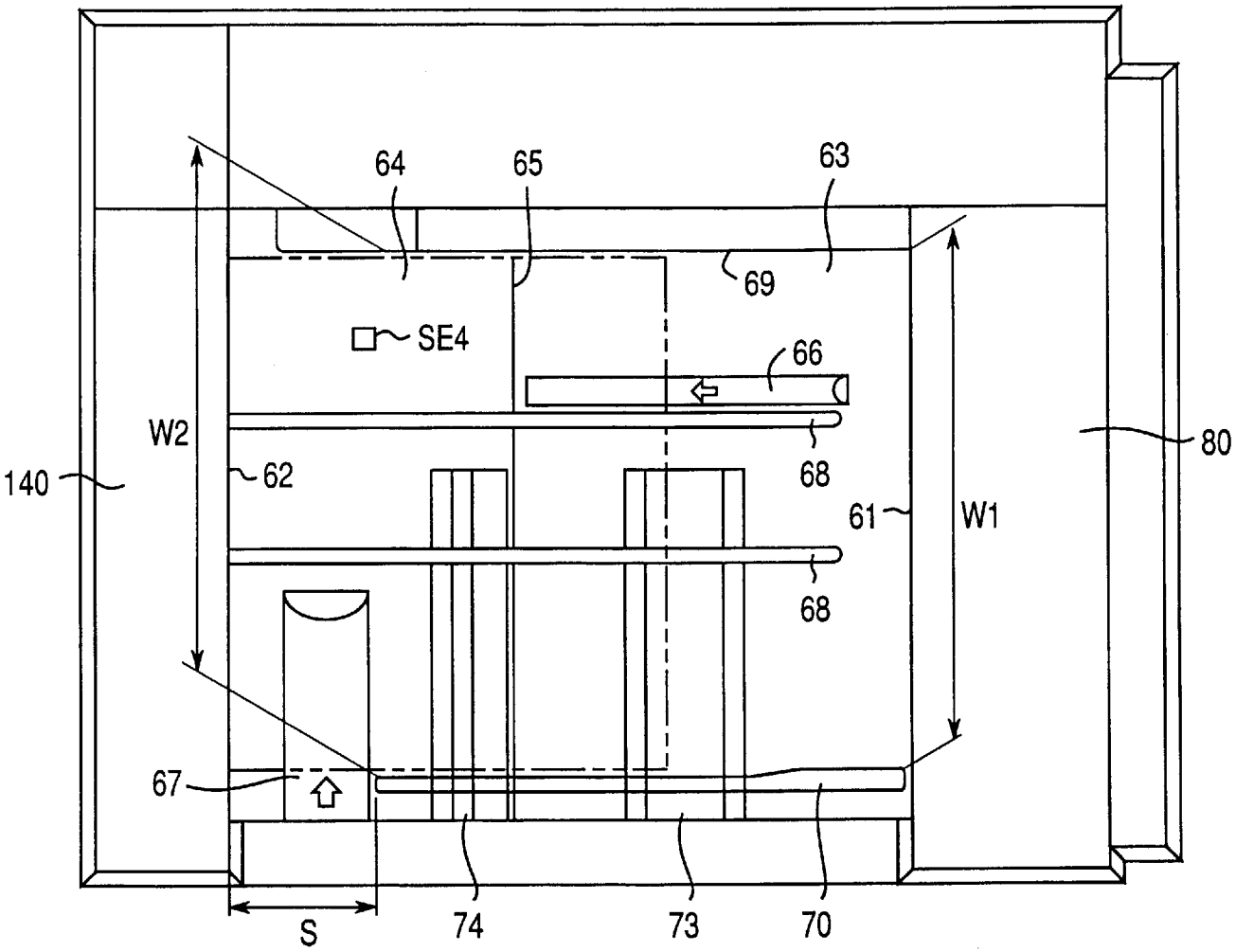
FIG. 4 is a plan view for explaining a planar configuration of the document tray.

As shown in FIG. 4, a first recess 66 extending in the document feed direction is formed in the first surface 63 of the document tray 60, and a second recess 67 extending in a direction perpendicular to the feed direction is formed in the second surface 64. These first recesses 66, 67 allow document sheets placed on the document tray 60 to be taken out simply and without damaging the document sheets by inserting fingers to the bottom of the discharged document sheets in the direction indicated by arrow.

Two grooves 68 for allowing a refeed lever 274 of the document refeed moving section 270, which will be described later, to be moved in the document feed direction are formed so as to stretch from the second surface 64 to the first surface 63. Reference numerals 73 and 74 denote guide grooves for a movable document-restricting plate 70. A fixed document-restricting plate 69 which serves as a one-side standard for document conveyance is provided at a rear-side end portion of the document tray 60, and the movable document-restricting plate 70 is provided at a front-side end portion of the document tray 60 so as to be movable in a direction perpendicular to the document feed direction. In the fixed document-restricting plate 69, as shown in FIG. 3, there are provided, in array and in the document feed direction, a plurality of openings 71 where a later-described discharged-document stopper 174 of the document restricting section 170 appears and disappears, and one opening 72 where a later-described document-pressing lever 246 appears and disappears.

The movable document-restricting plate 70, as shown in FIG. 4, is provided thicker, or tilted, on the feed side than on the discharge side in a document feed direction, the thickness or tilt being directed toward the fixed document-restricting plate 69 on the standard side. As a result, a spacing W2 between the fixed document-restricting plate 69 and the movable document-restricting plate 70 on the discharge side in a direction perpendicular to the document feed direction is wider than a spacing W1 on the feed side. Therefore, the document sheet discharged from the discharge port 62, even if skewed or shifted from the standard, is accommodated in wider spacing W2 between the fixed document-restricting plate 69 and the movable document-restricting plate 70. Then, as the document sheet is moved from discharge to feed side, the spacing between the fixed document-restricting plate 69 and movable document-restricting plate 70 becomes narrower, so that the document sheet is urged toward the direction perpendicular to the document feed direction so as to be aligned with the fixed document-restricting plate 69.

A spacing S is provided between a discharge side end of the movable document-restricting plate 70 and the discharge port 62. This allows the discharged document sheet to be taken out by inserting hand into this spacing S. Because the spacing S is formed smaller than the length of the minimum-size document sheet in the feed direction, the document sheet, even if skewed, or shifted from the standard, will never be escape out through the gap between the discharge side end of the movable document-restricting plate 70 and the discharge port 62.

Figure 5A:
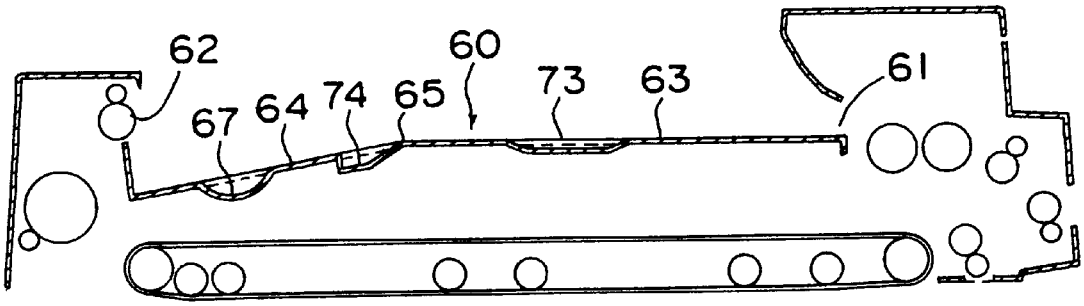
FIG. 5 is a sectional view for explaining another configuration of the document tray.
Figure 5B:
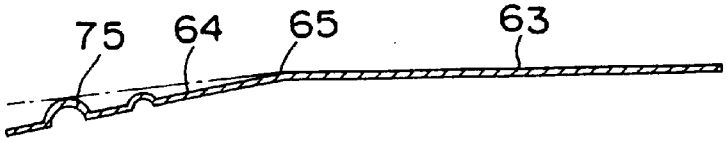
Figure 5C:
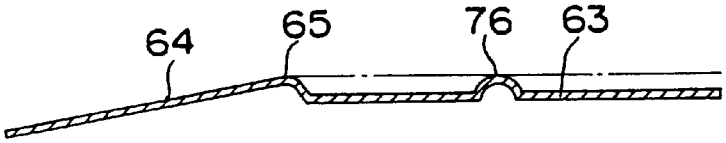
Figure 5D:
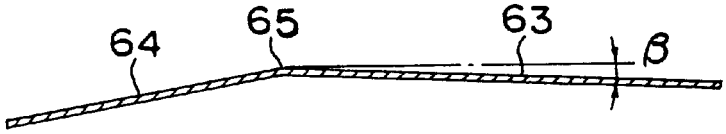

In addition, the first surface 63 and the second surface 64 of the document tray do not necessarily need to be flat, and the recess 67 for taking out the document sheet or the guide grooves 73, 74 and the like as described above may be formed therein as shown in FIG. 5A. Also, when a projection 75 is formed in the second surface 64 as shown in FIG. 5B, there is no problem only if the line interconnecting the vertex of the projection 75 and the bent portion 65 is tilted. Likewise, a projection 76 may be formed also in the first surface 63 as shown in FIG. 5C. The first surface 63 does not necessarily need to be horizontal, and may be tilted βE downward from the bent portion 65 toward the feed port 61 as shown in 5D.

(Document Feed Section)

Figure 2:
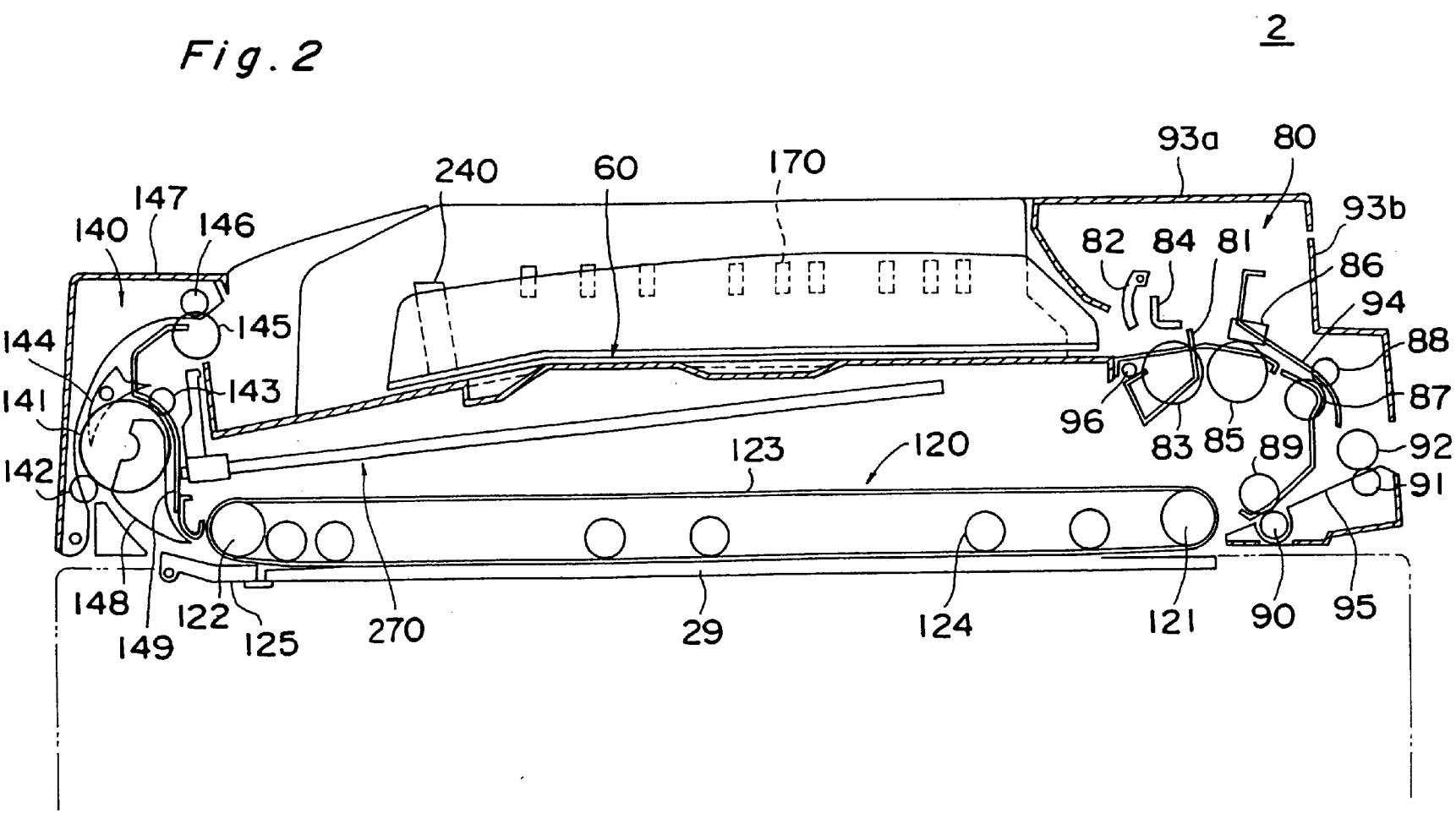
FIG. 2 is a sectional view of the document conveying apparatus according to the present invention.

The document feed section, as shown in FIG. 2, comprises an end restricting plate 81, a refeed preventing member 82, pickup rollers 83 as well as document pressing plates 84 contactable under pressure therewith, a separating roller 85 as well as a separating pad 86 making press contact therewith, an intermediate conveyor roller 87 as well as a pinch roller 88 making press contact therewith, a register roller 89 as well as a pinch roller 90 making press contact therewith, and a document feed roller 91 as well as a pinch roller 92 making press contact therewith, all of these members being covered with a fixed cover 93*a* and an openable/closable cover 93*b*. Along the pickup roller 83, the separating roller 85, the intermediate conveyor roller 87 and the register roller 89, are provided guides 94, by which a sheet path is formed. Also, by a guide 95 placed along the manual-feed document feed roller 91 and the register roller 89, a manual-feed sheet phase is formed.

The end restricting plate 81 is provided rotatable about a pivot shaft 96, where an end of the end restricting plate 81 is appearable to and disappearable from the sheet path on somewhat downstream side of the pickup roller 83. The end restricting plate 81 restricts the end of the document sheet set on the document tray 60. The end restricting plate 81 withdraws downward from when the first document sheet is fed until when the final document sheet is fed.

Figure 6:
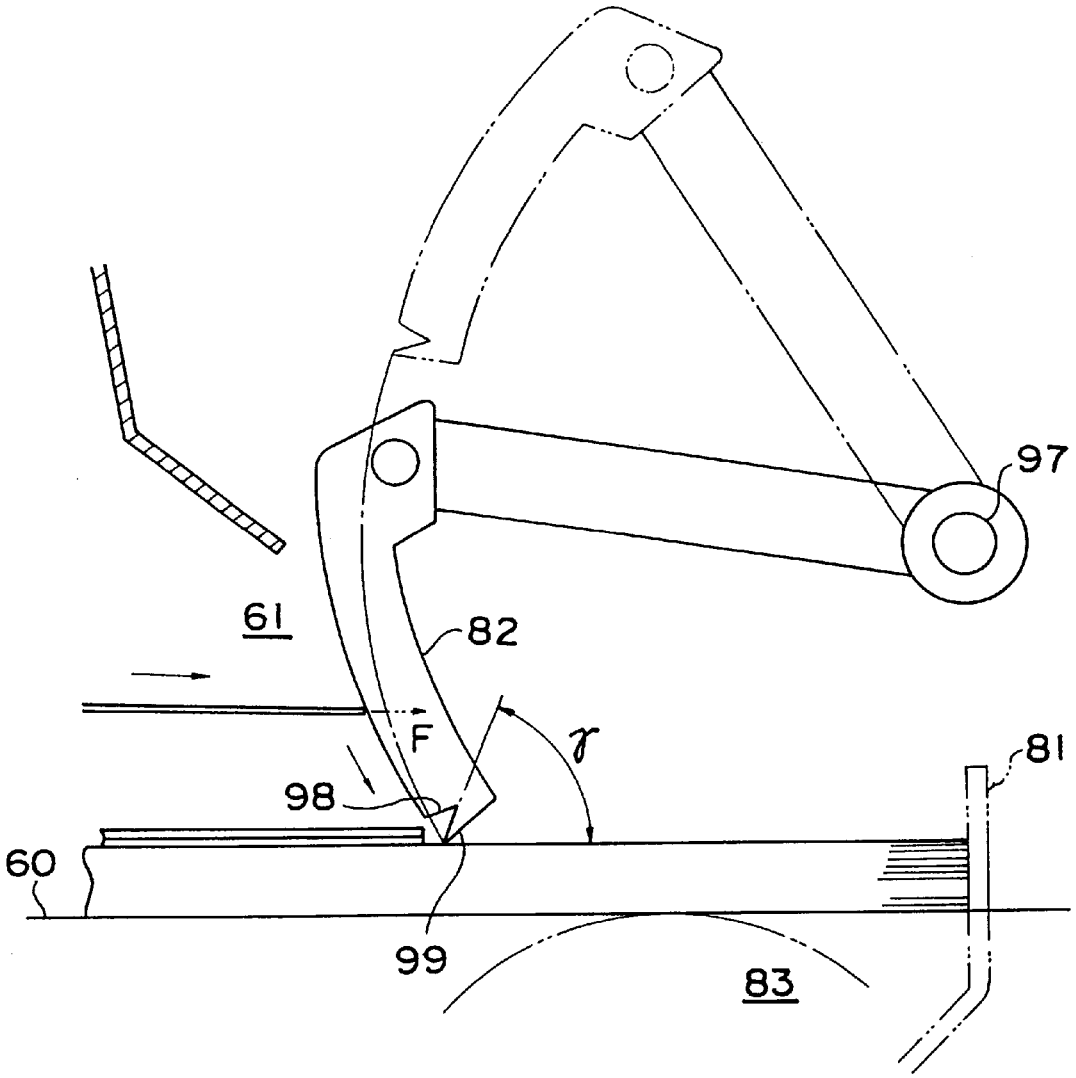
FIG. 6 is an enlarged view of the refeed preventing member.

The refeed preventing member 82, which comprises a generally L-shaped lever as shown in FIG. 6, is provided pivotable about a pivot 97 between an operative position where it presses the top surface of the fed document sheet and a withdrawal position above the operative position. The position of the pivot 97 serving as a fulcrum for the refeed preventing member 82 is so set that a force F with which the end of the discharged sheet rushing into the feed port 61 strikes against the refeed preventing member 82 does not cause the refeed preventing member 82 to be withdrawn upward. Also, the outer edge of the refeed preventing member 82 is formed into such an arc shape having an upward tilt from the upstream side of the document feed direction that when the refeed preventing member 82 is in the operative position, the discharged sheet that has struck against the outer edge of the refeed preventing member 82 is guided to the top surface of the fed sheet below.

At an end of the refeed preventing member 82, a claw portion 99 is provided by forming a V-shaped cutout 98. The withdrawal path of the end of this claw portion 99 about the pivot shaft 97 is inside the outer a edge configuration of the refeed preventing member 82 as indicated by one-dot chain line in FIG. 6. The angle γ of the upper edge of the claw portion 99 of the refeed preventing member 82 with respect to the fed document sheet in the feed direction is not more than 90E, preferably 80E.

When the document sheet is set on the document tray 60, the refeed preventing member 82 is positioned in the withdrawal position above. As the document sheets start to be fed, the refeed preventing member 82 pivots to the operative position with the claw portion 99 of its end in contact with the top surface of the fed document sheet. The lowermost sheet of the fed document sheets is fed, copying processed, and discharged from the discharge port 62. Then the discharged sheet is placed on the document tray 60.

With the document size large, the end of the discharged sheet may enter into the feed port 61 as shown in FIG. 6. In this case, the end of the discharged sheet strike against the outer edge of the refeed preventing member 82 and guided downward so as to be placed on the fed document sheets.

Even if the end of the discharged sheet has struck against the outer edge of the refeed preventing member 82 so that the force F acts thereon, the refeed preventing member 82 does not withdraw upward. Therefore, the discharged sheet will never evade the refeed preventing member 82 as the feeding of fed sheets goes on, so that the refeed is reliably prevented. When the last fed document sheet which makes contact with the claw portion 99 of the end of the refeed preventing member 82 is fed, the angle γ of the claw portion 99 of the refeed preventing member 82 is not more than 90E as described above, thus more preferable in that the discharged sheet is unlikely to evade the claw portion 99.

Figure 7:
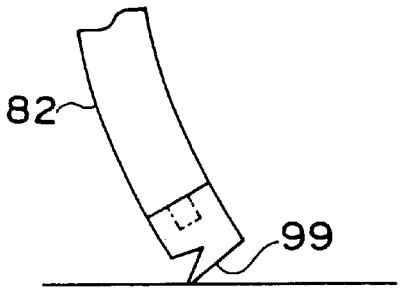
FIG. 7 is a partly enlarged view of another embodiment of the refeed preventing member.

When all the fed document sheets have been fed completely, the refeed preventing member 82 pivots to the withdrawal position above. In this operation, the claw portion 99 of the refeed preventing member 82 withdraws without getting caught in the discharged document sheet, the discharged sheet is not damaged at its rear end. In addition, in order to positively prevent damage of the top surface of fed sheets and the front end of discharged sheets, the claw portion 99 of the refeed preventing member 82 may be made of elastic material, preferably rubber material, and fitted to the tip end of the refeed preventing member 82 as shown in FIG. 7.

Figure 8:
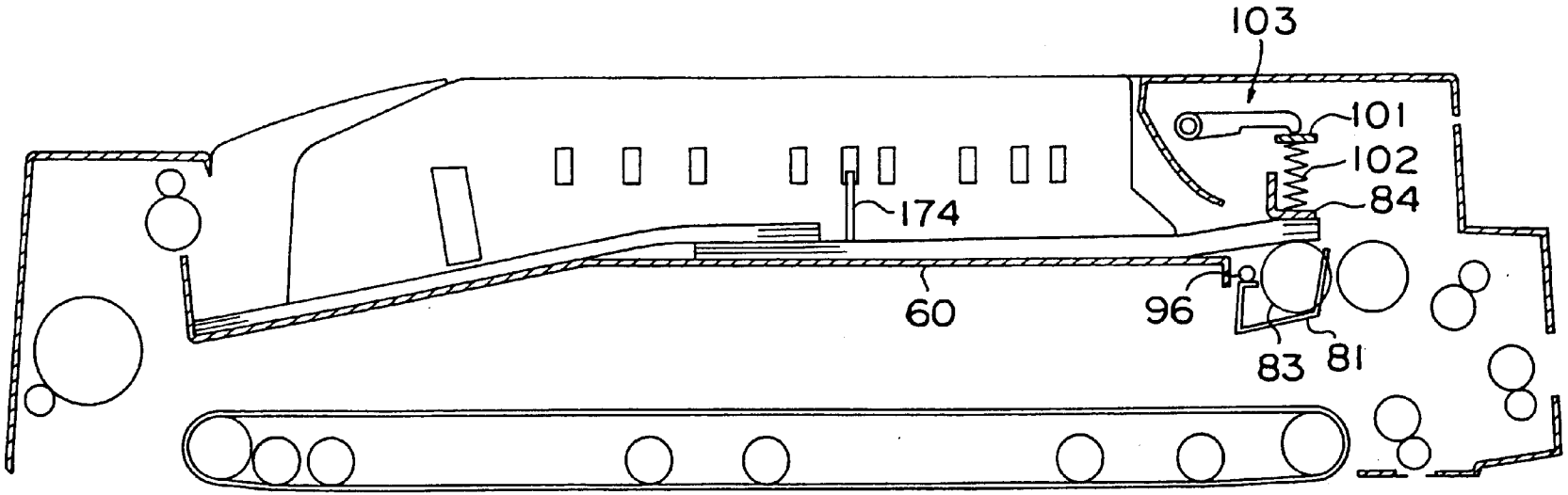
FIG. 8 is a sectional view for explaining the document presser plate.

The pickup roller 83 is provided rotatable clockwise in FIG. 8. This pickup roller 83 is provided three in combination in a direction perpendicular to the document feed direction as shown in FIG. 9.

The document pressing plates 84 are placed above the three pickup rollers 83 so as to be opposed thereto, and can be moved up and down to a pressing position and a withdrawal position above by a lever 100. Above the document pressing plates 84, an elongate spring support plate 101 is provided axially of the pickup rollers 83. Between this spring support plate 101 and each document pressing plate 84, two coil springs 102 are interveniently provided so that a sheet feed pressure is imparted to the fed sheets placed on the pickup rollers 83 by these coil springs 102. The sheet feed pressure to the fed sheets can be varied by a later-described sheet-feed-pressure variable mechanism 103.

Figure 9:
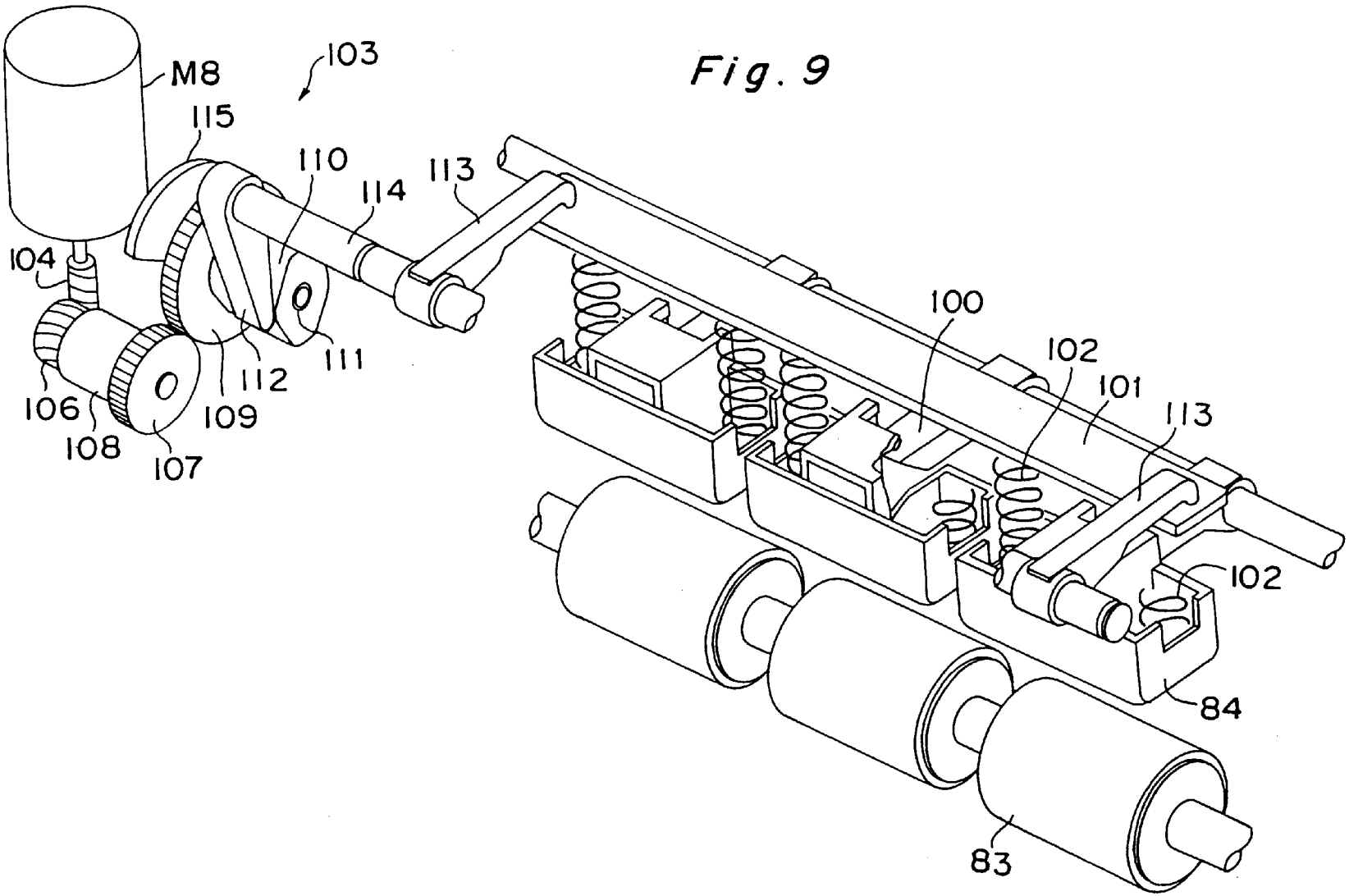
FIG. 9 is a perspective view of the paper-feed pressure variable mechanism.

The sheet-feed-pressure variable mechanism 103, as shown in FIG. 9, comprises a sheet-feed-pressure variable motor M8 with a worm 104 fitted to its drive shaft, a transmission shaft 108 equipped with a worm wheel gear 1060 and a gear 107 which are screwed to the worm 104 of the sheet-feed-pressure variable motor M8, a cam shaft 111 equipped with a gear 109 and a cam 110 which are screwed to the gear 107 of the transmission shaft 108, and a lever shaft 114 equipped with a drive lever 112 which contacts the cam 110 of the cam shaft 111 and a presser lever 113 which contacts the spring support plate 101. A detector plate 115 of a cutout circular shape is fitted to the cam shaft 111 so that the position of the cam 110 can be detected by an unshown sensor.

Figure 10A:
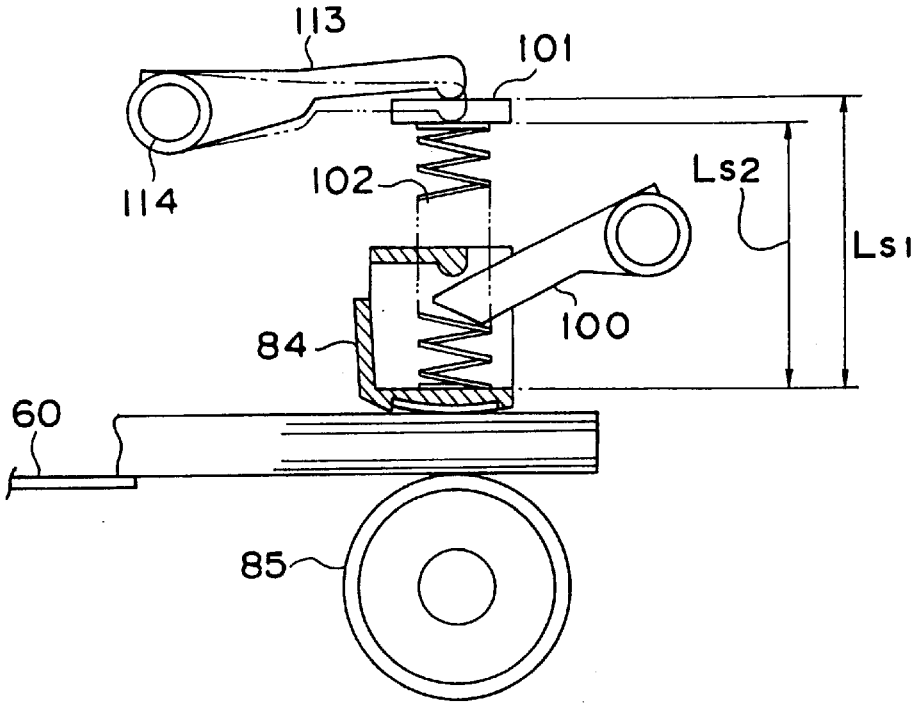
FIGS. 10A and 10B are partly enlarged views of the paper-feed pressure variable mechanism in one state that the paper-feed pressure is imparted and another that the mechanism is retreated, respectively.
Figure 10B:
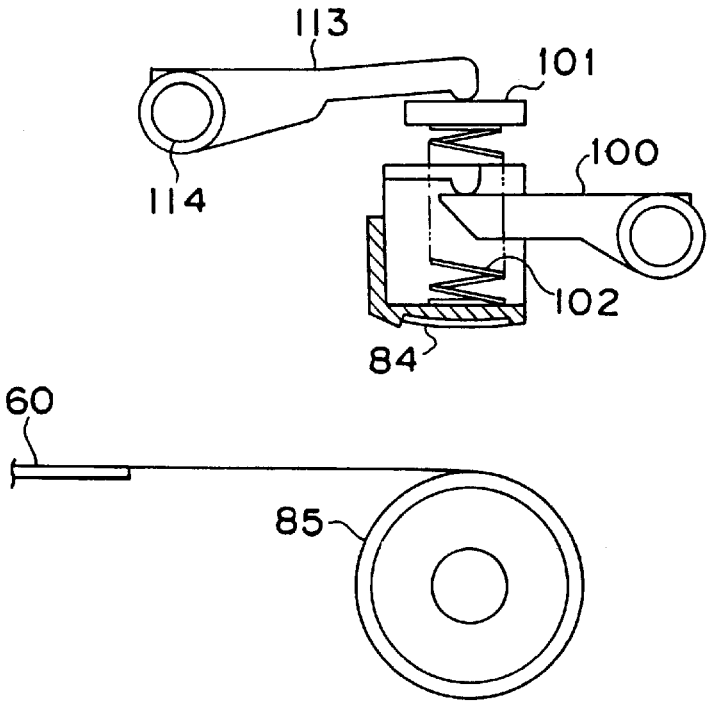

When the document is set on the document tray 60, the document pressing plate 84 is located in the withdrawal position by the lever 100 pivoting upward against the urging force of the coil springs 102 as shown in FIG. 10B. With the document set as shown in FIG. 10A, when the first fed document sheet is fed, the lever 100 pivots downward so that the document pressing plate 84 moves to the lower pressing position, where a sheet feed pressure is imparted to the top surface of the fed document sheet by the urging force of the coil springs 102. As a result, the fed document sheets are sent out one by one, starting with the lowermost one.

As the fed document sheets are fed one by one with their height decreased, the coil springs 102 expands so that the sheet feed pressure decreases. For this reason, when the height of the fed document sheets has decreased to more than a certain level, the sheet feed pressure may become insufficient. Also, when the document sheets are of such a size that the sheets are discharged with overlaps one on another as shown in FIG. 8, not only the height of the fed document sheets decreases so that the sheet feed pressure decreases, but also the weight of the discharged document sheet is applied to the rear end of the fed document sheet, with the result that the sheet feed pressure would become further insufficient.

Thus, in the case where insufficiencies in the sheet feed pressure of the fed document sheets are worried like this, the sheet feed pressure is increased by the sheet-feed-pressure variable mechanism 103. Two ways are available to attain this purpose. The first way is to count the number of fed document sheets previously and to increase the sheet feed pressure as shown in Table 1 when a specified number of document sheets have been fed. The second way is to detect the height of fed document sheets previously and to increase the sheet feed pressure as shown in Table 2 when the decrement of the height due to the feeding comes to over a specified value.

TABLE 1

| Document size | Sheet count |
|---|---|
| B4/legal | 20th |
| A3/W letter | 15th |

TABLE 2

| Document size | Decrement of height |
|---|---|
| B4/legal | 3 mm |
| A3/W letter | 2 mm |

In order to increase the sheet feed pressure for fed document sheets, the sheet-feed-pressure variable motor M8 of the sheet-feed-pressure variable mechanism 103 as shown in FIG. 9 is driven to a specified extent. This causes the transmission shaft 108 and the cam shaft 111 to be rotated, by which the drive lever 112 is pressed by the cam 110 of the cam shaft 111 so that the lever shaft 114 rotates. As a result, the presser lever 113 pivots, pressing the spring support plate 101. This causes the spring support plate 101 to move downward to a specified extent, so that the coil springs 102 changes in length so as to be shortened from Ls1 to Ls2, as shown in FIG. 10A. As a result of this, the urging force of the coil springs 102 increases so that the pressure between the pickup rollers 83 and the fed document sheet (sheet feed pressure) increases. This constitution eliminates the possibility of decreases in the sheet feed pressure due to the expansion of the coil springs with increase in the discharged document sheets which occurs with a constitution of non-variable sheet feed pressure, as well as the possibility of slippage of fed document sheets at the pickup rollers 83 due to the increase in pressing force of fed document sheets and discharged document sheets at the rear end of the fed document sheets, so that the frictional force between the feed rollers and the fed document sheets becomes greater than the frictional force between the rear end of the fed document sheets and the document tray.

Figure 11:
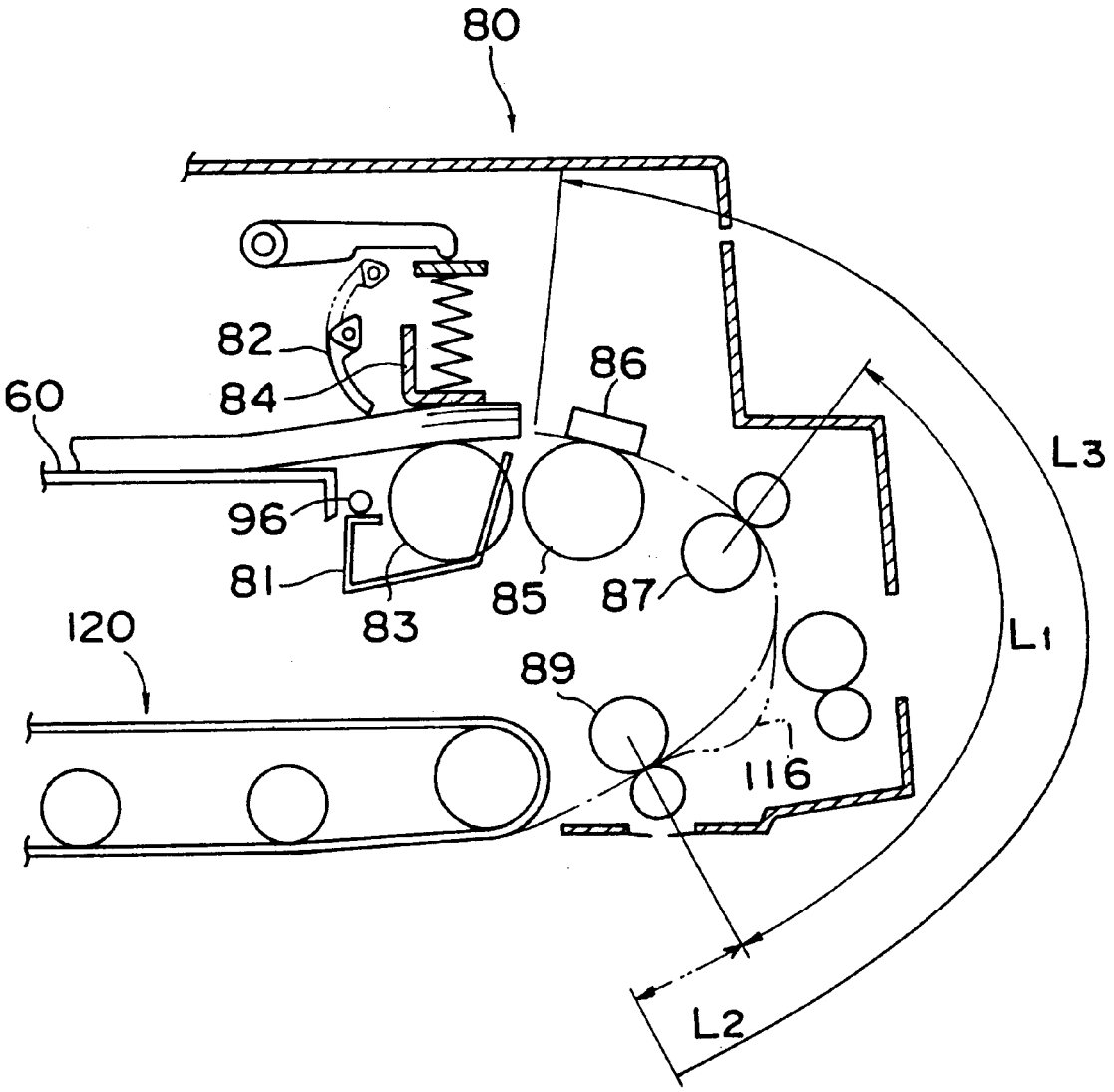
FIG. 11 is a sectional view for explaining the operation of the intermediate conveyance roller and the registration roller.
Figure 12:
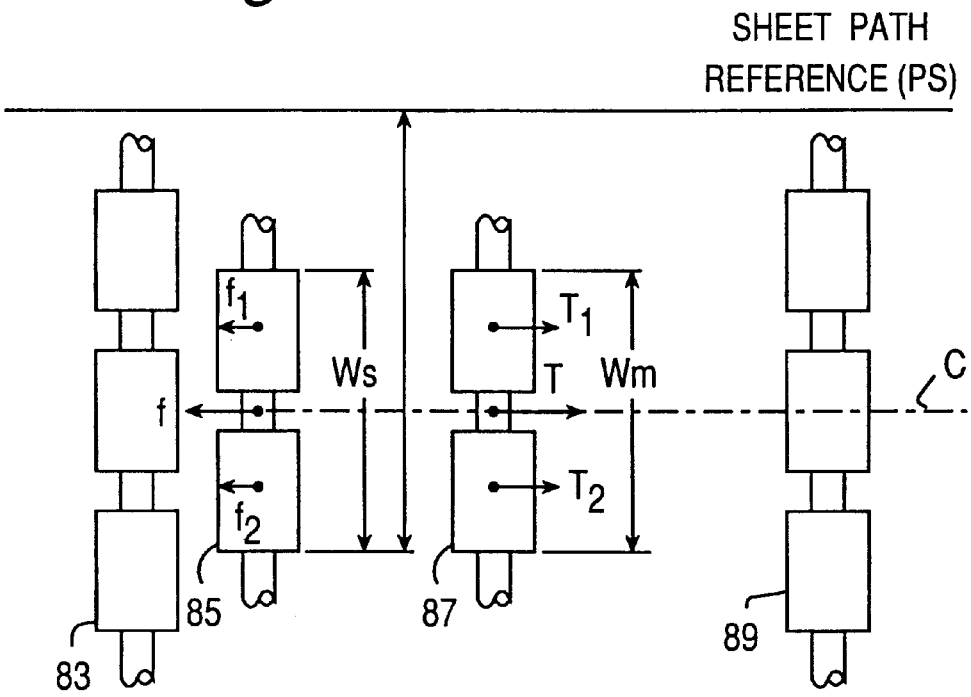
FIG. 12 is a view for explaining the arrangement of the separation roller, the intermediate conveyance roller and the registration roller.

The separating roller 85 is provided rotatable clockwise in FIG. 11. This separating roller 85 is provided two in combination in a direction perpendicular to the document feed direction as shown in FIG. 12. The separating pad 86 is so placed as to make press contact with the two separating rollers 85 generally from above, and separates the fed document sheets sent out from the pickup rollers 83 one by one for their conveyance. In addition, instead of the combination of the separating rollers 85 and the separating pad 86, known torque limitter type separating means or reverse separating means may also be used.

The intermediate conveyor roller 87 is placed midway of the sheet path between the separating rollers 85 and a later-described register roller 89, and provided rotatable clockwise in FIG. 11. This intermediate conveyor roller 87 is provided two in combination in a direction perpendicular to the document feed direction as shown in FIG. 12.

The register roller 89 is provided just before the document conveying section 120, and rotatable clockwise in FIG. 11. This register roller 89 is provided three in combination in a direction perpendicular to the document feed direction as shown in FIG. 12.

The document conveyance speed of the intermediate conveyor rollers 87 is faster than that of the separating rollers 85, and the document conveyance speed of the register rollers 89 is set faster than that of the intermediate conveyor rollers 87. Document sheets separated one by one by the separating rollers 85 are conveyed by the intermediate conveyor rollers 87, fitting to nip portions of the register rollers 89. At this time point, the register rollers 89 are at rest, whereas the separating rollers 85 and the intermediate conveyor rollers 87 will be driven for a certain time until they are stopped. As a result, the fed document sheet has a loop portion 116 formed between the intermediate conveyor rollers 87 and the register rollers 89 as indicated by two-dot chain line in FIG. 11. Then, in a certain time elapse since this state, the intermediate conveyor rollers 87 and the register rollers 89 are driven at the same time so that the document sheet is conveyed to the inlet of the document conveying section 120.

Now the placement relation between the separating rollers 85, the intermediate conveyor rollers 87 and the register rollers 89 is explained. As shown in FIG. 12, an outermost profile width, i.e., end-to-end spacing Wm of the two intermediate conveyor rollers 87 is smaller than an outermost profile width, i.e., end-to-end spacing Ws of the two separating rollers 85. A line of action of a resultant force f of frictional forces f1, f2 that occur at the two separating rollers 85, and a line of action of a resultant force T of conveying forces T1, T2 that occur at the two intermediate conveyor rollers 87 are on a line along the sheet path. Besides, the separating rollers 85, the intermediate conveyor rollers 87 and the register rollers 89 are arranged each symmetrical with respect to a line C parallel to the sheet path direction. By such an arrangement, the document sheets, when conveyed from the separating rollers 85 to the intermediate conveyor rollers 87, undergo no occurrence of any couple of forces and are therefore prevented from being fed askew. Further, the intermediate conveyor rollers 87 have an effect of reducing the time of conveyance from the separating rollers 85 to the register rollers 89, so that the productivity of sheet conveyance is enhanced.

Figure 13:
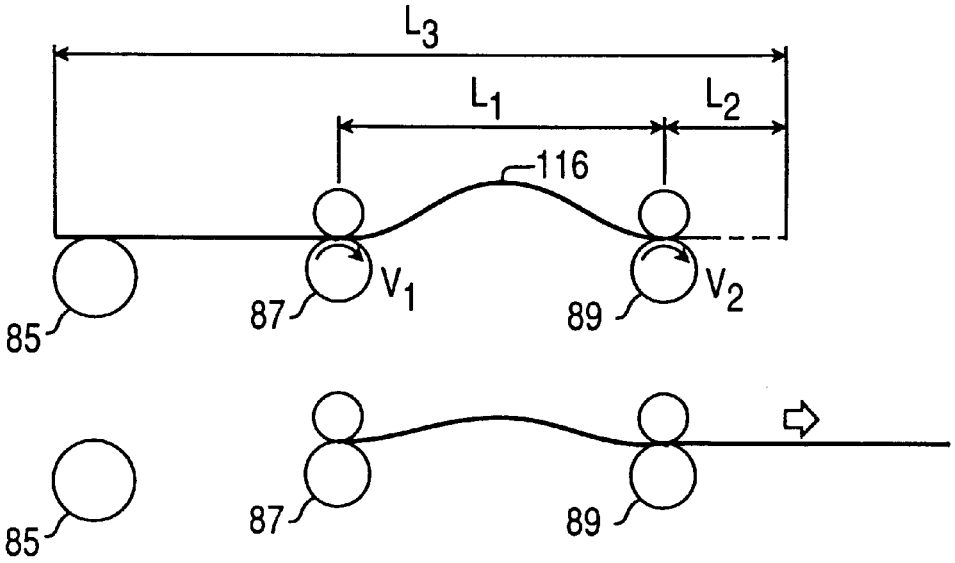
FIG. 13 is a view for explaining the operation of the intermediate conveyance roller and the registration roller.

Also, if the shortest sheet path length from the intermediate conveyor rollers 87 to the register rollers 89 is L1, the difference between the length of the document sheet conveyed by the intermediate conveyor rollers 87 and the shortest sheet path length L1, i.e., the length of the loop portion 116 of the document sheet conveyed by the intermediate conveyor rollers 87 for a certain time since the end of the document sheet is fitted to the nip portion of the register rollers 89 (in FIG. 13, the length of the loop portion 116 is extended downstream of the register rollers 89 for convenience of description) is L2, the length of a sheet in its feed direction of longest sheet size and minimum sheet width from the sheet path reference to the outermost profile is L3, and if the speed of the intermediate conveyor rollers 87 is V1 and the speed of the register rollers 89 is V2 as shown in FIG. 13, then the following relationship holds:

$$(L3-L1-L2)/V1 \leq L2/(V2-V1) \qquad \text{Equation 1}$$

By this relationship, when the intermediate conveyor rollers 87 and the register rollers 89 are driven after the formation of the loop portion 116, the loop portion 116 decreases due to the speed difference between the two sets of rollers, whereas the loop portion 116 will remain until the rear end of the document sheet passes through intermediate conveyor rollers 87. Therefore, even if the document sheet, after passing the separating rollers 85 and the intermediate conveyor rollers 87, has been put into the skewed feed state, that state is solved by the loop portion 116 so that the document sheet is conveyed in a correct state from the register rollers 89.

Besides, the width of one intermediate conveyor roller 87 is set smaller than the width of a separating roller 85 in its upstream, and located inside the width of the separating rollers 85. Therefore, because the sheets loosened and separated by the two separating rollers 85 are conveyed by the intermediate conveyor rollers 87 located downstream thereof, the sheets are less affected, for example, by the frictional force fi of the separating rollers 85 and the conveying force T1 of the intermediate conveyor rollers 87. Thus, occurrence of sheet wrinkles is prevented.

Also, the length from the path standard to the most distant, outermost profile end of the separating rollers 85 is set shorter than the width of the permissible minimum sheet size (shorter side of A5 sheet). As a result, all the permissible sizes of sheets are prevented from being fed askew.

(Document Conveying Section)

The document conveying section 120, as shown in FIG. 2, comprises a drive roller 121 placed near the document feed section 80, a driven roller 122 placed near the document discharge section 140, and an endless conveyor belt 123 stretched between the drive roller 121 and the driven roller 122, all of these members being covered with the document tray 60. The conveyor belt 123 is so sized as to cover the entire surface of the document glass 29. Inside the conveyor belt 123, a multiplicity of backup rollers 124 are rotatably installed for putting the conveyor belt 123 into press contact with the document glass 29.

The conveyor belt 123 is driven to rotate clockwise in FIG. 2, conveys the document on the document glass 29, and stops the document when the front end of the document sheet meets a scale 125 which is provided in the copying machine 1 close to an end of the document glass 29.

The scale 125 has both a function of stopping the front end of the document sheet conveyed up on the document glass 29 at the exposure standard position and a function of giving an instruction for manual placement of the document on the document glass 29 by lifting the ADF 2 so that the front end of the document sheets becomes coincident with the exposure standard position.

Figure 14A:
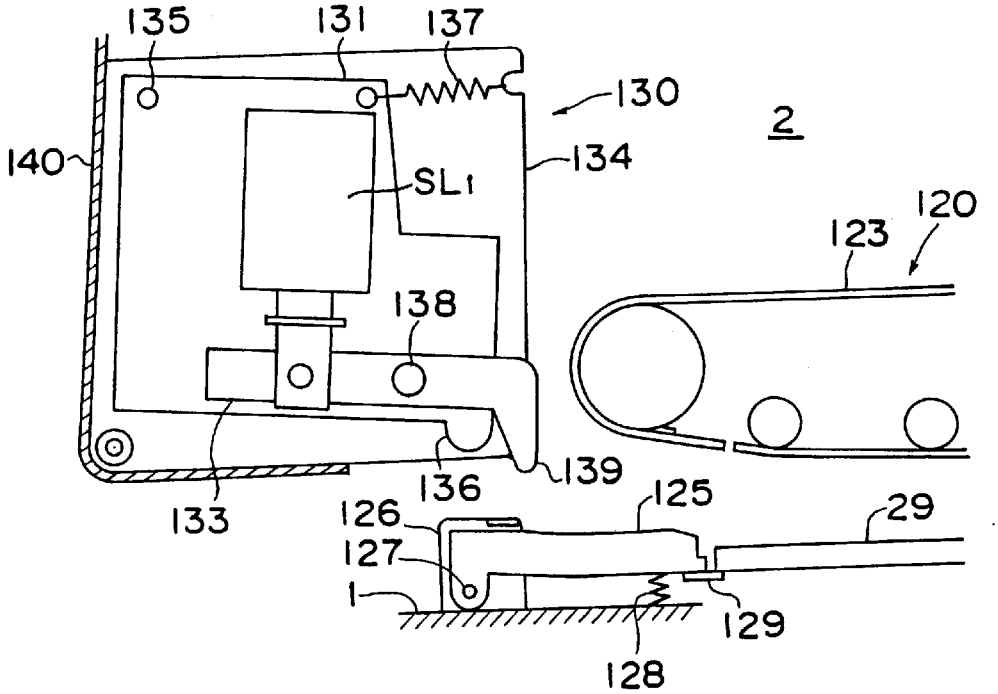
FIGS. 14A and 14B are sectional views showing the operation of the scale presser mechanism in one state that an ADF2 is up and another that the ADF2 is mounted.

This scale 125, as shown in FIG. 14A, is fitted to a holder 126 provided on both deep and fore sides of the upper frame of the copying machine main body 1, the scale 125 being pivotable on a pin 127 serving as a fulcrum and the front end of the scale 125 being urged upward by a spring 128. The scale 125 has, at the lower surface of its one end, a protrusion 129 to engage with the lower surface of the document glass 29. As a result of this, the upper surface of the end of the scale 125 is protruded to a specified height over the document glass 29. Moreover, this scale 125 is withdrawn from the top surface of the document glass 29 to below by a scale pressing mechanism 130.

The scale pressing mechanism 130 comprises a movable base plate 131, a scale solenoid SL1 and a lever 133. The movable base plate 131 is a generally rectangular plate, and one corner portion of its opposed two corner portions is fitted to an inside frame 134 of the document discharge section 140 so as to be vertically pivotable about a pivot 135 while the other corner portion has a restricting projection 136 formed opposed to the upper end of the holder 126 of the scale 125. This movable base plate 131 is urged in such a direction that the restricting projection 136 is directed toward the holder 126 of the scale 125 by a spring 137. The scale solenoid SL1 is fitted to the movable base plate 131 so that the plunger is directed downward. The lever 133 is fitted to the movable base plate 131 so as to be pivotable on a pivot 138, with one end of the lever 133 coupled to the plunger of the scale solenoid SL1 and with a protrusion 139 for pressing the scale 125 formed at the other end.

Figure 14B:
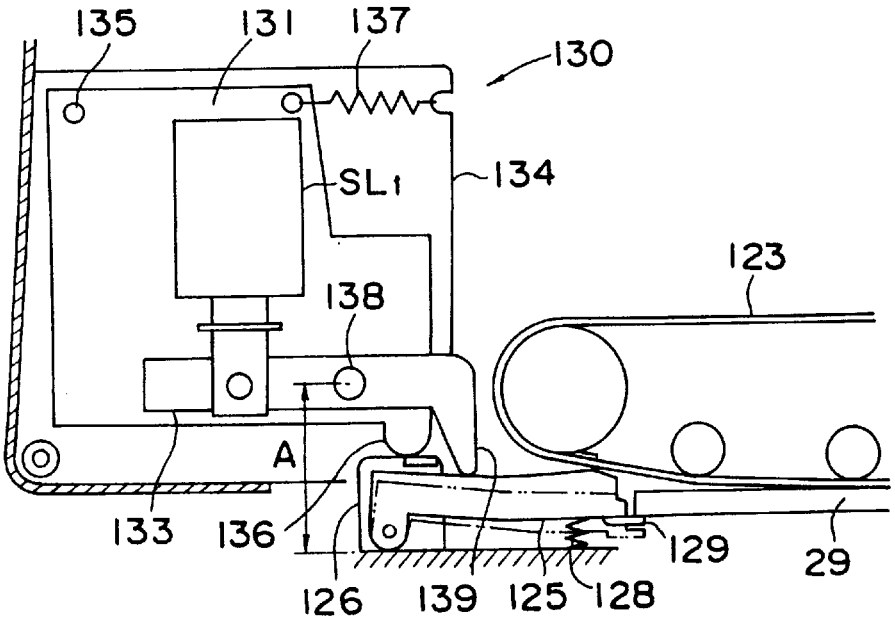

In this scale pressing mechanism 130, the scale solenoid SL1 is normally kept off with its plunger protruded downward and the lever 133 out of press against the lever 133. Upon completion of a scanning operation on the document sheet that has been stopped at the exposure standard position on the document glass 29, the scale solenoid SL1 is switched from off to on state, by which the lever 133 pivots clockwise in the figure so that its protrusion 139 presses the scale 125. In this state, the spring 137 is urged with such a force that the movable base plate 131 will not be pivoted by the urging force of the spring 128 of the scale 125, the force also being weaker than the force with which the lever 133 causes the scale 125 to be further pressed down by the scale solenoid SL1 when the scale 125 has reached the withdrawal position. With this arrangement, the lever 133 and the scale 125 are prevented from breaking. As a result of this, as indicated by two-dot chain line in FIG. 14B, the scale 125 is pressed downward against the urging force of the spring 128 so that the upper surface of the front end of the scale 125 withdraws downward from the top surface of the document glass 29. Thus, the document sheet on the document glass 29 is conveyed to the document discharge section 140 by movement of the conveyor belt 123.

Conventionally, the scale pressing mechanism is fitted to the ADF while the scale is fitted to the copying machine main body. Accordingly, in the conventional copying machine, it has been often the case that the pressing force for the scale lessens depending on variations in the fitting of the scale pressing mechanism to the ADF, especially its fitting precision at hinge portions of the ADF, such that the scale could not be withdrawn with reliability. However, in the scale pressing mechanism 130 of the present invention, even with variations in the fitting positional precision of the scale pressing mechanism 130 to the ADF 2 or in the fitting precision of the ADF 2 to the copying machine main body 1, setting the ADF 2 to the document glass 29 causes the restricting projection 136 of the movable base plate 131 to contact the upper end of the holder 126 of the scale 125 so that the movable base plate 131 pivots, by which the size A ranging from the pivot 138 of the lever 133 of the scale pressing mechanism 130 to the upper end of the holder 126 of the scale 125 is restricted to a constant value. As a result of this, a contact pressing amount for the scale 125 is ensured, making it possible to withdraw the scale 125 with reliability. Besides, such an arrangement enables the scale solenoid SL1 to be adjustment-free while the scale solenoid SL1 itself is not required to allow for torque corresponding to the variations so that the required amount of force is reduced, allowing a downsizing.

Now the document replacement in the document conveying section 120 is explained. In the document conveying section 120, subsequent to a completion of the scan on the document sheet conveyed to the exposure standard position, a document replacement is performed. A document sheet completely scanned is conveyed to the document discharge section 140, and a succeeding document sheet is conveyed to the exposure standard position. For enhanced productivity of copying process of the copying machine, the document replacement is started simultaneously with the completion of the scan of a document sheet, where the scanner starts to return after once braked.

For high-speed machines, there is a demand for speed enhancement in all of document replacement, scan and return processes, which would inevitably involve increases in current consumption for the driving of motor. The scanner varies in the time required for braking depending on the copying scale factor and, as a result, varies in the timing for the start of return, such that the respective peaks of current consumption of the ADF 2 and the scanner may overlap with each other. Resultantly, the current consumption may go beyond the specified, causing an excess of the power supply capacity such that the power supply may fall down during use. Indeed the power supply capacity can be increased to cope with such a fault, but it would result in a cost increase.

Thus, in this embodiment, based on the timing of occurrence of a peak of current consumption at a start of document replacement of the ADF 2 as well as a peak of current consumption at a start of return of the scanner, and based on the braking time of the scanner depending on the copying scale factor, the timing at which a document replacement of the ADF 2 is started is delayed to a specified time, by which the current consumption of the system as a whole is suppressed to within the specified range so that the copying process can be continued comfortably.

(Document Discharge Section)

The document discharge section 140, as shown in FIG. 2, comprises a reverse roller 141, pinch rollers 142, 143 which make press contact with the reverse roller 141, a switching claw 144 provided near the reverse roller 141, a discharge roller 145, and a pinch roller 146 which makes press contact with the discharge roller 145, all of these members being covered with an openable/closable cover 147. A guide 148 is provided, ranging from the outlet of the document conveying section 120 through an opposed portion of the reverse roller 141 and the pinch roller 142 to the discharge roller 145, with a sheet path formed by this guide 148. Also, a guide 149 are provided, ranging from the switching claw 144 through an opposed portion of the reverse roller 141 and the pinch roller 143 to the outlet of the document conveying section 120, with a reversal path formed by this guide 149.

Figure 15A:
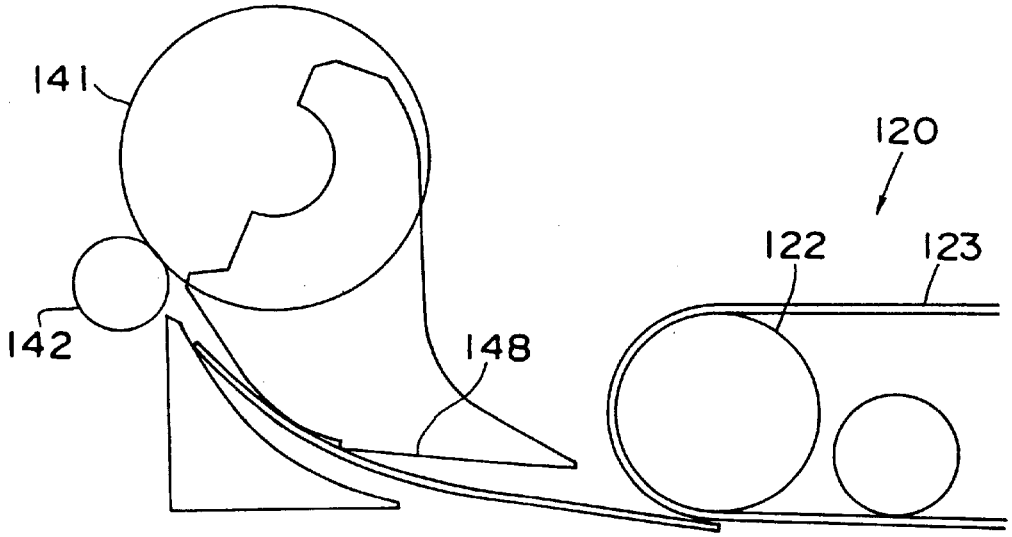
FIGS. 15A and 15B are sectional views showing the configuration of the paper-discharge path guide according to the prior art and the present invention, respectively.
Figure 15B:
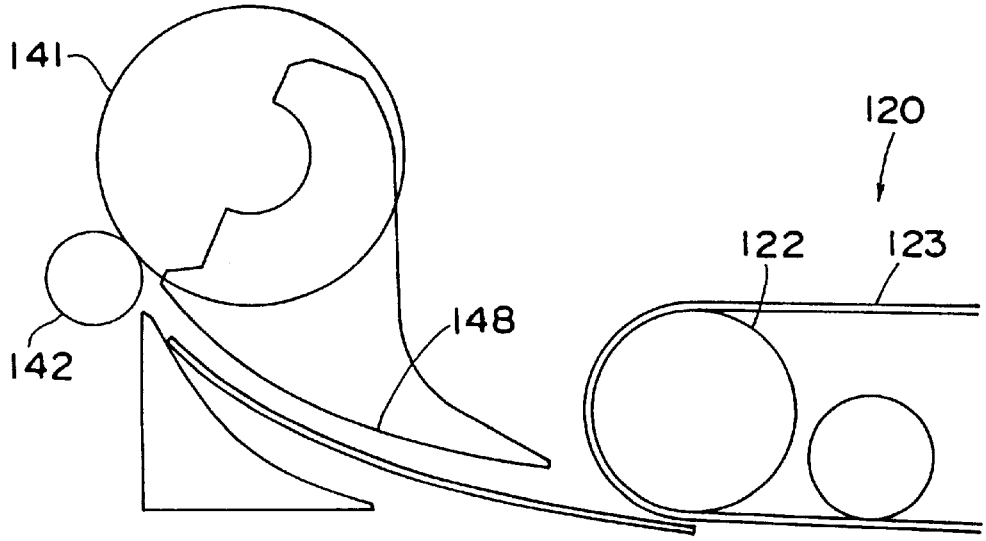

As shown in FIG. 15A, a document sheet which passes through the sheet path ranging from the document conveying section 120 to the reverse roller 141 is conveyed by the conveying force of the document conveying section 120. In this sheet path, a firm document sheet such as cardboard, in particular, when contacting the inner guide 148, would slip under increased resistance, thus no longer being discharged. Increasing the conveying force of the document conveying section 120 would cause a torque increase as well as wrinkles in the document sheet which would occur when the document sheet is stopped by being put into contact with the scale 125, unfavorably. Thus, in order to enable the document conveyance without increasing the conveying force of the document conveying section 120, as shown in FIG. 15B, the inner guide 148 that forms the sheet path ranging from the document conveying section 120 to the reverse roller 141 is formed in such a configuration as to fall inside the natural flexure curve of the document sheet having the maximum thickness that allows sheet passage from the outlet of the document conveying section 120 to the nip portion of the reverse roller 141 and the pinch roller 142. By doing so, the document sheet can be prevented from slipping so that the document sheet can be discharged reliably without increasing the conveying force of the document conveying section 120.

The reverse roller 141 can be driven to rotate clockwise in FIG. 2. The switching claw 144 is normally pivoting counterclockwise in FIG. 2, leading the document sheet to the upper sheet path. In the double-side mode, the switching claw 144 pivots clockwise from the state of FIG. 2 to a specified angle, leading the document sheet to the reversal path and returning it to the document conveyance path.

Figure 16:
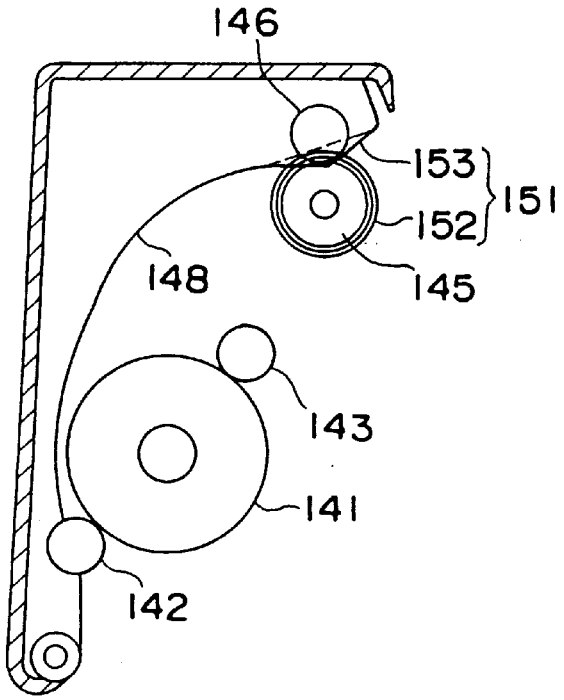
FIG. 16 is a sectional view showing the document urging mechanism of the paper discharge roller.
Figure 17:
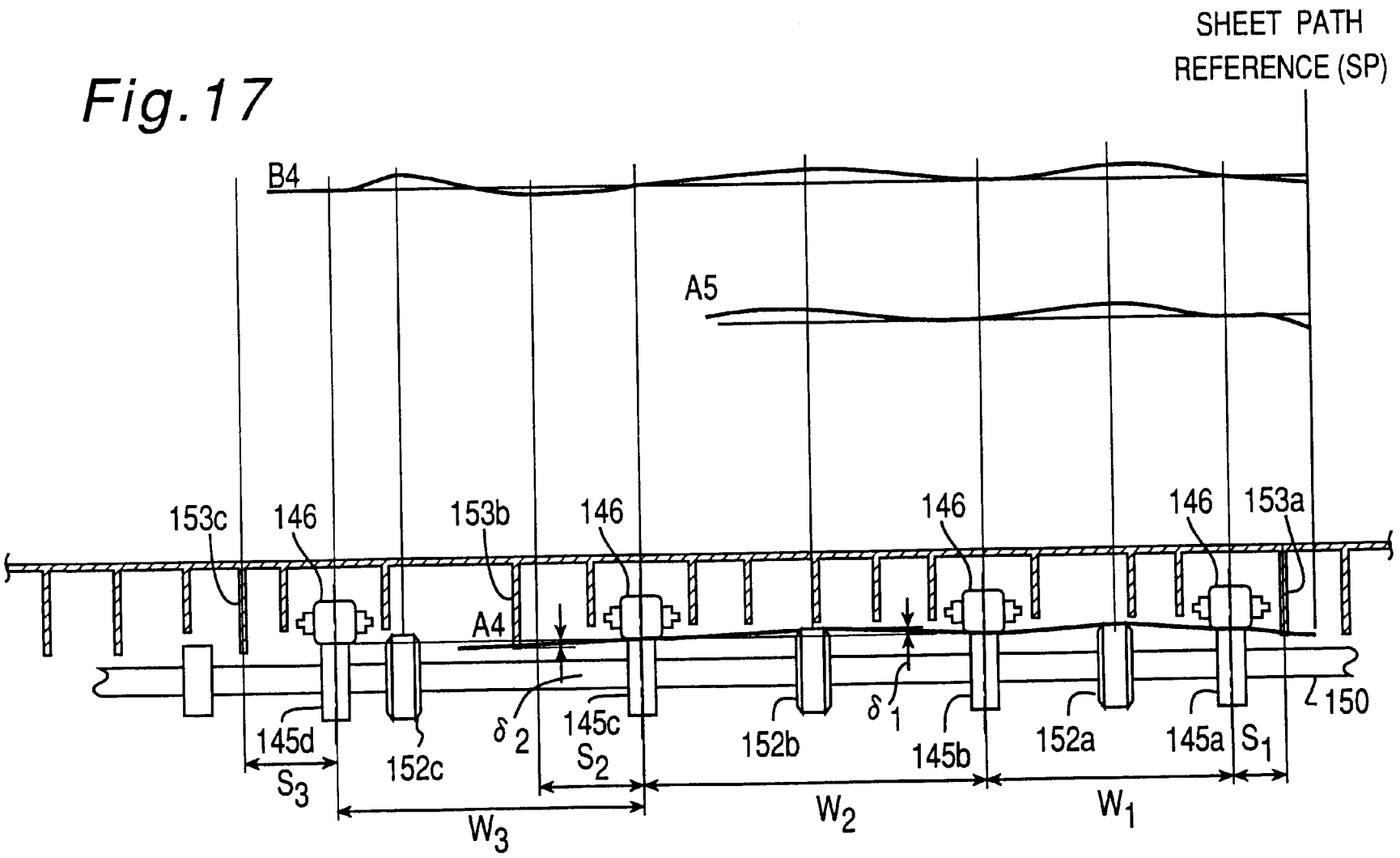
FIG. 17 is a front sectional view showing the document urging mechanism of the paper discharge roller.

The discharge roller 145 can be driven to rotate clockwise in FIG. 16. This discharge roller 145 comprises first, second, third and fourth discharge rollers 145*a,* 145*b,* 145*c* and 145*d* fixed to one rotating shaft 150 as shown in FIG. 17. These discharge rollers 145 are set to such intervals that all the passable sizes of document sheets can be discharged.

The discharge rollers 145 are equipped with a document urging mechanism 151 for urging the document sheet vertically to its surface in order to give a discharged sheet a curl extending in the document feed direction. This document urging mechanism 151 comprises a document urging roller 152 and a document urging rib 153.

The document urging roller 152 is fixed to the rotating shaft 150 of the discharge rollers 145. This document urging roller 152 comprises a first document urging roller 152*a* located intermediate between the first and second discharge rollers 145*a*, 145*b*, a second document urging roller 152*b* located intermediate between the second and third discharge rollers 145*b*, 145*c* and a third document urging roller 152*c* located between the third and fourth discharge rollers 145*c,* 145*d* and near the fourth discharge roller 145*d*. The diameter of these document urging rollers 152 is larger than the diameter of the discharge rollers 145, where one half of the diameter difference therebetween is the upward urging amount (δ1) against the document sheet.

The document urging rib 153 is extendedly provided downward of and on the edge of the guides 148 that form the sheet path, as shown in FIG. 16. This document urging rib 153, as shown in FIG. 17, comprises a first document urging rib 153*a* located on the sheet path standard side of the first discharge roller 145*a*, a second document urging rib 153*b* located on a side opposite to the sheet path standard side of the third discharge roller 145*c*, and a third document urging rib 153*c* located on a side opposite to the sheet path standard side of the fourth discharge roller 145*d*. The distance S1 between the first document urging rib 153*a* and the first discharge roller 145*a* is smaller than the distance W1 between the first discharge roller 145*a* and the second discharge roller 145*b*. The distance S2 between the second document urging rib 153*b* and the third discharge roller 145*c* is smaller than the distance W2 between the second discharge roller 145*b* and the third discharge roller 145*c*. The distance S3 between the third document urging rib 153*c* and the fourth discharge roller 145*d* is smaller than the distance W3 between the third discharge roller 145*c* and the fourth discharge roller 145*d*. In these document urging ribs 153, the size of projection formed by the four discharge rollers 145 from the conveyance surface is the downward urging amount (δ2) for the document.

When the document sheet of, for example, A4 size as shown in FIG. 17 passes through the discharge rollers 145 equipped with the above document urging mechanism 151, the document sheet is urged upward by the first and second document urging rollers 152*a,* 152*b* so that two upward curls are formed in the center of the sheet. Also, on both end portions of the discharged sheet, more rigid curls than those of the center are formed by the first and second document urging ribs 153*a*, 153*b*. If the document sheet is of A5 size, curls are formed on both sides of the document sheet by the first document urging rib 153*a* and the second document urging roller 152*b*. If the document sheet is of B4 size, strong curls are formed by the third document urging roller 152*c*. As a result of firm curls being formed on both side end portions in this way, the discharged sheet is discharged as keeping in the curled shape and will never loose the rigidity until it separates from the discharge rollers 145. Thus, the discharged document sheet is free from occurrence of twist at the front end, so that it is loaded onto the document tray 60 without causing already discharged document sheets to be fed out or to fly up.

Figure 18:
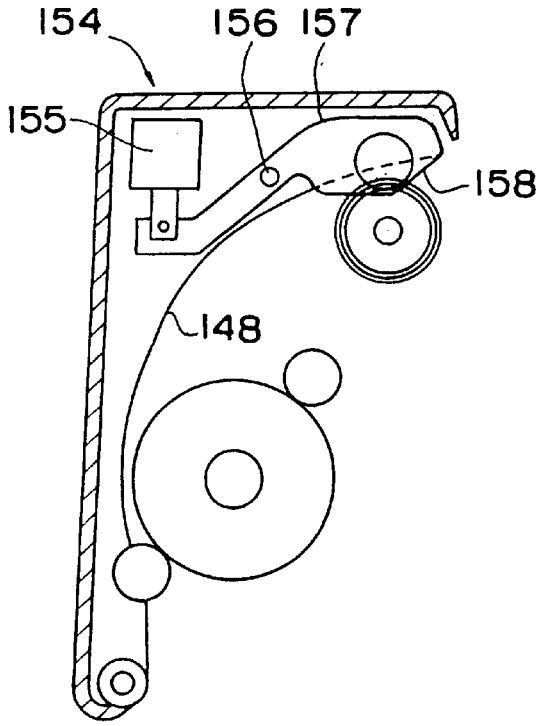
FIG. 18 is a sectional view showing another document urging rib of the paper discharge roller.

FIG. 18 shows a document urging mechanism 154 in which the urging amount is adjustable and which is used in place of the document urging mechanism 151 as described before. This document urging mechanism 154 comprises a solenoid 155 fitted to the guides 148, and a lever 157 fitted to the guides 148 so as to be rotatable by a pivot 156. One end of the lever 157 is fitted to the plunger of the solenoid 155, and a document urging protrusion 158 is formed at the other end. Provided that the discharged document sheet is of ordinary paper quality, the solenoid 155 is turned off, where a certain level of urging amount (δ1) is given to the document. Provided that the discharged document sheet is of relatively hard paper quality like Kent paper, the solenoid 155 is turned on, where the lever 157 pivots clockwise in FIG. 18 so that an urging amount larger than the ordinary (δ1+α) is given to the document. In this way, curls can be formed by imparting appropriate urging amounts depending on the type of document.

Figure 19:
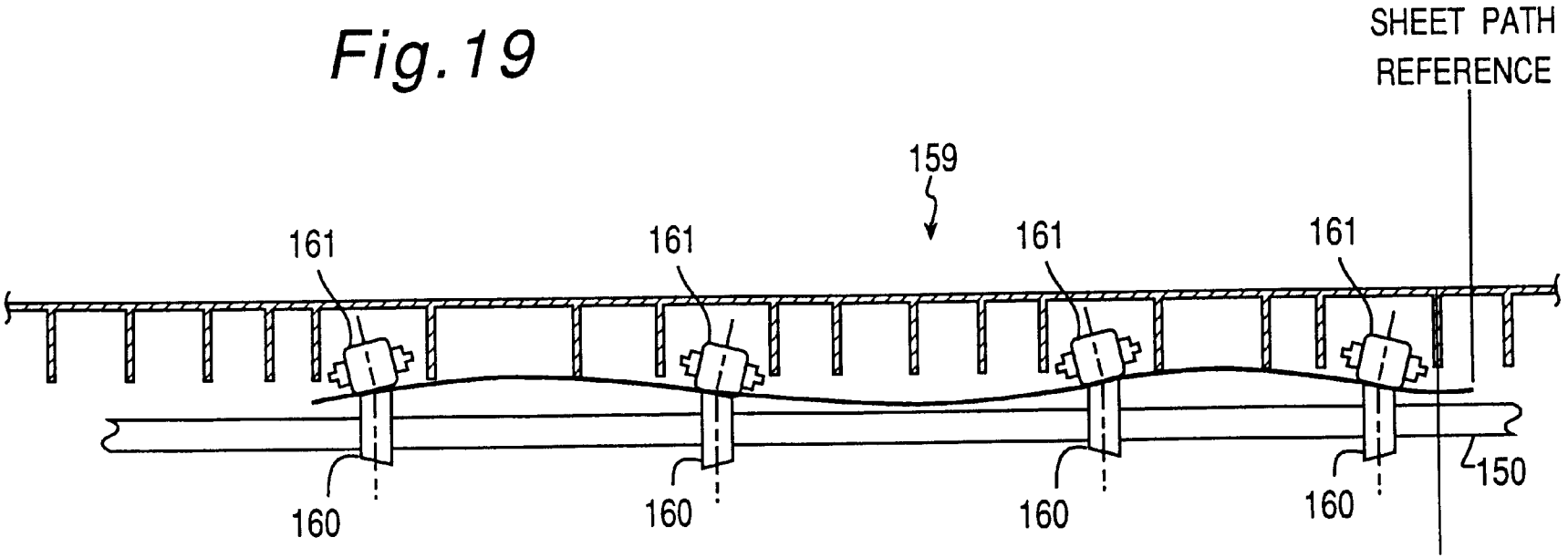
FIG. 19 is a front sectional view showing another document urging mechanism of the paper discharge roller.

FIG. 19 shows another embodiment for imparting curls to the document. This curl imparting mechanism 159 comprises a plurality of discharge rollers 160 of a truncated cone shape, and pinch rollers 161 making press contact with the outer circumferential surfaces of these discharge rollers 160. According to this curl imparting mechanism 159, curls can be imparted to the document sheet without urging the document sheet. It is of course possible to combine this curl imparting mechanism 159 with the document urging mechanisms 151, 154.

(Document Restricting Section)

Figure 20:
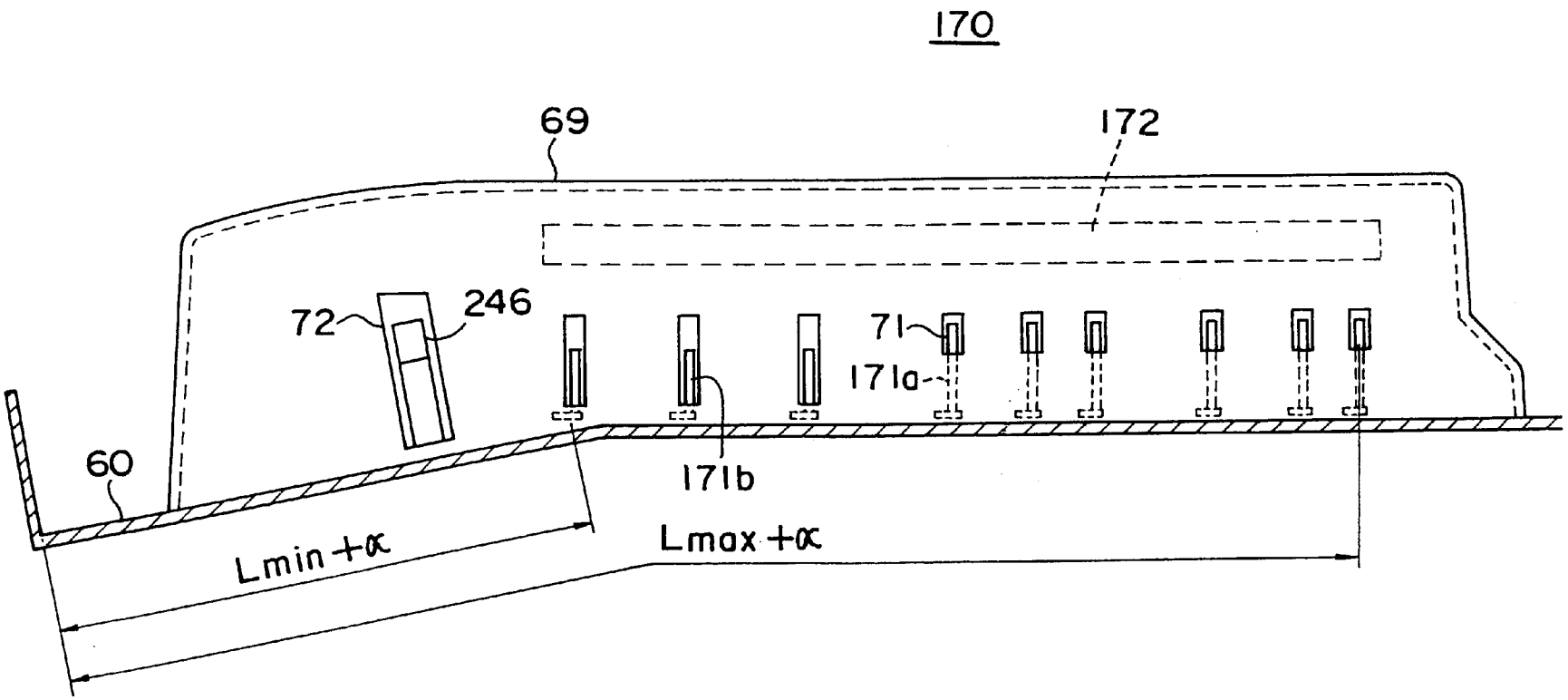
FIG. 20 is a front view of the document regulator.

The document restricting section 170 is designed to restrict the front end of the document sheet discharged from the document discharge section 140 and, as shown in FIG. 20, comprises a plurality of discharged-document stopper mechanisms 171 and a drive mechanism 172 for driving the discharged-document stopper mechanisms 171.

The discharged-document stopper mechanisms 171 are disposed nine in number correspondingly to the document size inside the fixed document-restricting plate 69 and along the document feed direction. In more detail, they are provided at a position of the farthest distance (Lmax+α) from the upstream end of the document tray 60 in the document feed direction for documents of the longest size (Lmax) in the document feed direction, and at a position of the nearest distance (Lmin+α) from the upstream end of the document tray 60 in the document discharge direction for documents of the shortest size (Lmin) in the document feed direction. For documents of the almost same length in the document feed direction, the same discharged-document stopper mechanisms 171 can be used to achieve a simplification in construction and a reduction in cost. Six discharged-document stopper mechanisms 171*a* on the downstream side of the document discharge direction slightly differ in configuration from three discharged-document stopper mechanisms 171*b*, on the upstream side. Hereinafter, the former will be referred to as A type discharged-document stopper mechanisms 171*a*, and the latter as B type discharged-document stopper mechanisms 171*b*.

FIG. 21 shows the A type discharged-document stopper mechanism 171*a*. This A type discharged-document stopper mechanism 171*a* is housed in the holder 173 fitted inside the fixed document-restricting plate 69 and comprises a stopper 174 and a lever 175.

The stopper 174 is formed into an inverted L shape by a first arm portion 176 and a second arm portion 177. One end of the first arm portion 176 is fitted to the lower end of the holder 173 by a pivot 178 so as to be pivotable between a withdrawal position depicted by solid line and a restrictive position depicted by two-dot chain line. Also, the stopper 174 is urged counterclockwise in the figure by an unshown spring, by which the second arm portion 177 is protruded from a rectangular opening 71 formed in the fixed document-restricting plate 69, making contact with the top surface of the document tray 60. The outer edge of the second arm portion 177 is formed into an arc shape around the pivot 178 as a center.

The lever 175 comprises a first lever 180 one end of which is fitted to the upper end of the holder 173 so as to be pivotable by a pivot 179, and a second lever 181 which is fitted to the front end of the first lever 180 so as to be pivotable by a pivot 182. The first lever 180 is urged counterclockwise in the figure about the pivot 179 by an unshown spring. The second lever 181 has an engaging portion 184 which makes contact with an engaging portion 183 of the first lever 180 so that the second lever 181 will pivot counterclockwise about the pivot 182 but not pivot clockwise. At a front end of the second lever 181, is provided a protrusion 185 which makes contact with the inner edge of the first arm portion 176 of the stopper 174.

Figure 21A:
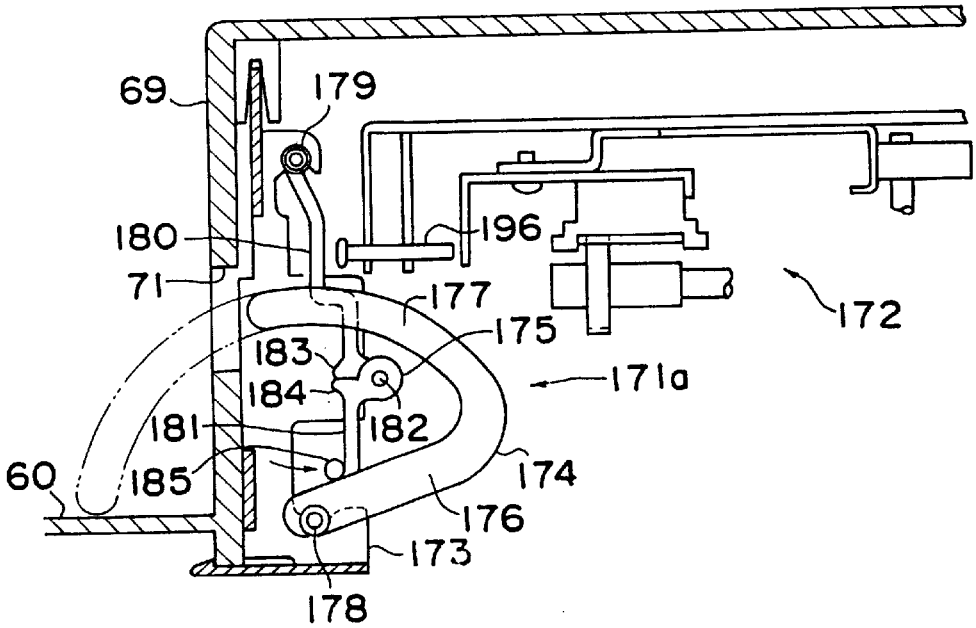
FIG. 21 is a sectional view sequentially showing operations of the A type discharged-document stopper mechanism.
Figure 21B:
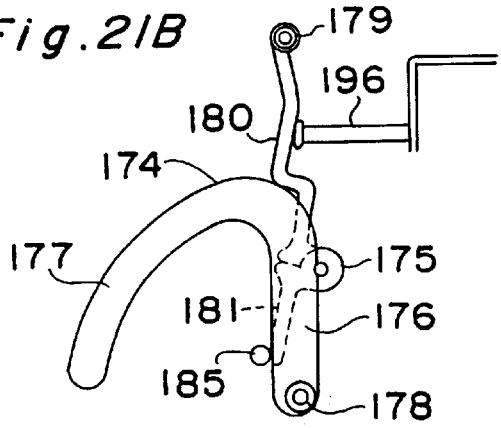
Figure 21C:
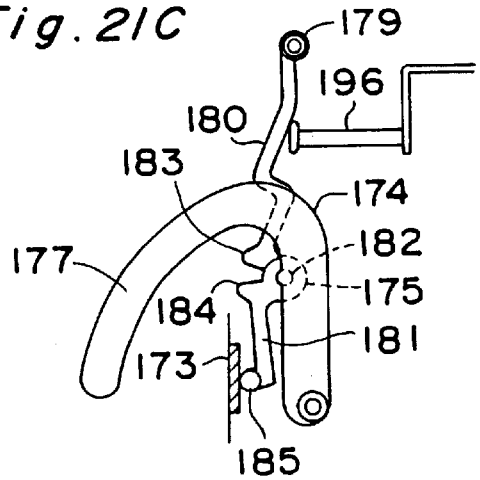

In the discharged-document stopper mechanism 171, the counterclockwise urging force of the lever 175 about the pivot 179 is set larger than the counterclockwise urging force of the stopper 174 about the pivot 178. Due to this, when the lever 175 is not pressed by a later-described drive pin 196 of the drive mechanism 172 as shown in FIG. 21A, the protrusion 185 of the lever 175 presses the stopper 174 in the direction of arrow, so that the stopper 174 is positioned in the withdrawal position, where the stopper 174 is withdrawn inside the document restricting plate 69. Also, when the lever 175 is pressed by the drive pin 196 as shown in FIG. 21B, the lever 175 pivots clockwise about the pivot 179, causing the protrusion 185 of the lever 175 to try to separate from the inner edge of the stopper 174, so that the stopper 174 accordingly pivots about the pivot 178 by its own urging force. As a result of this, the stopper 174 has its second arm portion 177 protruded from the opening 71 of the fixed document-restricting plate 69 so as to come into press contact with the document tray 60, being stopped in the restrictive position. Further, when the lever 175 is pressed by the drive pin 196, the protrusion 185 of the lever 175 separates from the inner edge of the stopper 174, coming into contact with the holder 173 as shown in FIG. 21C. As a result of this, the engaging portion 183 of the first lever 180 and the engaging portion 184 of the second lever 181 are separated from each other, resulting in bent state. Therefore, even with a large drive stroke of the drive pin 196, the lever 175 will never be broken.

Figure 22:
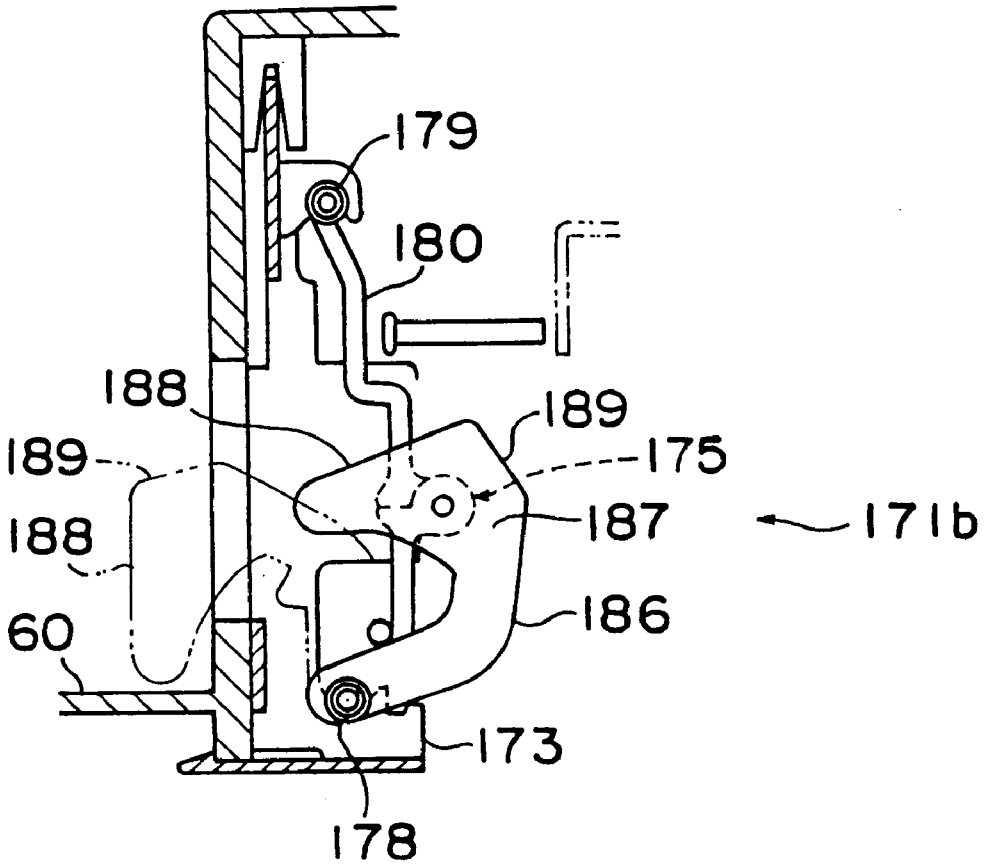
FIG. 22 is a sectional view showing the B type discharged-document stopper mechanism.

FIG. 22 shows the B type discharged-document stopper mechanism 171*b*. Because this stopper mechanism is similar to the A type discharged-document stopper mechanism 171*a* except the configuration of a stopper 186, corresponding parts are designated by like reference numerals and their description is omitted. As to the configuration of the stopper 186, the outer edge of a second arm portion 187 is formed by two linear edges 188, 189. When the stopper 186 is in the restrictive position, the first linear edge 188 on the front end side is vertical to the document tray 60 and the second linear edge 189 is tilted to the document tray 60.

Figure 23:
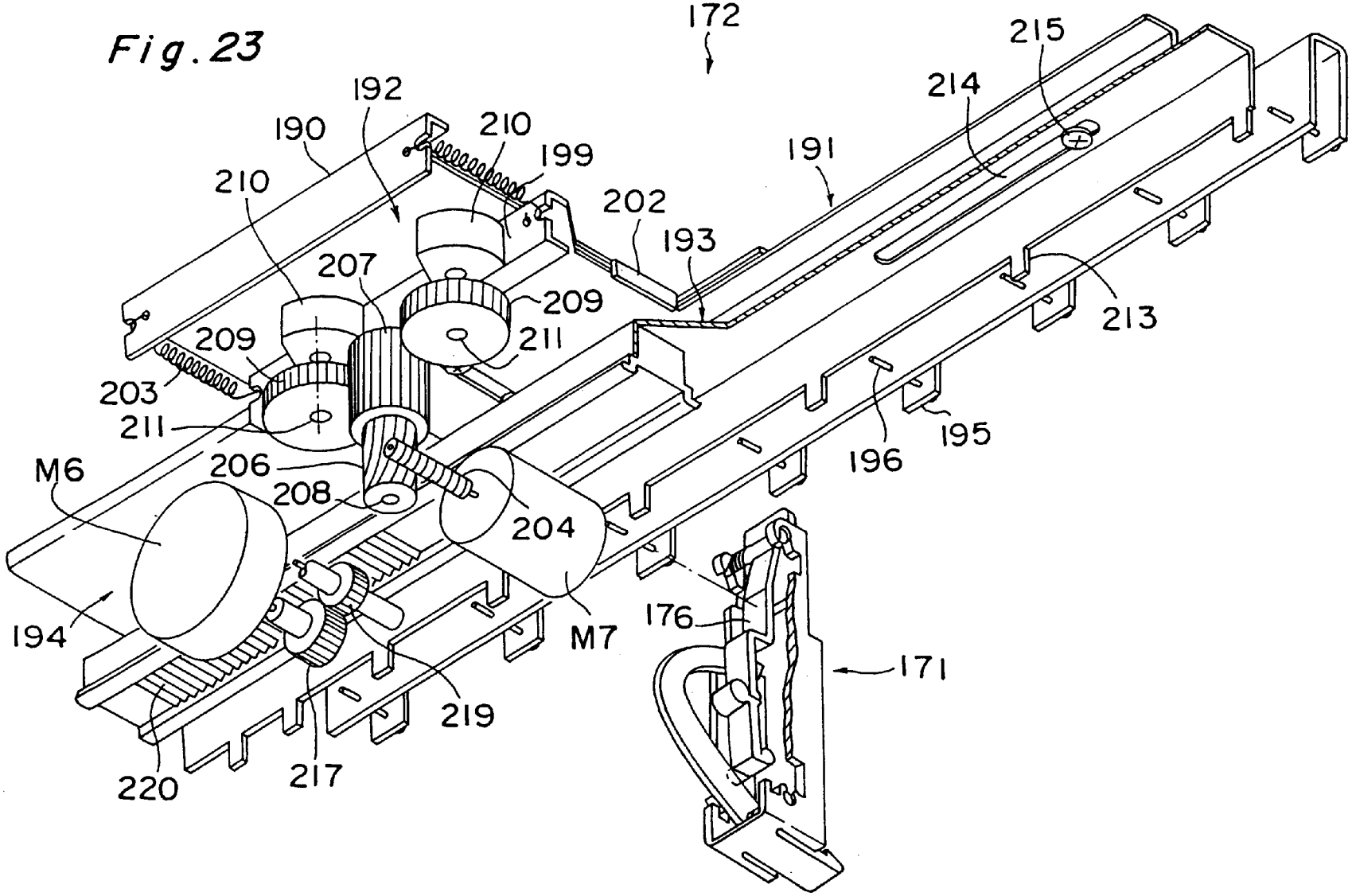
FIG. 23 is a perspective view showing the drive mechanism for the discharged-document stopper mechanism.

The drive mechanism 172 of the discharged-document stopper mechanism 171, as shown in FIG. 23, comprises a fixed frame 190, a first slider 191, a first drive mechanism 192 for driving the first slider 191 into sliding, a second slider 193, and a second drive mechanism 194 for driving the second slider 193 into sliding.

The fixed frame 190 is fixed inside the fixed document-restricting plate 69, and has a drive-pin holder 195 at a position opposite to the lever 175 of the discharged-document stopper mechanism 171. This drive-pin holder 195 is inverted-U shaped so that the drive pin 196 is slidably held so as to advance and withdraw with respect to the lever 175 of the discharged-document stopper mechanism 171.

Figure 24:
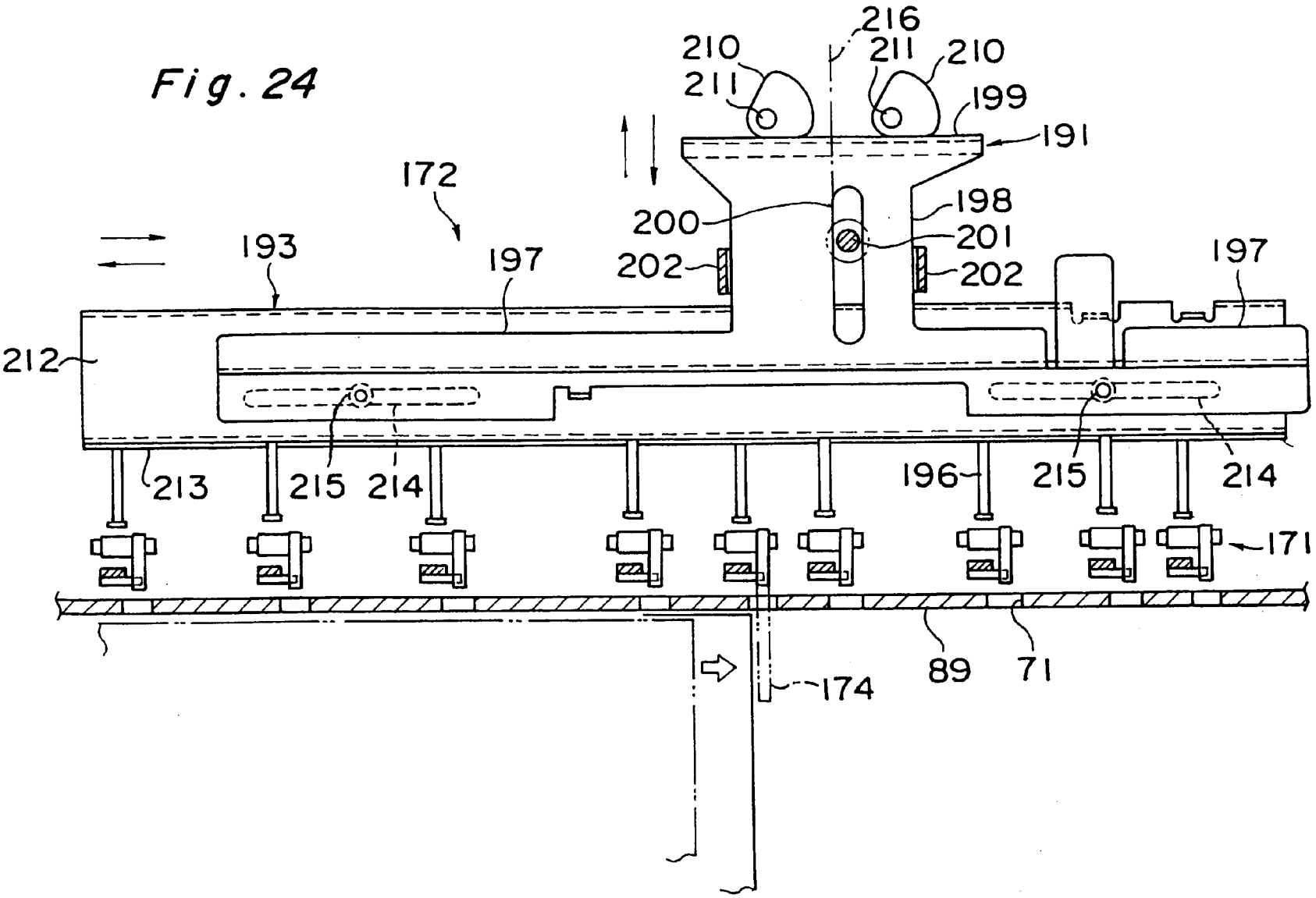
FIG. 24 is a plan view showing the drive mechanism for the discharged-document stopper mechanism.

The first slider 191, as shown in FIG. 24, a second slider holding portion 197 extending in the document feed direction, and a driver 198 extending from a generally center of the second slider holding portion 197 in a direction perpendicular to the document feed direction. A front end of the driver 198 is bent downward to form a drive surface 199 with which a later-described cam 210 of the first drive mechanism 192 comes into press contact. Also, a long hole 200 extending in a direction perpendicular to the document feed direction is formed in the driver portion 198. A screw 201 is inserted into this long hole 200 so as to be screwed into the fixed frame 190, by which the first slider 191 is fitted to the fixed frame 190. Then, the first slider 191 is slidable in a direction perpendicular to the document feed direction by both side edges of the driver 198 being guided by guides 202 formed in the fixed frame 190. Also, the first slider 191 is urged depthwise by springs 203 fitted between both ends of the drive surface 199 and the fixed frame 190 as shown in FIG. 23.

The first drive mechanism 192, as shown in FIG. 23, comprises a CD alignment motor M7 having a worm 204 fitted to its drive shaft, a coupling shaft 208 having a worm wheel 206 and a gear 207 to be screwed with the worm 204 of the CD alignment motor M7, and two cam shafts 211 each having a gear 209 and a cam 210 to be screwed with the gear 207 of the coupling shaft 208. As the CD alignment motor M7 rotates, the cam shafts 211 is rotated via the coupling shaft 208, so that the first slider 191 is reciprocatingly slid in a direction perpendicular to the document feed direction.

The second slider 193, as shown in FIG. 24, comprises a base portion 212 extending in the document feed direction, and a plurality (nine in this embodiment, but not limited to this) of pressing portions 213 protruding downward from a downwardly bent side edge of the base portion 212. A long hole 214 is formed at both end portions of the base portion 212, and the second slider 193 is slidable in the document feed direction with respect to the first slider 191 by inserting a screw 215 into this long hole 214 and thereby inserting it into the first slider 191. The plurality of pressing portions 213 are positioned at specified intervals in the document feed direction. In addition, the long hole 200 and the screw 201, by which the slide shaft of the first slider 191 is formed, are preferably located near the axis of symmetry of the two cam shafts 211 of the first drive mechanism 192. With this arrangement, when the pressing portions 213 that are the farthest from the slide shaft press the stopper 174 via the drive pins 196, the first slider 191 will operate smoothly without effecting prying action.

The second drive mechanism 194, as shown in FIG. 23, comprises a FD alignment motor M6 having a gear 217 fitted to its drive shaft, a pinion 219 to be engaged with the gear 217 of the FD alignment motor M6, and a rack 220 which is fitted to the lower surface of the base portion 212 of the second slider 193 and with which the pinion 219 is engaged. As the FD alignment motor M6 rotates, the rack 220 is moved via the gear 217 and the pinion 219, so that the second slider 193 moves in the document feed direction along with the rack 220.

Figure 25:
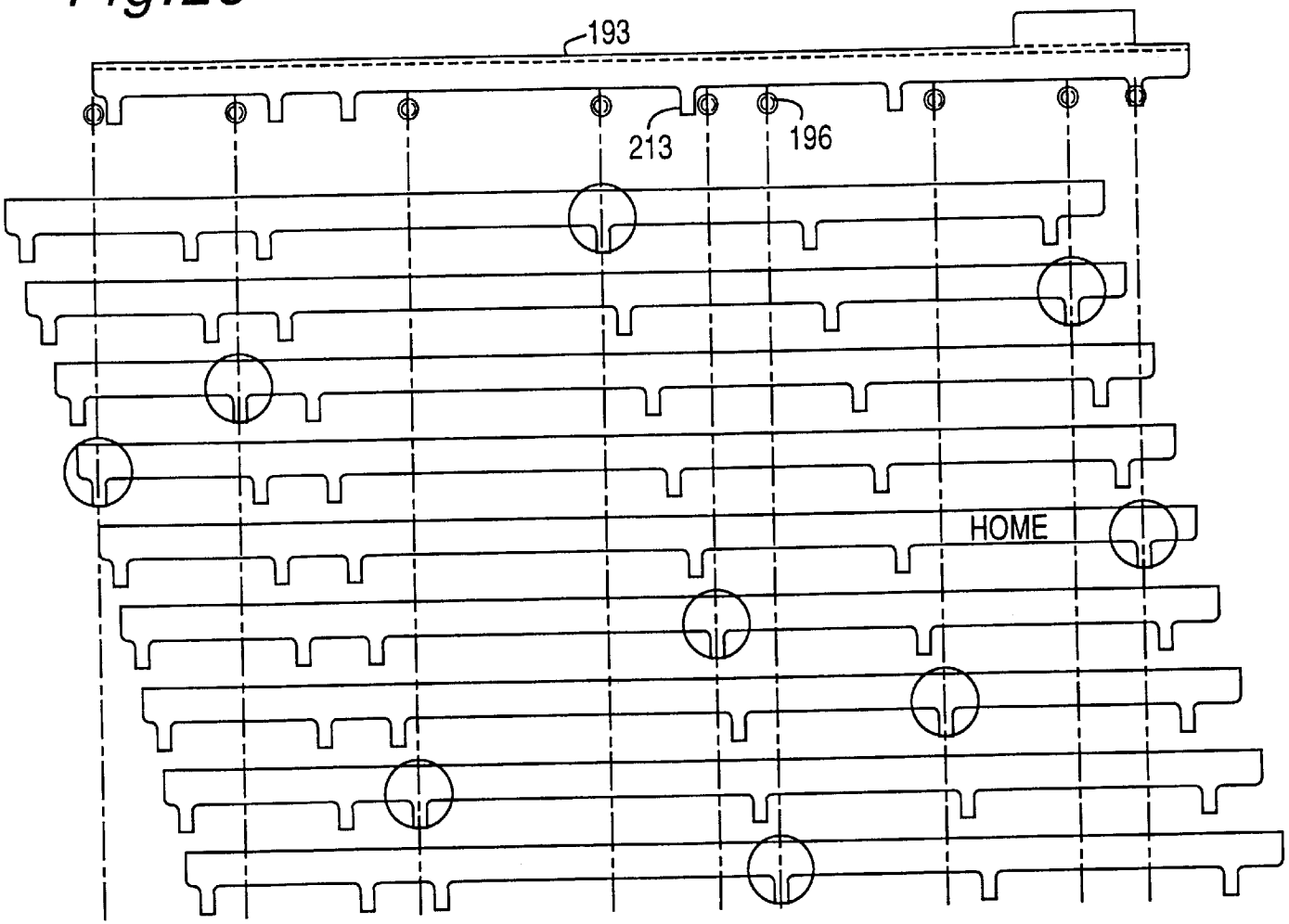
FIG. 25 is a view showing operation of the drive mechanism for the discharged-document stopper mechanism.

FIG. 25 shows the positional relation between pressing portions 213 and drive pins 196 of the second slider 193. When the second slider 193 is in the home position, pressing portions 213 encircled on the most downstream side of the document feed direction are opposed to drive pins 196 on the most downstream side of the feed direction. Each time the second slider 193 moves in steps of a specified distance from the home position toward the upstream side of the document feed direction, some one of the encircled pressing portions 213 is opposed to some one of the drive pins 196. Besides, each time the second slider 193 moves in steps of a specified distance from the home position toward the downstream side of the document feed direction, some one of the encircled pressing portions 213 is opposed to some one of the drive pins 196. The second slider 193, having a plurality of pressing portions 213 as shown above, results in the shortest travel so that some one of the pressing portions 213 can be opposed to a desired drive pin 196 promptly.

In the document restricting section 170 of the above-described constitution, when the first document sheet is fed and discharged, a discharged-document stopper mechanism 171 is selected according to the document size entered by the user or to the document size detected at the feed of the first document sheet. Then, the second slider 193 is moved by the second drive mechanism 194 so that the one of the pressing portions 213 is opposed to the drive pin 196 corresponding to the selected discharged-document stopper mechanism 171. Subsequently, the first slider 191 is slid in the direction perpendicular to the document feed direction by the pivoting of the cam 210 of the first drive mechanism 192, by which the pressing portion 213 presses the drive pin 196 corresponding to the selected discharged-document stopper mechanism 171. As a result, the lever 175 of the discharged-document stopper mechanism 171 is pressed by the drive pin 196, thus pivoting, so that the stopper 174 pivots from the withdrawal position to the restrictive position, resulting in press contact on the document tray 60 in the case of smaller document size or press contact on the fed document placed on the document tray 60 in the case of large document size. Accordingly, the front end of the discharged document sheet meets the stopper 174 on its discharge path, and pulled in, as it is, so as to be aligned.

For the document restricting section 170, when document sheets of sizes larger than that of the first sheet are included, it is preferable that the stopper 174 is returned from the restrictive position to the withdrawal position in order to prevent the document sheets from meeting the discharged-document stopper 174 and being thereby damaged on its way of discharge. In this case, a stopper 174 corresponding to the pertinent different size is actuated from the withdrawal position to the restrictive position. Also, when the stopper 174 has come to no longer withdraw due to some fault of sensors, motors or the like, it is preferable to prevent the use of the document conveying apparatus because of a possibility that the stopper 174 may remain on the document tray 60, making it impossible to set the next document, or that the discharged sheet may be caught, damaging the document.

Another embodiment of the document restricting section 170 is now explained.

Figure 26:
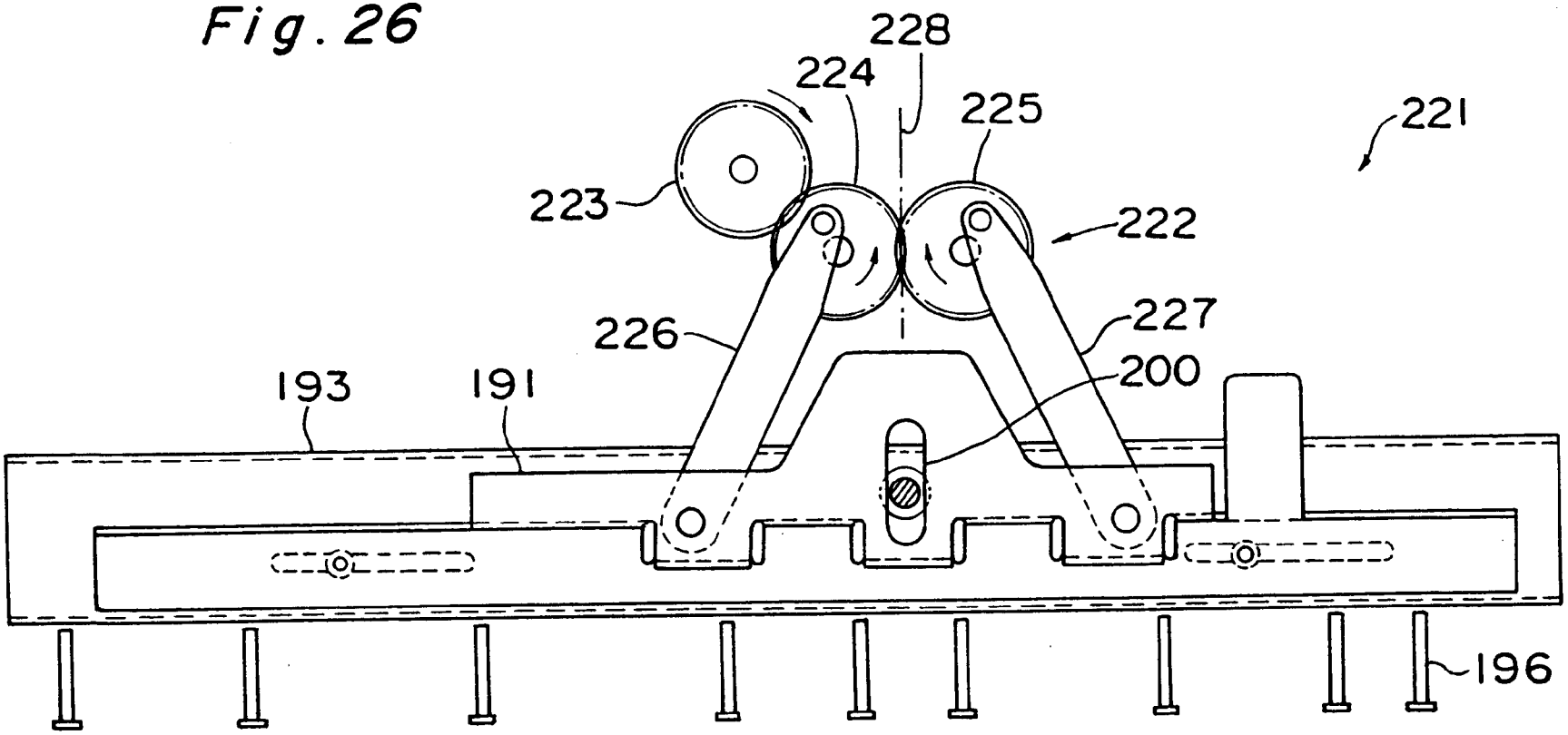
FIG. 26 is a plan view showing another drive mechanism for the discharged-document stopper mechanism.

FIG. 26 shows a drive mechanism 221 of another embodiment for driving the discharged-document stopper mechanism 171. This drive mechanism 221 is substantially the same as the foregoing drive mechanism of FIG. 24 except that a first drive mechanism 222 for driving the first slider 191 is a link mechanism. Therefore, corresponding members are designated by like reference numerals and omitted in description.

The first drive mechanism 222 comprises a drive gear 223 fitted to a drive shaft of an unshown motor, a first link gear 224 to engage with the drive gear 223, a second link gear 225 to engage with the first link gear 224, a first link 226 one end of which is pivotably fitted to the first link gear 224 with eccentricity and the other end of which is pivotably fitted to the first slider 191, and a second link 227 one end of which is pivotably fitted to the second link gear 225 with eccentricity and the other end of which is pivotably fitted to the first slider 191. The first and second links 226, 227 are arranged symmetric with respect to an axis of symmetry 228 given by the center line between the first and second link gears 224, 225. Then, the long hole 200 of the first slider 191 is formed on this axis of symmetry 228.

In this drive mechanism 221, when the drive gear 223 has rotated clockwise to a specified angle, the first and second link gears 224, 225 are rotated in opposite directions so that the first and second links 226, 227 press and slide the first slider 191. With the drive gear 223 rotated to a further specified in the same direction, the first and second links 226, 227 pull up and slide the first slider 191. By such a sliding action of the first slider 191, the discharged-document stopper mechanism 171 is driven like the foregoing, so that the discharged-document stopper 174 is moved to the withdrawal position and the restrictive position.

Figure 27:
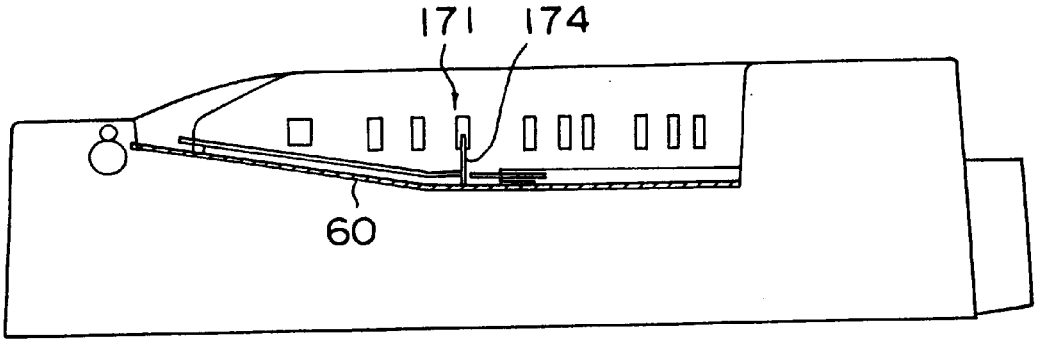
FIG. 27 is a view showing another means for end regulation of the discharged document.

FIG. 27 shows a case in which when different sizes of document sheets are included in the fed document sheets, the document tray 60 is so formed as to be higher on the discharge side and lower on the feed side with a view to reliably achieving the front end restriction of the discharged document sheets by the stopper 174 of the discharged-document stopper mechanism 171.

Figure 28:
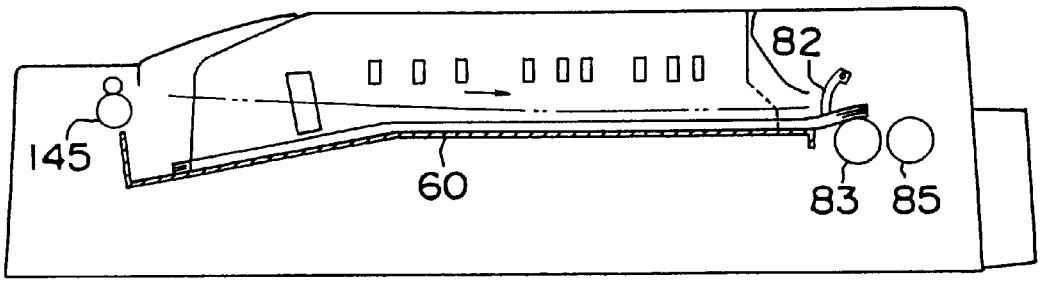
FIG. 28 is a view showing another means for end regulation of the discharged document.

FIG. 28 shows a case in which the refeed preventing member 82 for sorting fed document sheets and discharged document sheets serves also as a discharged-document restricting stopper corresponding to large-size document sheets.

Figure 29:
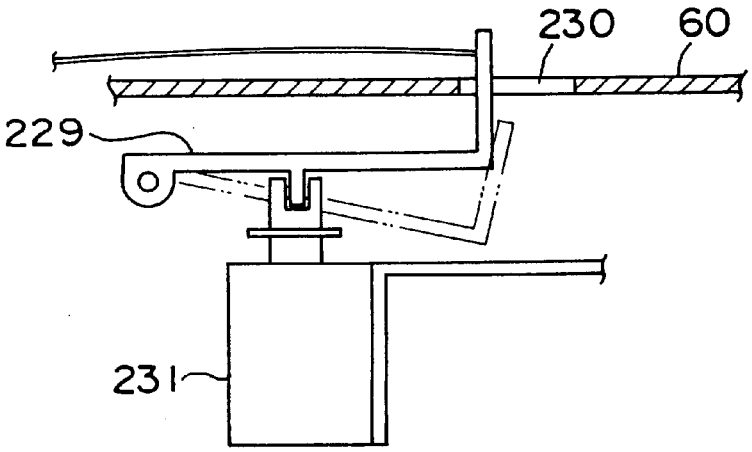
FIG. 29 is a sectional view showing another means for end regulation of the discharged document.

FIG. 29 shows a case in which a discharged-document stopper 229 is provided inside the document tray 60 so as to be protruded upward through an opening 230 formed in the document tray 60 by a solenoid 231. In this case, because the space below the document tray 60 can be effectively utilized, the apparatus can be prevented from upsizing.

(Document Move Preventing Section)

Figure 30:
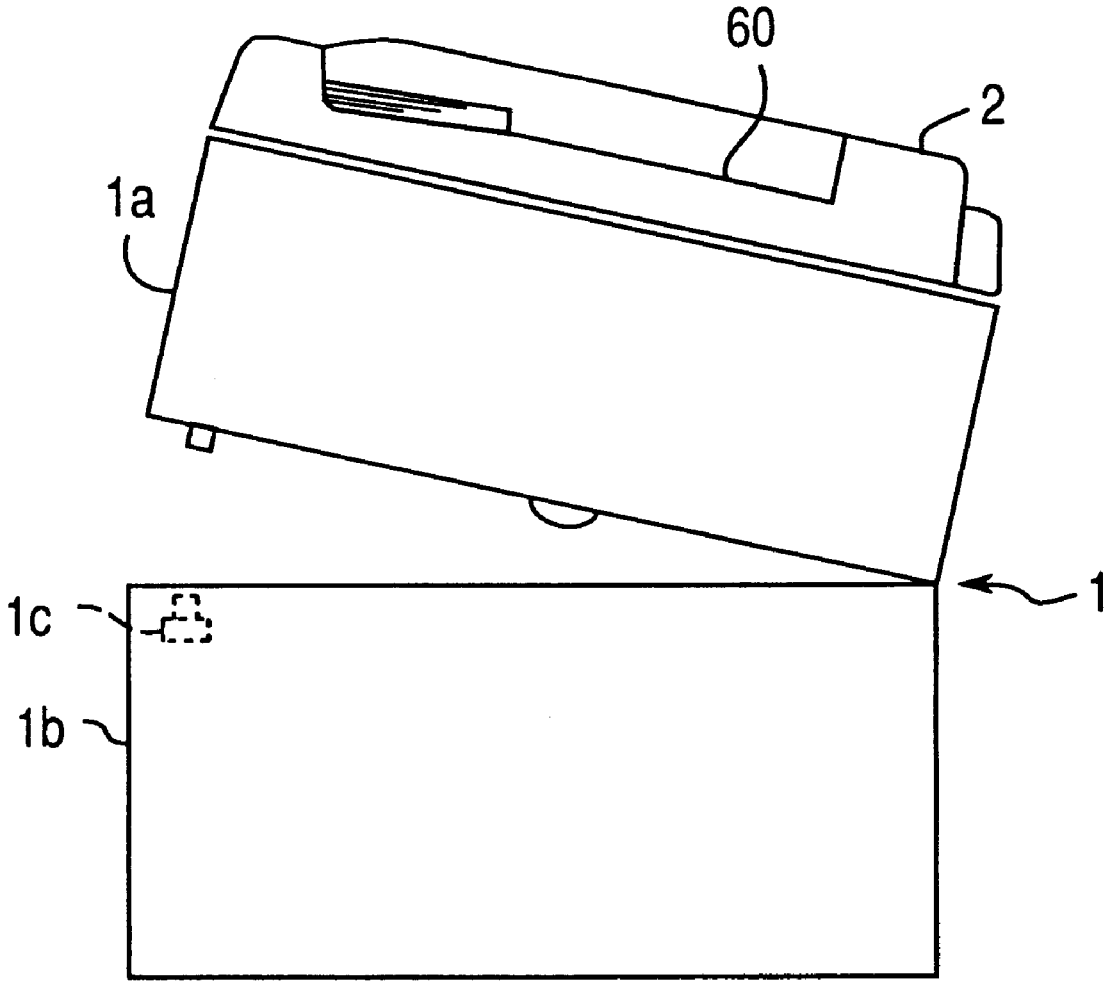
FIG. 30 is a front view of a copying machine showing a state that upper part of the copying machine main body is opened.
Figure 31:
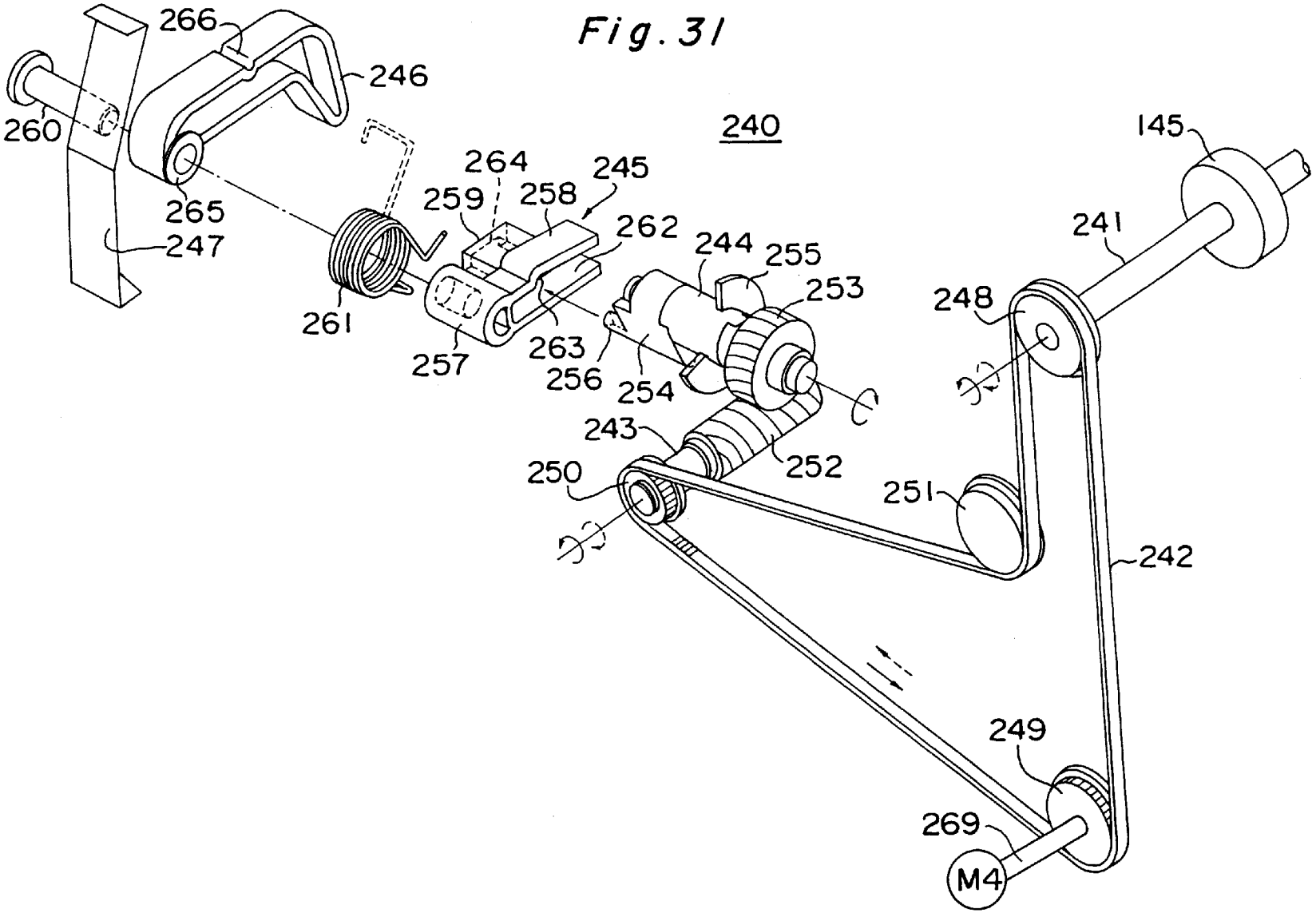
FIG. 31 is a perspective view of the document move preventer.

A document move preventing section 240, as shown in FIG. 30, is designed to prevent the document sheets on the higher position side on the document tray 60 (discharged document sheets in this embodiment) from moving when an upper machine body 1*a* of the copying machine main body 1 is opened for jam processing or the like. This document move preventing section 240, as shown in FIG. 31, generally comprises a drive shaft 269, a transmission belt 242, a transmission shaft 243, a crank shaft 244, a slider 245, a document-pressing lever 246 and a plate spring 247.

The drive shaft 269 is driven into forward and reverse rotation by a discharge motor M4. The drive shaft 269 serves as a drive shaft for the discharge roller 145 when rotating forward, and as a drive shaft for the document move preventing section 240 when rotating reverse. Like this, the drive shaft 269 can be implemented by the existing drive shaft for the discharge roller 145, thus eliminating the need of providing any special drive unit.

The transmission belt 242 is stretched on a pulley 248 provided to the discharge roller 145, a drive pulley 249, and a later-described one-way clutch 250 provided to the transmission shaft 243, and adjusted in tensile force by a presser pulley 251.

The transmission shaft 243 is supported by an unshown shaft parallel to a drive shaft 241 for the discharge rollers 145, and has the one-way clutch 250 and a worm 252. The one-way clutch 250 has the transmission belt 242 stretched thereon. The one-way clutch 250 does not transmit power to the transmission shaft 243 for the rotation in the direction of the solid-line arrow (forward rotation of the discharge roller 145), and transmits power for the rotation in the direction of broken-line arrow (reverse rotation of the discharge roller).

The crank shaft 244 is supported by an unshown frame so as to be perpendicular to the transmission shaft 243, and has a worm wheel 253 to be engaged with the worm 252, a crank arm 254, and a detector plate 255 for detecting the rotational angle by an unshown sensor. An engaging shaft 256 protruding parallel to the crank shaft 244 is provided at a front end of the crank arm 254.

The slider 245 comprises a shaft portion 257, an arm portion 258 extending perpendicularly from the shaft portion 257, and an engaging portion 259 extending from the arm portion 258 parallel to the shaft portion 257. The shaft portion 257 is rotatably supported by a pivot 260 eccentric to the crank shaft 244 together with the document-pressing lever 246. A twist spring 261 is fitted to this shaft portion 257. In the arm portion 258, is formed a slide groove 262 with which the engaging shaft 256 formed at the front end of the crank arm 254 of the crank shaft 244 is slidably engaged. On one side surface of this slide groove 262, is formed an engaging recess 263. In the engaging portion 259, is formed a recess 264 with which one end of the torsion spring 261 is engaged.

Figure 32A:
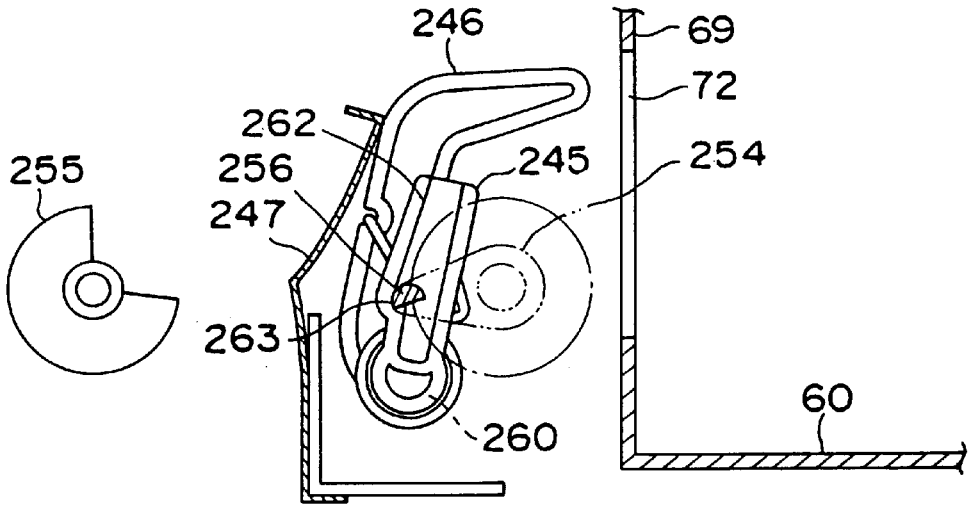
FIG. 32 is a sectional view sequentially showing operations of the document move preventing mechanism.

The document-pressing lever 246 is generally L-shaped, and has the pivot 260 inserted into its shaft portion 265. Also, the other end of the torsion spring 261 is engaged with a groove 266 formed in the rear surface of the document-pressing lever 246, by which the document-pressing lever 246 and the slider 245 are urged in such a direction as to overlap with each other as shown in FIG. 32, and are stabilized by the engaging portion 259 of the slider 245 being engaged with the document-pressing lever 246. The document-pressing lever 246 is pivotable between a withdrawal position where it is withdrawn inside the fixed document-restricting plate 69 as shown in FIG. 32A, and a press position where an end of the document-pressing lever 246 is protruded from the opening 72 formed in the fixed document-restricting plate 69 so as to press the top surface of the discharged document sheet placed on the document tray 60.

The plate spring 247 is intended to urge the document-pressing lever 246 and the slider 245 clockwise in FIG. 32 when the document-pressing lever 246 is in the withdrawal position, in order to prevent the engaging shaft 256 of the crankshaft 244 from separating off from the engaging recess 263 of the slide groove 262 of the slider 245.

In the document move preventing section 240 of the above-described constitution, in the normally state, the engaging shaft 256 of the crank shaft 244 is engaged with the engaging recess 263 of the slider 245, so that the document-pressing lever 246 is positioned in the withdrawal position. In this state, when a sensor 1*c* provided on the lower machine body 1*b* has detected that the upper machine body 1*a* has been slightly opened or that the lever for opening the upper machine body 1*a* has been operated as shown in FIG. 30, or when such an abnormal situation is detected that the machine body 1 must have the upper machine body 1*a* opened due to paper jam or the like, the discharge motor for the discharge rollers 145 rotate reverse.

Figure 32B:
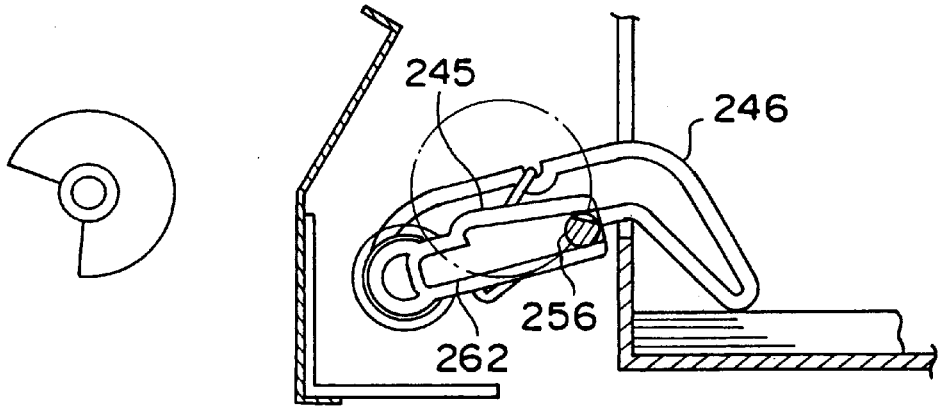

Accordingly, the drive shaft 241 for the discharge rollers 145 rotate in the direction of the solid-line arrow, the rotational force being transmitted to the one-way clutch 250 of the transmission shaft 243 via the transmission belt 242 so that the transmission shaft 243 rotates in the direction of the broken-line arrow. As a result of this, the crank shaft 244 rotates in the direction of arrow, and as the engaging shaft 256 of the crank shaft 244 slides within the slide groove 262 of the slider 245, the slider 245 and the document-pressing lever 246 integrally pivot clockwise in FIG. 32A about the pivot 260. Then, as shown in FIG. 32B, the document-pressing lever 246 is protruded from the opening 72 of the fixed document-restricting plate 69, making contact with the top surface of the discharged document sheet on the document tray 60.

Figure 32C:
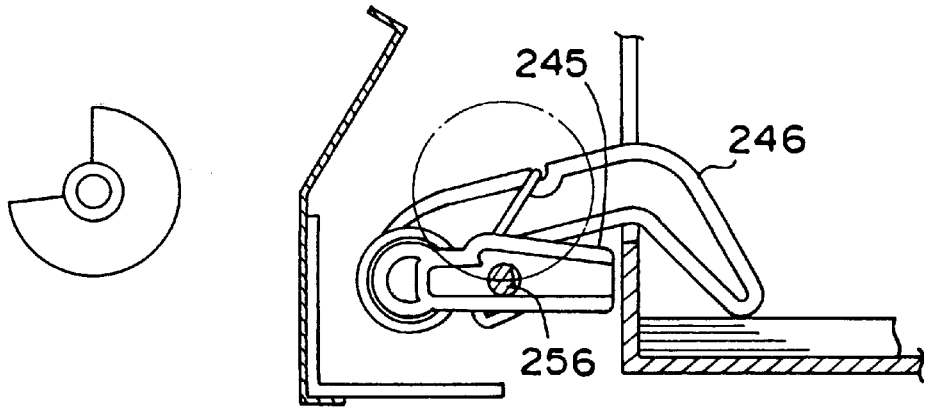

As the crank shaft 244 continues rotating further, only the slider 245 rotates as shown in FIG. 32C so that the torsion spring 261 is twisted to an extent of the pivoting difference between this slider 245 and the document-pressing lever 246, by which a pressing force is imparted to the document-pressing lever 246. When this occurs, an unshown sensor detects the off edge of the detector plate 255, stopping the reverse rotation of the discharge rollers 145. In this way, the discharged document sheets on the document tray 60 are pressed by the document-pressing lever 246, so that even if document tray 60 is tilted with the upper machine body 1*a* of the copying machine main body 1 opened, the higher-place discharged document sheets are prevented from moving to lower places.

When the upper machine body 1*a* of the copying machine main body 1 has been returned, upon detection of that, the discharge rollers 145 rotate reverse once again. As the engaging shaft 256 of the crank shaft 244 slides within the slide groove 262 of the slider 245, the slider 245 pivots counterclockwise, causing the pressing force of the document-pressing lever 246 to be released. Subsequently, the slider 245 pivots counterclockwise along with the document-pressing lever 246, returning to the withdrawal position. In this process, upon engagement of the engaging shaft 256 of the crank shaft 244 with the engaging recess 263 of the slide groove 263, an unshown sensor detects the on edge of the detector plate 255, causing the reverse rotation of the discharge motor.

In addition, under the forward rotation of the discharge rollers 145, the one-way clutch 250 does not transmit their rotational force to the transmission shaft 243, but it may occur that slight rotational force is transmitted by frictional force. In this case, however, the crank shaft 244 has its engaging shaft 256 engaged with the engaging recess 263 as shown in FIG. 32A, so that the slider 245 is prevented from rotating. Thus, the document-pressing lever 246 will never operate.

In the above embodiment, movement of the discharged document sheets is prevented by providing the document move preventing section 240 on the discharge side. Otherwise, when the discharge side becomes the higher with the upper machine body 1*a* of the copying machine main body 1 opened, the document move preventing section 240 may be provided on the feed side to prevent the movement of the discharged document sheets. In this case, use can be made of the reverse rotation of the pickup rollers 83 and the separating rollers 85.

It is also possible that, instead of pressing the document from above by the document-pressing lever 246 as in the foregoing embodiment, the document-pressing lever 246 is put into press contact with the document tray 60 on the downstream side of the document end so as to restrict the lower-place end portion of the document, thus preventing its movement.

Further, without providing any special document move preventing section 240 as in the foregoing embodiment, the existing document pressing plate 84 provided above the pickup rollers 83 of the document feed section 80 may be utilized to prevent the movement of the fed document sheets.

(Document Refeed Moving Section)

Figure 33:
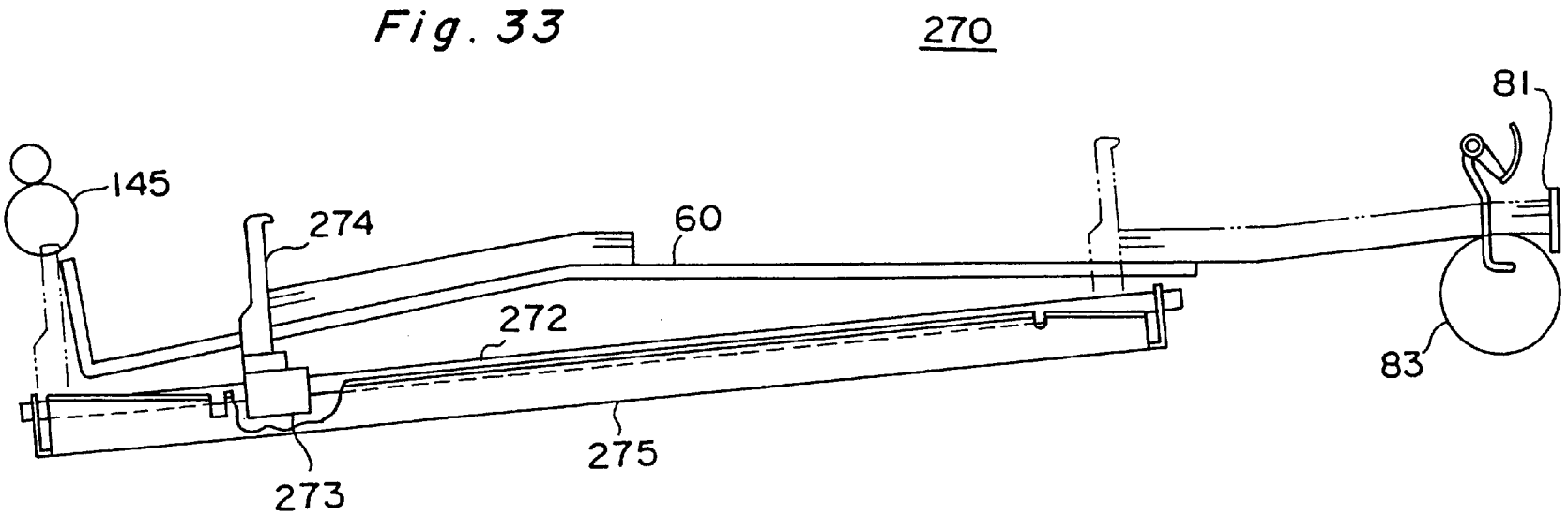
FIG. 33 is a front view of the document refeeding mover.
Figure 34:
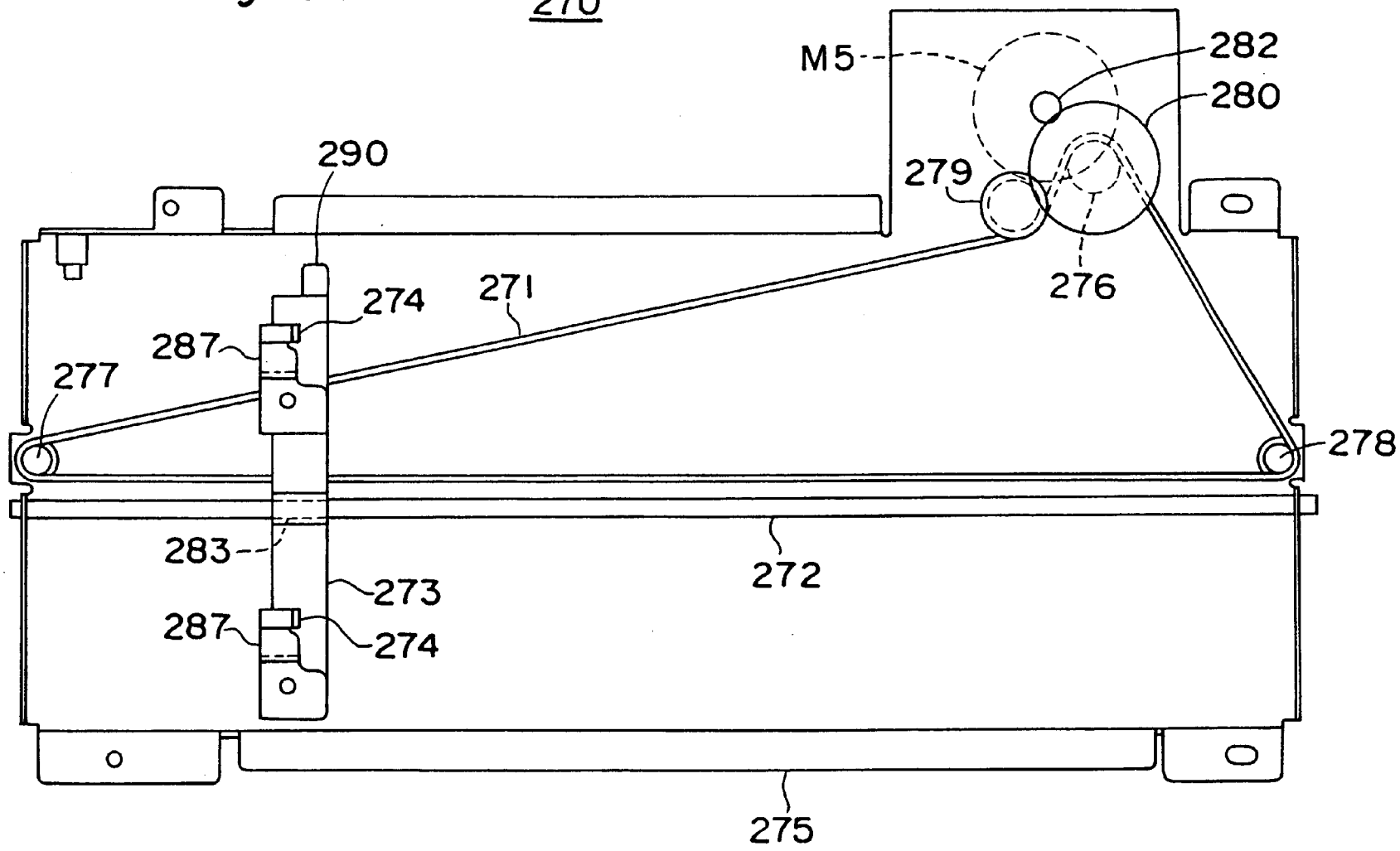
FIG. 34 is a plan view of the document refeeding mover.

The document refeed moving section 270 is intended for, when the document recirculation mode has been set, moving discharged document sheets to the feed port 61 to refeed them, or moving the discharged document sheets to the center of the document tray 60 to make it easy to take out the document sheets. This document refeed moving section 270, as shown in FIGS. 33 and 34, comprises a moving belt 271, a guide rail 272, a slider 273 and refeed levers 274, all of these members being provided inside the document tray 60.

The moving belt 271 is stretched on the three pulleys 276, 277, 278 arranged into a triangle on a base plate 275, and adjusted in tensile force by a presser pulley 279. Longer sides of the moving belt 271 are parallel to the document feed direction. This moving belt 271 is reciprocatingly movable by the gear 282 of the document moving motor M5 being screwed to a gear 280 provided to one pulley 276.

The guide rail 272 comprises a straight rod having a circular cross section, and is supported at both ends by a base plate 275 so as to be parallel in adjacency to the longer sides of the moving belt 271.

Figure 35:
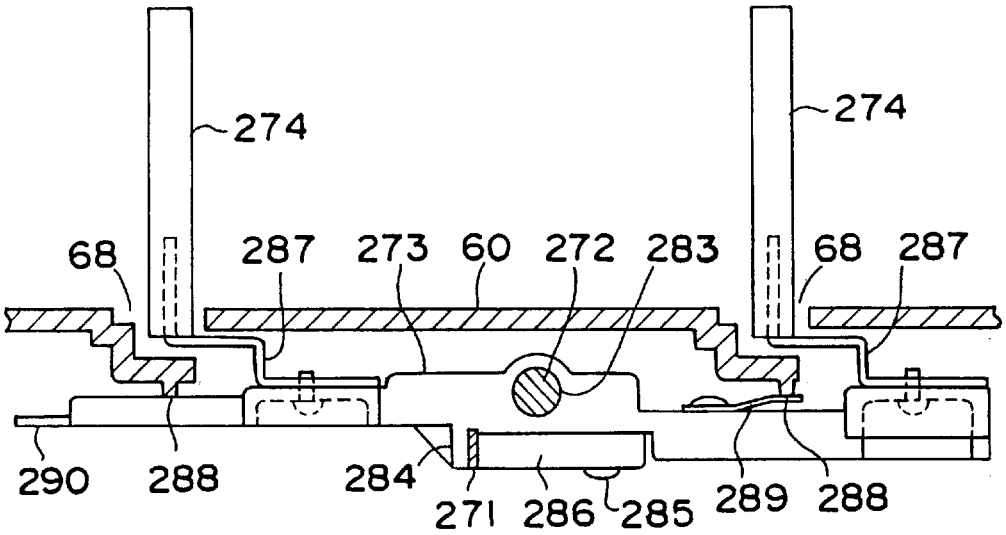
FIG. 35 is a plan view of the document refeeding mover.

The slider 273 is shaped into an elongate plate and, as shown in FIG. 35, has the guide rail 272 inserted into a through hole 283 bored in the center of the slider 273. Also, the moving belt 271 is pinched between a protrusion 284 protrusively provided to the rear surface of the slider 273 and an end surface of a spacer plate 286 attached by a screw 285. This allows the slider 273 to be reciprocatingly slidable on the guide rail 272 along with the movement of the moving belt 271. On upper surfaces of both wings of the slider 273, are attached generally L-shaped metal fittings 287, as described later, for attaching the refeed levers 274. One wing of the slider 273 makes contacts with a protrusion 288 formed on the lower surface of the document tray 60, while a plate spring 289 making press contact with another protrusion 288 is attached to the top surface of the other wing. With this arrangement, the slider 273 is prevented from rattling while a height with respect to the document tray 60 in the direction of gravity is formed. At an end of the slider 273, a detector plate 290 for detecting the home position of the slider 273 with a sensor is protrusively provided.

Figure 36A:
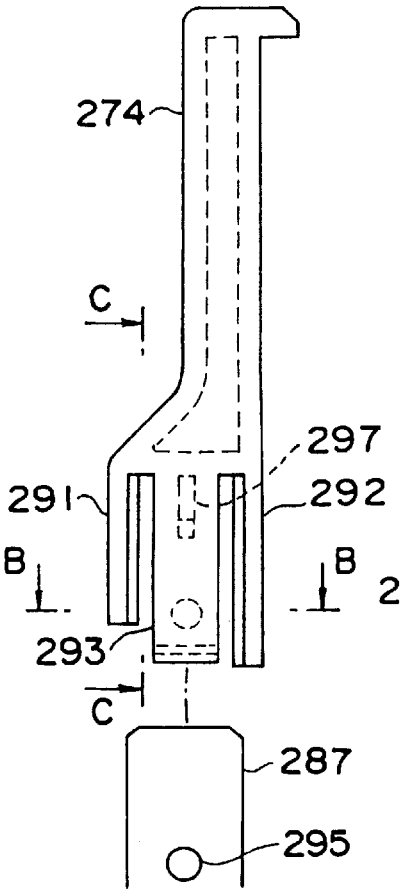
FIGS. 36A, 36B and 36C are a front view of the refeed lever, a sectional view taken along the line B—B of FIG. 36A and a sectional view taken along the line C—C of FIG. 36A.
Figure 36B:
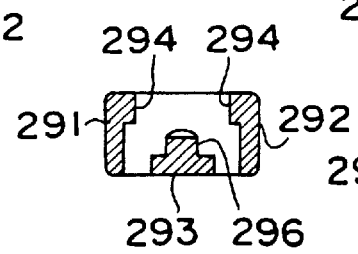
Figure 36C:
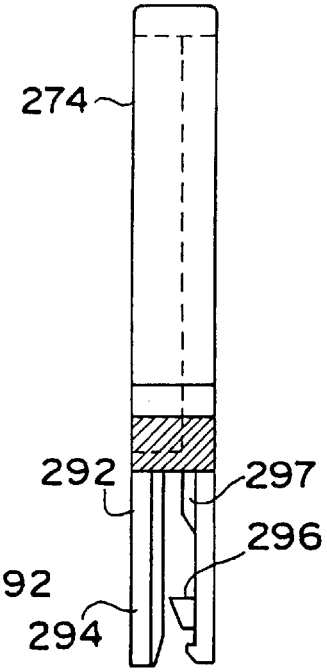

The refeed levers 274 are removably fitted to the front ends of the metal fittings 287 at both wings of the slider 273 in a fitting structure as described below, so as to be protruded above the two grooves 68 formed on the document tray 60. That is, as shown in FIG. 36, first and second projecting pieces 291, 292 opposed to each other in the document feed direction, as well as a third projecting piece 293 located between these projecting pieces 291, 292 are protrusively provided at the lower ends of the refeed levers 274. On the opposed surfaces of the first and second projecting pieces 291, 292, linear projections 294 are formed in the vertical direction. Then, the first and second projecting pieces 291, 292 having these linear projections 294 and the third projecting piece 293 form a space into which the end of the metal fitting 287 is inserted. A columnar protrusion 296 to be engaged with an engaging hole 295 formed in the metal fitting 287 is protrusively provided in the inner surface of the front end of the third projecting piece 293, and a reinforcing rib 297 is formed in the inner surface of the base. The front end of the protrusion 296 is tapered in the direction of insertion of the metal fittings 287.

In this fitting structure, when the lower end of the refeed lever 274 is inserted into the metal fitting 287, the tapered face of the protrusion 296 first makes contact with the front end of the metal fitting 287, causing the third projecting piece 293 to be opened outward. As the refeed lever 274 is further pushed in, the protrusion 296 of the third projecting piece 293 is engaged with the engaging hole 295 of the metal fitting 287 so as to be prevented from falling off. Next, for removal of the refeed lever 274, the third projecting piece 293 is flexed outward so that the protrusion 296 is uncoupled from the engaging hole 295, and then the refeed lever 274 may be pulled up.

Figure 37A:
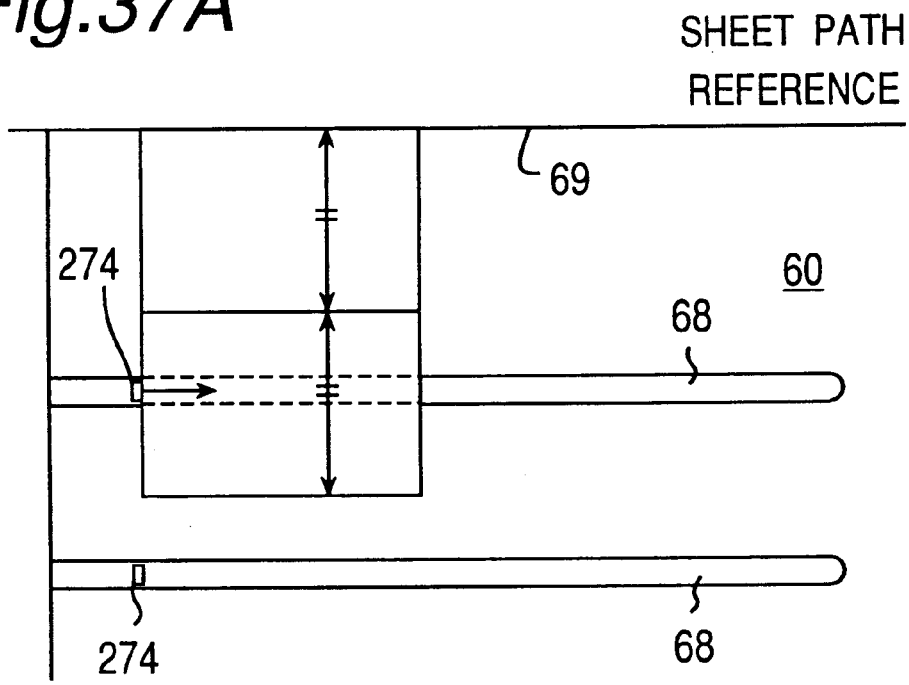
FIG. 37 is a view for explaining a position where the refeed lever is pressed.
Figure 37B:
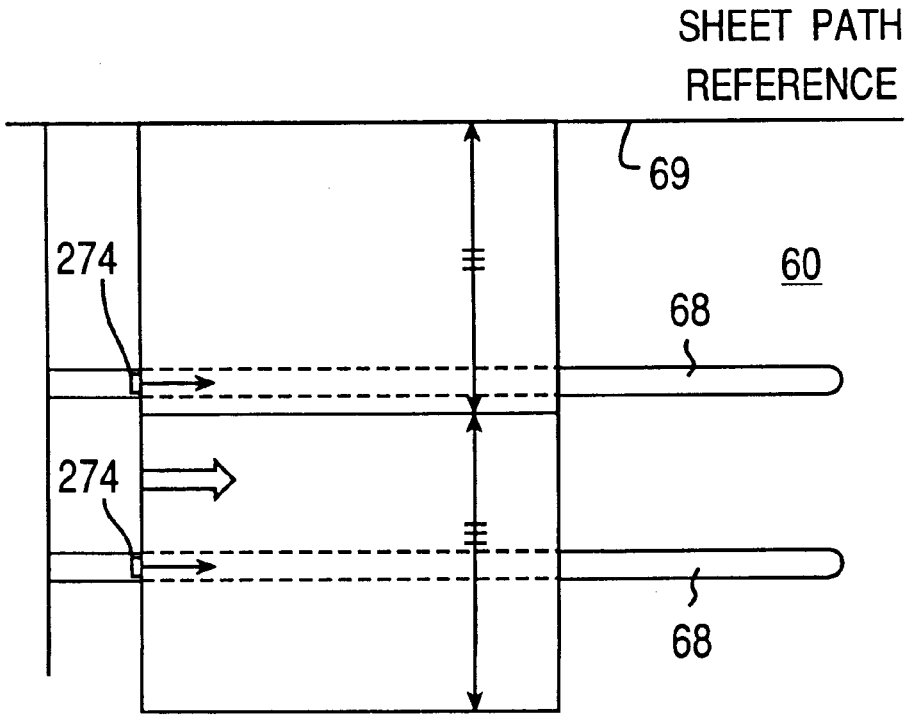

When the refeed levers 274 are to press the rear end of a minimum-size document, only the refeed lever 274 on the sheet path side presses as shown in FIG. 37A, the press being effected at a position falling outside ½ of the widthwise length of the document from the fixed document-restricting plate 69. Also, when the refeed levers 274 are to press the rear end of a maximum-size document, the two refeed levers 274 press the document as shown in FIG. 37B, the press being effected at a position intermediate of the two refeed levers 274, falling outside ½ of the widthwise length of the document from the fixed document-restricting plate 69. For this reason, in either case, the document moves while keeping in contact with the document restricting plate 69 on the sheet path side, thus never being separated from the sheet path standard.

In addition, for cases in which the press is effected by the two refeed levers 274, the outer refeed lever 274 may be preliminarily protruded on the downstream side of the inner refeed lever 274 in the document feed direction, in order that the outer refeed lever 274 primarily presses the document.

Preferably, the grooves 68 of the document tray 60 are provided at such places that the widthwise end of the document will not stretch over the grooves, in order to prevent the document from any obstruction in move or the occurrence of document jam.

In the document refeed moving section 270 of the above-described constitution, with the document recirculation mode set, when all the document sheets have been discharged, the document moving motor MS rotates forward, causing the moving belt 271 to move. Accordingly, the slider 273 slides to a specified move amount corresponding to the document size on the guide rail 272 from the home position toward the downstream side of the document feed direction. As a result of this, the refeed levers 274 press the rear end of the discharged document sheet, thereby moving the discharged document sheet to the feed port 61. Then, when the front end of the document sheet makes contact with the end restricting plate 81 of the document feed section 80, causing the empty sensor SE1 to turn on, document sheets are refed. Meanwhile, the refeed levers 274 return to the home position.

In the normal document copying mode in which the document recirculation mode has not been selected, the discharged document sheets are moved by the refeed levers 274 to easy-to-take out places in the center of the document tray 60.

In addition, the document refeed moving section 270 is capable of the following control operations.

By providing an on-discharge-tray sensor SE4 (see FIG. 4) for detecting document sheets discharged onto the document tray 60, the refeed levers 274 are so arranged to be moved only on conditions that the on-discharge-tray sensor SE4 has been turned on and that the empty sensor SE1 has been turned off. With this arrangement, if discharged document sheets are erroneously taken out by the user upon completion of document discharge despite the selection of the document recirculation mode, the on-discharge-tray sensor SE4 turns off so that the refeed levers 274 will not operate, thus avoiding wasteful operations.

Also, if the empty sensor SE1 is turned on during the move or return to the home position of the document sheets by the refeed levers 274, the refeed levers 274 are stopped from returning operation. With this arrangement, even if the user has erroneously placed the next document sheets or any obstacle on the document tray 60, the empty sensor SE1 detcts this, causing the refeed levers 274 to be stopped from returning. Thus, the refeed levers 274, the document sheets and the obstacle are prevented from being damaged.

If the empty sensor SE1 does not turn on even by moving the refeed levers 274 to the predetermined amount depending on the document size, then the refeed levers 274 are moved further to a specified amount. With this arrangement, even if the apparatus has misdetected the document size as one size smaller, the document sheets can be moved to the feed port 61 reliably, thus allowing the document sheets to be refed.

If the empty sensor SE1 does not turn on by moving the refeed levers 274 to the predetermined amount depending on the document size, and if the sheet-feed empty sensor does not turn on by moving the refeed levers 274 further to the specified amount, then the refeed levers 274 are stopped from moving. With this arrangement, even if document sheets are taken out by the user during the move of the refeed levers 274, the refeed levers 274 are stopped from moving, thus avoiding wasteful operations.

When the discharge sensor is off before the move of the refeed levers 274, the refeed levers 274 are prevented from moving. With this arrangement, if the user erroneously takes out the document sheets upon completion of the document discharge despite the selection of the recirculation mode, the discharge sensor turns off so that the refeed levers 274 will not operate, thus avoiding wasteful operations.

By providing a different-size detecting means for detecting any inclusion of document sheets of different sizes in a comparison of the size of the first document sheet detected by the document size detecting means with the document sizes of subsequent document sheets, the refeed levers 274 are prevented from operating if any inclusion of different sizes of document sheets is detected by the different-size detecting means, in the case where any one of the count mode, the automatic recirculation copying mode and the automatic jam correction mode has been selected. With this arrangement, occurrence of misfeeds of sheets can be prevented.

It is preferable to provide alarm means for issuing an alarm when the refeed levers 274 are disabled to operate. With this arrangement, the user can be urged to set the document manually to the feed port 61. In this case, the operation is preferably started when the start key is pressed with all the document sheets set on the document tray after the alarm means has issued the alarm. With this arrangement, the user can be forced to press the start key so that the copying process can be resumed without fail.

With the automatic jam correction mode selected, the sweep-out and idly feed processes are carried out by conveying the document sheets at the highest possible speed. The document feeding speed herein referred to is preferably the drivable highest speed possible in terms of hardware configuration of the document conveying apparatus. With this arrangement, the sweep-out and idle feed processes without copying process can be carried out in short time, so that the wait time can be reduced.

<Document Conveying Modes of the ADF>

The document conveying modes of the ADF 2 are now explained.

In the present embodiment, the document conveying modes include four modes of the prestep mode, the two-in-one mode, and the count mode in addition to the double-side mode, which is a conventional practice, and further includes the scale mode suited for ordinary paper and the pulse control mode suited for thin paper, for the purpose of stopping the document conveyed by the ADF 2 correctly at the exposure standard position SP. Further, the document recirculation mode can be set in the document conveying mode. The automatic jam correction mode for occurrence of paper jam or document jam can also be set. Referring to the feed of the document, a position where the document is set with its front end registered at the exposure standard position SP is referred to as an exposure position, a position where the document is set with its front end registered at an intermediate position IP is referred to as a prestep position, and a position where the document is set with its front end registered at the nip position of the register roller 8 is referred to as a first-out position. In addition, the size of the document is here assumed so that the small size is A4 transverse, and the large size is A3 longitudinal, unless otherwise specified.

The aforementioned document conveying modes are known modes described in detail in U.S. Pat. No. 5,559,594. Therefore, an outline of the operations of those modes is described here and the detail of U.S. Pat. No. 5,559,594 will be incorporated herein by referencing it.

The scale mode is a mode in which the document that has been conveyed up by the conveyor belt 123 is forcedly stopped with its front end brought into contact with the scale 125. In this mode, the conveying force of the conveyor belt 123 is set weaker than the buckling strength of the document, so that a slip occurs between the document and the conveyor belt 123 when the front end of the document makes contact with the scale 125, thus allowing the document to be stopped accurately at the standard position SP.

The pulse control mode is a mode in which, with the scale 125 withdrawn downward from the top surface of the document glass 29, the register rollers 89 and the conveyor belt 123 are driven by the single main motor (stepping motor) M3 so as to become equal to each other in the conveying speed, so that the main motor M3 is controlled by a number of pulses corresponding to the length L over which the document on standby immediately before the register rollers 89 is conveyed up to the standard position SP, by which the document is stopped without contact with the scale 125.

The double-side mode is a mode in which a double-sided document is copied to form an image on both sides of one sheet of copying paper or on one side of two sheets of copying paper. The first double-sided document sheet is conveyed onto the document glass 29, conveyed to the document discharge section 140 without being exposed to light, and reversed by the reverse roller 141, where the rear surface of the document is first exposed to light, thereby copied. Subsequently, the document sheet is reversed again and its front surface is exposed to light, thereby copied, and then the first double-sided document sheet is discharged.

The prestep mode is a mode in which when the document size is not greater than one half the length from the exposure standard position SP to the document first-out position, a preceding document sheet is stopped with its front end registered with the exposure standard position SP, a succeeding document (second document sheet) is conveyed to a position where its front end is registered with the intermediate position IP, and a succeeding (third-sheet) document sheet is first-out fed until its front end comes into contact with the register roller 89.

The two-in-one mode is a mode in which two document sheets are arrayed as one set on the document glass 29 and the document image is formed on one sheet of copying paper. The first document sheet is first conveyed onto the document glass 29, and then the second document sheet is conveyed and stopped when its front end comes into contact with the register rollers 89. Thereafter, the two document sheets are conveyed concurrently with the rear end of the first document sheet and the front end of the second document sheet registered with each other up to the exposure standard. Then, when the first and second document sheets are discharged from the document glass 29 upon completion of exposure, the third document sheet is conveyed onto the document glass 29.

The count mode is a mode in which in order to check whether the number of document sheets is an odd number or an even number in the two-in-one mode, the double-side copy and the combined copy, the number of document sheets is counted by making the document sheets circulated over one cycle without being accompanied by the copying operation before the copying operation is started with the use of the ADF 2. In the count mode, which is not accompanied by copying operation, it is preferable to carry out the processing at the highest possible speed (in the shortest possible time). Even in the count mode, when the document sheet is stopped at the exposure standard position SP, the distance between one document sheet and another would be increased, resulting in an increased idle feed time. Thus, in the count mode, the document sheet is once stopped with reference to the time point when the rear end of the document sheet reaches a specified stoppage reference position (near the register rollers 89) on the document glass 29.

The document recirculation mode is a mode in which after all the document sheets have been discharged over one recirculation of copying of the document, the moving process of moving the document sheets on the document tray 60 to the feed port 61 by the document refeed moving section 270 is executed and the document copying is performed once again. The automatic jam correction mode is a mode in which upon occurrence of paper jam or document jam, copying process after the occurrence of jam is automatically started by executing the document sweep-out mode, the idle feed mode and the aforementioned discharged-sheet moving process.

The sweep-out mode is a mode in which upon occurrence of paper jam, not only the document sheets under feed within the ADF 2 but also the document sheets remaining in the feed port are all discharged without being subjected to copying process. The idle feed mode is a mode in which after the document sheets are returned to the feed port by executing the sweep-out mode and the moving process upon occurrence of paper jam, or after the document sheets are returned to the feed port by the operator upon occurrence of document jam, the document sheets that have been already finished being copied are conveyed and discharged without being copied. After the completion of the idle feed mode, the copying process is resumed automatically.

<Control Circuit of Copying Machine>

Figure 38:
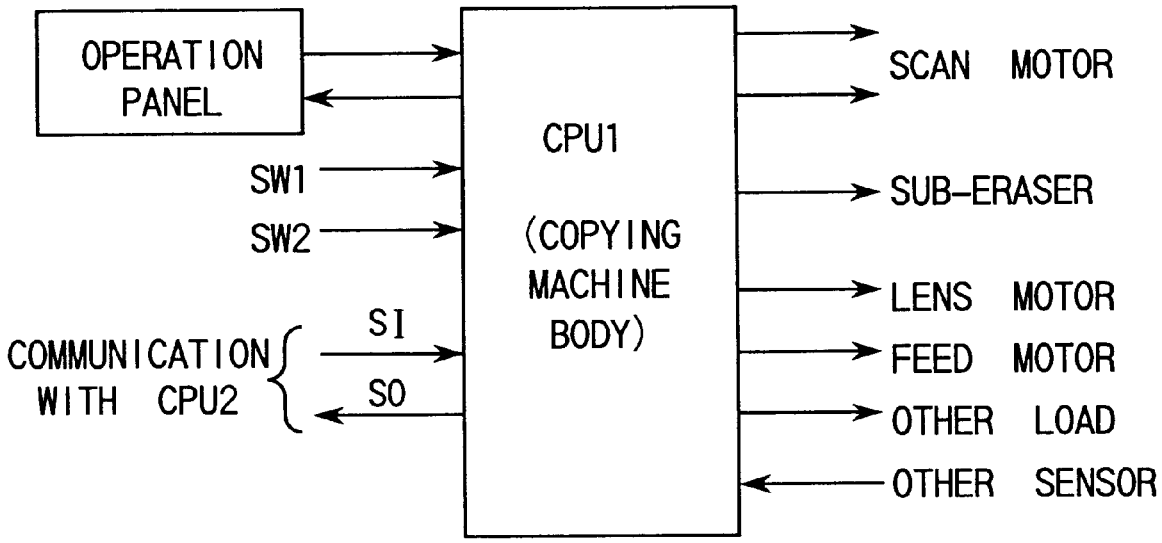
FIG. 38 is a block diagram showing the control unit of the copying machine main body.
Figure 39:
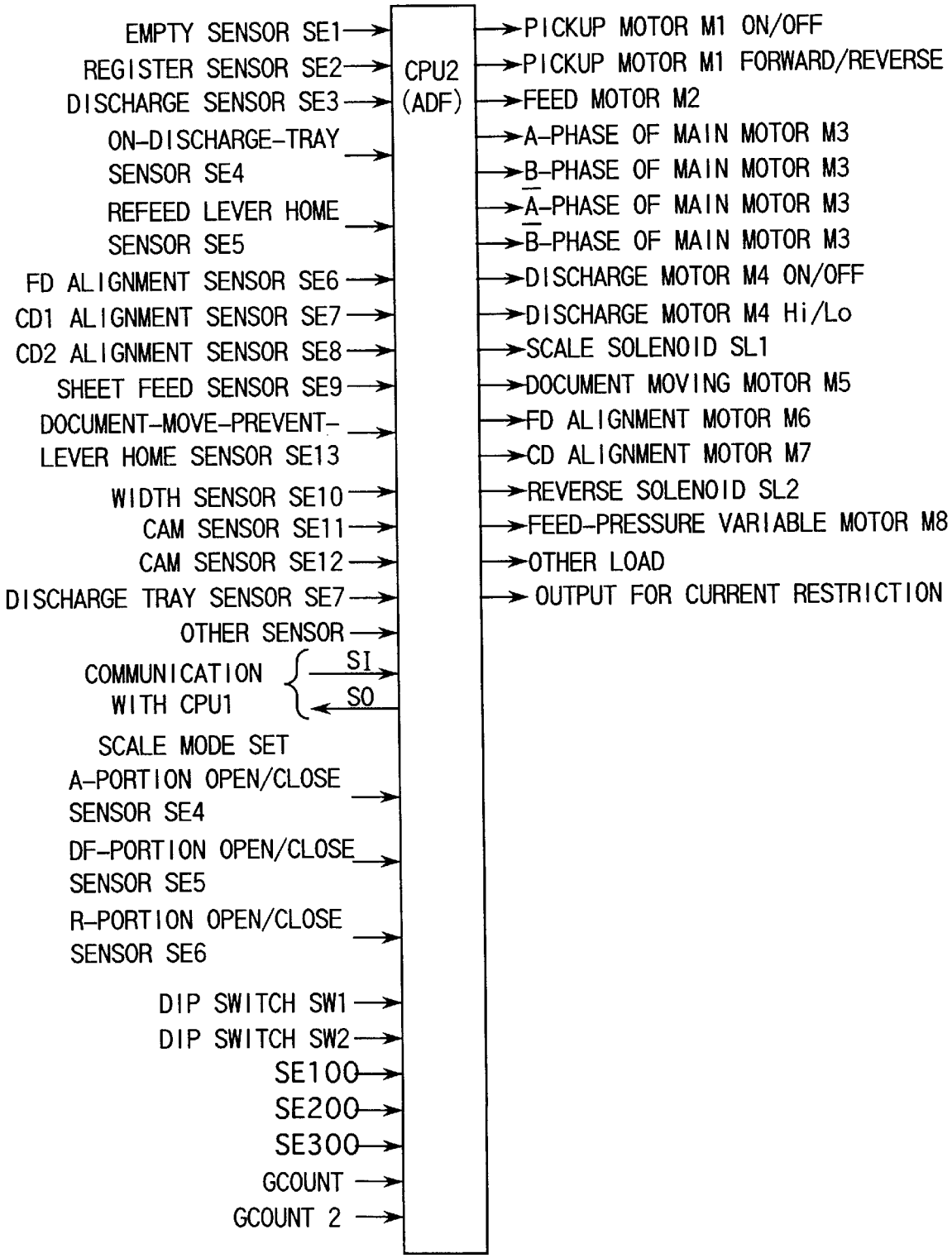
FIG. 39 is a block diagram showing the control unit of the ADF.

The copying machine in this embodiment comprises a CPU1 for controlling the copying machine 1 shown in FIG. 38 and a CPU2 for controlling the ADF 2 shown in FIG. 39. The CPU1 and CPU2 exchange information with each other at necessary timing.

In comparison of the motor and the sensor used in FIG. 39 and the following description with the embodiment of the above-described document conveying apparatus 2, a pickup motor M1 is a motor that pivots the end restricting plate 81 and the document pressing plates 84, a sheet feed motor M2 is a motor that drives the pickup rollers 83, the separating rollers 85 and the intermediate conveyor rollers 87, the main motor M3 is a motor that drives the register rollers 89 and the conveyor belt 123, and the discharge motor M4 is a motor that drives the discharge rollers 145. A document moving motor M5 is a drive motor that drives the refeed levers 274 of the document refeed moving section 270. An FD alignment motor M6 is a drive motor that moves the second slider 193 out of the drive mechanism for the discharged-document stopper 174 in the document feed direction (FD). A CD alignment motor M7 is a drive motor that moves the first slider 191 out of the drive mechanism for the discharged-document stopper 174 of the document restricting section 170 in a cross direction (CD) perpendicular to the document feed direction. A feed-pressure variable motor M8 is a drive motor for the sheet-feed-pressure variable mechanism 103 of the document feed section 80.

An empty sensor SE1 is an empty sensor that detects the document set at the feed port 61. A register sensor SE2 is a sensor that is installed immediately before the register rollers 89 to detect the arrival and passage of the document. A discharge sensor SE3 is a sensor that is installed at the inlet of the reverse roller 141 to detect the document passing the same. A width sensor SE10 is a sensor that is installed besides the register sensor SE2 to detect the widthwise size of the document. Cam sensors SE11, SE12 are sensors that detect the pivoting of the end restricting plate 81, the document pressing plates 84, respectively.

Also, the on-document-tray sensor SE4 is a sensor that detects the document placed on the discharge side of the document tray 60. A refeed-lever home sensor SE5 is a sensor that detects the home position of the refeed levers 274.

An FD alignment sensor SE6 is a sensor that detects the home position of the second slider 193.

A CD 1 alignment sensor SE7 is a sensor that moves the first slider 191 to detect the restricting position of the discharged-document stopper 174.

A CD 2 alignment sensor SE8 is a sensor that moves the first slider 191 to detect the withdrawal position of the discharged-document stopper 174.

A sheet feed sensor SE9 is a sensor that is installed immediately after the separating rollers 85 to detect both the arrival and passage of the document and the FD length of the document as well as the document size.

A document-move preventing lever home sensor SE13 is a sensor that detects the home position of the document-pressing lever 246 of the document move preventing section 240. The width sensor SE10 is installed beside the register sensor SE2 to detect the widthwise size of the document. The cam sensors SE11, SE12 are sensors that detect the pivoting of the end restricting plate 81, the document pressing plates 84, respectively.

Figure 40:
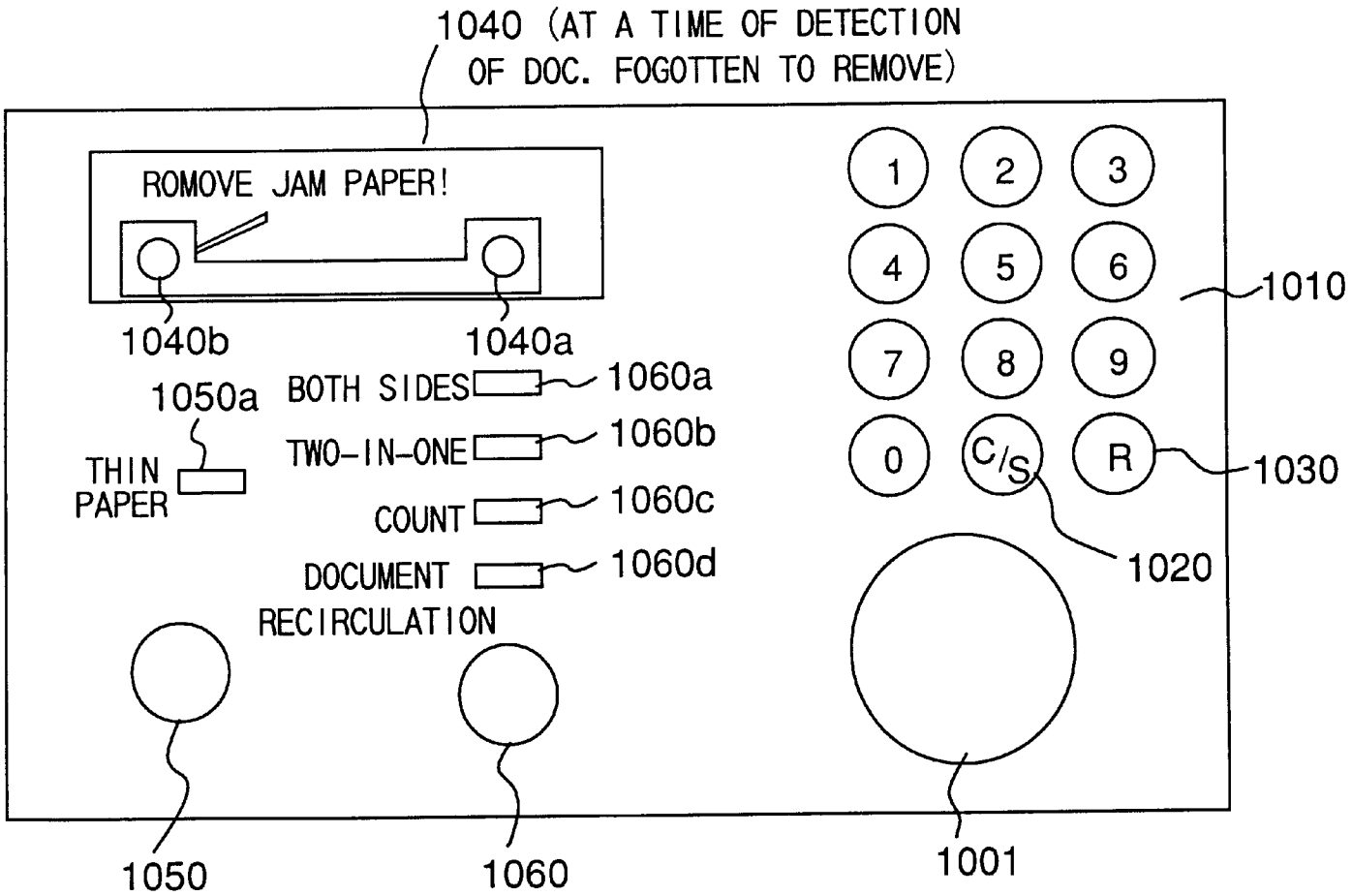
FIG. 40 is a plan view showing the key arrangement and the like of the copying-machine operating section.

FIG. 40 shows the copying machine operating section. In this operating section, reference numeral 1001 denotes a copy start key, 1010 denotes a ten-key pad, 1020 denotes a clear/stop key, 1030 denotes a reset key and 1040 denotes an indicator. Reference numeral 1050 denotes a document select key, 1050*a* denotes a The thin-paper mode indicator LED, and the thin-paper mode indicator LED 1050*a* lights up when the thin-paper mode is selected by the document select key 1050. Numeral 1060 denotes a mode select key, 1060*a* denotes a double-side mode indicator LED, 1060*b* denotes a two-in-one mode indicator LED, 1060*c* denotes a count-mode indicator LED, 1060*d* denotes a document-recirculation-mode indicator LED, and a mode selected by the mode select key 1060 is displayed by the indicator LEDs 1060*a*, 1060*b*, 1060*c* and 1060*d*.

<Control of Copying Machine>

First, the control of the copying machine is described in details with reference to flow charts. It is to be noted that in the following description, the ON EDGE means that the switch, sensor, signal, or the like is switched from off to on state, and the OFF EDGE means that the switch, sensor, signal, or the like is switched from on to off state. It is also assumed that the sensors SE1, SE2, SE3, SE10, SE11, and SE12 will be composed of photo coupler comprising a light-emitting element and a light-receiving element. These sensors will be turned on when the optical path from the light-emitting element to the light-receiving element is shielded, and turned off when it is opened. For flags, it is assumed that a "1" represents an ON state, and a "0" represents an OFF state. When the recirculation mode is selected by the operator, the recirculation mode is set to "1".

<Main Routine>

Figure 41:
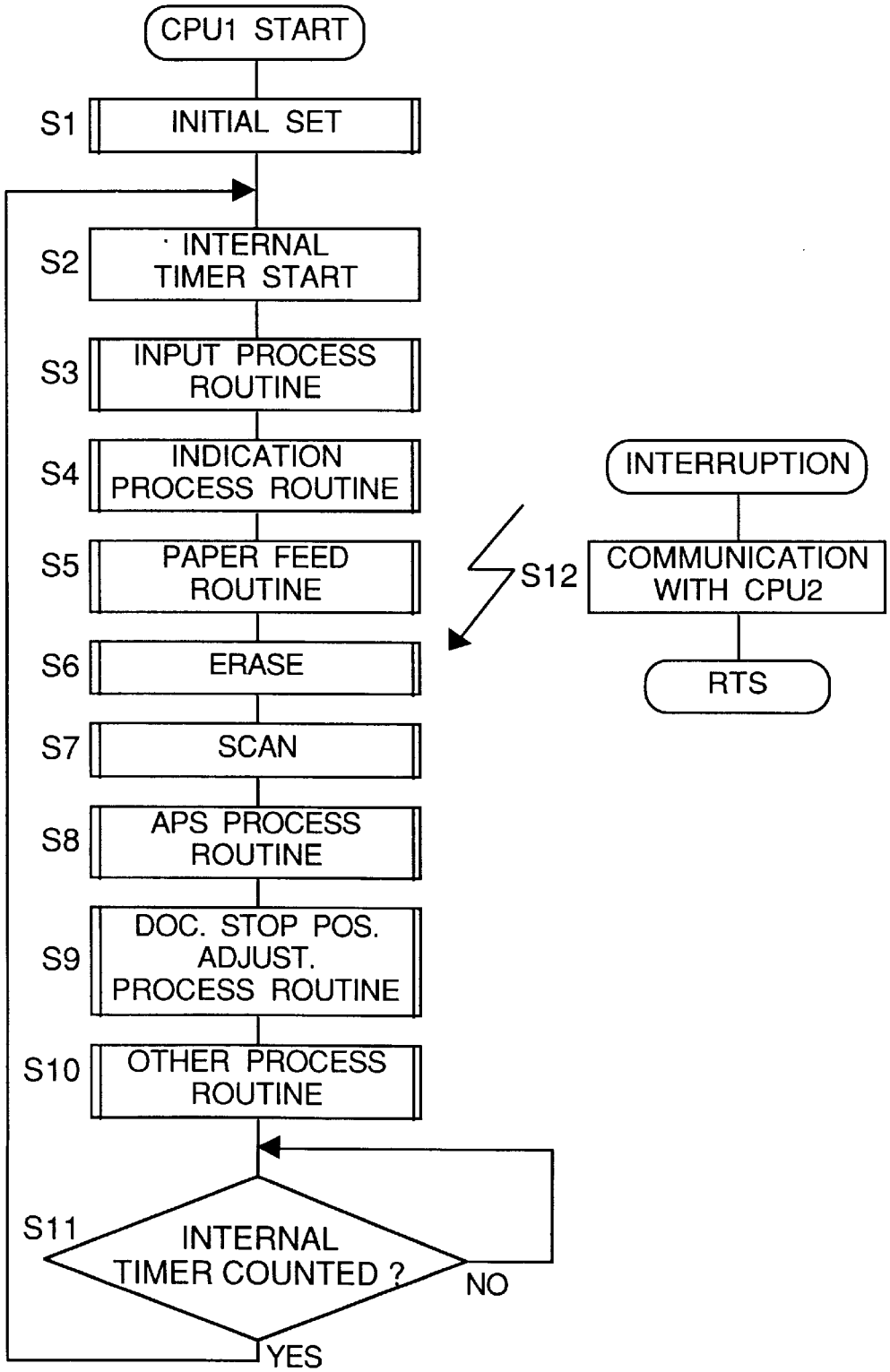
FIG. 41 is a flowchart showing the main routine of the CPU 1 for controlling the copying machine.

FIG. 41 shows a main routine of the CPU1 that controls the copying machine 1. With power on, the CPU1 is reset and the program starts. At S1, initial setting is performed, where the RAM is cleared, various registers are reset, and various types of equipment are set to their initial modes. Subsequently at S2, an internal timer is started. The internal timer functions to determine the required time of one cycle routine of this main routine and its value is set at S1. Also, the internal timer serves as a reference for the count of other various timers involved in subroutines.

Next, the subroutines of S3 through S10 are sequentially called and necessary processes are executed. Then, at S11, the program returns to S2 upon completion of the count of the internal timer. S3 is an input subroutine for processing information inputted from a control panel or the like; S4 is an indication subroutine for processing the indication of various indicators arranged on the control panel; S5 is a subroutine for feeding copying paper up to the timing roller 38; S6 is a subroutine for erasing surface charges of the photosensitive drum 10; S7 is a subroutine for forming an electrostatic latent image on the photosensitive drum 10 with scanning operation by the optical system 20; S8 is an APS (Automatic Paper Selection) subroutine for automatically selecting a proper size of sheets from the document size and the copying magnification; S9 is a stop position adjustment subroutine for adjusting the document stop position on the document glass 29; S10 is a subroutine for executing other processes including the driving of the photosensitive drum 10 and other peripheral elements, the conveying of copying paper, the fixing, the detection of paper jams, and the like, as well as a process for adjusting the document stop position on the document glass 29 when the stop position adjustment mode is entered. In addition, the CPU1 is connected to the CPU2 via a serial communication line and the transmission and reception between them is executed at S12 by interrupt processing.

<Input Process>

Figure 42:
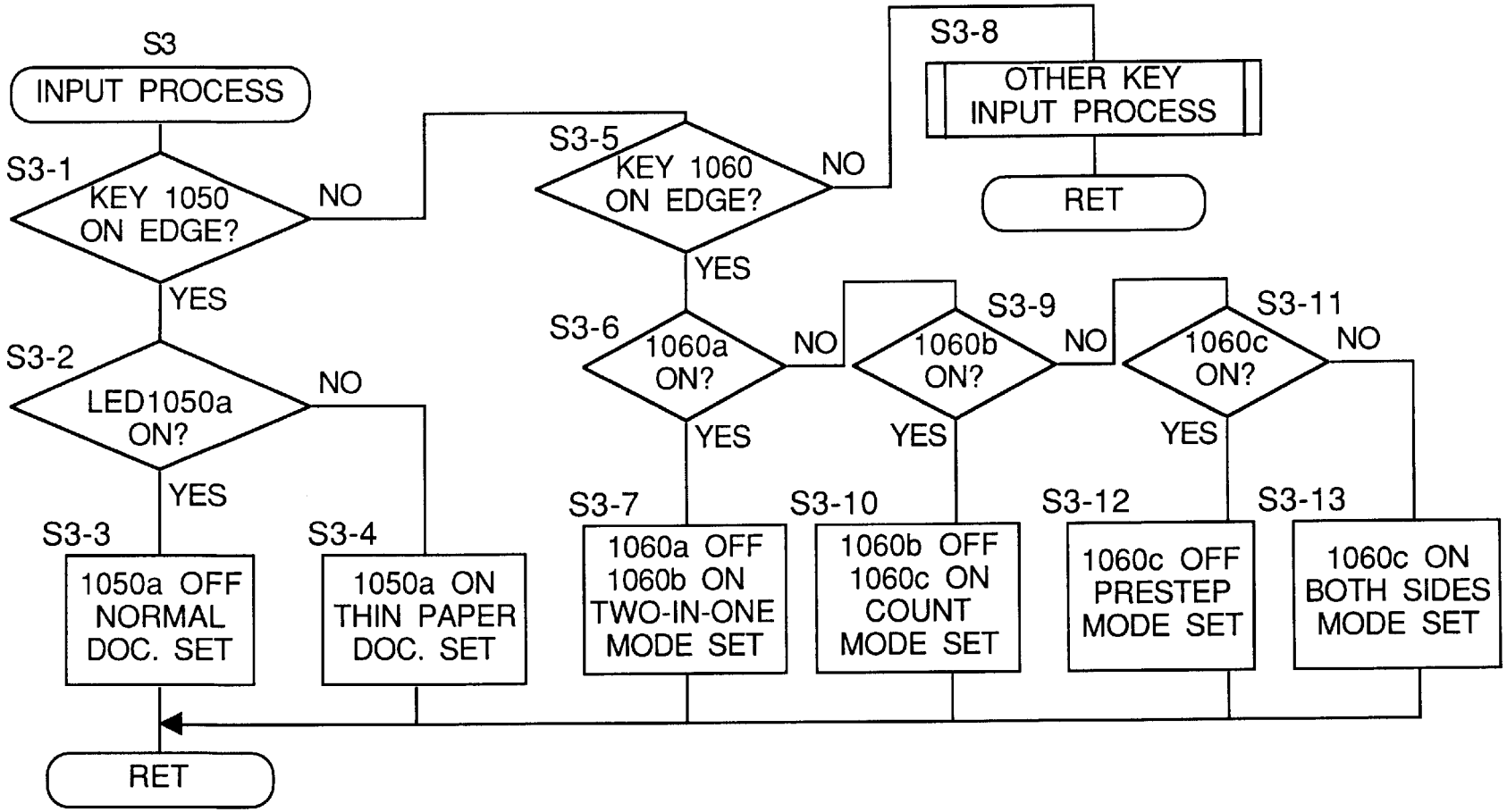
FIG. 42 is a flow chart showing a subroutine for input process in the CPU 1.

FIG. 42 shows the control of the CPU1 for the input process S3. In this input process S3, input from the copying machine operating section shown in FIG. 40 is processed. In this input process S3, when an ON EDGE of the document select key 1050 is detected at S3-1, it is decided whether or not the thin-paper mode indicator LED 1050*a* is on. If the thin-paper mode indicator LED 1050*a* is on, the LED 1050*a* is turned off at S3-3 so that a normal copying state for an ordinary document is set; if off, the LED 1050*a* is turned on at S3-4 so that a copying state for a thin-paper document is set.

If the ON EDGE of the document select key 1050 is not detected at S3-1, an ON EDGE of the mode select key 1060 is detected at S3-5. If an ON EDGE is not detected here, an other key input process is executed at S3-8. Meanwhile, if an ON EDGE is detected at S3-5, it is decided at S3-6, S3-9, S3-11 whether or not the LEDs 1060*a*, LED 1060*b*, LED 1060*c* are on, respectively. If the LED 1060*a* is on, the LED 1060*a* is turned off and the LED 1060*b* is turned on at S3-7 so that the two-in-one mode is set; if the LED 1060*b* is on, the LED 1060*b* is turned off and the LED 1060*c* is turned on at S3-10 so that the count mode is set; and if the LED 1060*c* is on, the LED 1060*c* is turned off at S3-12, and if the LED 1060*c* is off, the LED 1060*c* is turned on at S3-13, so that the double-side mode is set.

<Display Process>

Figure 43:
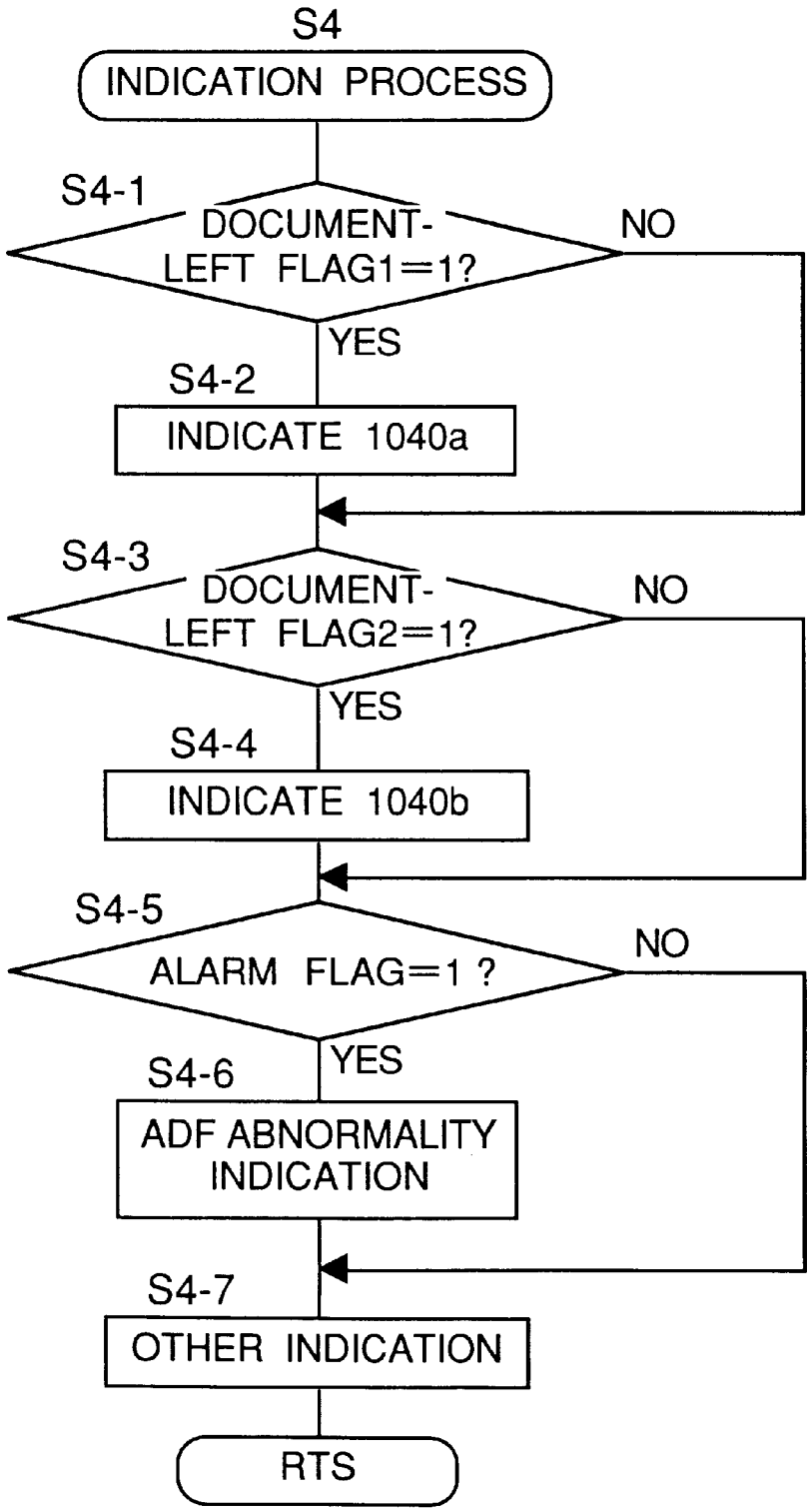
FIG. 43 is a flow chart showing a subroutine for indication process in the CPU 1.

FIG. 43 is a subroutine for controlling the display of the indicator 1040 in the copying machine operating section. At S4-1, it is decided whether or not a document-forgotten-to-remove flag 1 is set to "1". If the document-forgotten-to-remove flag 1 is set, a sheet-feed-section jam indication 1040*a* is displayed in the indicator 1040 at S4-2. Subsequently, at S4-3, it is decided whether or not the document-forgotten-to-remove flag 2 is set to "1". If the document-forgotten-to-remove flag 2 is set to "1", a sheet-feed-section jam indication 1040*b* is displayed in the indicator 1040. If the document-forgotten-to-remove flag 1 or 2 is set to "1", removal of jammed paper is alarmed in the indicator 1040 as shown in the figure. At S4-5, the condition of a alarm flag, which is set to "1" when an abnormality of the ADF is detected in ADF control of CPU2 as described hereinafter, is decided. If the alarm flag is set to "1", then, at S4-6, an indication showing abnormality of ADF is displayed in the indicator 1040. Further, at S4-7, other necessary information is processed.

<Erase>

Figure 44:
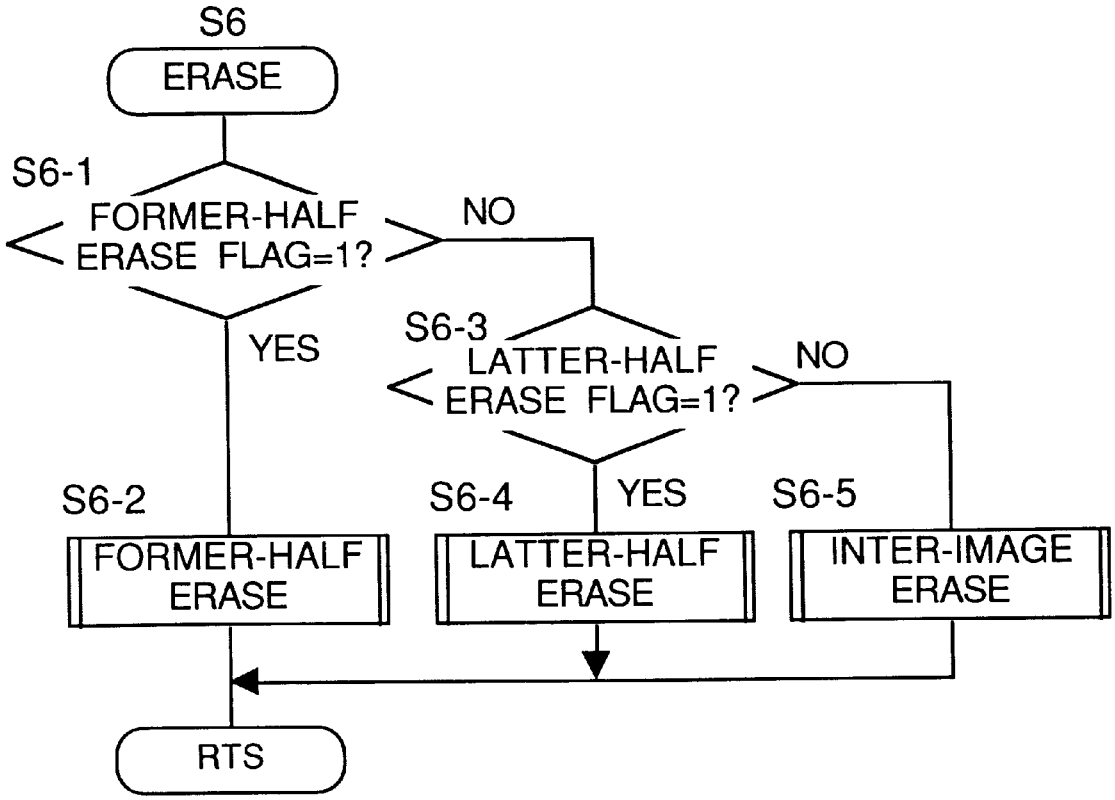
FIG. 44 is a flow chart showing a subroutine for erase in the CPU 1.

FIG. 44 shows an erase subroutine to be executed at S6. In this subroutine, it is first decided at S6-1 whether or not a first-half erase flag is "1". Then, if the first-half erase flag is "1", charges on the first-half portion of an area of the photosensitive member corresponding to the document placed on the document glass are erased by the eraser 13, at S6-2. For example, on condition that an area on the photosensitive member corresponding to the A3 size should be charged from a view point of the size or the arrangement position of the document placed on the document glass, if the first-half erase flag has been set to "1", then the first half portion in the charging area on the photosensitive member corresponding to the A3 size is illuminated so that the charges are removed. Meanwhile, if the first-half erase flag is "0", then it is decided at S6-3 whether or not the second-half erase flag is "1". If the second-half erase flag is "1", then charges on the second-half portion of an area of the photosensitive member corresponding to the document placed on the document glass 29 are removed by the eraser 13, at S6-4. However, if the second-half erase flag is also "0", then inter-image portions are erased at S6-5.

Actually, when the ADF adopted is of such a type that the document is fed by starting with its last page, the two-in-one mode is set. With an odd number of document sheets set onto the document tray 60, the aforementioned first-half erase flag is set to "1" in the copying operation for the last page document sheet, the flag being transmitted to the CPU1. As a result, the last-page document is set onto the document glass 29 with its front end coincident with the IP, and charges on an area of the photosensitive member corresponding to the area from the scale 125 to the document are removed. The second-half erase flag, with the two-in-one mode set, is set to "1" when the second-sheet document is large size out of a pair of document sheets set onto the document glass, the flag being transmitted to the CPU1. As a result, charges on an area on the photosensitive member corresponding to the second-sheet document are removed. It is noted that the second-sheet document is subsequently copied onto one sheet alone by its entire surface.

<Scan>

Figure 45:
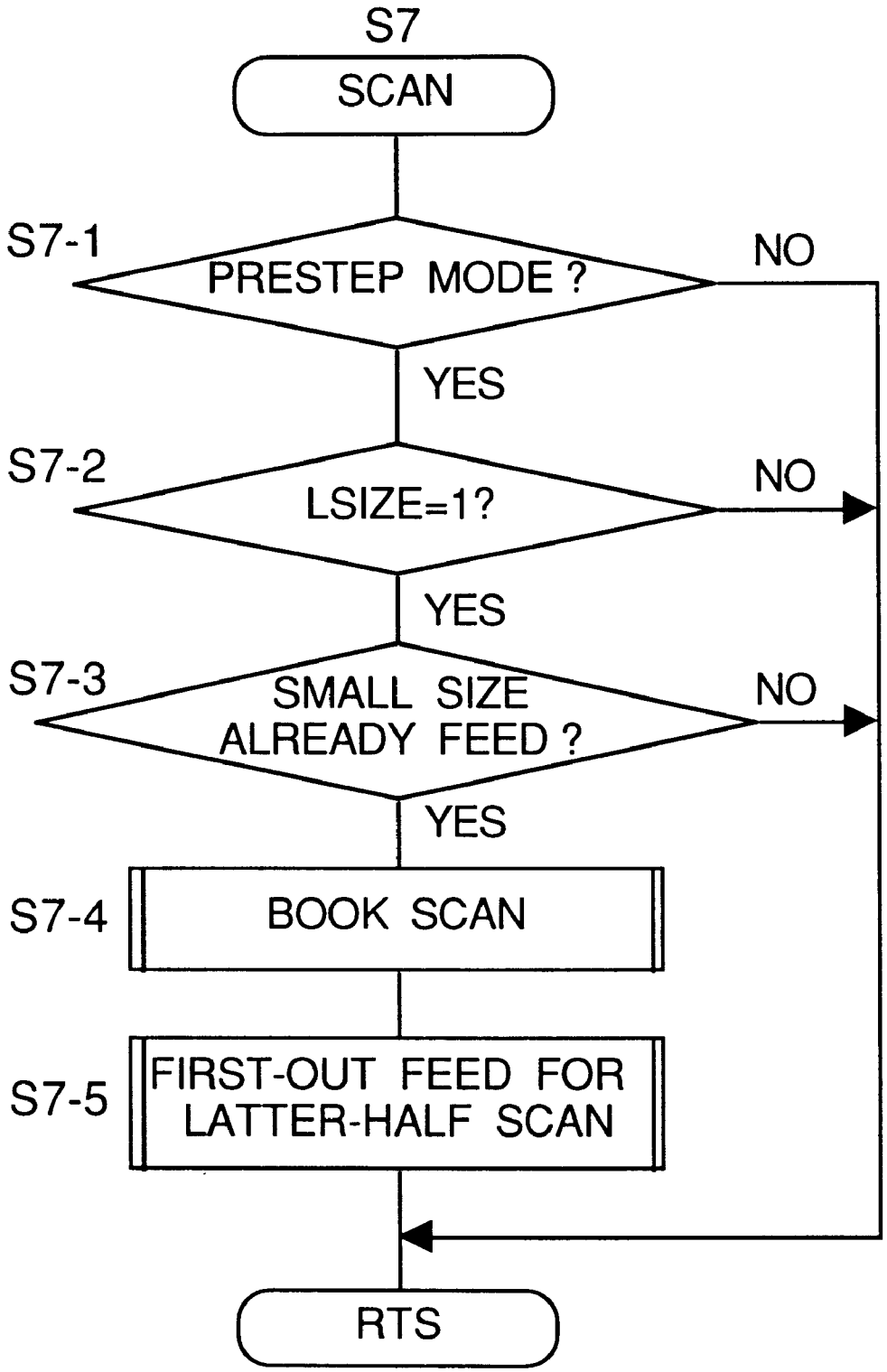
FIG. 45 is a flow chart showing a subroutine for scan in the CPU 1.

FIG. 45 shows a subroutine of scan by the optical system 20 to be executed at S7. First, it is decided at S7-1 whether or not the current mode is the prestep mode. Then, it is decided at S7-2 whether or not a flag LSIZE is "1". It is decided at S7-3 whether or not small-size paper has previously been fed. The flag LSIZE is set to "1" when a large-size document is set to the exposure position, the flag being transmitted to the CPU1. If YES has been decided at every step of S7-1, S7-2 and S7-3, a book scan is processed at S7-4. At S7-5, the paper onto which an image is to be transferred in the second-half scan of the book scan is first-out fed.

<APS Routine>

Figure 46:
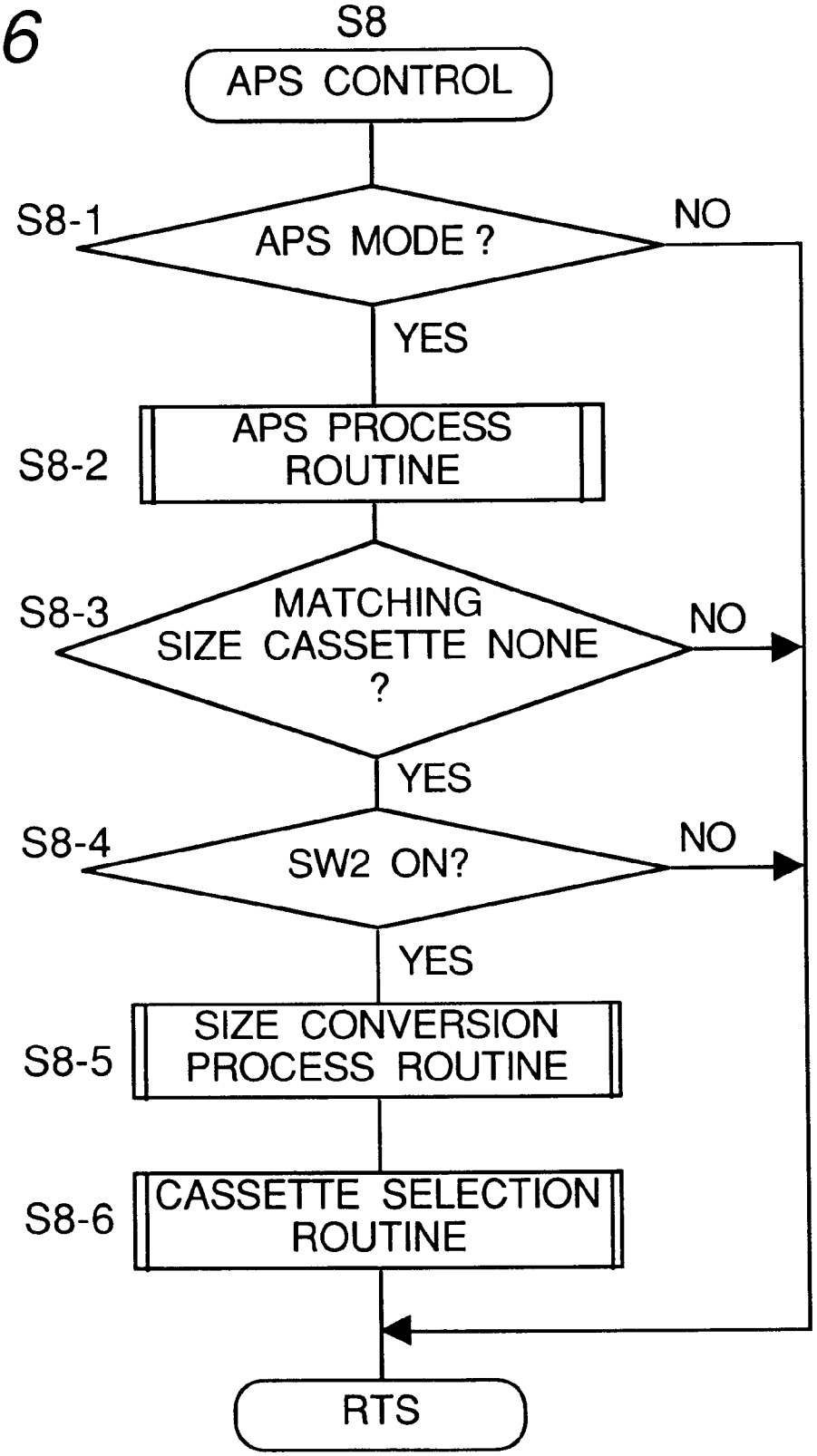
FIG. 46 is a flow chart showing a subroutine for APS control in the CPU 1.

In the APS control routine, as shown in FIG. 46, it is decided at S8-1 whether or not the APS mode has been selected. This APS mode is to be set or canceled by an APS mode select key (not shown) provided on the control panel of the copying machine main body 1. Then if the APS mode has been selected, the APS process is executed at S8-2, where a sheet of an optimum size is fed depending on the document size and the copying magnification. Now, if a sheet of matching size has been accommodated in the paper feed section, the program returns (S8-3); if a sheet of matching size has not been accommodated in the paper feed section, it is decided at S8-4 whether or not a switch SW2 has been turned on. This switch SW2 is a switch for designating whether or not an inch-base size is converted into a metric-base size (A size or B size). For example in a copying machine that takes the metric size as the reference size, when the switch SW2 is turned on, an inch-base size read in the APS mode is converted as shown in Table 3 below at S8-5, and paper is fed from the paper feed section in which the sheets of the size resulting from the conversion are accommodated, at S8-6. Conversely, when the switch SW2 is turned off, metric-base sizes on the right hand of Table 1 are converted into inch-base sizes on the right hand. In this table, L represents the longitudinal direction (longer side) and T represents the transverse direction (short side).

TABLE 3

| Size read | Size after conversion |
|---|---|
| Letter(L/T) | 6 A4 (L/T) |
| Legal | 6 B4 (L) |
| FLS | 6 B4 (L) |
| 11 H 15 (L) | 6 A3 (L) |
| 11 H 17 (L) | 6 A3 (L) |

<Document Stop Position Routine>

Figure 47:
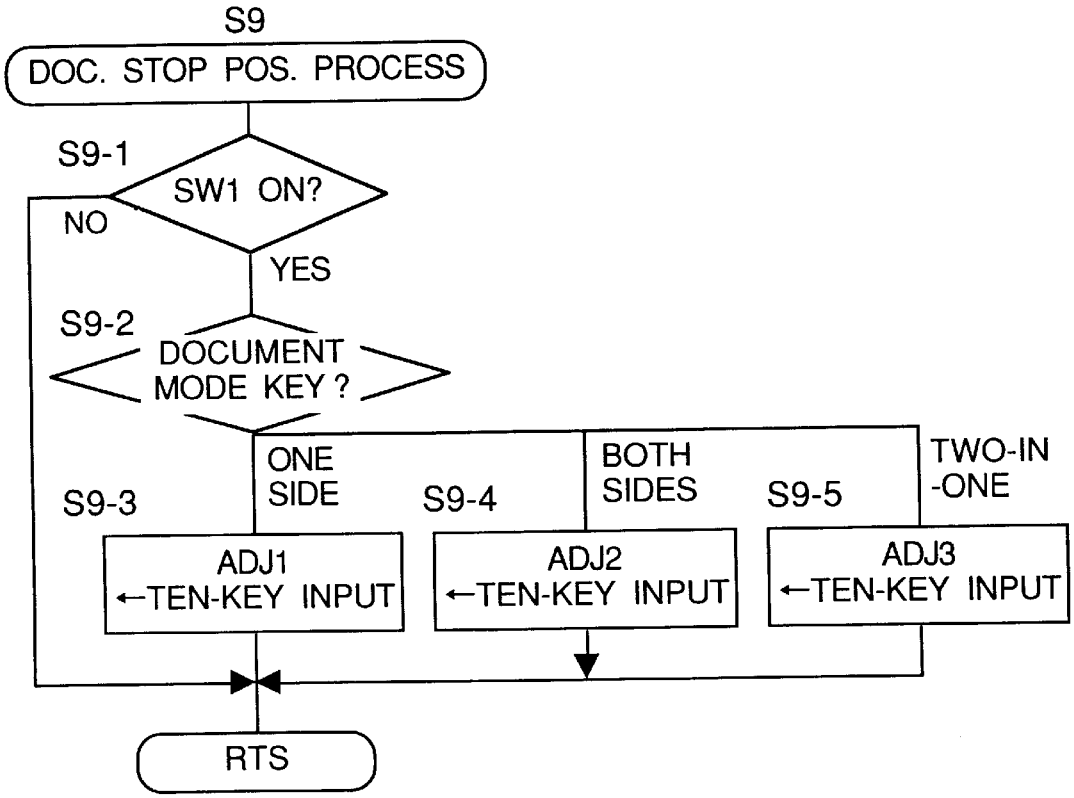
FIG. 47 is a flow chart showing a subroutine for a document stop position process in the CPU 1.

In the document stop position routine (S9), as shown in FIG. 47, it is decided at S9-1 whether or not a document stop position adjustment switch SW1 has been turned on. This document stop position adjustment switch SW1 is preferably disposed at a place that cannot normally be viewed by the user, such as behind the copying machine main body 1. If the document stop position adjustment switch SW1 has been turned off, the program returns. If it has been turned on, the document mode is discriminated at S9-2, where the program is branched to S9-3, S9-4, or S9-5 according to the one-sided mode, the double-side mode, or the two-in-one mode, respectively. At this point, adjustment quantities of document stop position inputted with the ten-key pad, ADJ1, ADJ2, and ADJ3, are stored in the RAM of the copying machine 1, whereupon the program returns.

In more detail, the ADJ1 is data for use of document stop position adjustment in the one-sided mode and the two-in-one mode. As the ADJ1, a positive numerical value is inputted when the document stop position is moved to the upstream side in the document feed direction. Conversely, a negative numerical value is inputted when the document stop position is moved to the downstream side. The ADJ2 is data for use of document stop position adjustment in the double-side mode. As the ADJ2, a positive numerical value or a negative numerical value is inputted according to the moving direction. The ADJ3 indicates an interval adjustment quantity of two document sheets arranged on the document glass 29 in the two-in-one mode, where a positive numerical value implies an expansion of the document interval while a negative numerical value implies a reduction of the document interval. These adjustment quantities ADJ1 to 3 stored in the RAM of the copying machine 1 are transmitted from the CPU1 of the copying machine 1 to the CPU2 of the ADF 2, whereby the driving system is controlled based on these data. Thus, the document stop position in the various modes as well as the interval between two document sheets exposed simultaneously in the two-in-one mode can be controlled to a proper value by inputting the adjustment quantities ADJ1, ADJ2, and ADJ3 with the ten-key pad.

<Control of ADF>

Next, the control of the ADF 2 is described in detail with reference to flow charts.

<Description of Pulses and Timers>

Before describing the control procedure by which the CPU2 controls the ADF 2, explained are pulses and timers for controlling the counter and the main motor M3 used for the control.

Counter DCNT1: Used to feed copying paper to the copying machine main body 1; its value is transmitted to the CPU1 by an interrupt process. When the document is set to the tray 60 (when the empty sensor SE1 is turned on), the counter DCNT1 is set to "1". The counter is incremented if the sensor SE1 is on at the OFF EDGE of the register sensor SE2, and decremented at the ON EDGE of a flag DCHG that requests replacement of the document. The copying machine main body 1 is controlled so as to feed sheets of a number resulting from multiplying the value of the counter DCNT1 by the copy number.

Counter DCNT2: Counts the number of document sheets that are present in the conveying path of the ADF 2 at the time of paper feed. The counter DCNT2 is incremented at the ON EDGE of the register sensor SE2, and decremented upon completion of the discharge of the document.

Counter DCNT3: Used to count the number of the document sheets discharged at the time of a document replacement process in the prestep mode, the two-in-one mode and the double-side mode. The number of document sheets set on the document glass 29 by the document replacement process is set to the counter. The counter is decremented upon completion of the discharge of the document.

Counter GCNT: Used to count the number of document sheets during a copying operation. The counter is incremented at the OFF EDGE of the register sensor SE2, and reset upon completion of a copying operation.

Pulse Counter PLSCNT1: Counts the number of pulses from when the main motor M3 is turned on. The counter is incremented in the forward rotation mode and decremented in the reverse rotation mode.

Pulse Counter PLSCNT2: Counts the number of pulses of the main motor M3 from when the register sensor SE2 is turned off. The counter is incremented in the forward rotation mode and decremented in the reverse rotation mode.

Counter GCOUNT: Used to count the number of fed document sheets in the count mode, the sweep-out mode and the idle feed mode. The counter GCOUNT is incremented upon completion of the feed of the document, and reset at the time when the first-sheet document is started being fed.

Counter GCOUNT2: Counts the number of fed document sheets in the modes other than the count mode, the sweep-out mode and the idle feed mode. The counter GCOUNT2 is incremented upon completion of the feed of the document, and initialized to "0" unless the sweep-out mode is set at the time when the first-sheet document is started being fed.

Pulse Counter PLSCNT5: Counts the move quantity of the document moving motor M5. The counter PLSCNT5 is decremented at all times.

Counter SIZCNT1: Used to detect the size of the document. A value of the pulse counter PLSCNT1 is stored when the register sensor SE2 is turned off.

Pulse P01: A number of pulses to be counted from when the main motor M3 is driven to rotate forward until when it is reduced in speed, in the case where a small-size document is conveyed in the prestep mode. At a time point when this number of pulses has been fully counted, the next document sheet is started to be first-out fed.

Pulse P02: A number of pulses to be counted from when the main motor M3 is driven to rotate forward until when it is turned off, in the case where a small-size document is conveyed in the prestep mode. The number corresponds to L/2.

Pulse P03: A number of pulses to be counted from when the main motor M3 is driven to rotate forward until when it is reduced in speed, in the case where a document other than small size is conveyed in the prestep mode. At a time point when this number of pulses has been fully counted, the next document sheet is started to be first-out fed.

Pulse P04 (corresponding to L): A number of pulses to be counted from when the main motor M3 is driven into forward rotation until when it is turned off, in the case where a document other than small size is conveyed in the prestep mode.

Pulse P05: A number of pulses to be counted from when the main motor M3 is driven to rotate forward until when it is reduced in speed, in the case where two sheets of a small size document are set on the document glass 29 in the two-in-one mode and next a large size document is conveyed.

Pulse P06 (A4 transverse+α, or corresponding to L/2): A number of pulses to be counted from when the main motor M3 is driven to rotate forward until when it is turned off, in the case where two small-size document sheets on the document glass 29 and successively a large-size document sheet are conveyed in the two-in-one mode (the main motor M3 is temporarily stopped for discharge of the preceding document).

Pulse P07: A number of pulses to be counted from when the register sensor SE2 is turned off until when the main motor M3 is driven to rotate reverse, in the case where a small-size document sheet is conveyed in the two-in-one mode.

Pulse P08: A number of pulses to be counted when a small-size document sheet is switched back in the two-in-one mode.

Pulse P09: A number of pulses to be counted from when the register sensor SE2 is turned off until when the main motor M3 is turned off in the count mode.

Timer T101: Provides timing with which the feed motor M2 is turned on after the pickup motor M1 is turned off.

Timer T102: Provides timing with which the feed motor M2 is turned off after the register sensor SE2 is turned on.

Timer T201: Provides timing with which the scale solenoid SL1 is turned off after the main motor M3 is turned off.

Timer T202: Provides timing with which the pickup motor M1 is turned on after the register sensor SE2 is turned off in the two-in-one mode.

Timer T301: Provides timing with which the discharge motor M4 is turned off after the discharge sensor SE3 is turned off.

Timer T401: Provides timing with which the main motor M3 is turned off after it is turned on, for the process of discharging the last two document sheets in the two-in-one mode, in the second embodiment.

Timer T501: Provides timing with which the main motor M3 is turned off after it is driven to rotate reverse, for the process of switching back the document in the two-in-one mode, in the second embodiment.

Timer T502: Provides timing with which the document moving motor M5 is started to rotate reverse after it is stopped.

Timer T601: Provides timing from brake-on to brake-off in the FD alignment motor M6.

Timer T602: A timer for detecting any operational fault of the first slider due to the CD alignment motor M7; provides timing from the start of reverse rotation of the CD alignment motor M7 until the detection of an ON EDGE of the CD1 alignment sensor SE7.

Timer T603: A timer for detecting any operational fault of the first slider due to the CD alignment motor M7; provides timing from the start of forward rotation of the CD alignment motor M7 until the detection of an ON EDGE of the CD2 alignment sensor SE8.

Timer T604: A timer for detecting any move (operation) fault of the second slider due to the FD alignment motor M6; provides timing from turn-on of the FD alignment motor M6 until the detection of an EDGE of the FD alignment sensor SE6.

<Main Routine>

Figure 48:
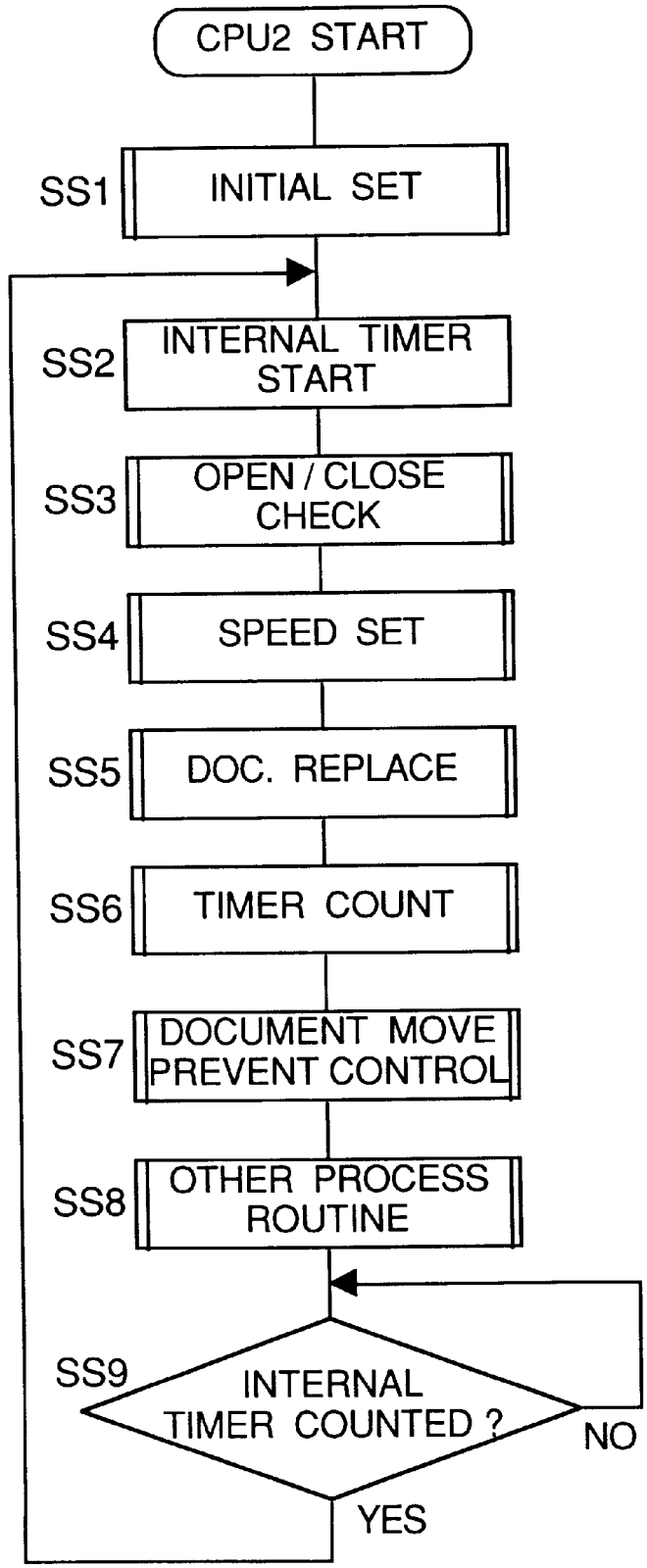
FIG. 48 is a flowchart showing the main routine of the CPU 2 for controlling the ADF.

FIG. 48 shows a main routine of the CPU2 for controlling the ADF 2. With power on, the CPU2 is reset and the program starts. At SS1, initial setting is performed, where the RAM is cleared, various registers are reset, and various types of equipment are set to their initial modes. Subsequently at SS2, an internal timer is started. The internal timer functions to determine the required time of one cycle routine of this main routine and its value is set at SS1. Also, the internal timer serves as a reference for the count of other various timers involved in subroutines as described below.

Next, the subroutines of SS3 through SS7 are sequentially called and necessary processes are executed. Then, at SS8, the program returns to SS2 upon completion of the count of the internal timer. SS3 is a subroutine for checking whether the opening/closing mechanisms for opening/closing operation upon the document glass of the ADF and the jam process of the ADF are opened or closed, to thereby decide whether the individual parts are opened or closed. SS4 is a subroutine for setting a document conveying speed of the ADF 2. SS5 is a subroutine for replacing a document sheet with another on the document glass 29. SS6 is a subroutine for executing the count of the various timers. SS7 is a subroutine for controlling the document presser lever of the document move preventing section by which the document located upstream of the document tray 60 when the upper part 1*a* of the copying machine main body 1 is prevented from moving downstream. SS8 is to execute other processes, including A/D conversion, input process, output process, and detection of paper jams.

Figure 49A:
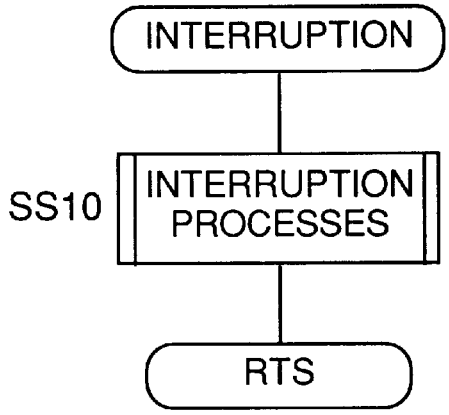
FIG. 49 is a flow chart showing a subroutine for interrupt process in the CPU 2.
Figure 49B:
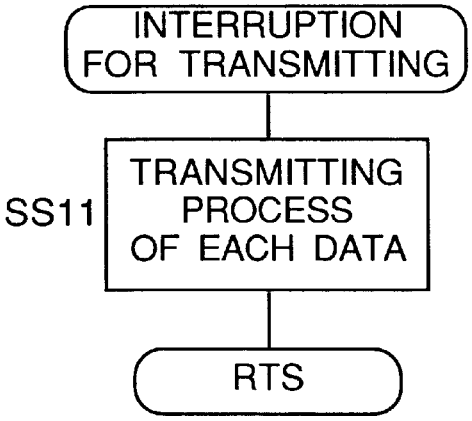
Figure 49C:
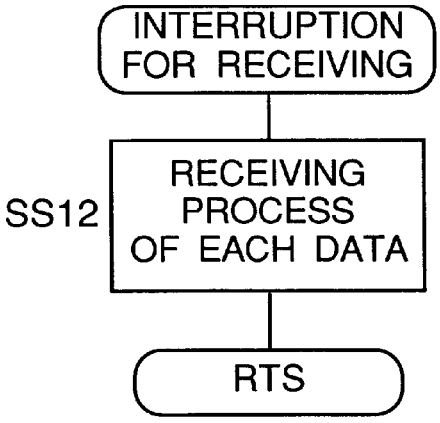

Interrupt processes to the CPU2, as shown in FIG. 49, include various types of interrupt processes such as control of the main motor M3 at SS10, data transmission and data reception in conjunction with the CPU1 at SS11 and SS12, where all the interrupt processes are executed independently of the processing involved in the main routine of the CPU2.

<Initial Setting>

Figure 50:
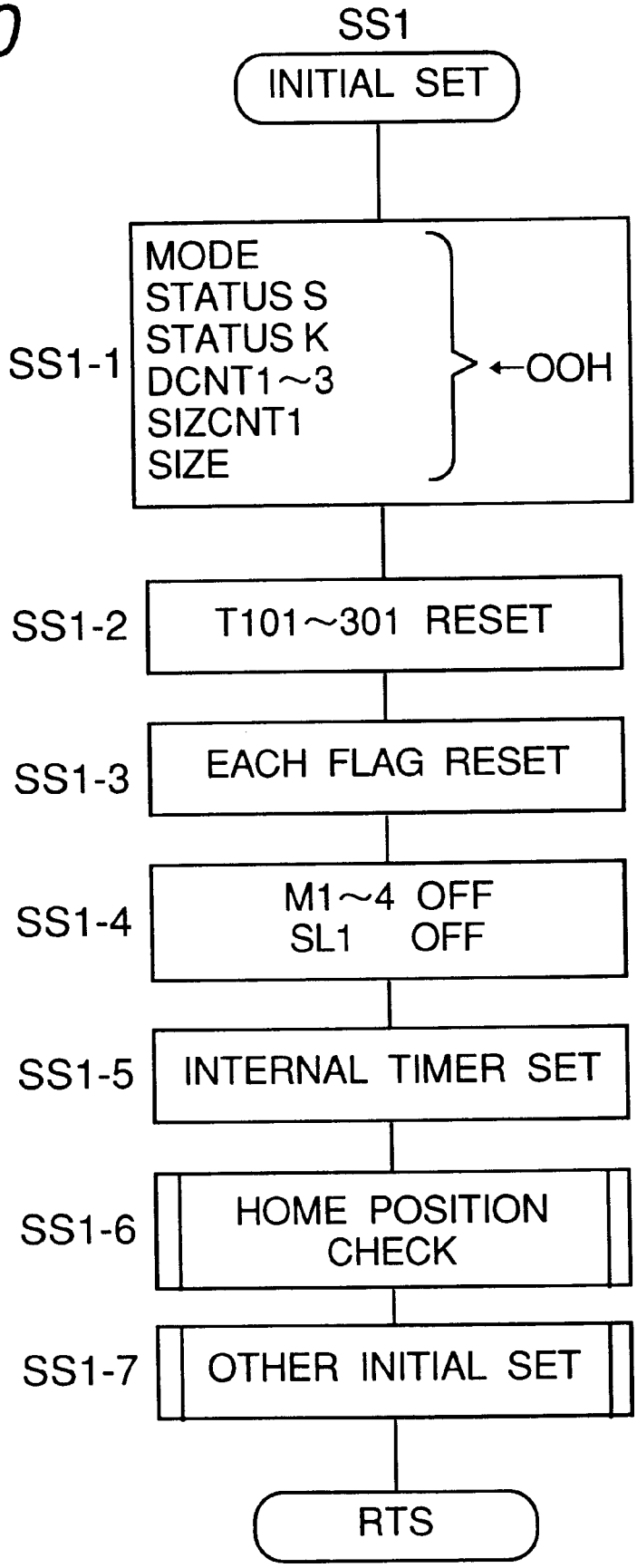
FIG. 50 is a flow chart showing a subroutine for initial setting in the CPU 2.

FIG. 50 shows a subroutine for initial setting (SS1) to be executed by the CPU2. At SS1-1, the data of the RAM and the counters are all cleared. At SS1-2, timers T101, T102, T202, T301 are reset. At SS1-3, the flags are reset. At SS1-4, the motors M1, M2, M3, M4 and the scale solenoid SL1 are all turned off. At SS1-5, the internal timer is set to a specified value. At SS1-6, it is checked whether or not the front-end restricting plate and the pressing plate are in their initial home positions. At SS1-7, other initial settings are processed.

<Home Check>

Figure 51:
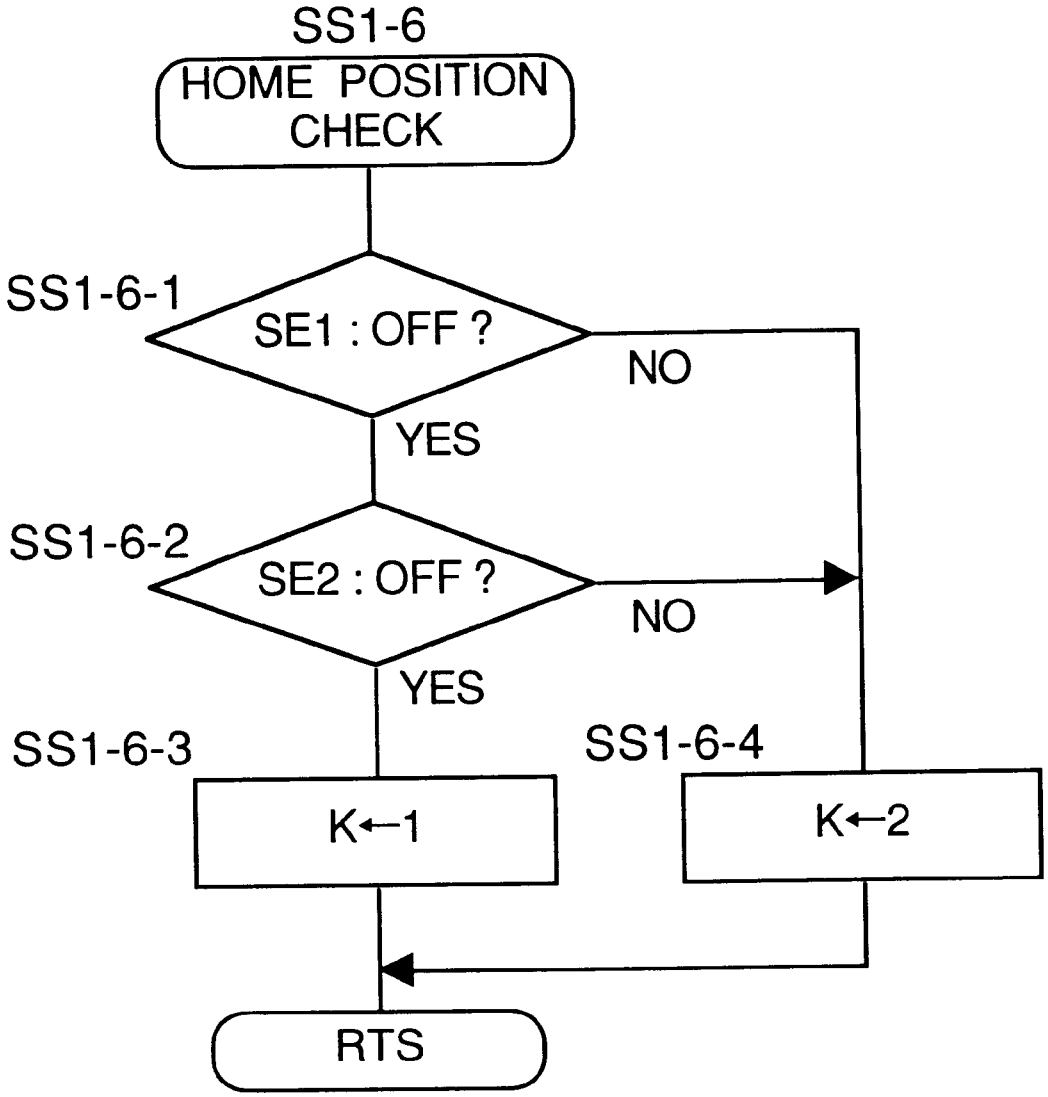
FIG. 51 is a flow chart showing a subroutine for home check in FIG. 50.

A home check subroutine as shown in FIG. 51 is to check whether or not the front-end restricting plate 81 and the pressing plate 84 (which are hereinafter referred to generically as a "pickup section") should be positioned in their specified home positions. First at SS1-6-1, it is decided whether or not the empty sensor SE1 has been turned off and it is decided at SS1-6-2 whether or not the register sensor SE2 has been turned off. Then, if both sensors SE1, SE2 have been turned off, which means that there is document neither on the document tray 60 nor at the first-out position, a document feed status K is set to "1" at SS1-6-3, where an operation for returning the pickup section to the home position is executed. If the document is present either on the document tray 60 or at the first-out position and either one of the sensor SE1 or SE2 has been turned on, then the feed status K is set to "2" at SS1-6-4, where the current state is maintained without executing the returning process to the home position.

<Opening/Closing Check>

Figure 52:
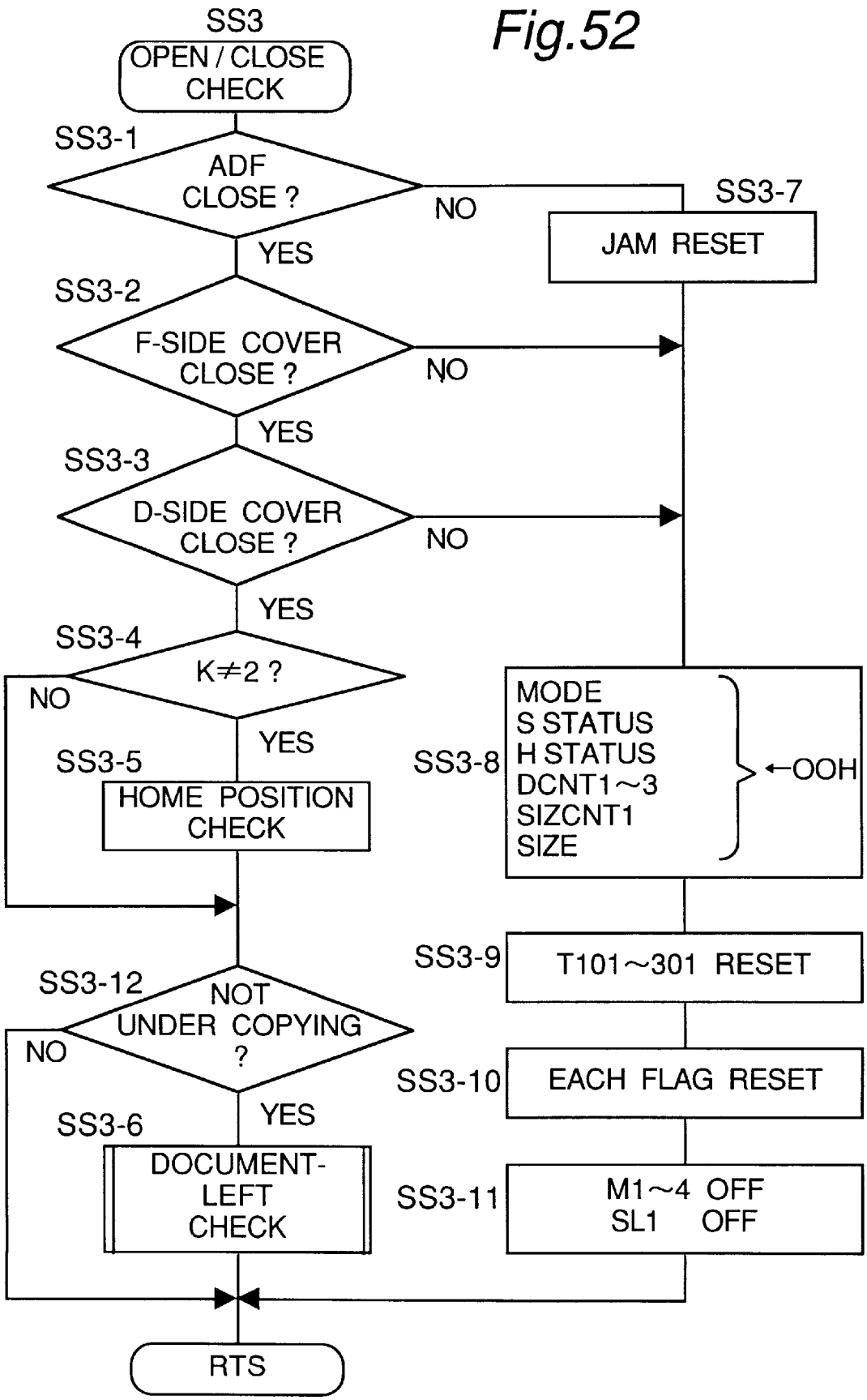
FIG. 52 is a flow chart showing a subroutine for opening/closing check in the CPU 2.

FIG. 52 details the opening/closing check subroutine of SS3. In this subroutine, it is decided at SS3-1 whether or not the ADF 2 has been closed to the document glass 29. If the ADF 2 has been closed, then it is decided whether or not the feed-side cover 93 and the discharge-side cover 147 are opened or closed, at SS3-2 and SS3-3, respectively. If both covers 93, 147 are closed, then it is decided at SS3-4 whether or not the feed status K is "2". If K 2, which means that the pickup section is not in the home position, the aforementioned home check process is executed (SS3-5). If K=2, it is decided at SS3-12 whether or not a copying operation is under progress, without executing the home check process. If a copying operation is under progress, then the step of SS3-6 is not executed. If a copying operation is not under progress, then it is decided at SS3-6 whether or not there is a document sheet left in the ADF 2, for example, after jam processing. Meanwhile, if the ADF 2 has been decided at SS3-1 to be opened to the document glass 29, the jam state is reset at SS3-7 irrespectively of whether or not the document has jammed in the feed section or the discharge section of the ADF 2. As a result, even if the document has jammed inside the ADF 2, opening the ADF 2 makes it possible to place a document sheet on the document glass 29 and execute a copying operation. Accordingly, a user who will place a document onto the document glass 29 and copy it without using the ADF 2 may execute a necessary copying operation in preference to jam processing with the ADF 2. Next, when the jammed state is reset, or when the feed-section or discharge-section cover 93 or 147 is opened, data in the RAM and the counters are all cleared at SS3-8, the timers T101, T102, T202, and T301 are reset at SS3-9, the flags are reset at SS3-10, and the motors M1, M2, M3, and M4 and the scale solenoid SL1 are turned off at SS3-11.

<Document-Forgotten-to-Remove Check>

Figure 53:
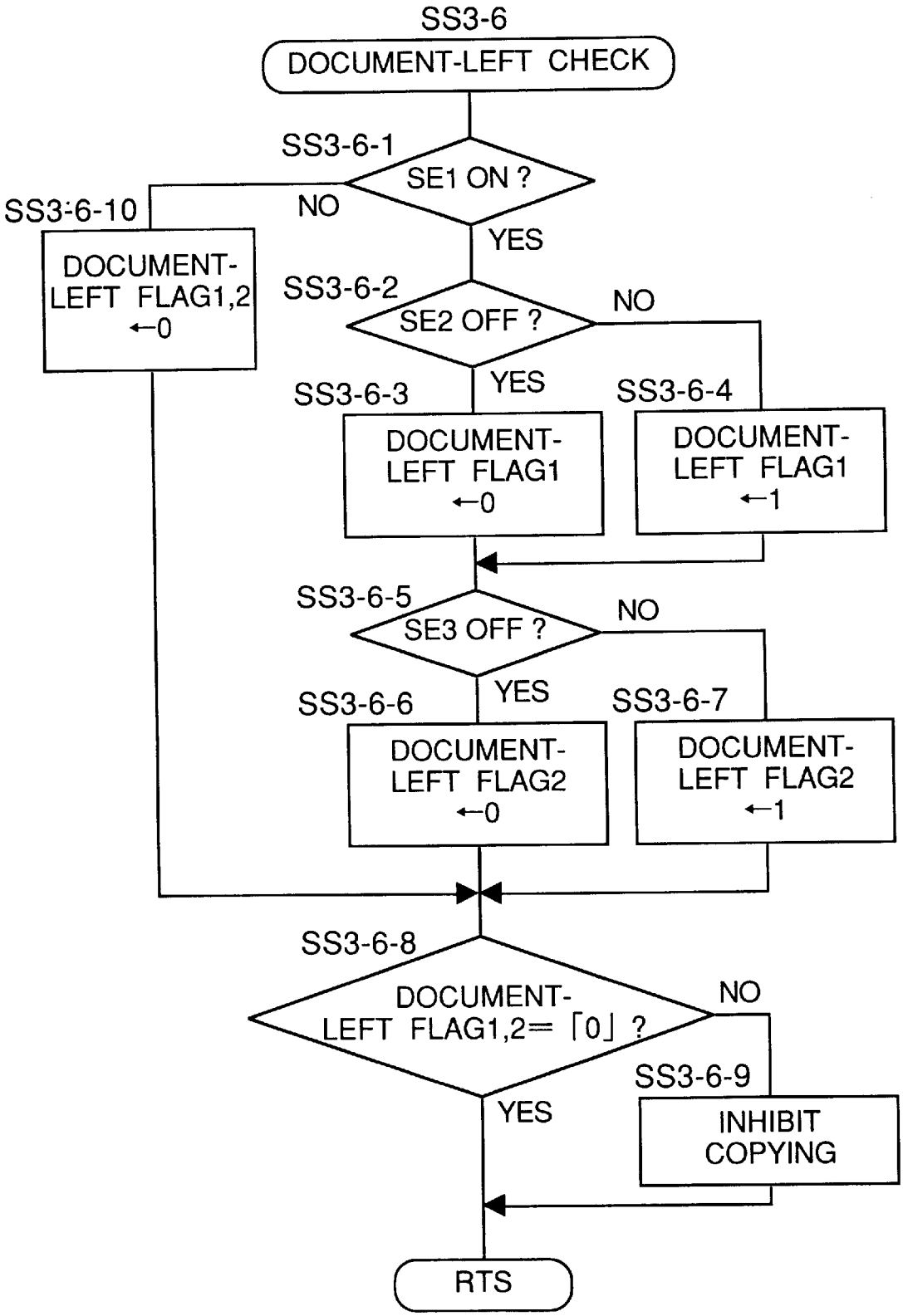
FIG. 53 is a flow chart showing a subroutine for forget-to-take-out check in FIG. 52.

FIG. 53 details a document-forgotten-to-remove check subroutine of SS3-6. In this subroutine, it is first decided at SS3-6-1 whether or not the sensor SE1 has been turned on, or whether or not there is a document on the document tray 60. If the empty sensor SE1 has been turned off (there is no document), then a document-forgotten-to-remove flag 1 and a document-forgotten-to-remove flag 2 are set to "0" at SS3-6-10. Meanwhile, if the empty sensor SE1 is decided to be on (there is a document), then it is decided at SS3-6-2 whether or not the register sensor SE2 has been turned off, or whether or not there is a document at the first-out position of the register rollers. If the register sensor SE2 has been turned off (there is no document), then the document-forgotten-to-remove flag 1 is reset to "0" at SS3-6-3; if the register sensor SE2 has been turned on (there is a document), then the document-forgotten-to-remove flag 1 is set to "1" at SS3-6-4. Next, it is decided at SS3-6-5 whether or not the discharge sensor SE3 has been turned off, or whether or not there is a document at the reversing section. If the discharge sensor SE3 is off (there is no document), then the document-forgotten-to-remove flag 2 is reset to "0" at SS3-6-6; if the discharge sensor SE3 is on (there is a document), the document-forgotten-to-remove flag 2 is set to "1" at SS3-6-7. Now that both document-forgotten-to-remove flag 1 and document-forgotten-to-remove flag 2 have been set as a result of the above steps, if it has been decided at SS3-6-8 that both document-forgotten-to-remove flag 1 and document-forgotten-to-remove flag 2 are "0", which means that there is no document left, then the program returns; if it has been decided that either one of the document-forgotten-to-remove flag 1 or the document-forgotten-to-remove flag 2 is set to "1", then the program prevents a copying operation, returning. Thus, it is checked at SS2-6-9 whether or not there is a document left within the ADF 2 at a time point when a document is set onto the document tray 60, whereby copying operation is prevented so as to allow the user to take measures promptly. Also, if a means for indicating the position where a document left is present is provided on the control panel or the like, the position of the document left can be known immediately, allowing a prompt countermeasure.

<Speed Setting>

Figure 54:
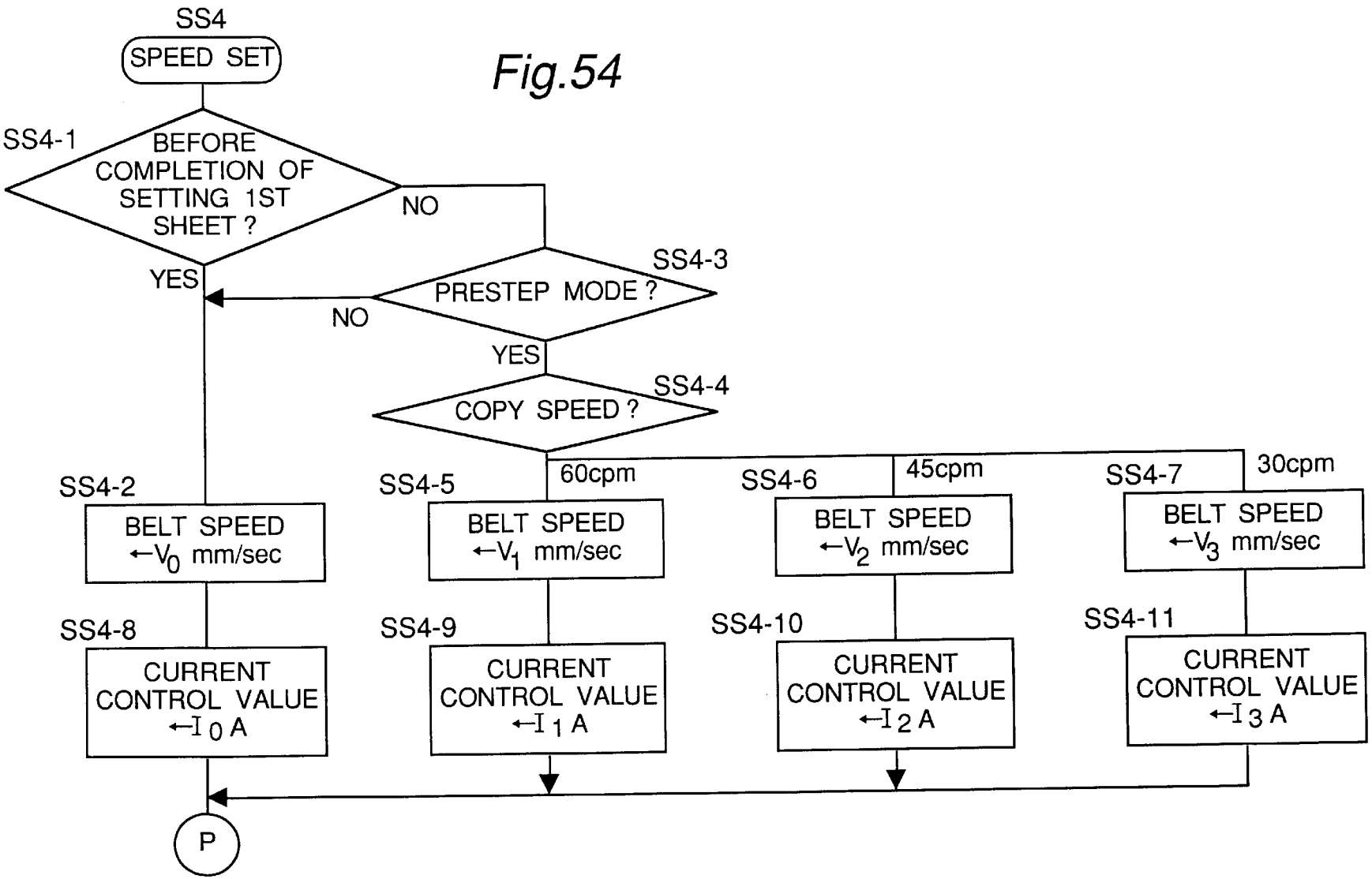
FIG. 54 is a flow chart showing a subroutine for speed setting in the CPU 2.

FIG. 54 shows a speed setting subroutine to be executed at SS4. In this example, the document conveying speed (belt speed) of the conveyor belt 123 is set to four types of $V_0$, $V_1$, $V_2$, and $V_3$. The belt speeds $V_1$, $V_2$, and $V_3$ are values corresponding to supposed three kinds of copy speeds, respectively, due to differences among the models of the copying machine.

The belt speed $V_1$ is a speed at which 100% of copy productivity is maintained in a combination with a model of A4 transverse feed and a copy speed of 60 cpm. This means that the belt speed $V_1$ is such that document replacement can be accomplished within a return time of the optical system 20. More specifically, if the system speed of the copying machine is 300 mm/sec, the scan length for A4 transverse is 210 mm. The return time of the optical system 20 is (60 sec/60 cpm)−(210 mm/300 mm/sec)=0.3 sec (cpm: copy cycle per minute). If the distance from the nip portion of the register rollers 89 to the exposure standard position SP is expressed as L, the conveying distance for the document replacement in the prestep mode is L/2, resulting in a document replacement time of ($L/2V_1$). Hence, $L/2V_1$#0.3, and $V_1$∃L/2 H 0.3.

The belt speed $V_2$ corresponds to a copying machine having a copy speed of 45 cpm, while the belt speed $V_3$ corresponds to a copying machine having a copy speed of 30 cpm. In this example, $V_1>V_2>V_3$.

The belt speed $V_0$ is a speed at which the first-sheet document is conveyed to the exposure standard position SP, and which is set to a value larger than the aforementioned belt speed $V_1$ so as not to deteriorate the copy productivity. Further, the belt speed is set to $V_0$ also for the modes other than the prestep mode, i.e., for the double-side document conveying mode and the number-of-document-sheets count mode.

In this subroutine, it is first decided at SS4-1 whether or not the process of setting the first-sheet document to the exposure position SP has already been completed. If it has not yet been completed, the belt speed is set to $V_0$ at SS4-2. If the process has been completed, it is decided at SS4-3 whether or not the current mode is the prestep mode. Then, if it is not the prestep mode, the belt speed is set to $V_0$ at SS4-2. If it is the prestep mode at SS4-3, the copy speed is checked at SS4-4. The copy speed is checked based on copy speed data of the copying machine 1 transmitted from the CPU1. If the copy speed is 60 cpm, the belt speed is set to $V_1$ at SS4-5; if the copy speed is 45 cpm, the belt speed is set to $V_2$ at SS4-6. Further, if the copy speed is 30 cpm, the belt speed is set to $V_3$ at SS4-7. Moreover, if the belt speed has been set to $V_0$, the current control value outputted from the CPU2 is set to $I_0A$ at SS4-8. Likewise, if the belt speed has been set to $V_1$, $V_2$, or $V_3$, then the current control value is set to $I_1A$, $I_2A$, or $I_3A$ at SS4-9, SS4-10, or SS4-11, respectively.

Figure 55:
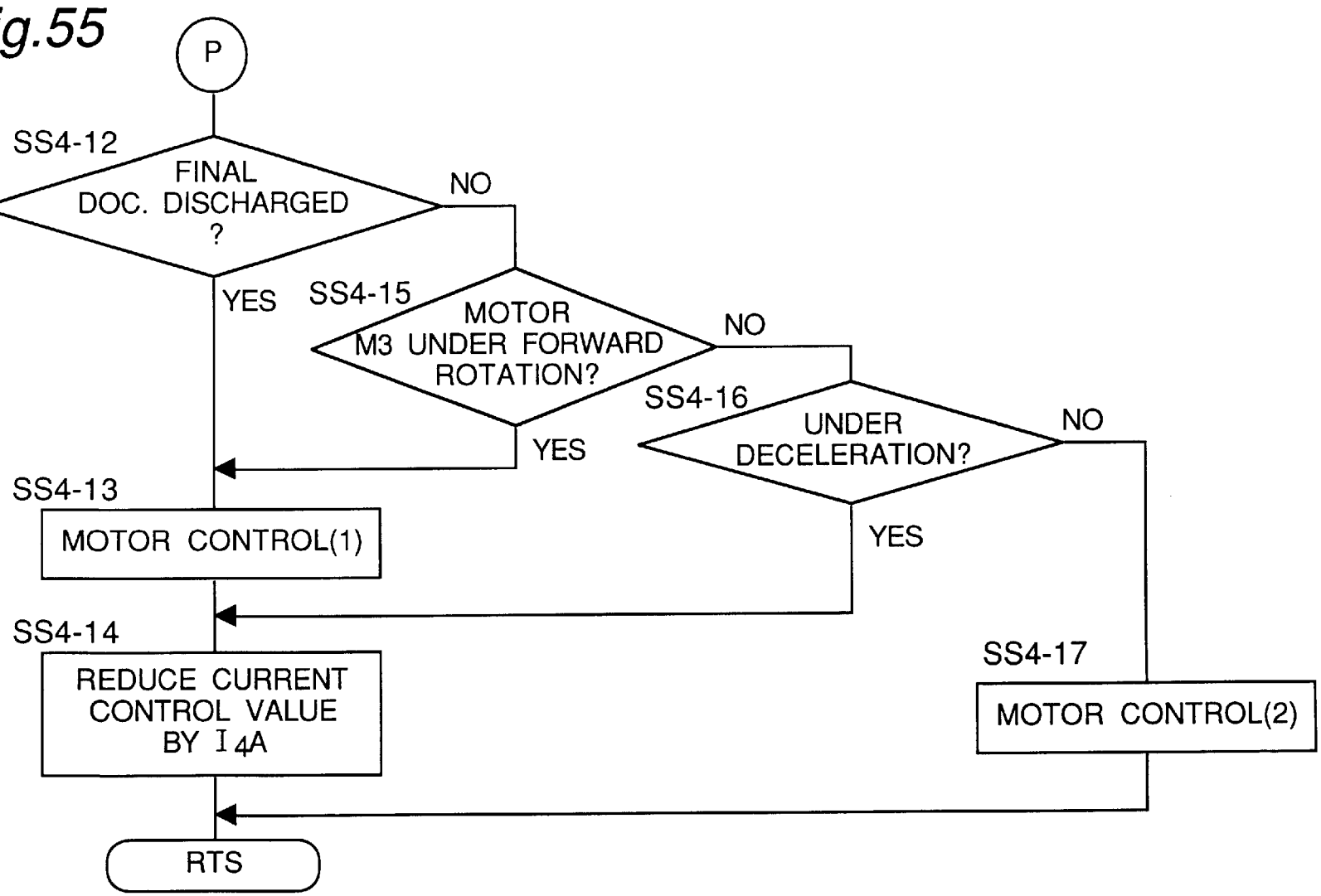
FIG. 55 is a flow chart showing a subroutine for speed setting subsequent to FIG. 54.
Figure 56A:
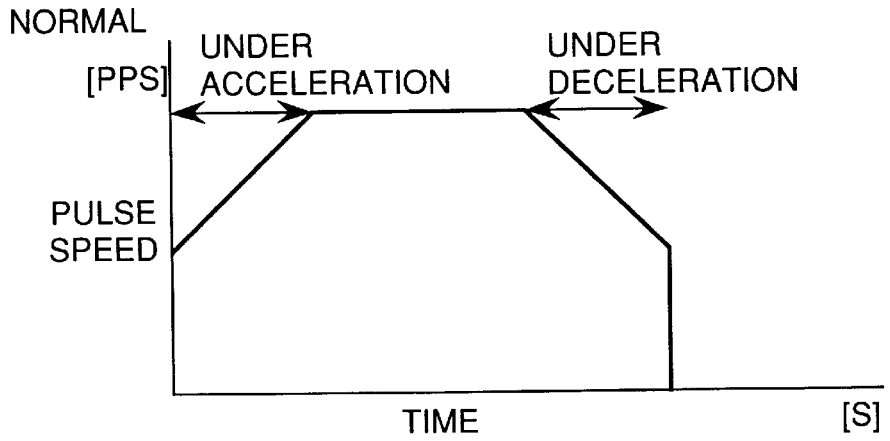
FIG. 56 is a relational view between time and pulse speed, showing the pulse control of the main motor.
Figure 56B:
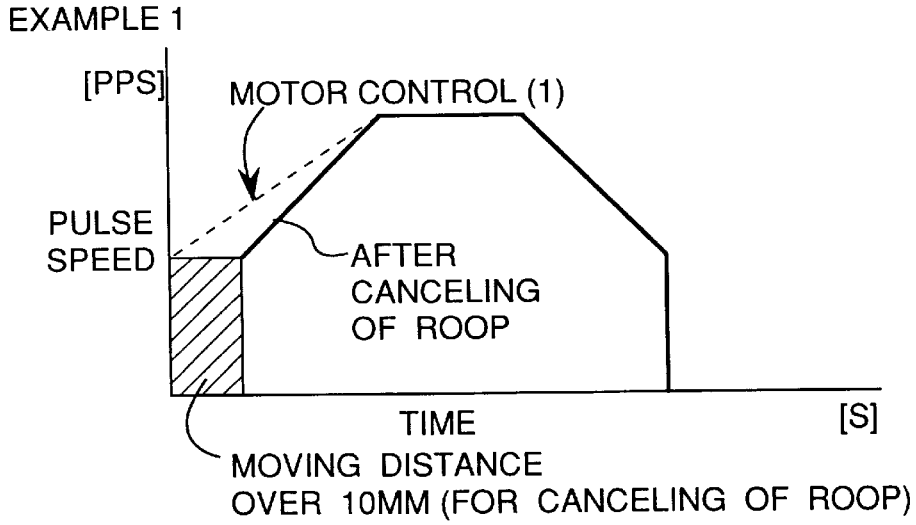
Figure 56C:
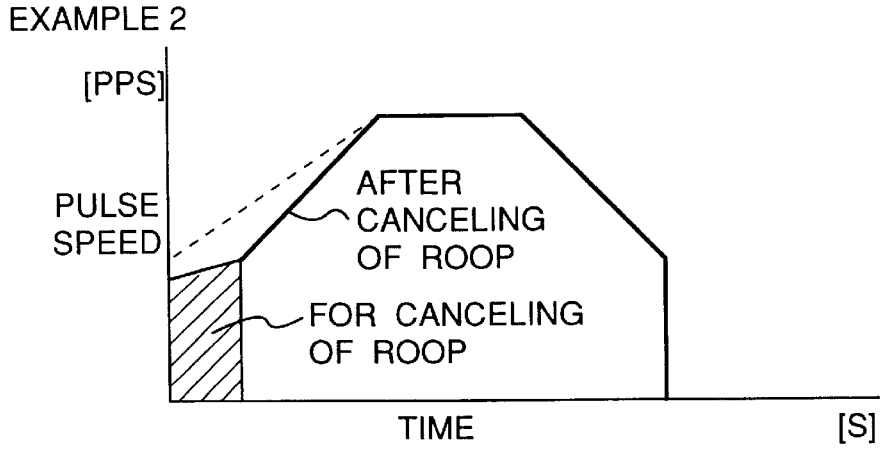

Next, as shown in FIG. 55, it is decided at SS4-12 whether or not the final document sheet is being discharged, and at SS4-15 whether or not the main motor M3 is being rotated forward for reversing the document sheet from rear to front surface in the double-side mode. If the ADF 2 has been set to any one of these states, the load imposed on the conveyor belt 123 at that time is a small one, in which case the main motor M3 is subjected to normal trapezoidal control at SS4-13 (see FIG. 56A). Under this condition, it is unnecessary to pull off the document from the separating section, and the main motor M3 is not subject to any excessive load. Therefore, the current control value is lowered by $I_4A$ or so at SS4-14. Meanwhile, if the final document sheet is not being discharged or if the operation of setting a document surface in the double-side mode is not under progress, it is decided at SS4-16 whether or not the main motor M3 is under speed reduction. If it is under speed reduction (see FIG. 56A), the main motor M3 requires a small torque and the separating section has caught no document so that it is less loaded. Therefore, the current control value is lowered by $I_4A$ or so at SS4-14. However, if it has been decided at SS4-12, SS4-15, or SS4-16 that the final document sheet is not being discharged, that the operation of setting a document surface in the double-side mode, or that the main motor M3 is not under speed reduction, i.e., if there is a document in the register section or the separating section, then there will be a large variation in the load imposed on the main motor M3 when the loop of the document that has been stopped in the first-out position is canceled, so that the main motor M3 as a stepping motor will be driven at a constant low speed until the loop is canceled, and thereafter controlled so as to be accelerated at the time of the canceling of the loop (SS4-17) (see FIGS. 56B, 56C). An excessive load will be imposed on the main motor M3 when the document is pulled off from the separating section, in which case the current value is held in normal state. As a result, in this subroutine, the current value is controlled in response to the load imposed on the main motor M3, leading to a reduction in power consumption.

The belt speeds $V_1$, $V_2$, $V_3$ may be arranged to be able to be set by a DIP switch contained in the ADF 2, other than the way that the belt speeds are set based on data transmitted from the CPU1. Otherwise, this type of data detection means may be provided at a portion of the ADF 2 where it is in contact with the copying machine main body 1. More specifically, a magnet showing the copy speed is provided on the upper frame of the copying machine main body 1, and a sensor for detecting the magnet is provided on the ADF 2. The CPU2 reads the copy speed of the copying machine main body 1 based on a signal shown by the magnet and derived from the sensor, to set a belt speed.

<Document Replacement>

Figure 57:
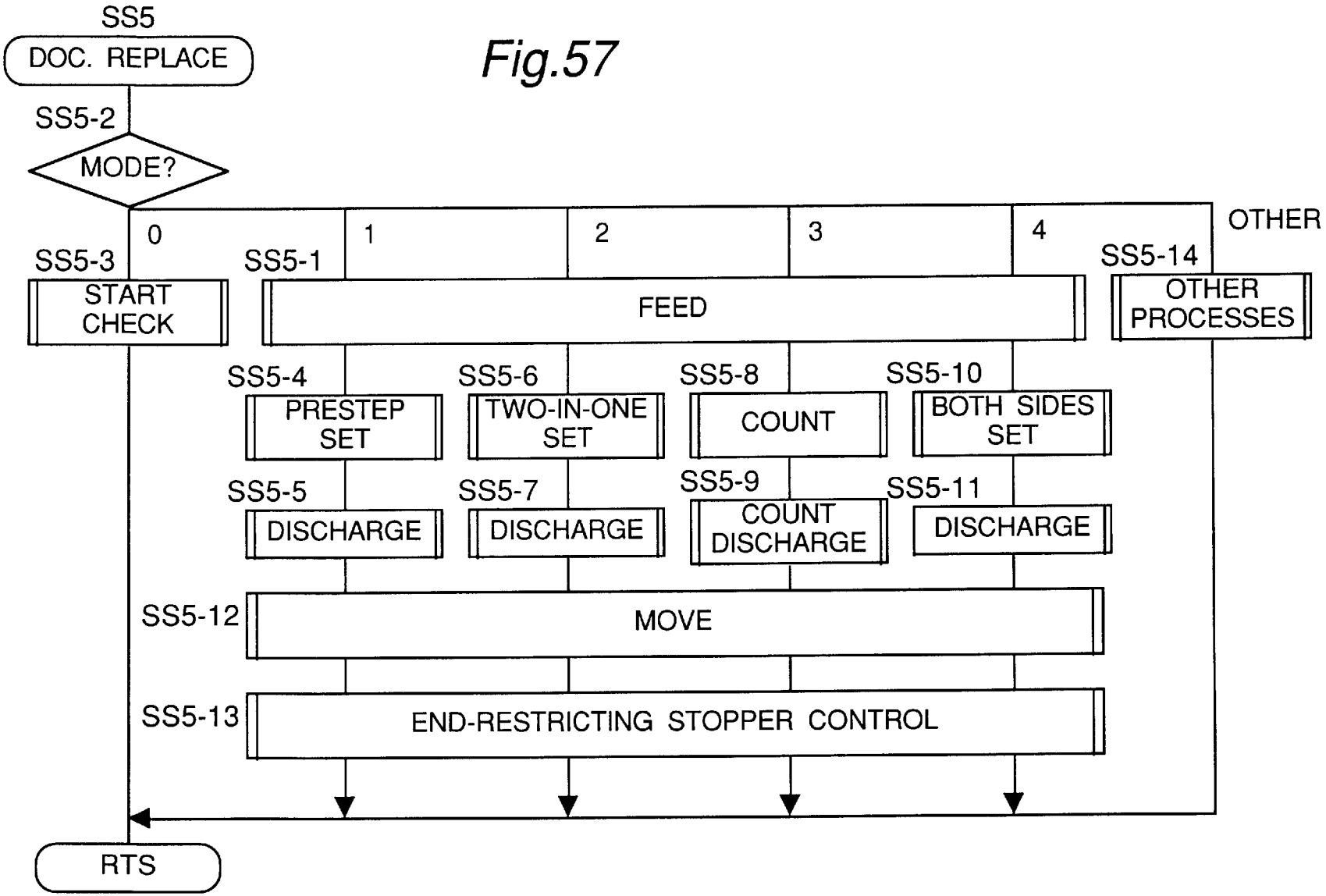
FIG. 57 is a flow chart showing a subroutine for document replacement in the CPU 2.

FIG. 57 shows a document replacement subroutine to be executed at SS5. In this subroutine, the MODE is checked at SS5-2, and the following operations are executed based on the resulting value. The MODE is set to a specified value depending on the document feed form selected by the operator.

First, the MODE is decided at SS5-2. If the MODE is "0", the start check is processed at SS5-3. If the MODE is "1", a paper feed process is executed at SS5-1, the prestep setting is processed at SS5-4, the paper is discharged at SS5-5, and the end-restricting stopper control is executed at SS-13. If the MODE is "2", the two-in-one setting is processed at SS5-6, the paper is discharged at SS5-7, and the end-restricting stopper control is executed at SS-13. If the MODE is "3", "5" or "6", the paper feed process is executed at SS5-1, the counting of the number of document sheets is processed at SS5-8, and the counted paper discharge is processed at SS5-9. If the MODE is "4", the paper feed process is executed at SS5-10, the paper feed process for the double-side mode is executed at SS5-10, the paper is discharged at SS5-11, and the end-restricting stopper control is executed at SS-13. If the MODE is other than any of the foregoing, other operations are processed at SS5-14. When the recirculation mode has been selected by the operator, the processes of SS5-11, SS5-9, SS5-7 and SS5-5 are executed and thereafter the moving process SS5-12 is executed.

<Start Check>

Figure 58:
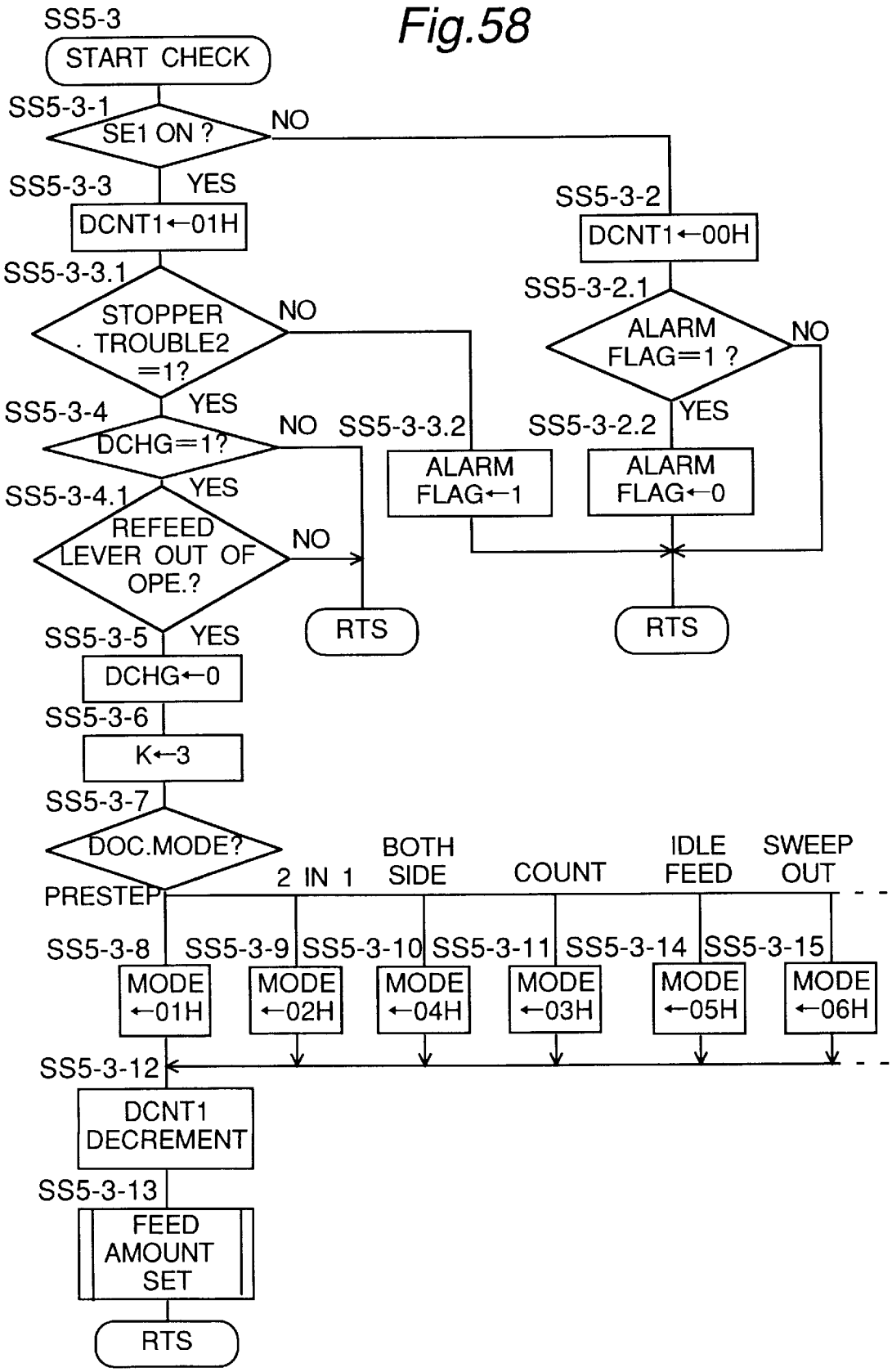
FIG. 58 is a flow chart showing a subroutine for start check in the CPU 2.

FIG. 58 shows a start check subroutine to be executed at SS5-3. This subroutine is processed when the MODE is "0", i.e., when the ADF 2 is on standby. It is first decided at SS5-3-1 whether or not the empty sensor SE1 has been turned on. If it has not been turned on, no document has been set onto the tray 60, where the DCNT1 is reset to "0" at SS5-3-2. Then, at SS5-3-2.1, it is decided whether or not an alarm flag is "1". If it is "1", the alarm flag is set to "0" at SS5-3-2.2, enabling the use of the ADF; if it is "0", the program immediately returns.

When the empty sensor SE1 is turned on (when a document is set to the tray 60), the counter DCNT1 is set to "1" at SS5-3-3, and it is decided at SS5-3-3.1 whether or not a flag for stopper trouble 2 is "1". If the flag is "1", the alarm flag is set to "1" at SS5-3-3.2 and the program returns. If the flag for stopper trouble 2 is "0", it is decided at SS5-3-4 whether or not a flag DCHG is "1". The flag DCHG is a command that requests document replacement when it is "1", which command is transmitted from the CPU1. This flag DCHG is set to "1" at a time point when the print key is turned on and when the scanning of a copy number of document sheets is completed. Accordingly, if the flag DCHG is "0", the program immediately returns; if it is "1", it is confirmed at SS5-3-4.1 that the refeed lever is out of operation, thereafter the flag DCHG is reset to "0" at SS5-3-5, and the status K is set to "3" at SS5-3-6. If the refeed lever is under operation, the paper feed has been disabled so that the program immediately returns. The status K is used in the paper feed subroutine, and causes the document to be fed one sheet each time when it is set to "3".

Next, the document mode is checked at SS5-3-7. If it is the prestep mode, the MODE is set to "1" at SS5-3-8; if it is the two-in-one mode, the MODE is set to "2" at SS5-3-9; if it is the double-side mode, the MODE is set to "4" at SS5-3-10; if it is the count mode, the MODE is set to "3" at SS5-3-11; if it is the idle feed mode, the MODE is set to "5" at SS5-3-14; and if it is the sweep-out mode, the MODE is set to "5" at SS5-3-15. The cases of the other document modes are omitted. Subsequently, the counter DCNT1 is decremented at SS5-3-12, and the feed amount setting process is executed at SS5-3-13.

<Feed Amount Setting>

Figure 59:
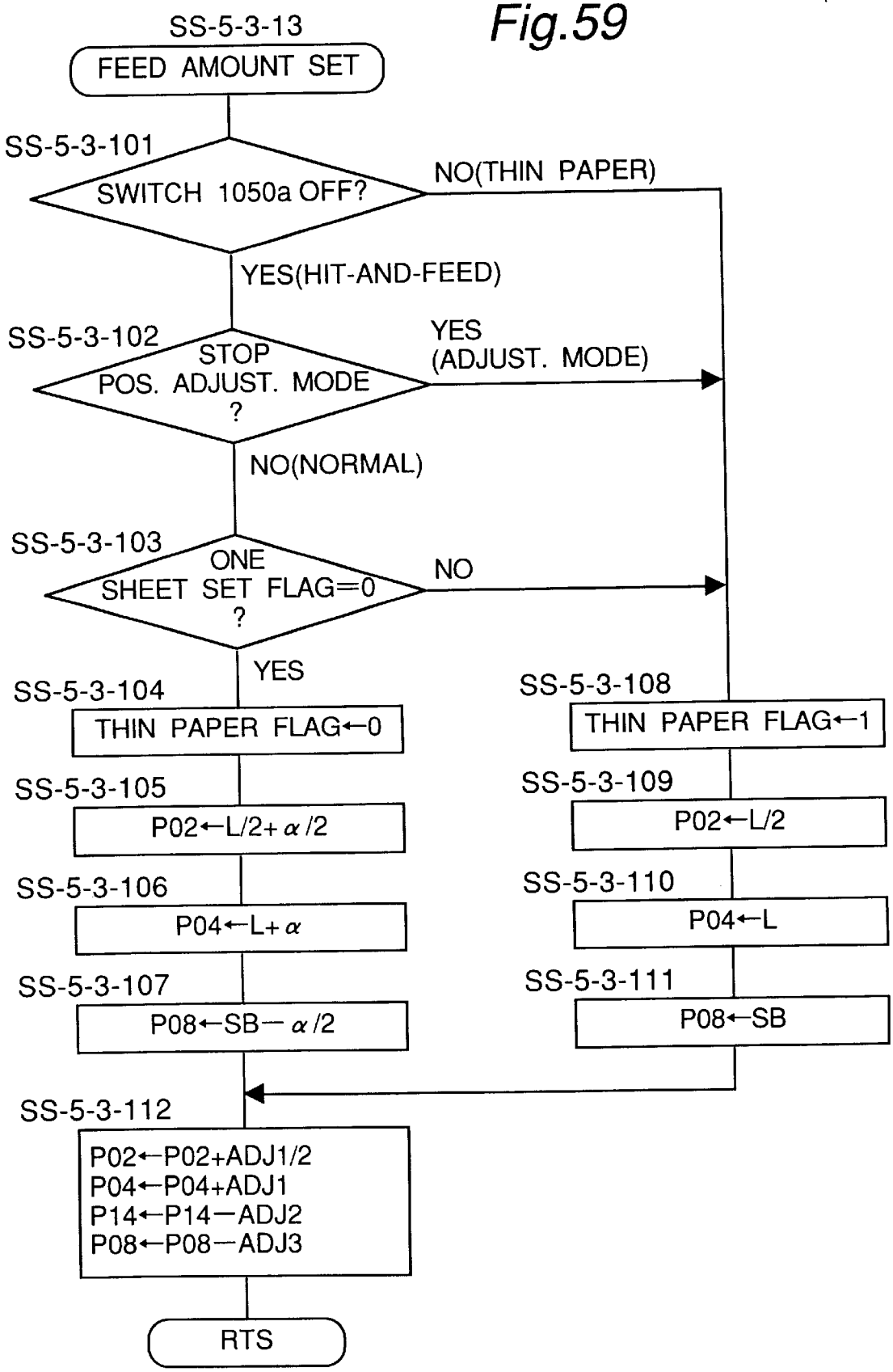
FIG. 59 is a flow chart showing a subroutine for feed amount setting in FIG. 58.
Figure 60:
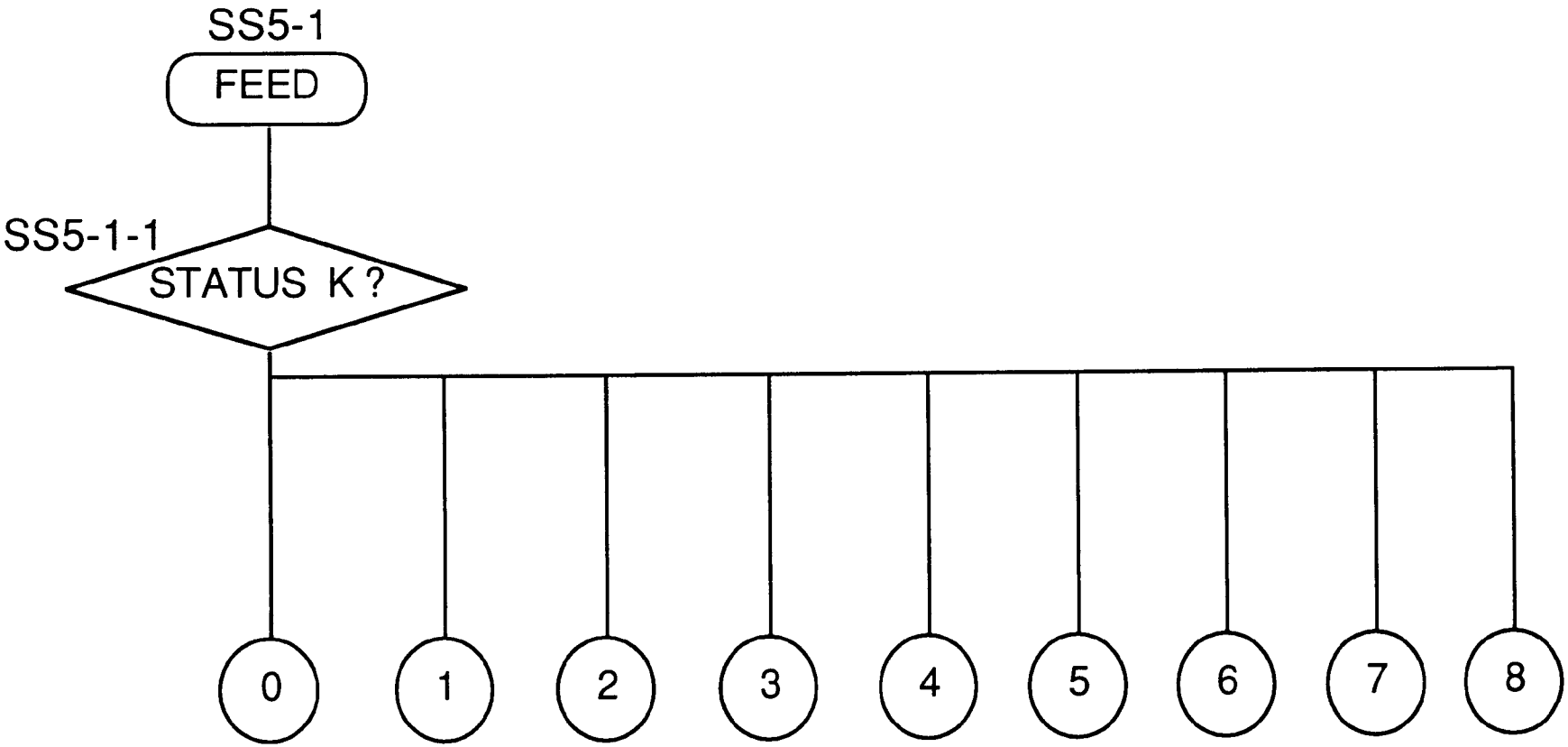
FIG. 60 is a flow chart showing a subroutine for paper feed in the CPU 2.

FIG. 59 shows the processing contents of a feed amount setting subroutine at SS5-3-13. It is decided at SS5-3-101 whether or not the LED 1050*a* on the control panel has been turned off, i.e., whether the current mode has been set to a thin-paper document copying state. This LED 1050*a* is to be turn on and off in response to the operation of the document select key 1050. The document select key may be freely operated by the user, and is to be pressed when the document is thin paper to set the thin-paper document copying state (hereinafter, referred to thin-paper mode). Further, it is decided at SS5-3-102 whether or not the stop position adjustment mode has been set, and at SS5-3-103 whether or not a one-sheet setting flag has been set to "0". This one-sheet setting flag is set to "1" when the final-page document sheet (that will be first fed in the copying machine of the present embodiment) is set onto the document glass 29 on condition that the number of document sheets is an odd number in the two-in-one mode. As a result of these processes, if the LED 1050*a* is turned off (i.e., the hit-and-stop mode has been set) and if the stop position adjustment mode is not set and if the one-sheet setting flag is set to "0", then the operations of SS5-3-105 through SS5-3-107 are executed. Otherwise, the operations of SS5-3-108 through SS5-3-111 are executed.

The thin-paper flag is reset to "0" at SS5-3-1040 and the counters P02, P04, and P08 for specifying the document feed amount are set to $(L/2+\alpha/2)$, $(L+\alpha)$, and $(SB-\alpha/2)$ at SS5-3-105, SS5-3-1060 and SS5-3-107, respectively. Meanwhile, the thin-paper flag is set to "1" at SS5-3-108, and the document feed amount counters P02, P04, and P08 are L/2, L, and SB at SS5-3-109, SS5-3-110, and SS5-3-111, respectively. It is noted that SB represents the number of pulses required for the stepping motor to once switch back the first-sheet document in the two-in-one mode. As SB is increased, the interval between the rear end of the first-sheet document and the front end of the second-sheet document is reduced; conversely, as SB is decreased, the interval is lengthened. That is, the document sheets are conveyed on the document glass with a larger interval between the rear end of the first sheet and the front end of the second sheet in the hit-and-stop mode, than in the thin-paper mode.

Now that the number of pulses of the main motor M3 for specifying the document feed amount has been set in the above way, the counters P02 and the like are corrected according to different types of ADF at SS5-3-112. More specifically, the document feed amount counter P02 for the one-sided mode, the document feed amount counter P04 for one-sided large-size documents, the document feed amount counter P014 for reversing the document in the double-side mode, and the document feed amount P08 required for a switchback are updated to (P02+ADJ1/2), (P04+ADJ1), (P014−ADJ2), and (P08−ADJ3), respectively. It is noted that the counter correction amounts ADJ1, ADJ2, and ADJ3 are inputted from the copying machine main body 1 (see FIG. 68). As seen above, even in the normal mode (hit-and-stop mode), when the final-page document sheet alone is set onto the document glass in the case of an odd number of document sheets, the operation enters the document feed control process based on pulse control, so that the document can be stopped accurately at a position where no scale is present.

<Paper Feed>

Figure 61:
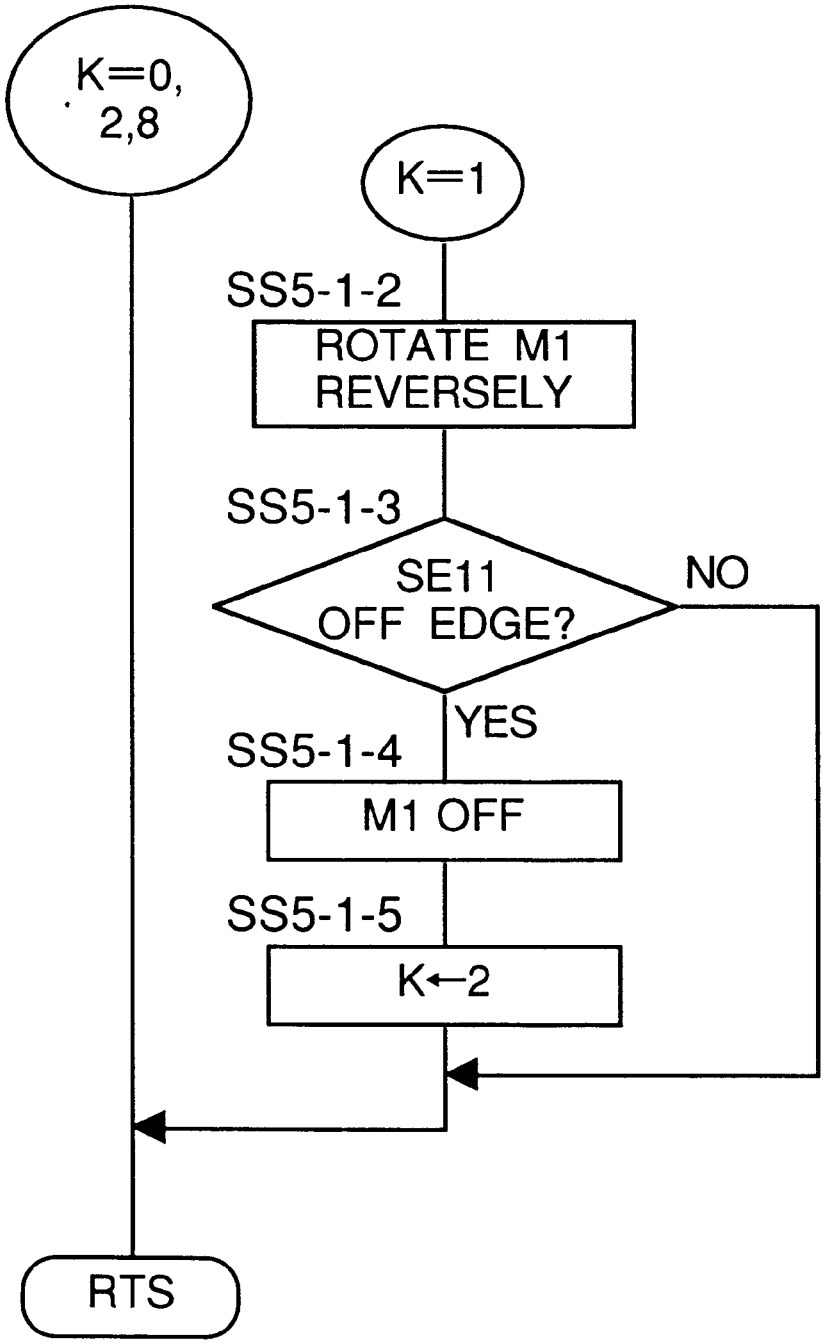
FIG. 61 is a flow chart showing a subroutine for paper feed subsequent to FIG. 60.
Figure 62:
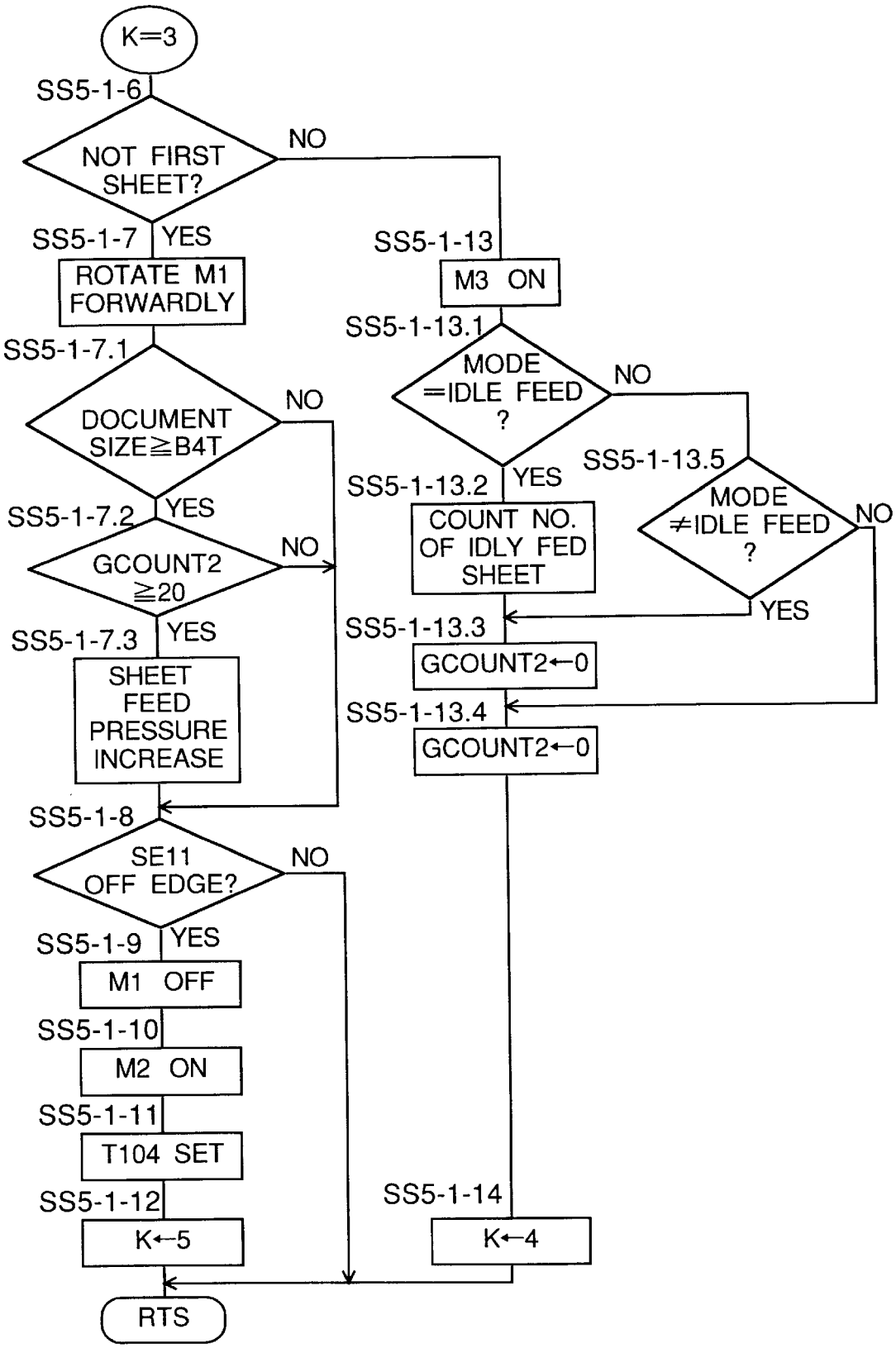
FIG. 62 is a flow chart showing a subroutine for paper feed subsequent to FIG. 60.

FIGS. 60 through 66 show a paper feed subroutine to be executed at SS5-1. In this subroutine, the paper feed status K is checked at SS5-1, and the following operations are executed based on the resulting values "0" to "8". If the status K is "1", the front-end restricting plate 81 and the pressing plate 84 are moved to their home positions. In more detail, as shown in FIG. 61, the pickup motor M1 is rotated reverse at SS5-1-2, and it is decided at SS5-1-3 whether or not the cam sensor SE11 that detects the home positions of the front-end restricting plate 81 and the pressing plate 84 is at the OFF EDGE. The home position of the front-end restricting plate 81 is a restricting position (the position as shown in FIG. 3) for the document, while the home position of the pressing plate 84 is a press-releasing position (the position as shown in FIG. 10B) for the document. If the cam sensor SE11 has been verified at SS5-1-3 to be at the OFF EDGE and the completion of the movement of both the front-end restricting plate 81 and the pressing plate 84 to the home position has been detected, the pickup motor M1 is turned off at SS5-1-4 and the status K is set to "2" at SS5-1-5.

If the status K is "2", then nothing is processed. If the status K is "3", then the front-end restricting plate 81 is hold to the withdrawal position while the pressing plate 84 is moved downward to impart a feed pressure to the document.

More specifically, it is decided at SS5-1-6 whether or not the document is the first sheet. If it is not the first sheet document, the front-end restricting plate 81 is in the withdrawal position while the pressing plate 84 is in the release position. Therefore, the pickup motor M1 is rotated forward at SS5-1-7. In this case, if it is decided at SS5-1-7.1 that the document size is B4T or greater, and if it is decided at SS5-1-7.2 that the value of the counter GCOUNT showing the number of the copied document is 20 or more, then the motor 105 for the feed-pressure variable motor M8 is driven so that the sheet feed pressure is preliminarily increased. Then, it is decided at SS5-1-8 whether or not the cam sensor SE11 is at the OFF EDGE. With the front-end restricting plate 81 held in the withdrawal position, when the pressing plate 84 presses the front end of the document against the pickup roller 83, the cam sensor SE11 detects this event. Therefore, when the cam sensor SE11 is verified at SS5-1-8 to be at the OFF EDGE, the pickup motor M1 is turned off at SS5-1-9 and the feed motor M2 is turned on at SS5-1-10 to feed the document. Further, the timer T104 is set at SS5-1-11, and the status K is set to "5" at SS5-1-12.

Meanwhile, if the document is decided at SS5-1-6 to be the first sheet, then the main motor M3 is turned on at SS5-1-13 and it is decided at SS5-1-1.1 whether or not the MODE is the idle feed mode. If it is the idle feed mode, the number of sheets to be idly fed is counted at SS5-1-13.2. The number of sheets to be idly fed is counted by subtracting the number of return sheets specified by the copying machine main body from the number of copied sheets (the value of the counter GCOUNT2). Subsequently, the counter GCOUNT2 is reset to "0" at SS5-1-13.3, the GCOUNT is reset to "0" at SS5-1-13.4, and thereafter the status K is set to "4" at SS5-1-14.

Figure 63:
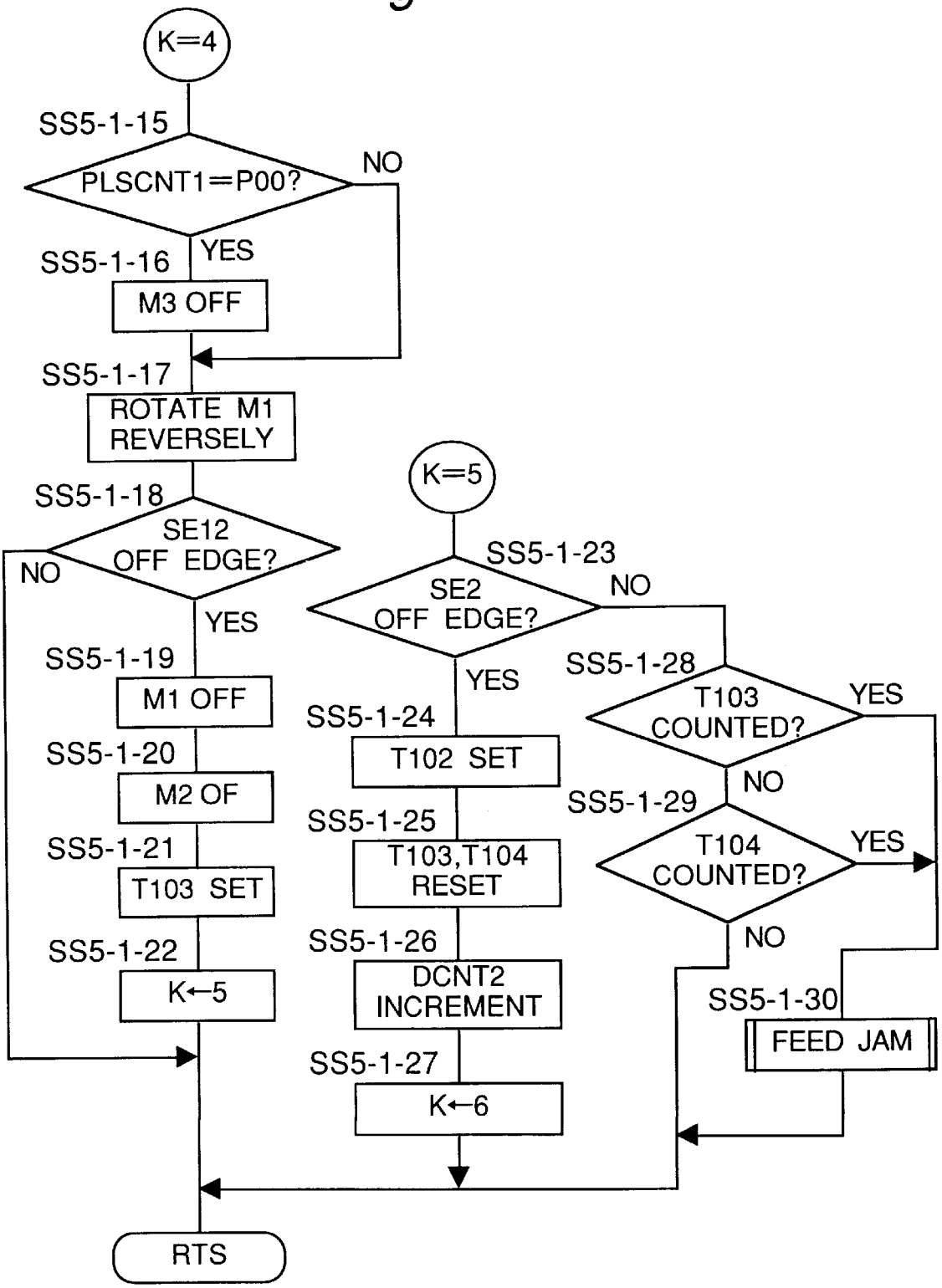
FIG. 63 is a flow chart showing a subroutine for paper feed subsequent to FIG. 60.
Figure 64:
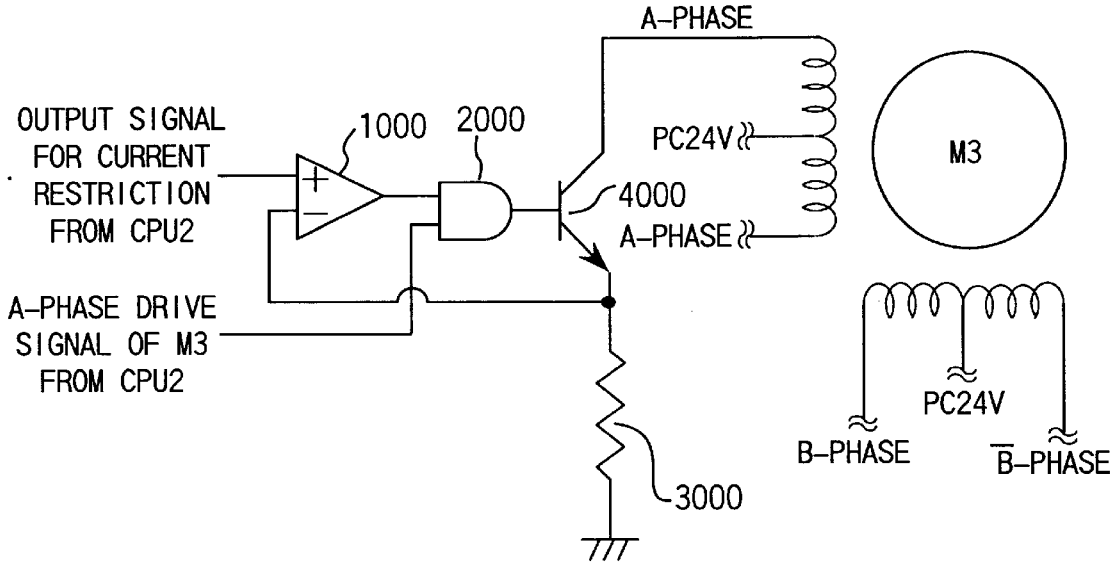
FIG. 64 is a circuit diagram of the main motor (stepping motor)
Figure 65:
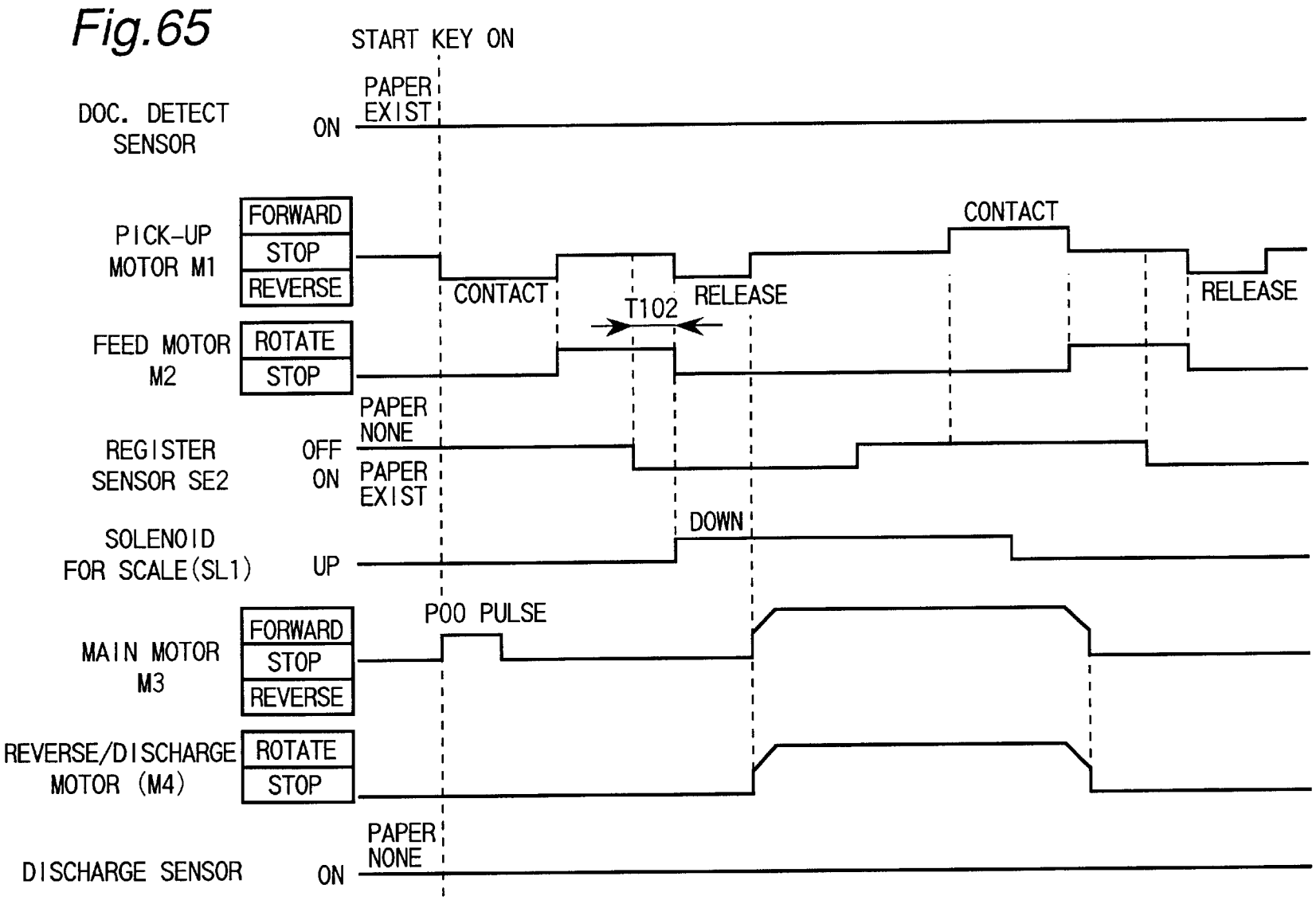
FIG. 65 is a time chart showing the control of the main motor (stepping motor)

As shown in FIG. 63, if the status K is "4", since the document is the first sheet, the main motor M3 is adjusted in phase and the pickup motor M1 is rotated to move the front-end restricting plate 81 and the pressing plate 84 from the home position to the pressing position. Particularly, at SS5-1-15, the main motor (stepping motor) M3 is kept rotating for a specified period, and it is decided whether or not the processes of phase-adjusting the main motor M3 and canceling any backlash of the driving system have been completed. In this connection, the circuit of the main motor M3 is shown in FIG. 64. In this circuit, the main motor M3 is arranged to be rotated with drive signals fed in the order of A phase 6 A' phase 6 B phase 6 B' phase, and a current control output and an A-phase drive signal of the main motor M3 are given by the CPU2. The current value of the current control output is inputted to a comparator 1000, where it is compared to a specified current value set by a resistor 3000. Then, when the value of the current control output is large (+), an "H" signal is generated from the comparator 1000. Subsequently, the signal is ANDed with the A-phase drive signal of the main motor (stepping motor) M3 by an AND gate 2000, where if the drive signal is also on, or "H", then a drive current is fed to the A phase by a transistor 4000. Although only the circuit diagram for feeding an ON signal to the A phase is shown as an example in this figure, yet the case is the same also with A' phase, B phase, and B' phase, where a drive signal is passed in the order of A phase 6 A' phase 6 B phase 6 B' phase, causing the main motor M3 to be driven to rotate. However, when the rotating shaft of the main motor M3 is forcedly rotated because of jam processing or the like so that the main motor M3 is run starting with, for example, A' phase or B' phase, the motor rotating shaft is once rotated reverse to turn back to A phase or B phase and starts forward rotation therewith, in which case the number of pulses fed to the main motor M3 and its feed amount would result in a mismatch. Also, the driving system, which is equipped with a multiplicity of gears and toothed belts and others, moves from a state that backlashes of the gears and the like have been cleared, into normal rotating operation at the time of start. Thus, at SS5-1-15, the main motor M3 is first driven before the start of document feed operation, where it is decided whether or not the count value of the pulse counter PLSCNT1 has reached a value (P00) necessary to solve any variation in feed amount due to the reverse rotation of the main motor M3 and backlashes of the driving system. When the pulse counter PLSCNT1 has reached P00, the main motor M3 is stopped (SS5-1-16). Therefore, the count value P00 must be a value necessary for the phase adjustment of the main motor M3 and the solving of the backlashes of the driving system. For example, as shown in FIG. 65, when the start switch of the copying machine is turned on, it is desirable to give the main motor M3 at least four pulses of rotation because the present main motor M3 is of two phase excitation. In the case of one-two phase excitation, eight or more pulses are necessary.

Next, at SS5-1-17, the pickup motor M1 is rotated reverse so that the front-end restricting plate 81 is moved down to the withdrawal position, and that the pressing plate 84 is moved down to the pressing position. When an edge 149*b* of a disc 149 is detected by the OFF EDGE of the cam sensor SE12 at SS5-1-18, the pickup motor M1 is stopped at SS5-1-19. Thereby, the movement of the front-end restricting plate 81 to the withdrawal position and the movement of the pressing plate 84 to the pressing position are completed. Then, the feed motor M2 is driven at SS5-1-20 so that the document is conveyed forward, the timer T103 is set at SS5-1-21, and the status K is set to "5" at SS5-1-22, where the program returns. The timer T103 functions to detect whether or not the document has jammed by detecting whether or not the document fed from the document tray 60 has reached the register sensor SE2 provided at the position of the register roller 8 within a specified time. The timer T104 that has been set at SS5-1-11 is a similar jam-detecting timer, but their timer values are such that T104<T103, the value for the first sheet being set a little longer. This setting is based on the fact that although the front end of the first-sheet document is positioned at the front-end restricting plate 81, the second and following sheets have been fed more or less in accompaniment up to near the nip portion of the separating roller 85 and the separating pad 86. This arrangement prevents the possibility that paper jams would be caused frequently due to too short a timer value for the first sheet, or that the document would be damaged because of too short a timer value for the second and following sheets.

If the status K is "5", it is decided at SS5-1-23 whether or not the document has been conveyed to the position of the register rollers 89 by detecting the ON EDGE of the register sensor SE2 (i.e., there is a document). Another timer T102 is set at SS5-1-24 in which the ON EDGE is detected. The timers T103, T1040 are reset at SS5-1-25, and the document counter DCNT2 is incremented. The status K is changed to "6" at SS5-1-27. Meanwhile, if the document has not been detected at SS5-1-23, it is decided at SS5-1-28 and SS5-1-29 whether or not the timers T103 and T104 have expired, respectively. If the timers have expired, it is decided at SS5-1-30 that there has occurred a paper jam.

Figure 66:
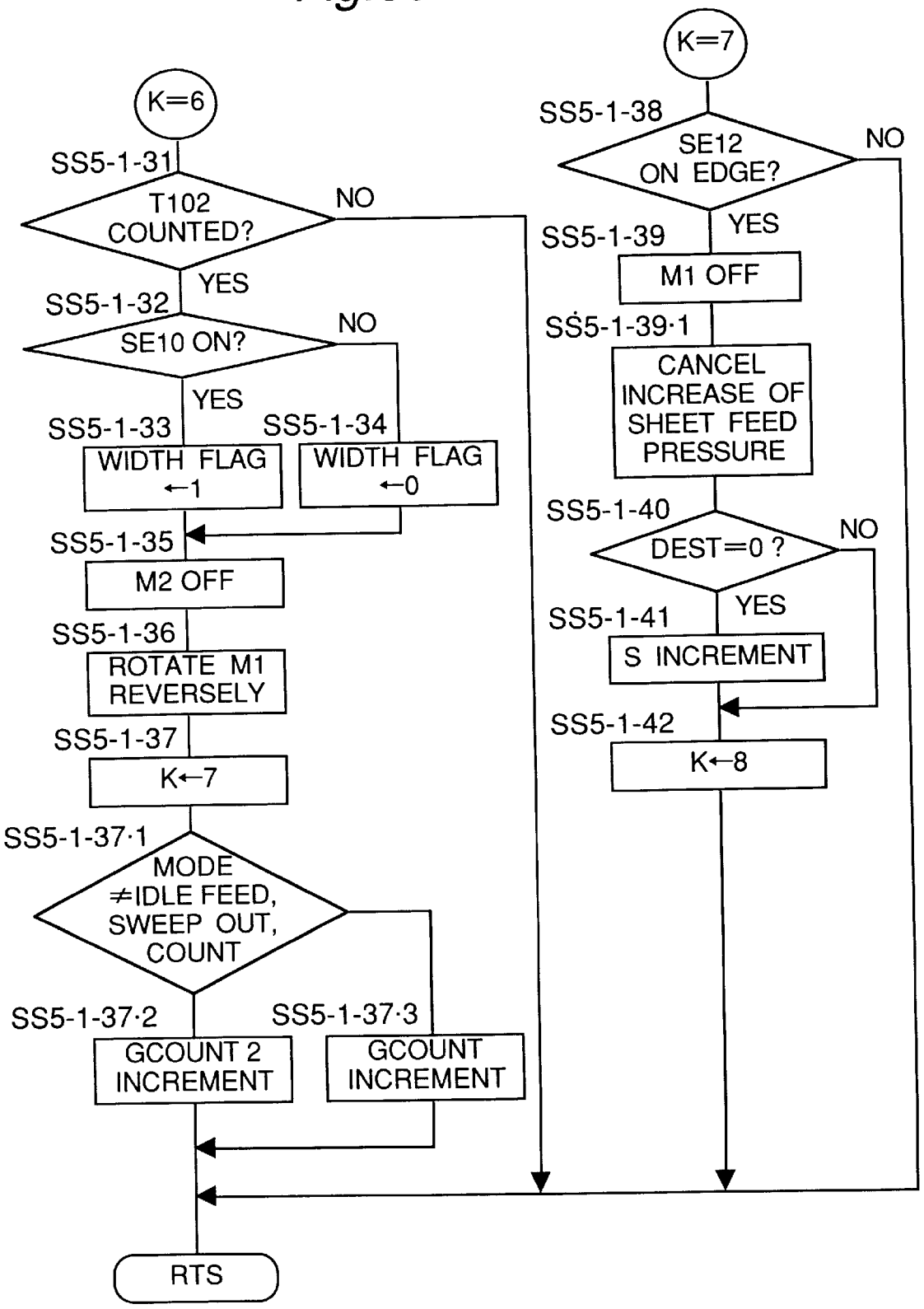
FIG. 66 is a flow chart showing a subroutine for paper feed subsequent to FIG. 60.

If the status K is "6", it is confirmed at SS5-1-31 whether or not the timer T102 has counted up, as shown in FIG. 66. At a time point when the timer T102 expires, the document has formed a loop with its front end in contact with the nip portion of the register rollers. Then, if the timer T102 has been confirmed to have expired, it is decided at SS5-1-32 whether the width sensor SE10 has been turned on or off. The width sensor SE10 is intended to detect the width of a fed document (i.e. the size of the document in a direction perpendicular to the conveyance direction of the document). If it has been turned on, the width flag is set to "1" at SS5-1-33; if it has been turned off, the width flag is reset to "0" at SS5-1-34. Subsequently, the feed motor M2 is turned off at SS5-1-35, and the pickup motor M1 is rotated reverse at SS5-1-36. As a result, only the pressing plate 84 starts to move upward to the press-releasing position. In this operation, the end restricting plate 81 remains in the withdrawal position. Further, the status K is set to "7" at SS5-1-37. If it is decided at SS5-1-37.1 that it is the count mode, the idle feed mode or the sweep-out mode, then the counter GCOUNT is incremented at SS5-1-37.1; if not, the counter GCOUNT2 is incremented at SS5-1-37.2.

If the status K is "7", the movement of the pressing plate 84 upward to the press-releasing position, which has been commenced at the previous process when the status K is "6", is completed. If the cam sensor SE12 has been confirmed at SS5-1-38 to be at the ON EDGE, the pickup motor M1 is turned off at SS5-1-39 and moreover the feed pressure variable motor M8 for the feed pressure variable mechanism is driven to cancel the increase in the sheet feed pressure. Subsequently, it is decided at SS5-1-40 whether or not the flag DSET is "0". This flag DSET will be set to "1" when the document is set to the exposure position. Only when the flag DSET is "0", a set status S is incremented at SS5-1-41. Further, the status K is set to "8" at SS5-1-42.

<Prestep Set>

Figure 67:
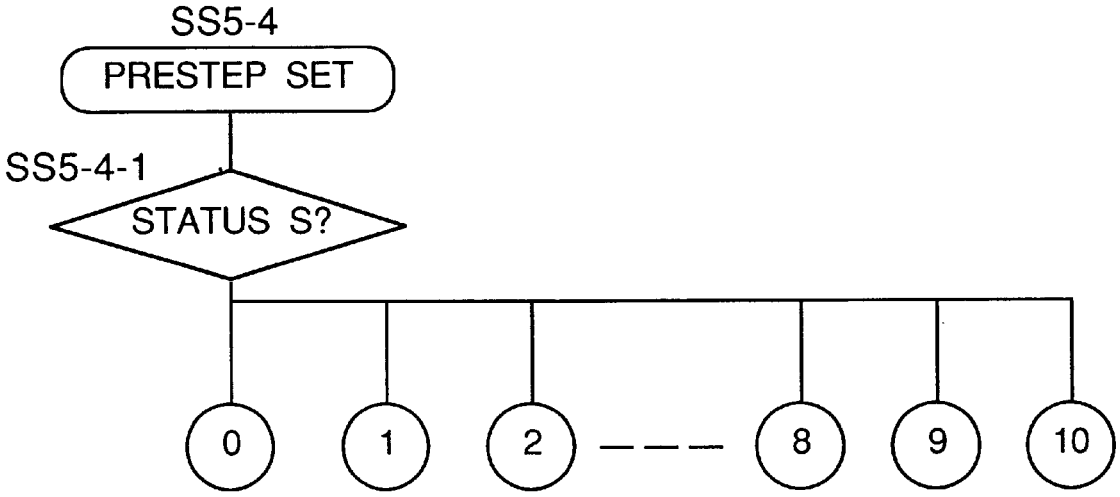
FIG. 67 is a flow chart showing a subroutine for prestep setting in the CPU 2.

FIGS. 67 through 78 show a prestep set subroutine to be executed at SS5-4. In this subroutine, the document fed at the feed subroutine of previous SS5-1 is set at the exposure position on the document glass 29. As shown in FIG. 67, the set status S is checked at SS5-4-1, and the following operations are executed based on the resulting values "0" to "10".

Figure 68:
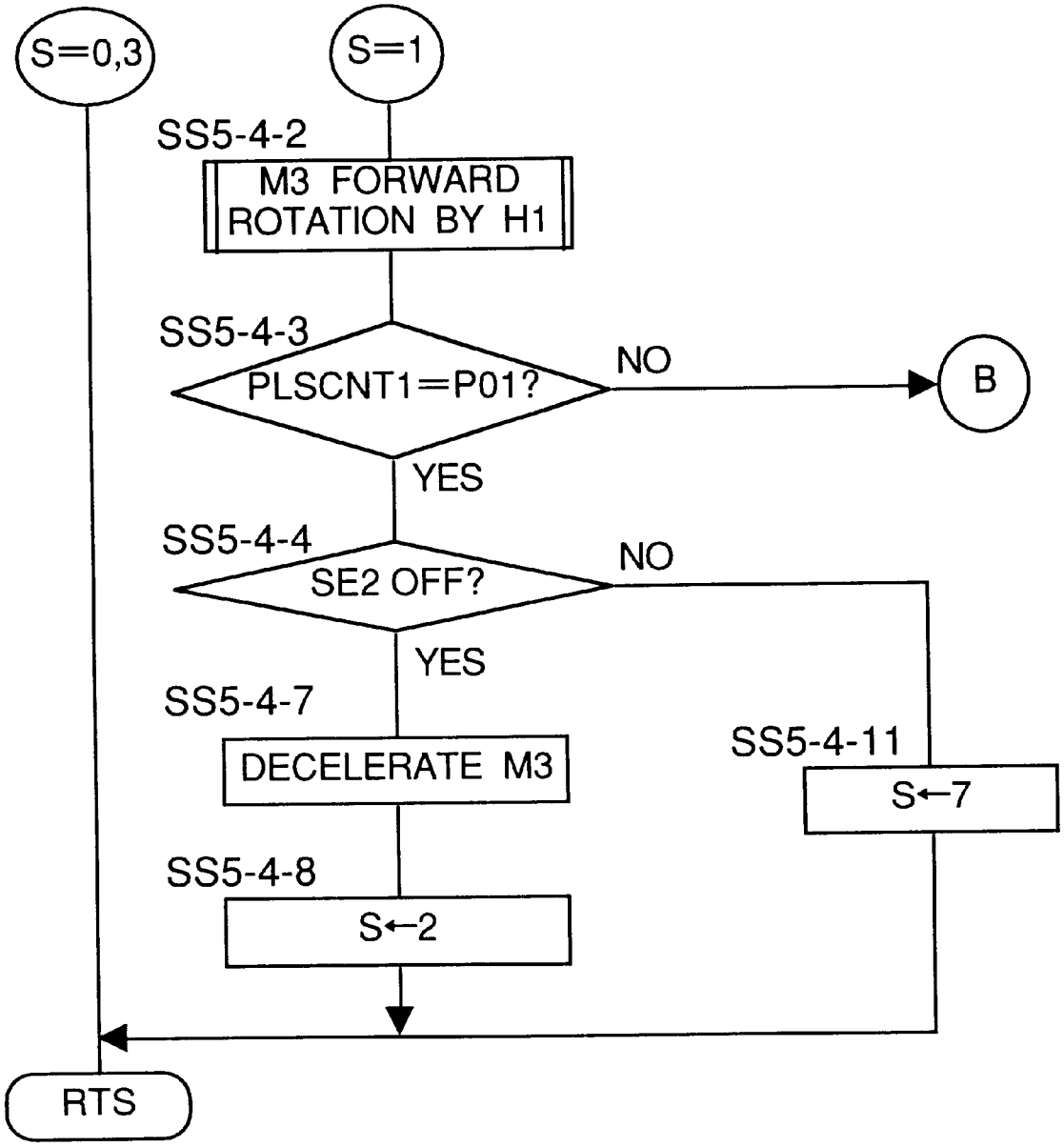
FIG. 68 is a flow chart showing a subroutine for prestep setting subsequent to FIG. 67.

As shown in FIG. 68, if the set status S is "0" or "3", nothing is processed. If the set status S is "1", the main motor M3 is rotated forward at high speed at SS5-4-2. As a result, the document is fed from the register rollers 89 onto the document glass 29 at high speed. Then, it is decided at SS5-4-3 whether or not the pulse counter PLSCNT1 has counted the pulse P01. If the pulse counter PLSCNT1 has counted the pulse P01, it is decided at SS5-4-4 whether or not the register sensor SE2 is off. If the register sensor SE2 is off, i.e. when the rear end of the document passes through register sensor SE2, the main motor M3 is reduced in speed at SS5-4-7 to slow down the conveyance speed of the document. Thereafter, the status S is set to "2" at SS5-4-8. Meanwhile, if the register sensor SE2 has been turned on, the status S is set to "7" at SS5-4-11.

Figure 69:
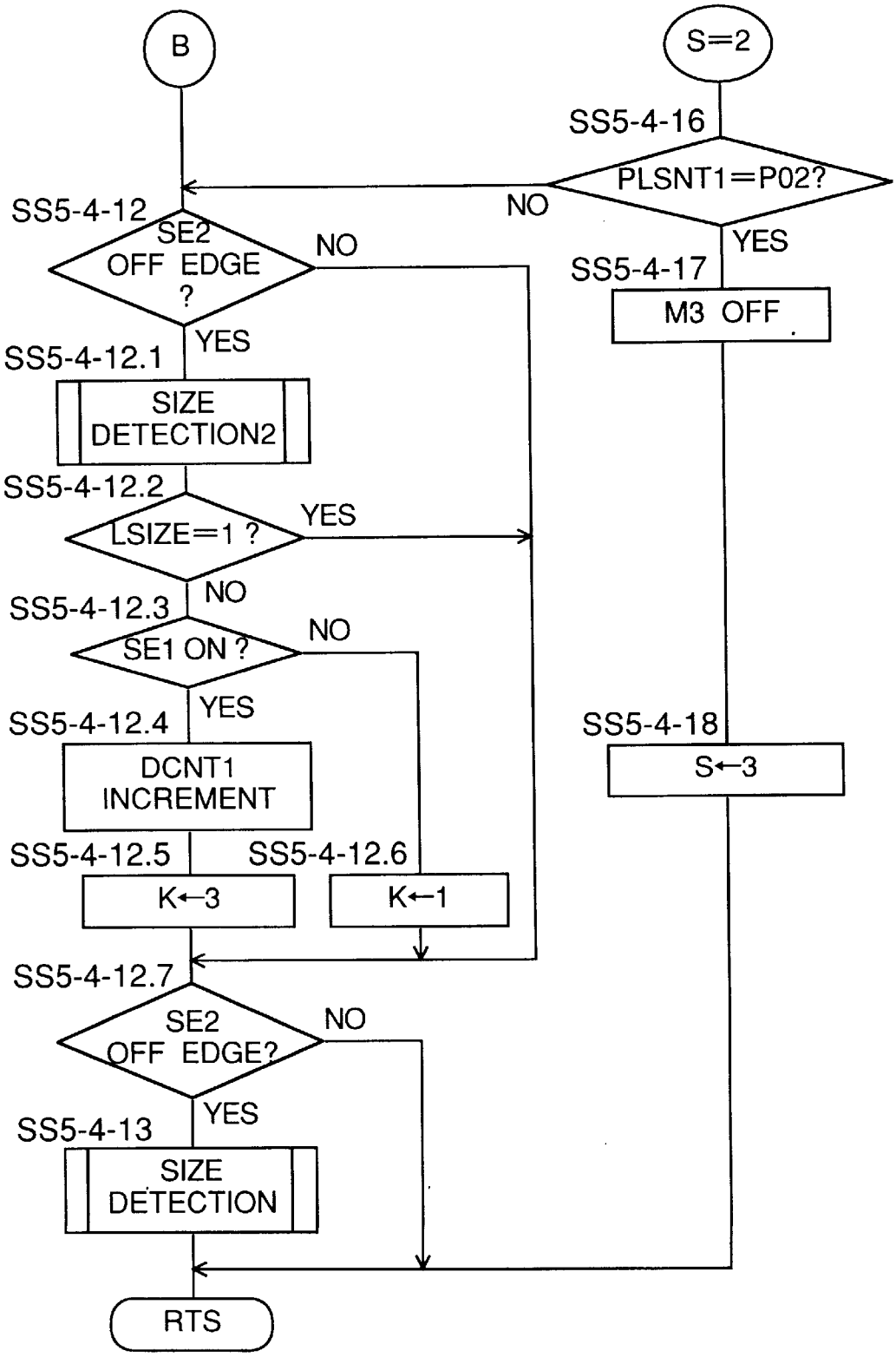
FIG. 69 is a flow chart showing a subroutine for prestep setting subsequent to FIG. 67.

Meanwhile, in the case where the pulse counter PLSCNT1 is counting the pulse P01 (NO at SS5-4-3), as shown in FIG. 69, if the feed sensor SE9 is confirmed at SS5-4-12 to be at the OFF EDGE, size detection 2 is executed at SS5-4-12.1, and it is decided at SS5-4-12.2 whether or not the flag LSIZE is "1". If the flag LSIZE is not "1", it is decided at SS5-4-12.3 whether or not the empty sensor SE1 is on. If the empty sensor SE1 is on, i.e. when a next document to be fed exist at the feed port 61, the counter DCNT1 is incremented at SS5-4-12.4 and thereafter the status K is set to "3" at SS5-4-12.5 to feed the next document. If the empty sensor SE1 is not on, i.e. when all of the next document are fed and none of the next document exist at the feed port 61, the status K is set to "1" at SS5-4-12. 6. Next, it is decided at SS5-4-12.7 whether or not the register sensor SE2 has detected an OFF EDGE. If it has detected, the document size is detected at SS5-4-13, where the program returns; if not, the program returns as it is. Meanwhile, if the flag LSIZE is "1" at SS5-4-12.2, it is decided at SS5-4-12.7 whether or not the register sensor SE2 has detected an OFF EDGE. If it has detected, the document size is detected at SS5-4-13, where the program returns; if not, the program returns as it is.

Figure 70:
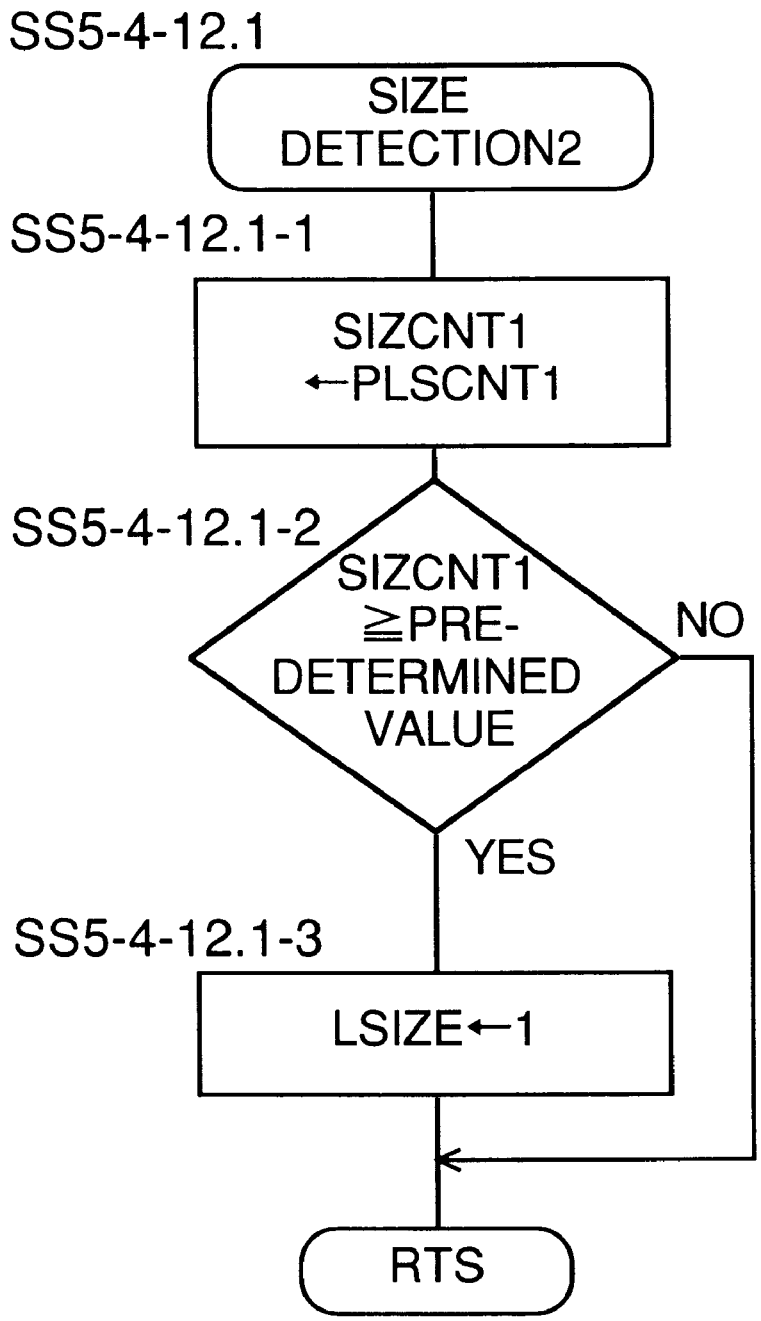
FIG. 70 is a flow chart showing a subroutine for size detection 2 of FIG. 69.

In the size detection 2 at SS5-4-12.1, as shown in FIG. 70, the value of the pulse counter PLSCNT1, which is the number of conveyance pulses of the main motor M3 up to the current time point, i.e. until the document have passed through the register sensor SE2, is read to the SIZCNT1 at SS5-4-12.1-1 and compared with a specified value at SS5-4-12.1-2. The specified value means a number of pulses corresponding to the short edge of the letter size. As a result of the comparison, if it has been decided to be the predetermined value or more, i.e. when the length of the document in the conveyance direction is longer than the short edge of the letter size, the document is decided as the large size, i.e. LSIZE=1, at SS5-4-12.1-3.

If the status S is "2", it is decided at SS5-4-16 whether or not the pulse counter PLSCNT1 has counted the P02, as shown in FIG. 69. The pulse P02 is a number of pulses needed to convey the document by a distance L/2. Therefore, if the pulse counter PLSCNT1 has counted the pulse P02 (when the front end of the document has reached the intermediate position IP), the main motor M3 is turned off at SS5-4-17 to stop the conveyance of the document, and the status S is set to "3" at SS5-4-18. If the pulse counter PLSCNT1 is counting the pulse P02, the above-mentioned SS5-4-12 to SS5-4-13 are processed.

Figure 71:
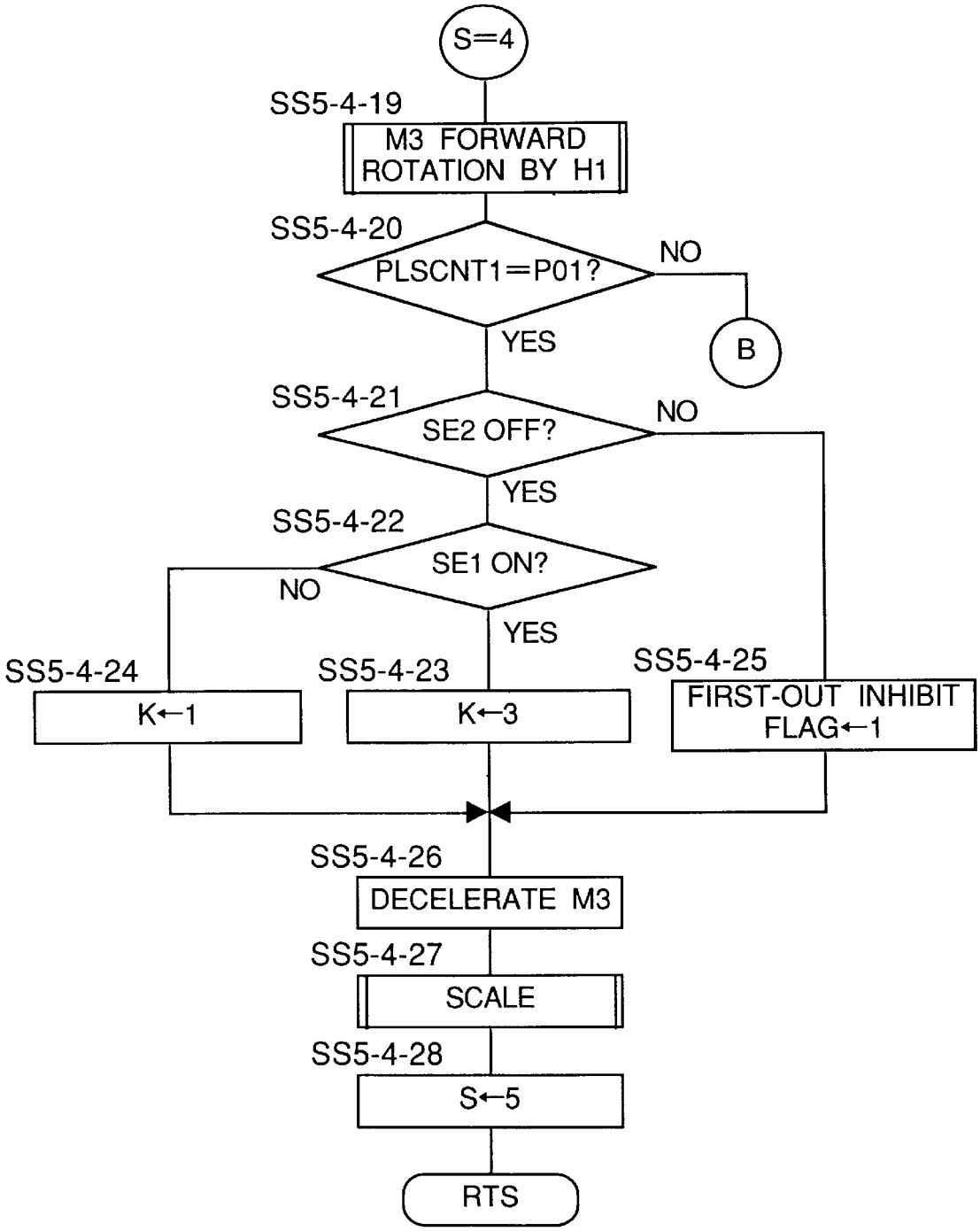
FIG. 71 is a flow chart showing a subroutine for prestep setting subsequent to FIG. 67.

If the set status S is "3", nothing is processed as shown in FIG. 68. As shown in FIG. 71, if the status S is "4" (on completion of first-out feed of the next document sheet), the main motor M3 is rotated forward at high speed at SS5-4-19. As a result of this operation, the preceding document sheet is conveyed to the exposure position and the succeeding document sheet is conveyed to the prestep position. Then, if the pulse counter PLSCNT1 has been decided at SS5-4-20 to have counted the pulse P01, it is decided at SS5-4-21 whether or not the register sensor SE2 is off, and at SS5-4-22 whether or not the empty sensor SE1 is on. If the register sensor SE2 is off while the empty sensor SE1 is on, i.e., if the succeeding document sheet is small size and there is a document sheet left on the tray 61, then the status K is set to "3" at SS5-4-23, the main motor M3 is reduced in speed at SS5-4-26, the scale 125 is protruded at SS5-4-27 (in the case of the scale mode), and the status S is set to "5" at SS5-4-28.

Meanwhile, if the register sensor SE2 is on, the succeeding document sheet is large size. Therefore, a first-out inhibit flag is set to "1" at SS5-4-25, and the above-mentioned operations of SS5-4-26 to -28 are processed. If the empty sensor SE1 is off, there is no document sheet left. Therefore, the feed status K is set to "1" at SS5-4-24, and the above-mentioned operations of SS5-4-26 to -28 are processed. If the pulse counter PLSCNT1 is counting the pulse P01 (NO at the above SS5-4-20), then the operations of SS5-4-12 to -15 are processed and the size of the succeeding document sheet is detected.

Figure 72:
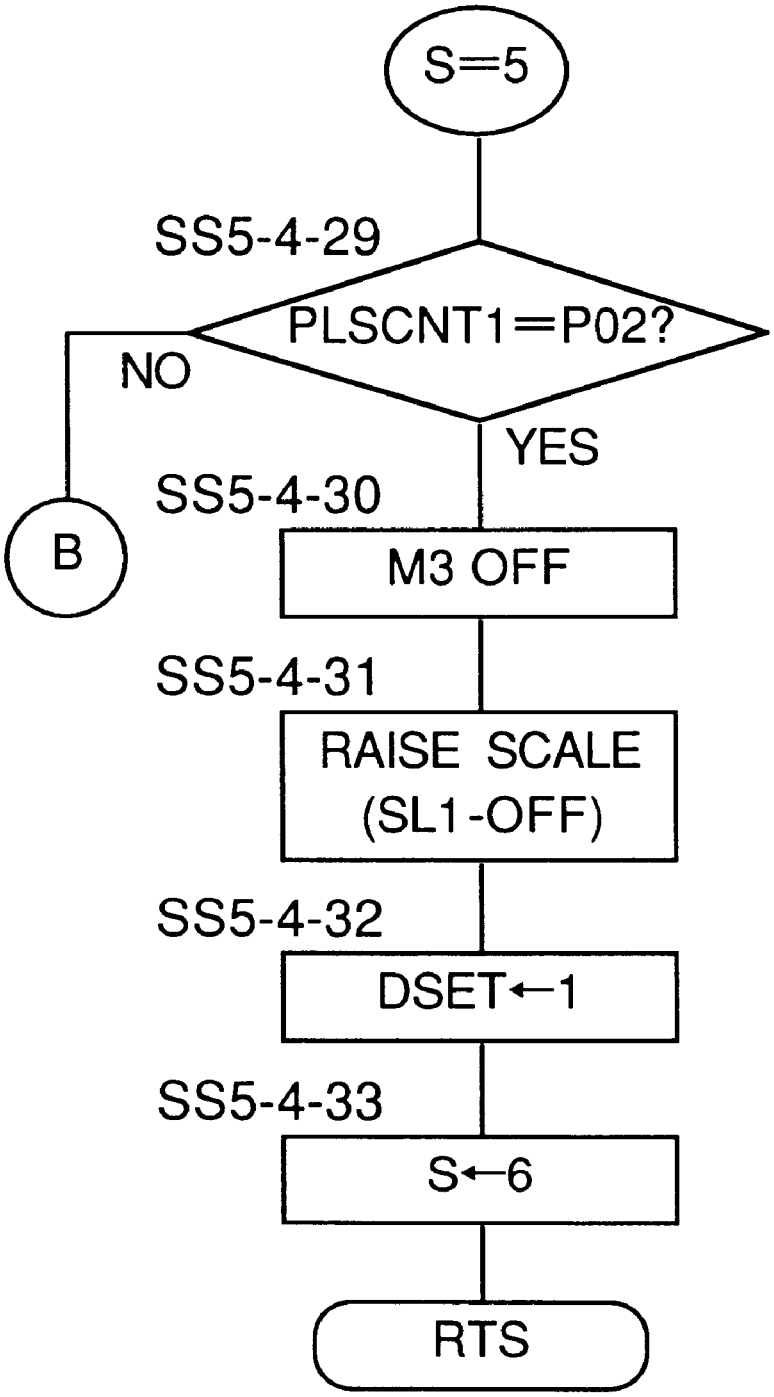
FIG. 72 is a flow chart showing a subroutine for prestep setting subsequent to FIG. 67.

If the set status S is "5", it is decided at SS5-4-29 whether or not the pulse counter PLSCNT1 has counted the pulse P02, as shown in FIG. 72. If it is YES, i.e., if the front end of the preceding document has reached the exposure standard position SP while the front end of the succeeding document has reached the intermediate position IP, then the main motor M3 is turned off at SS5-4-30. Subsequently, the scale 125 is moved up by the solenoid SL1 at SS5-4-31, a flag DSET is set to "1" at SS5-4-32, and the status S is set to "6" at SS5-4-33. The flag DSET, when set to "1", represents that the document has been set at the exposure position, the flag being transmitted to the CPU1. In the copying machine main body 1, when this flag DSET is "1", the scanning operation of the optical system 20 becomes possible. If the PLSCNT1 is counting the pulse P02, the above-mentioned operations of SS5-4-12 to -15 are processed.

Figure 73:
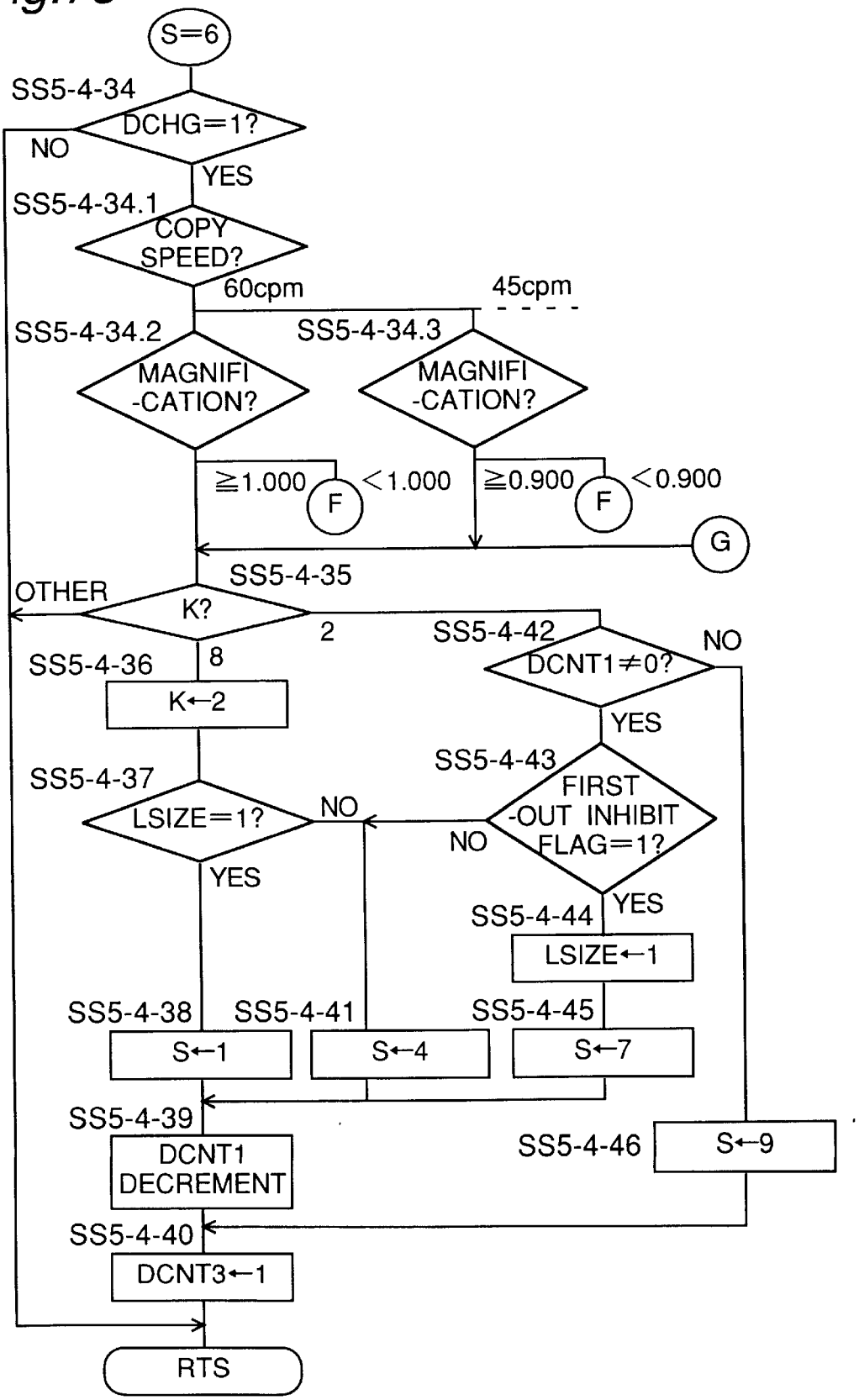
FIG. 73 is a flow chart showing a subroutine for prestep setting subsequent to FIG. 67.

If the set status S is "6", it is decided at SS5-4-34 whether or not the flag DCHG is "1" as shown in FIG. 73. Then, only when it is "1", the following operations are executed. The flag DCHG is transmitted from the CPU1 of the copying machine main body 1 in order to request a document replacement to the ADF 2.

If the flag DCHG is "1", the copy speed is checked at SS5-4-34.1 and the magnification is checked at SS5-4-34.2 and SS5-4-34.3 for each speed. If the copy speed is 60 cpm and the copying magnification is not less than 1, or if the copy speed is 45 cpm and the copying magnification is not less than 0.9, then the following operations are executed. The value of the status K is checked at SS5-4-35. In this example, only when the value of the status K is "2" or "8", the following operations are executed. If the status K is "8" (if the succeeding document sheet has already been first-out fed), the status K is set to "2" at SS5-4-36, and it is decided at SS5-4-37 whether or not the flag LSIZE is "1". If the flag LSIZE is "1" (if a large-size document sheet has been fed), then the status S is set to "1" at SS5-4-38, the counter DCNT1 is decremented at SS5-4-39, and the counter DCNT3 for counting the number of document sheets to be discharged is set to "1" at SS5-4-40. If the flag LSIZE is "0" (if a small-size document sheet has been fed), then the status S is set to "4" at SS5-4-41, and the above-mentioned operations of SS5-4-39 to -40 are processed.

If the status K has been decided at SS5-4-35 to be "2" (a state in which the succeeding document has not been fed, i.e., there is no succeeding document or it is in the first-out feed state), then it is decided at SS5-4-42 whether or not the counter DCNT1 is "0". If the DCNT1 is "0", it is decided at SS5-4-43 whether or not a first-out inhibit flag is "1". If the first-out inhibit flag is "1", then the flag LSIZE is set to "1" at SS5-4-44, the status S is set to "7" at SS5-4-45, and the above-mentioned operations of SS5-4-39 to -40 are processed. If the first-out inhibit flag is "0", then the above-mentioned operations of SS5-4-41 and SS5-4-39 to -40 are processed. If the counter DCNT is not "0", then the status S is set to "9" at SS5-4-46 and the operation of SS5-4-40 is processed.

Figure 74:
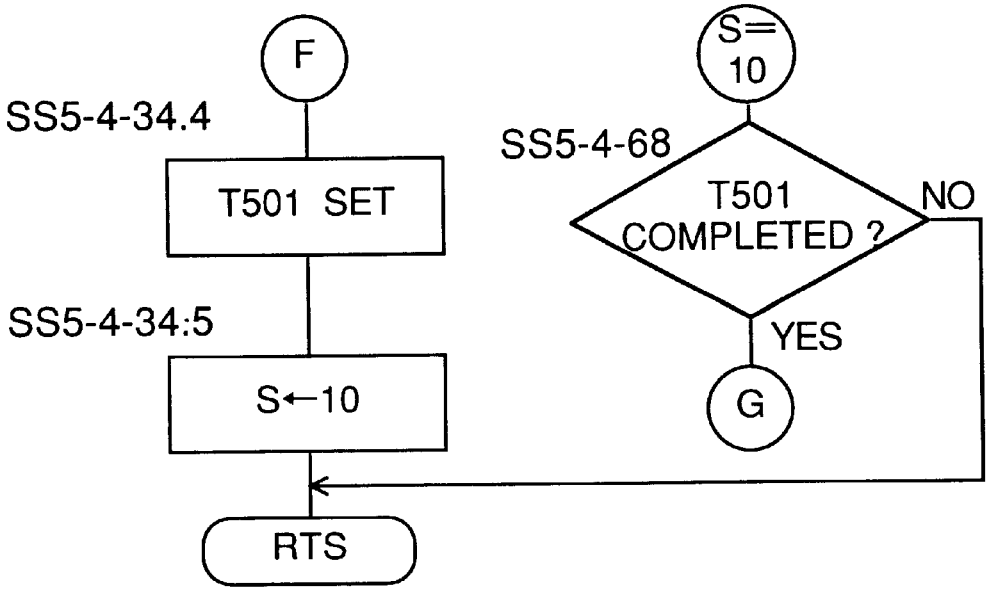
FIG. 74 is a flow chart showing a subroutine for prestep setting subsequent to FIGS. 67 and 73.

As a result of confirmation of the copy speed and the magnification at SS5-4-34.1 to SS5-4-34.3, if the copy speed is 60 cpm and the magnification is less than 1 or if the copy speed is 45 cpm and the magnification is less than 0.9, then the timer T501 is set at SS5-4-34.4, the status S is set to "10" at SS5-4-34.5, and the program returns, as shown in FIG. 74. The timer T501 is purposed to provide timing from an end of scan to a start of document replacement.

In the case where the status S is "10", as shown in FIG. 74, if the T501 has completed the count at SS5-4-68, the foregoing steps of SS5-4-35 through SS5-4-46 in FIG. 73 are processed.

Figure 75:
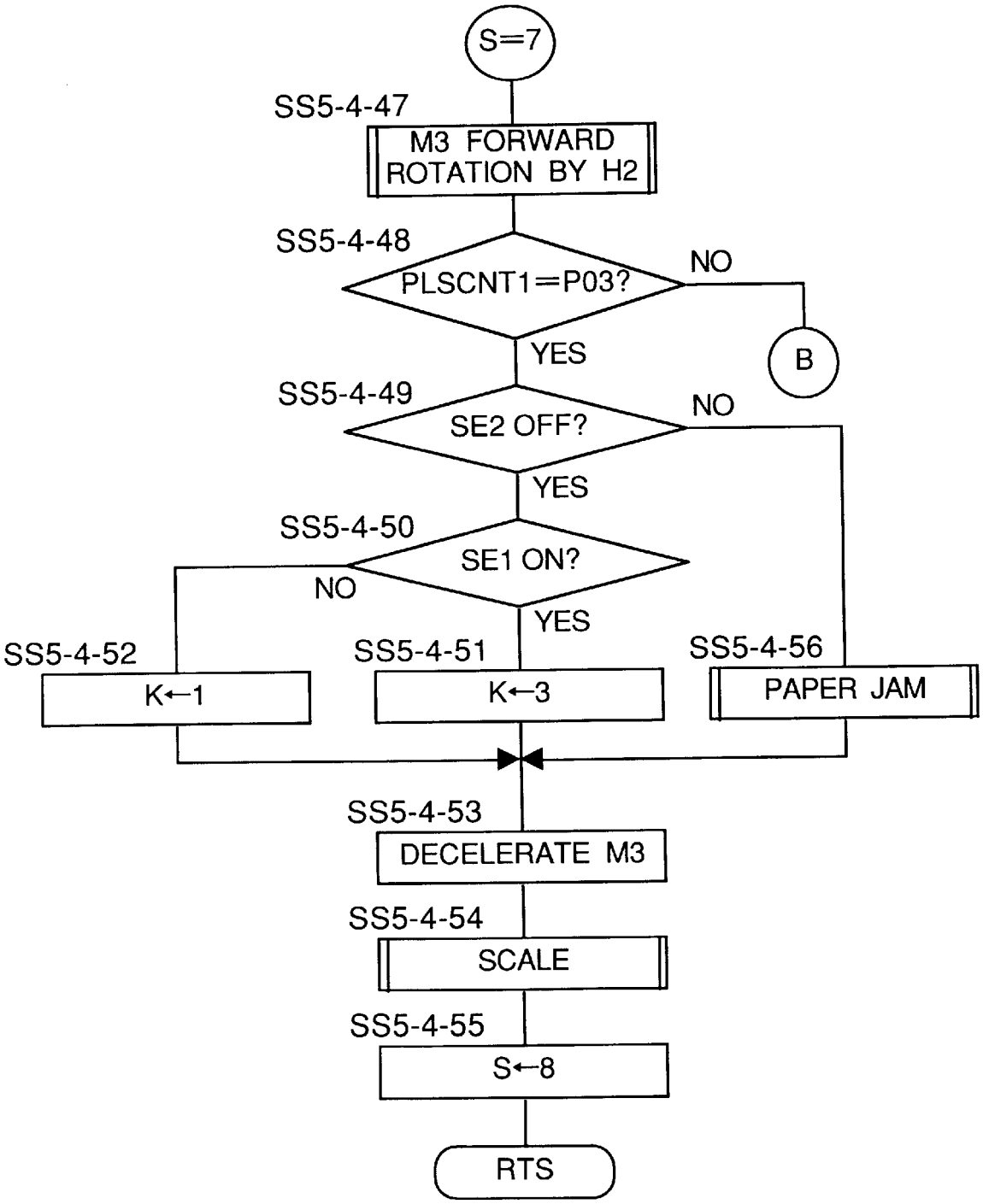
FIG. 75 is a flow chart showing a subroutine for prestep setting subsequent to FIG. 67.

If the status S is "7", then the main motor M3 is rotated forward at high speed at SS5-4-47 as shown in FIG. 75. As a result, the large-size document sheet is conveyed from the intermediate position IP. Then, it is decided at SS5-4-48 whether or not the pulse counter PLSCNT1 has counted the pulse P03. If the pulse counter PLSCNT1 has counted the pulse P03, it is decided at SS5-4-49 whether or not the register sensor SE2 is off, and at SS5-4-50 whether or not the empty sensor SE1 is on. If the register sensor SE2 is off while the empty sensor SE1 is on, i.e. in the case that the rear end of the document has passed through the register sensor SE2 and the next document sheet are set at the feed port, then the status K is set to "3" at SS5-4-51 for feeding the next document sheet. Further, the main motor M3 is reduced in speed at SS5-4-53, the scale 125 is protruded at SS5-4-54 (in the scale mode), and the status S is set to "8" at SS5-4-55.

If the register sensor SE2 has been turned on, then the rear end of the large-size document sheet has not yet passed the register rollers 89. Therefore, a paper jam is processed at SS5-4-56. Also, if the empty sensor SE1 is off, there is no succeeding document. Therefore, the status K is set to "1" at SS5-4-52, and the above-mentioned operations of SS5-4-53 to -55 are processed. If the pulse counter PLSCNT1 is counting the pulse P03 (NO at SS5-4-48), the operations of SS5-4-12 to -15 are processed and the size of the document is detected.

Figure 76:
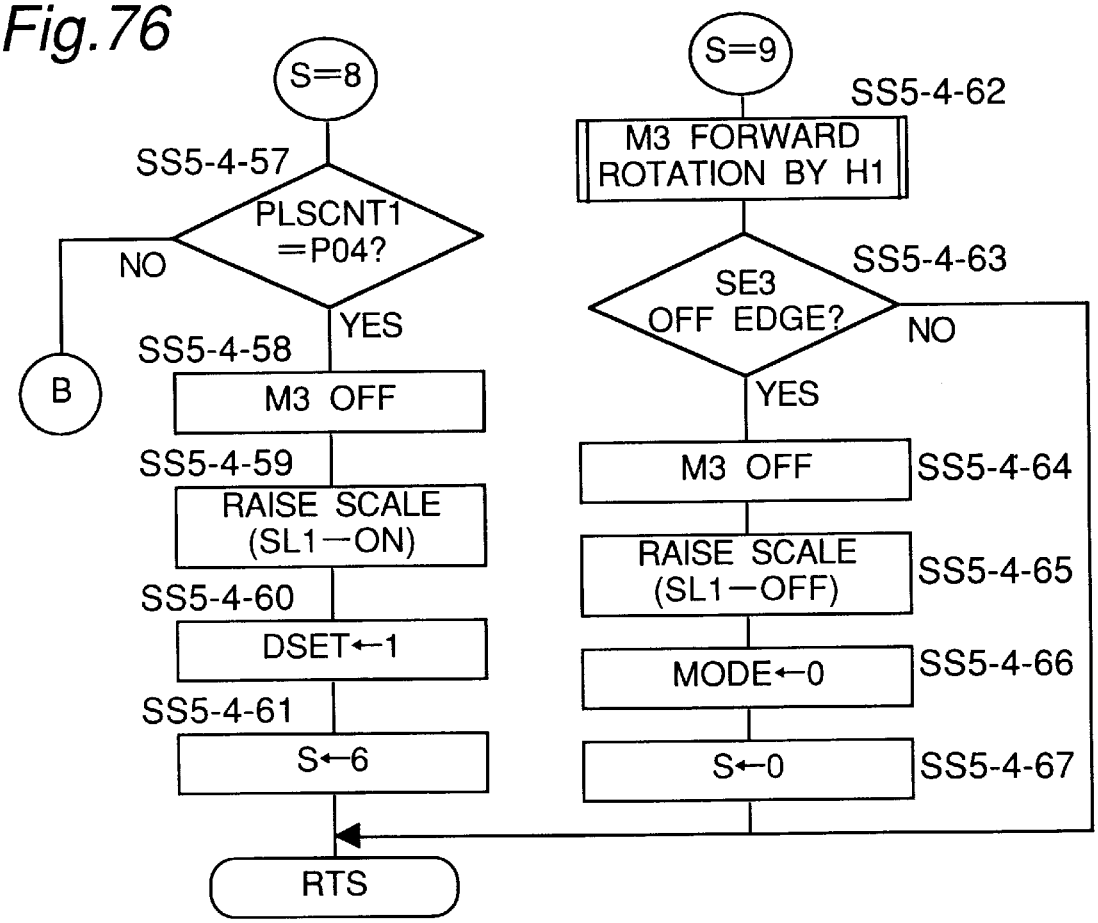
FIG. 76 is a flow chart showing a subroutine for prestep setting subsequent to FIG. 67.

If the status S is "8", it is decided at SS5-4-57 whether or not the pulse counter PLSCNT1 has counted the pulse P04, as shown in FIG. 76. If it is YES, i.e., if the front end of the large-size document has reached the exposure standard position SP, then the main motor M3 is turned off at SS5-4-58. Subsequently, the solenoid SL1 is turned on at SS5-4-59 so that the scale 125 is protruded upward from the upper surface of the document glass 29, the flag DSET is set to "1" at SS5-4-60, and the status S is set to "6" at SS5-4-61. If the pulse counter PLSCNT1 is counting the pulse P04, then the above-mentioned operations of SS5-4-53 to -55 are processed.

If the status S is "9", the main motor M3 is rotated forward at high speed at SS5-4-62. As a result, the document is discharged from the exposure position. Then, when the discharge sensor SE3 is confirmed at SS5-4-63 to be at the OFF EDGE, i.e., when the rear end of the document is separated from the conveyor belt 123, the main motor M3 is turned off at SS5-4-64, and the solenoid SL1 is turned off at SS5-4-65 so that the scale 125 is moved up. Subsequently, the MODE is reset to "0" at SS5-4-66, and the status S is reset to "0" at SS5-4-67.

Here is explained the detection of a paper jam in the prestep mode. If the status S is "1", a paper jam will not be processed even if the register sensor SE2 is on (i.e., even if NO at SS5-4-4). However, if the status S is "7", a paper jam will be processed if the register sensor SE2 has been turned on after the document is conveyed up to an extent of the pulse P03 (NO at SS5-4-49). More specifically, the pulse P03 is set slightly shorter than the distance L, such that a NO decided at SS5-4-49 means that the document is longer than L (500 mm) or that the document stays in proximity to the register rollers 89 due to some conveyance fault. Such a case is detected to be a paper jam. Further, if the status S is "4", the first-out inhibit flag is set to "1" even if the register sensor SE2 is on (NO at SS5-4-21), but a paper jam will not be processed. Through the above processes, the document can be successfully conveyed even if large-size document sheets are mixedly set on the tray 61 in the prestep mode.

<Scale>

Figure 77:
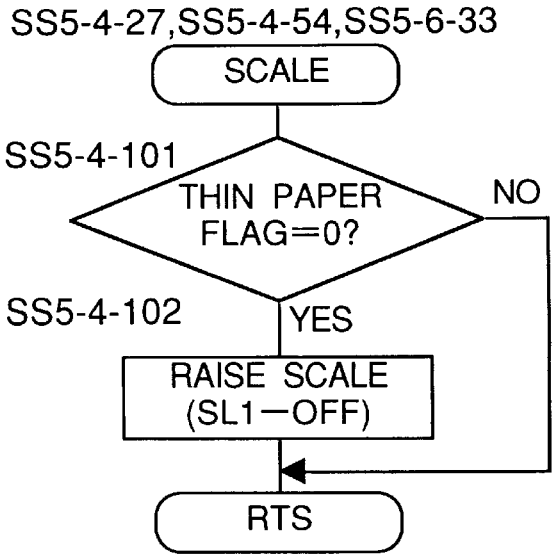
FIG. 77 is a flow chart showing a subroutine for scale in the CPU 2.

FIG. 77 shows a subroutine for the scale (SS5-4-27, SS5-4-54, SS5-6-33). In this subroutine, it is decided at SS5-4-101 whether or not the thin-paper flag is "0". If it is "0" (if the scale mode has been selected), the solenoid SL1 is turned on at SS5-4-102 so that the scale 125 is slightly protruded above the document glass 29, whereby the document is forcedly stopped at the exposure standard position SP.

<Main Motor High-Speed Rotation>

Figure 78:
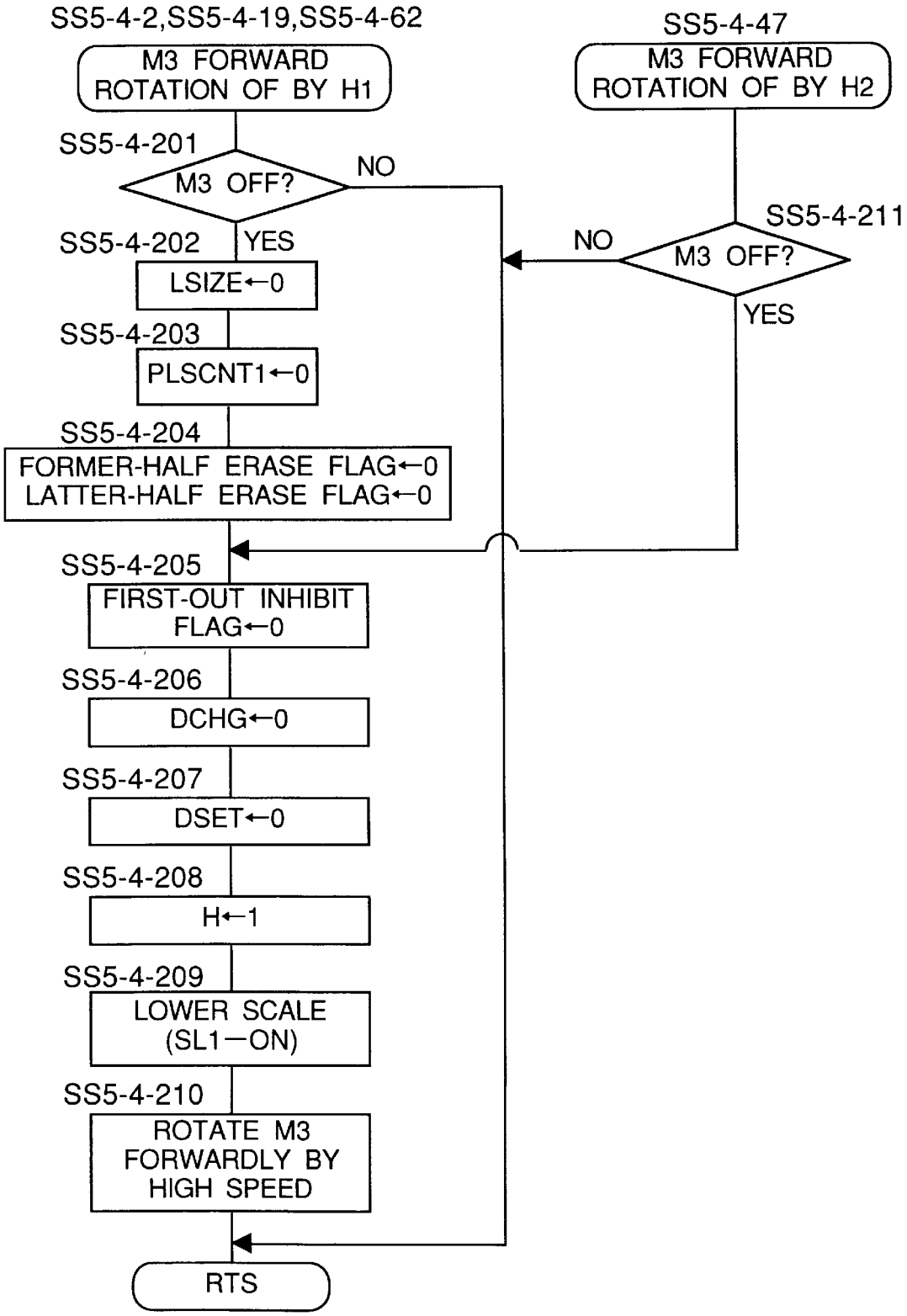
FIG. 78 is a flow chart showing a control subroutine for the main motor in the prestep setting.

FIG. 78 shows a subroutine for high-speed forward rotation of the main motor M3 to be executed in the main motor high-speed rotation (SS5-4-2, SS5-4-19, SS5-4-62, and ss5-4-47). In this subroutine, it is decided at SS5-4-201 and at SS5-4-211 whether or not the main motor M3 has been turned off. If it has already been turned on, this subroutine is terminated immediately. If the main motor has been decided at SS5-4-201 to have been turned off, i.e., if the set status S is "1", "4", and "9", then the flag LSIZE is reset to "0" at SS5-4-202, the pulse PLSCNT1 is reset to "0" at SS5-4-203, and the first- and second-half erase flags are reset to "0" at SS5-4-204. Subsequently, the first-out inhibit flag is reset to "0" at SS5-4-205, the flag DCHG is reset to "0" at SS5-4-206, and the flag DSET is reset to "0" at SS5-4-207. Further, a discharge status H is set to "1" at SS5-4-208, the solenoid SL1 is turned on at SS5-4-209 so that the scale 125 is moved down, and the main motor M3 is set to the high-speed forward rotation at SS5-4-210, permitting an interrupt. Each time this interrupt is permitted, the main motor M3 is driven, where the pulse counter PLSCNT1 and the pulse counter PLSCNT2 count. Meanwhile, if the main motor M3 has been decided at SS5-4-211 to have been turned off, i.e., if the set status S is "7", the above-mentioned operations of SS5-4-205 to -210 are processed.

<Two-in-One Mode>

Figure 79:
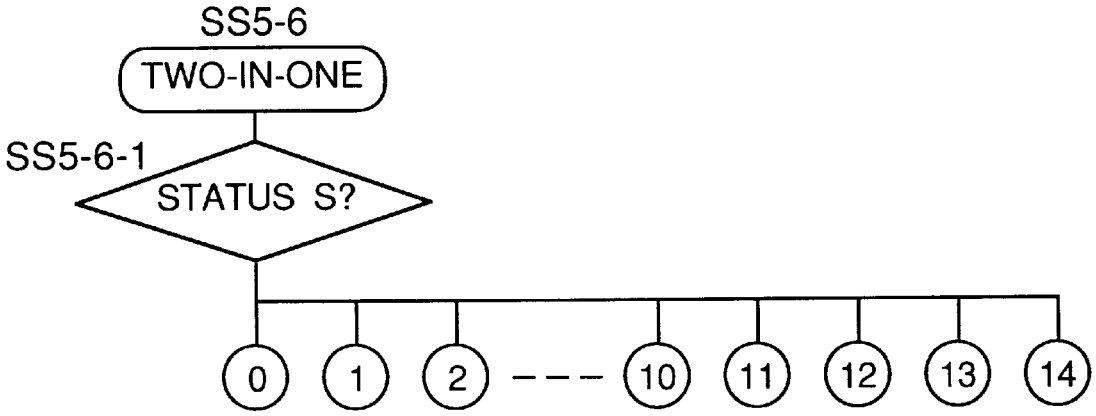
FIG. 79 is a flow chart showing a subroutine for two-in-one setting in the CPU 2.
Figure 80:
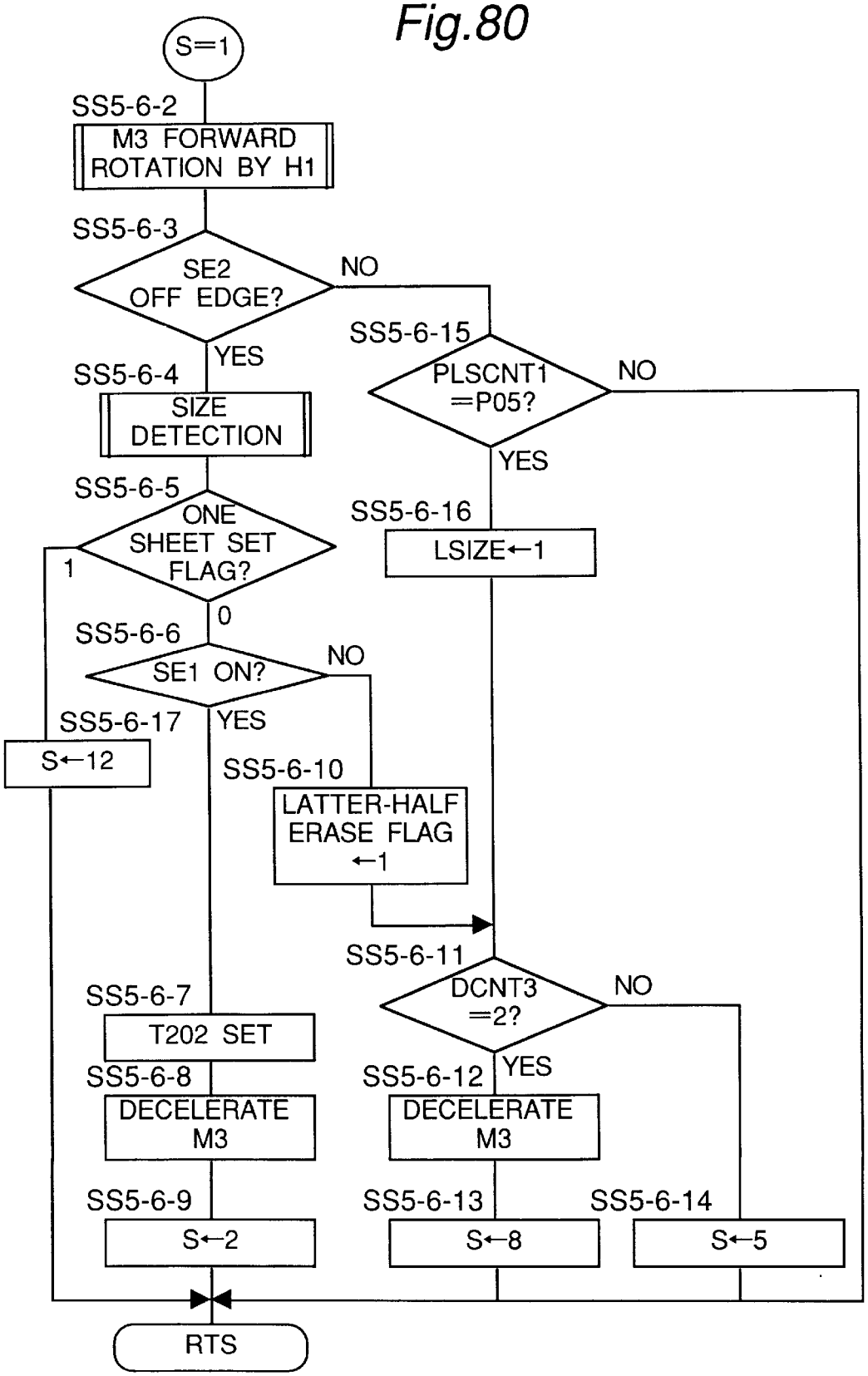
FIG. 80 is a flow chart showing a subroutine for the two-in-one setting subsequent to FIG. 79.

FIGS. 79 through 89 show a two-in-one set subroutine to be executed at SS5-6. In this subroutine, the document fed at the previous feed subroutine of SS5-1 is set at the exposure position on the document glass 29. As shown in FIG. 79, the status S is checked at SS5-6-1 and the following operations are executed based on the resulting values "0" through "14". If the status S is "0", nothing is processed. As shown in FIG. 80, if the status S is "1" (paper feed is completed), the main motor M3 is rotated forward at high speed at SS5-6-2. As a result, the document is fed from the register rollers 89 onto the document glass 29. Then, it is decided at SS5-6-3 whether or not the register sensor SE2 is at the OFF EDGE. If it is at the OFF EDGE (if the rear end of the document has passed the detection point of the register sensor SE2), the size of the document is detected at SS5-6-4. Next, a one-sheet set flag is decided at SS5-6-5. If the one-sheet set flag is "0", it is decided at SS5-6-6 whether or not the empty sensor SE1 is on. If the register sensor SE2 is at the OFF EDGE while the empty sensor SE1 is on, i.e., if the document fed is small size and the succeeding document sheet is left on the tray 60, then the timer T202 for feeding the succeeding document sheet is set at SS5-6-7, the main motor M3 is reduced in speed at SS5-6-8, and the status S is set to "2" at SS5-6-9.

Meanwhile, if the empty sensor SE1 has been decided at SS5-6-6 to be off, i.e., if only one sheet of the last document, which has been provided totally in an odd number of sheets, is left as a result of paper feeding, then there is no succeeding document sheet so that the second-half erase flag is set to "1" at SS5-6-10. The second-half erase flag designates the erasing of charges on the photosensitive drum 10 on the second-half scanning area of the optical system 20 in the two-in-one mode. Subsequently, it is decided at SS5-6-11 whether or not the counter DCNT3 is "2". If it is "2", i.e., if two document sheets to be discharged are present on the document glass 29, the main motor M3 is reduced in speed at SS5-6-12 and the status S is set to "8" at SS5-6-13. If the counter DCNT3 is not "2", the status S is set to "5" at SS5-6-14.

If the register sensor SE2 has been decided at SS5-6-3 not to be at the OFF EDGE, it is decided at SS5-6-15 whether or not the pulse counter PLSCNT1 has counted the pulse P05. The pulse P05 is a number of pulses larger than the number of pulses to be counted until the small-size document passes the register sensor SE2. If the PLSCNT1 counts up to the number before the register sensor SE2 is turned off, then the document is large size and therefore the flag LSIZE is set to "1" at SS5-6-15 and the above-mentioned operations of SS5-6-11 to -13 or operation of SS5-6-14 are processed. If the one-sheet set flag is decided at SS5-6-5 to be "1", i.e., if the document, which is previously known to be provided in an odd number of sheets as a result of the document count or the like, is small size, then the status S is set to "12" at SS5-6-17.

If the status S is "2", it is decided at SS5-6-18 whether or not the timer T202 has completed the count. After completion of the count, if the status K has been decided at SS5-6-19 to be "2", then the status K is set to "3" at SS5-6-20, whereby the succeeding document is started to be first-out fed. If the timer T202 has not completed the count, or if the status K is not "2" even if the timer has completed, then it is decided at SS5-6-21 whether or not the pulse counter PLSCNT2 has counted the pulse P07. If the pulse counter PLSCNT2 has counted the pulse P07, then the main motor M3 is changed to the low-speed reverse rotation at SS5-6-22. At this point, the document starts to switch back. Then, the status S is set to "3" at SS5-6-23.

Figure 82:
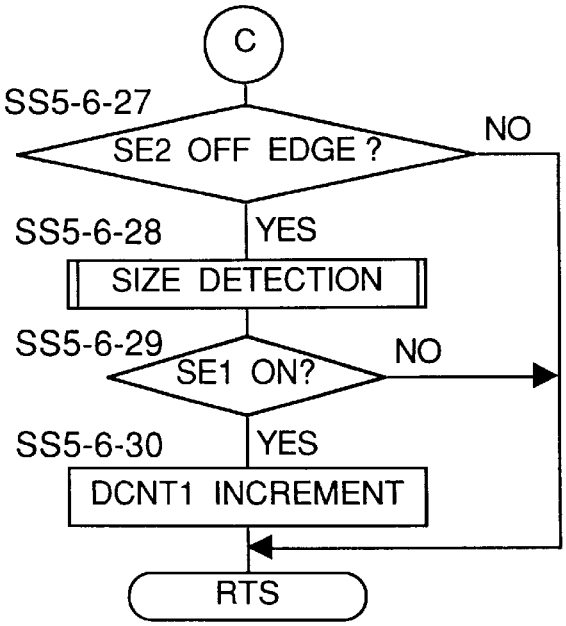
FIG. 82 is a flow chart showing a subroutine for the two-in-one setting subsequent to FIG. 79.

In the case where the pulse counter PLSCNT2 has been decided at SS5-6-21 to be counting the pulse P07, as shown in FIG. 82, if the register sensor SE2 is confirmed to be at the OFF EDGE at SS5-6-27, the size of the document to be then fed onto the document glass 29 is detected at SS5-6-28. Subsequently, if the empty sensor SE1 is decided at SS5-6-29 to be on (if a document sheet remains left on the tray 60), then the counter DCNT1 is incremented at SS5-6-30.

Figure 81:
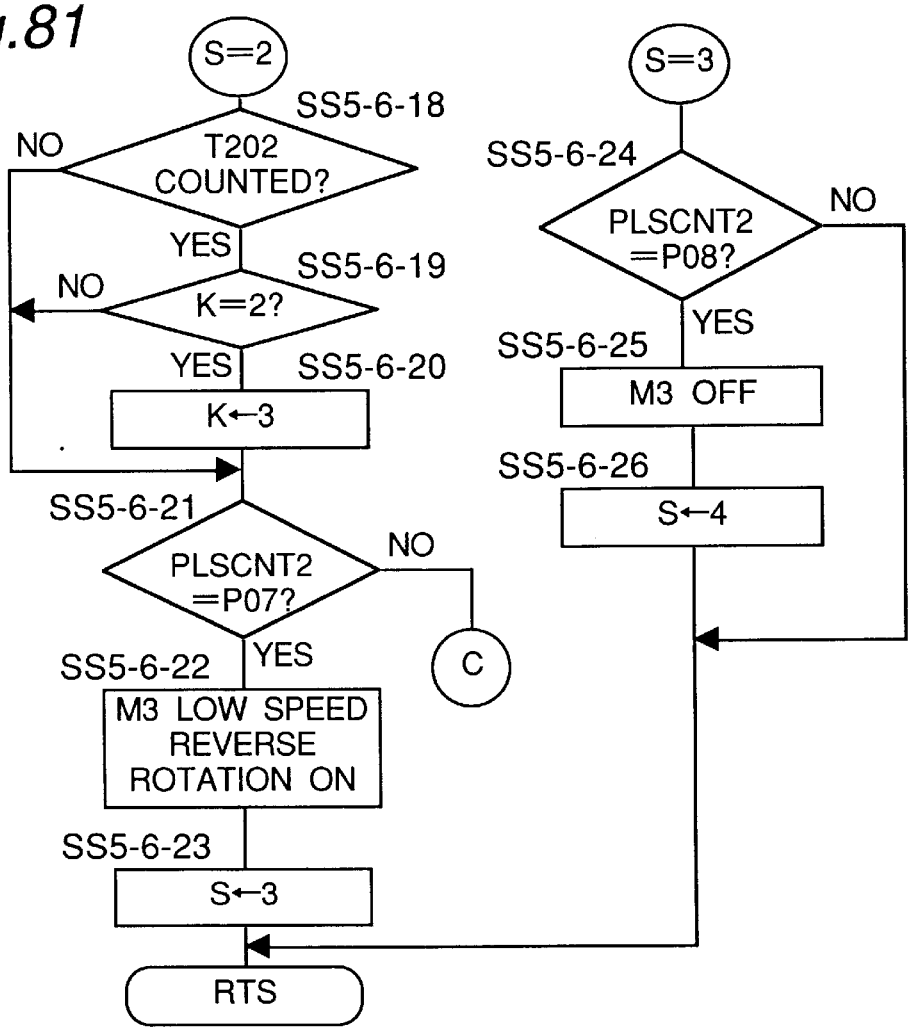
FIG. 81 is a flow chart showing a subroutine for the two-in-one setting subsequent to FIG. 79.

If the status S is "3", it is decided at SS5-6-24 whether or not the pulse counter PLSCNT2 has counted the pulse P08, as shown in FIG. 81. If it has completed the count, the main motor M3 is turned off at SS5-6-25. As a result, the document is finished being switched back. Then, the status S is set to "4" at SS5-6-26. If the status S is "4", nothing is processed.

Figure 83:
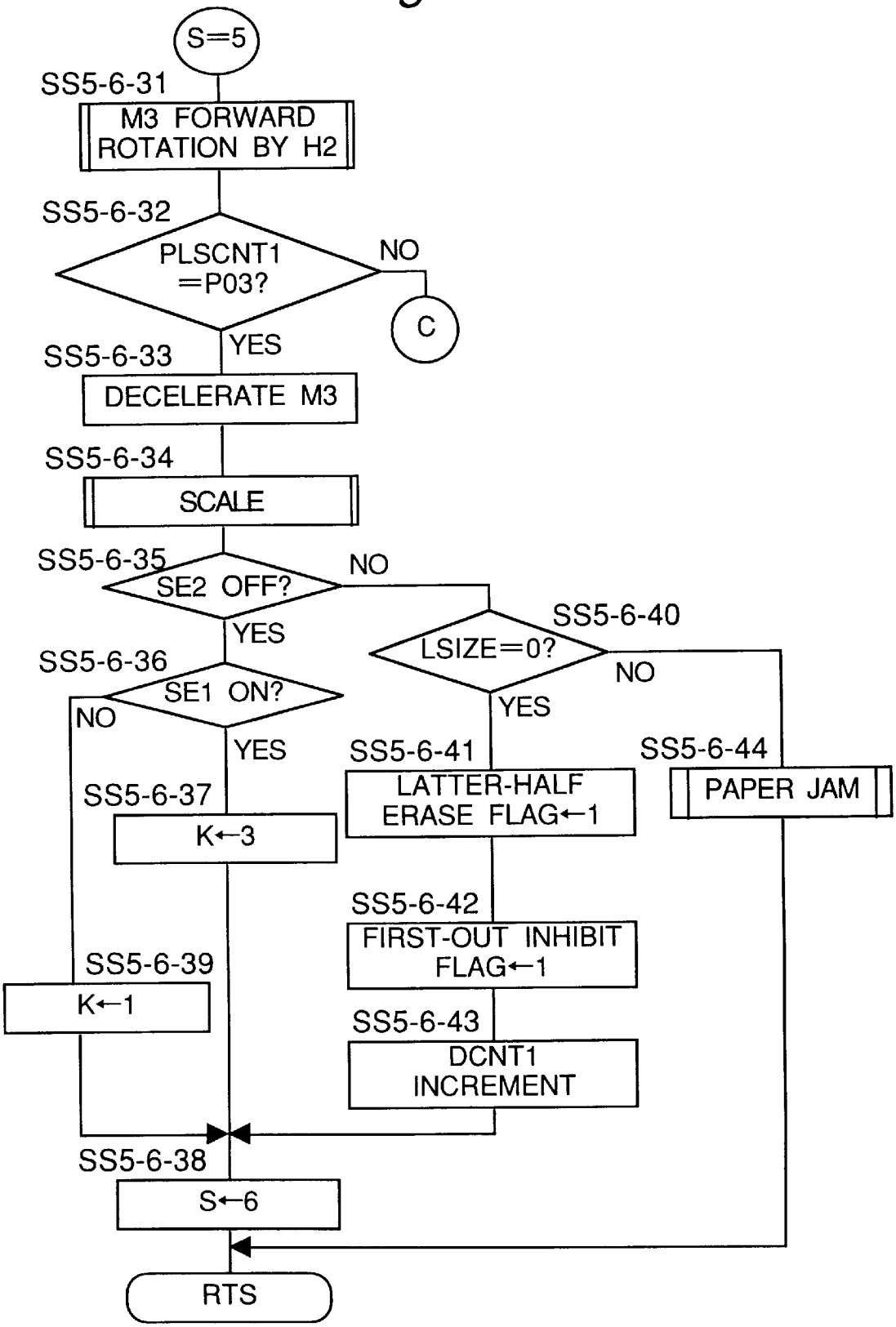
FIG. 83 is a flow chart showing a subroutine for the two-in-one setting subsequent to FIG. 79.

If the status S is "5" (feed-out of the succeeding document from the register rollers 89), the main motor M3 is rotated forward at high speed at SS5-6-31 as shown in FIG. 83. As a result, the preceding switched-back document and the succeeding document are conveyed to the exposure position. Then, if the pulse counter PLSCNT1 has been decided at SS5-6-32 to have counted the pulse P03, the main motor M3 is reduced in speed at SS5-6-33 and the scale 125 is protruded at SS5-6-34 (in the case of scale mode).

Next, it is decided at SS5-6-35 whether or not the register sensor SE2 is off, and at SS5-6-36 whether or not the empty sensor SE1 is on. If the register sensor SE2 is off while the empty sensor SE1 is on, i.e., if the succeeding document is small size and there is a following document left on the tray 60, then the feed status K is set to "3" at SS5-6-37, and the status S is set to "6" at SS5-6-38. If the empty sensor SE1 has been decided at SS5-6-36 to be off, then there is no succeeding document. Therefore, the feed status K is set to "1" at SS5-6-39 and the above-mentioned operation of SS5-6-38 is processed.

If the register sensor SE2 has been decided at SS5-6-35 to be on, then it is decided at SS5-6-40 whether or not the flag LSIZE is "0". If it is YES, then a large-size document is two-in-one set in succession to the small-size document. Therefore, the second-half erase flag is set to "1" in order to copy only the first-going small-size document at SS5-6-41. Further, the first-out inhibit flag is set to "1" at SS5-6-42, the counter DCNT1 is incremented at SS5-6-43, and the above-mentioned operation of SS5-6-38 is processed. If the flag LSIZE is decided at SS5-6-40 to be "1", then the large-size document, which has been fed alone up to the position of the scale 125, still stays in proximity to the register rollers 89, such that a paper jam process is executed at SS5-6-44. If the pulse counter PLSCNT1 has been decided to be counting the pulse P03 (NO at SS5-6-32), then the above-mentioned operations of SS5-6-27 to SS5-6-30 (see FIG. 82) are processed and the size of the succeeding document is detected.

Figure 84:
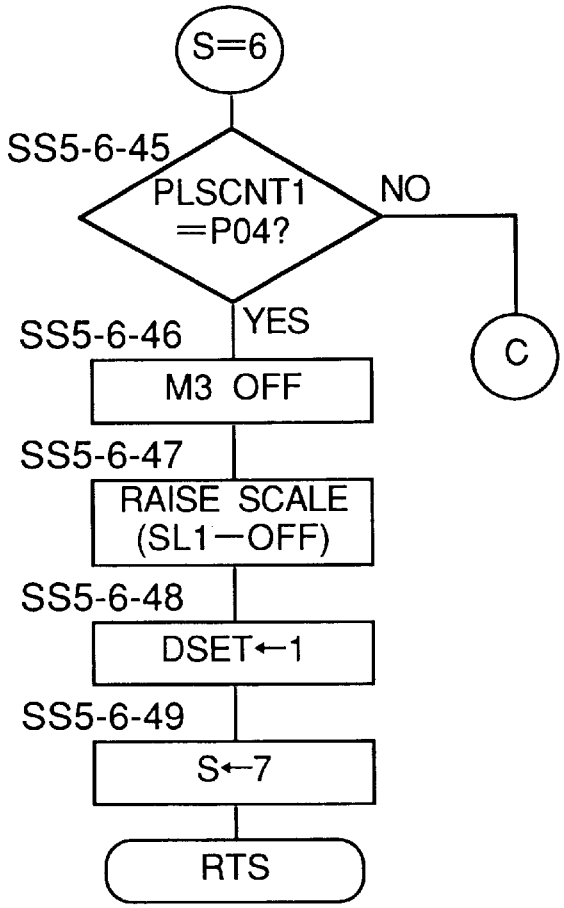
FIG. 84 is a flow chart showing a subroutine for the two-in-one setting subsequent to FIG. 79.

If the status S is "6", it is decided at SS5-6-45 whether or not the pulse counter PLSCNT1 has counted the pulse P04, as shown in FIG. 84. If it is YES, i.e., if the front end of the document has reached the exposure standard position SP, then the main motor M3 is turned off at SS5-6-46. At this point, if the succeeding document is large size, then the second half of the document stays in the paper feed section. Subsequently, the solenoid SL1 is turned off at SS5-6-47 so that the scale 125 is moved up, the flag DSET is set to "1" at SS5-6-48, and the status S is set to "7" at SS5-6-49.

Figure 85:
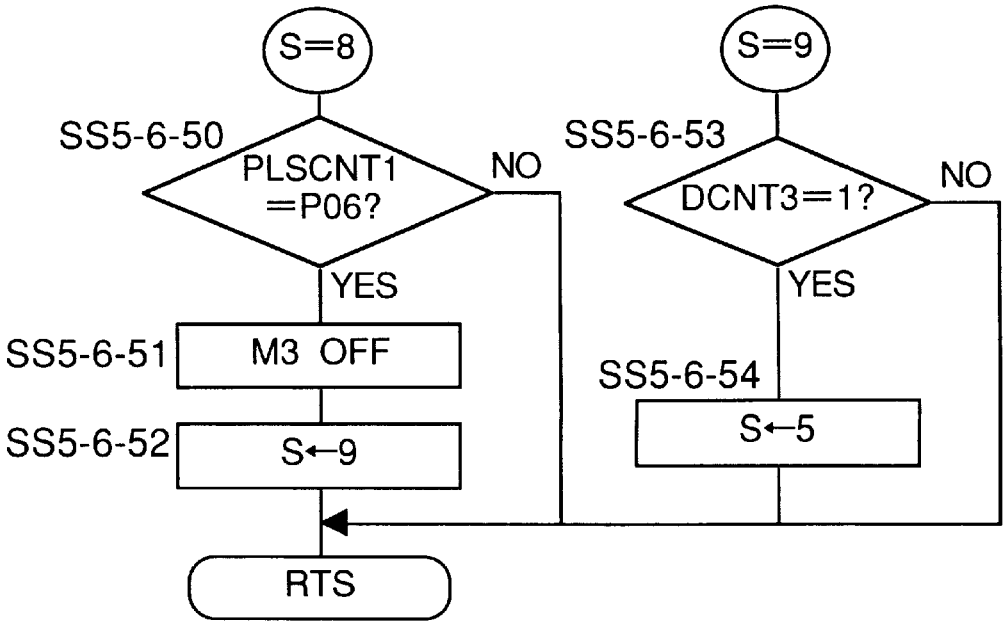
FIG. 85 is a flow chart showing a subroutine for the two-in-one setting subsequent to FIG. 79.

As shown in FIG. 85, if the status S is "8" (paper feed of a large-size document), it is confirmed at SS5-6-50 that the pulse counter PLSCNT1 has completed the count of the pulse P06, and the main motor M3 is turned off at SS5-6-51. Further, the status S is set to "9" at SS5-6-52.

If the status S is "9", the status S is set to "5" at SS5-6-54 only when the counter DCNT3 has been decided at SS5-6-53 to be "1" (one-sheet document is discharged).

Figure 86:
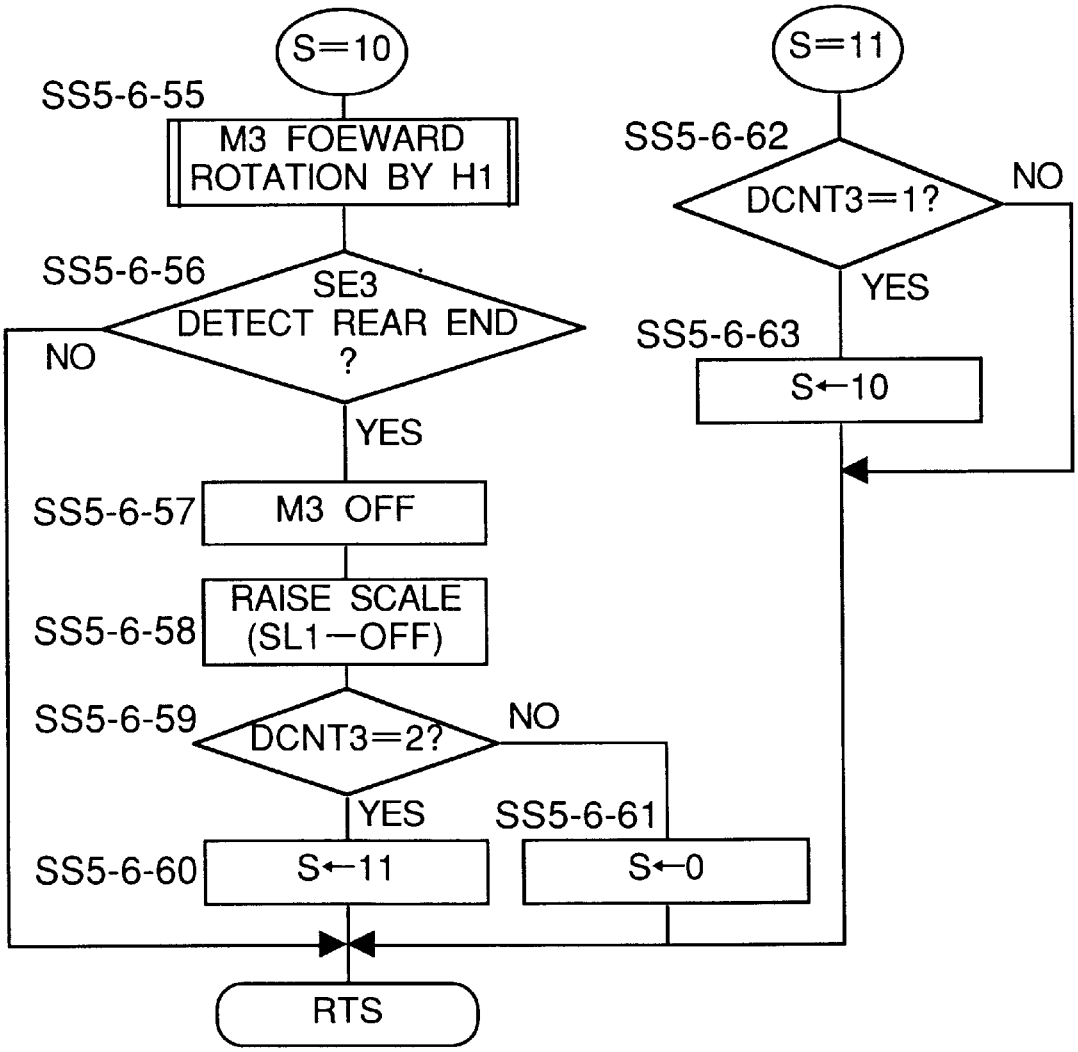
FIG. 86 is a flow chart showing a subroutine for the two-in-one setting subsequent to FIG. 79.

If the status S is "10", the main motor M3 is rotated at high speed at SS5-6-55 as shown in FIG. 86. As a result, the document is discharged from the exposure position. Then, when the rear end of the document to be discharged is detected by the discharge sensor SE3 at SS5-6-56, i.e., when the rear end of the document has separated from the conveyor belt 123, the main motor M3 is turned off at SS5-6-57. By this operation, an interval is provided between two document sheets if they are simultaneously discharged. Next, the solenoid SL1 is turned off at SS5-6-58 so that the scale 125 is moved up. Also, it is decided at SS5-6-59 whether or not the counter DCNT3 is "2". If it is "2", the status S is set to "11" at SS5-6-60; if it is not "2" (only one sheet of document is discharged), the status S is reset to "0" at SS5-6-61.

If the status S is "11", then it is decided at SS5-6-62 whether or not the counter DCNT3 is "1". If it is "1", the status S is set to "10" at SS5-6-63. As a result, the succeeding document is discharged. If the counter DCNT3 is not "1", i.e., if the counter DCNT3 is "2", the first-fed document is to be discharged, in which case nothing is processed.

Figure 87:
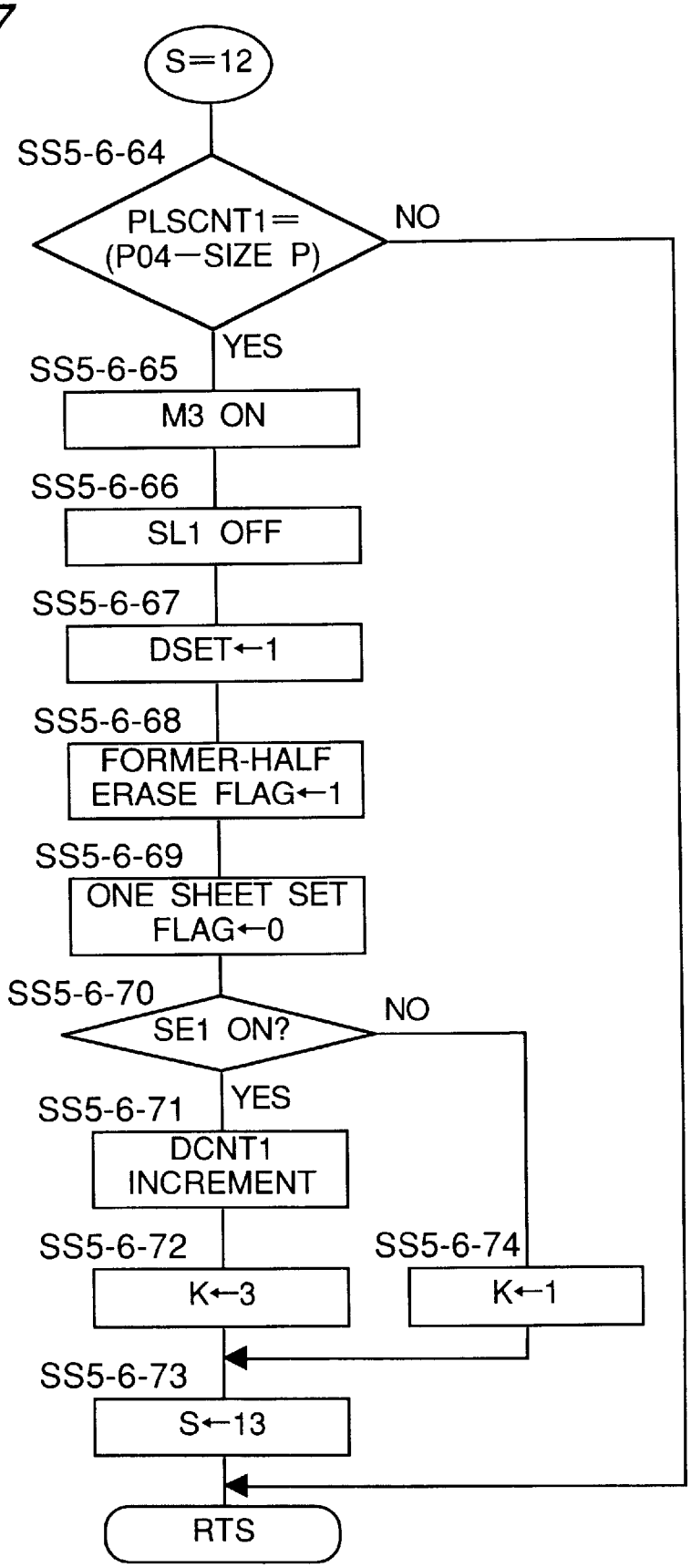
FIG. 87 is a flow chart showing a subroutine for the 2-in-1 setting subsequent to FIG. 79.

If the status S is "12", operations shown in FIG. 87 are executed. The status S is set to "12" when the one-sheet set flag is "1", i.e., when the number of document sheets is an odd number and moreover the last-page document sheet to be first set is set onto the document glass 29 one sheet alone. In this step, it is decided at SS5-6-64 whether or not the pulse counter PLSCNT1 has reached the "pulse P04–size P". It is noted that the pulse P04 is a number of pulses required for the main motor M3 to convey the document from the register rollers 89 to the scale 125. Set as this number of pulses at SS5-3-13 is L+ADJ1, which does not include the hit-and-stop amount $\alpha$. Size P is a number of pulses corresponding to the document size determined by the document size detection process. Accordingly, that the pulse counter PLSCNT1 is "pulse P04–size P" means that the second document sheet is set onto the document glass 29 with a spacing apart from the scale 125 by an extent of the document size. Then, if the PLSCNT1 has become "pulse P04–size P", where the document is set on the document glass 29 with a spacing apart from the scale 125 by an extent of the document size, then the main motor M3 is turned off at SS5-6-65. Next, the solenoid SL1 is turned off at SS5-6-66 so that the scale 125 is moved up, the flag DSET is set to "1" at SS5-6-67, the first-half erase flag is set to "1" at SS5-6-68, and electrostatic latent images on the photosensitive member corresponding to its portions where no document is present on the document glass 29 are erased. Thereafter, the one-sheet set flag is reset to "0" at SS5-6-69. Subsequently, if it is confirmed at SS5-6-70 that the empty sensor SE1 has been turned on and that there is a document sheet left on the document tray 60, then the counter DCNT1 is incremented by "+1" at SS5-6-71, the status K is set to "3" at SS5-6-72, and the status S is set to "13" at SS5-6-73. If it is confirmed at SS5-6-70 that no document sheet is present on the document tray 60, then the status K is set to "1" at SS5-6-74. As seen above, when the number of document sheets is an odd number, the last-page document is set to a position apart from the scale 125 by an extent of the document size as measured from the exposure standard position SP on the document glass 29, i.e., to the intermediate position IP. In the present case, since one-sheet small-size document is set to the second-half part, the first-half erase flag is set so that the first-half part is erased. Even in such a case that the number of document sheets has been counted as an odd number and therefore the one-sheet set flag has been set, if the document is large size at the time of actual copying operation, the operation goes from SS5-6-15 to SS5-6-16, so that the document is set alone in accordance with the scale 125 and that the erasing is not performed. When only one document sheet remains as the last document at the last time of paper feed, the document is set to the scale side so that the second-half erase flag is set (SS5-6-10). Also when a small-size document and a large-size document are two-in-one set, only the small-size document located on the scale side is copied while the second-half erase flag is set on the large-size document side for erasing. Then, the large-size document is subsequently subjected to copying operation. In this copying, the document is copied on its entire surface and a copy free from any excessive copy, shadows and dirties of the belt projected into marginal portions, and any image defects can be obtained.

Figure 88:
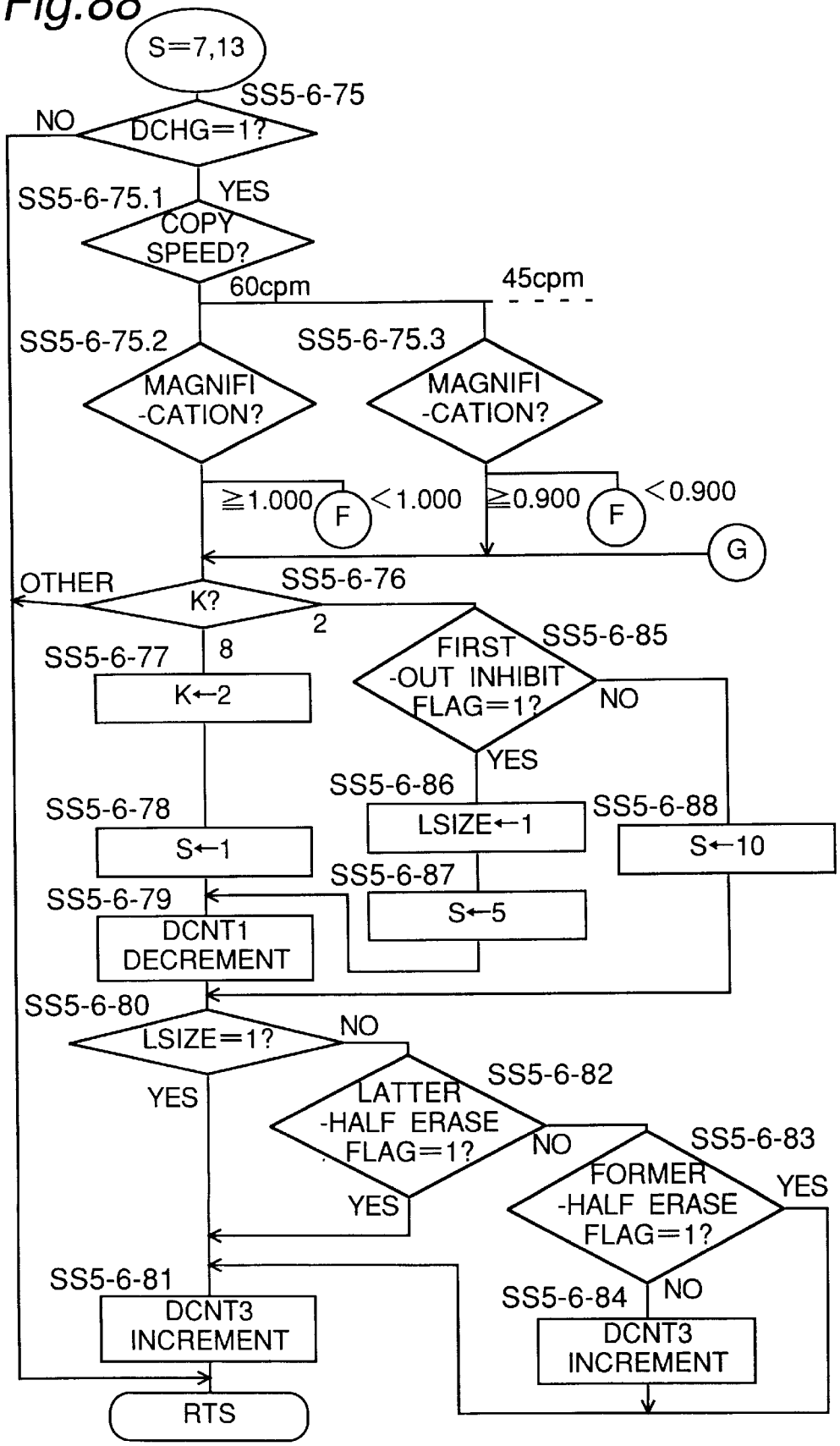
FIG. 88 is a flow chart showing a subroutine for the two-in-one setting subsequent to FIG. 79.

FIG. 88 shows operations to be executed when the status S is "7" or "13". In this process, it is decided at SS5-6-75 whether or not the flag DCHG is "1", and the following operations are executed only when the flag DCHG is "1". If the flag DCHG is "1", the copy speed is checked at SS5-6-75.1 and the magnification is checked for each speed at SS5-6-75.2 and SS5-6-75.3. If the copy speed is 60 cpm and the magnification is not less than 1, or if the copy speed is 45 cpm and the magnification is not less than 0.9, then the following operations are executed. If the flag DCHG is "1", the value of the feed status K is checked at SS5-6-76. In this example, only when the status K is "2" or "8", the following operations are executed.

If the status K is "8" (when the succeeding document has already been first-out fed), the status K is set to "2" at SS5-6-77, and the status S is set to "1" at SS5-6-78. Further, the counter DCNT1 is decremented at SS5-6-79 and it is decided at SS5-6-80 whether or not the flag LSIZE is "1". If the flag LSIZE is "1" (if a small-size document has been fed), the counter DCNT3 for counting the number of document sheets to be discharged is incremented at SS5-6-81. If the flag LSIZE is "0" (if a large-size document has been fed), it is decided at SS5-6-82 whether or not the second-half erase flag is "1". If the second-half erase flag is "1" (if one sheet of small-size document has been set or if one sheet of small-size document and one sheet of large-size document have been set), then the above-mentioned operation of SS5-6-81 is processed. If the second-half erase flag is "0", then it is decided at SS5-6-83 whether or not the first-half erase flag is "1". If the first-half erase flag is "0", the counter DCNT3 is incremented at SS5-6-84 and thereafter the operation of SS5-6-81 is processed.

If the status K has been decided at SS5-6-76 to be "2" (when the succeeding document has not been first-out fed), it is decided at SS5-6-85 whether or not the first-out inhibit flag is "1". If the first-out inhibit flag is "1", then the flag LSIZE is set to "1" at SS5-6-86, the status S is set to "5" at SS5-6-87, and the operations of SS5-6-79 to -84 are processed. If the first-out inhibit flag is "0", then the status S is set to "10" at SS5-6-88 and the operations of SS5-6-80 to -84 are processed.

Figure 89:
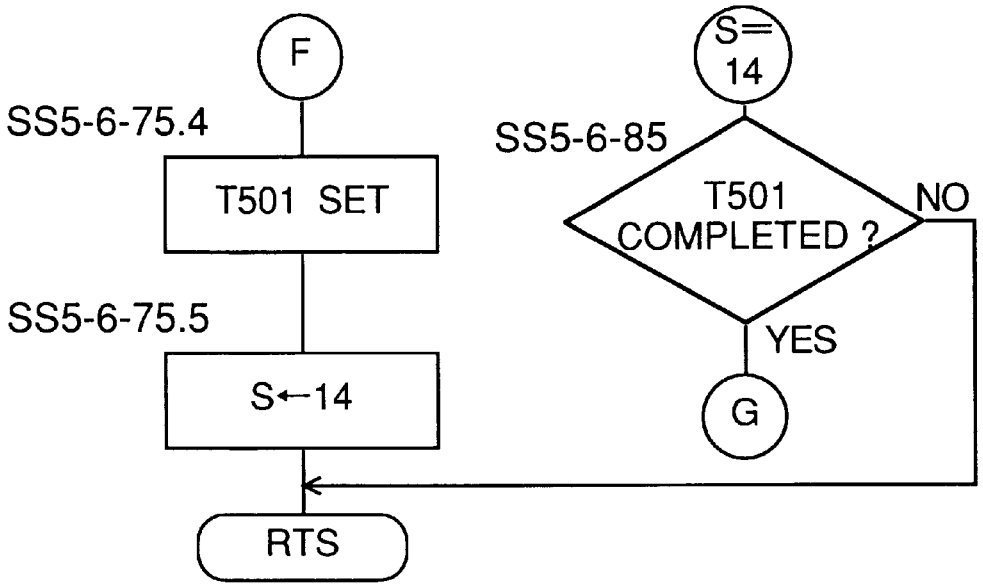
FIG. 89 is a flow chart showing a subroutine for the two-in-one setting subsequent to FIGS. 79 and 88.

As a result of confirmation of the copy speed and the magnification at SS5-6-75.1 to SS5-6-75.3, if the copy speed is 60 cpm and the magnification is less than 1 or if the copy speed is 45 cpm and the magnification is less than 0.9, then the timer T503 is set at SS5-6-75.4, the status S is set to "14" at SS5-6-75.5, and the program returns, as shown in FIG. 89. The timer T503 is purposed to provide timing from an end of scan to a start of document replacement.

In the case where the status S is "14", as shown in FIG. 89, if the T503 has completed the count at SS5-6-85, the foregoing steps of SS5-6-76 through SS5-6-84 in FIG. 88 are processed.

<Paper Discharge>

Figure 90:
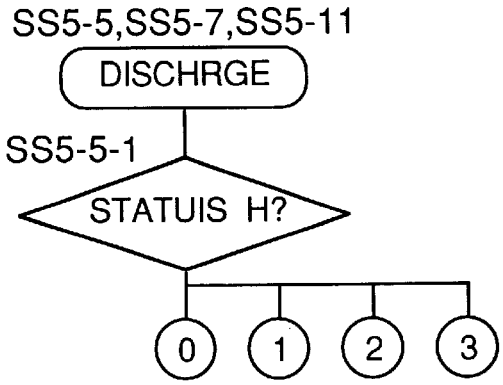
FIG. 90 is a showing a subroutine for paper discharge in the CPU 2.

FIGS. 90 to 93 show a counted paper discharge subroutine to be executed at SS5-5, SS5-7, and SS5-11. The paper discharge executed in this subroutine is paper discharge in the prestep mode, the two-in-one mode and the double-side mode. In this subroutine, as shown in FIG. 90, the paper discharge status H is checked at SS5-5-1 and the following operations are executed based on the resulting values "0", "1", "2" and "3".

Figure 91:
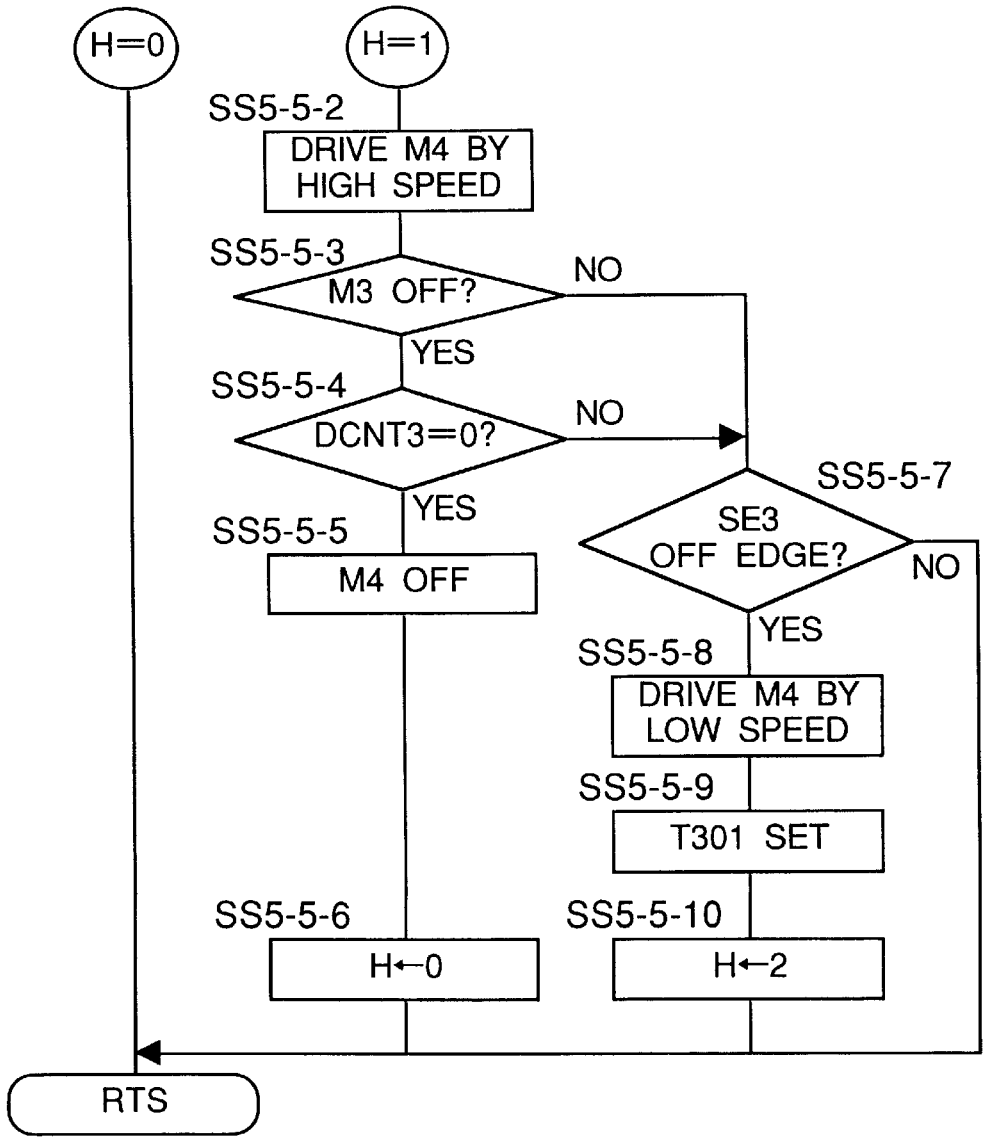
FIG. 91 is a flow chart showing a subroutine for paper discharge subsequent to FIG. 90.

As shown in FIG. 91, if the status H is "0", nothing is processed. If the status H is "1", then the discharge motor M4 is driven into high-speed rotation at SS5-5-2 and it is decided at SS5-5-3 whether or not the main motor M3 is on, and at SS5-5-4 whether or not the counter DCNT3 is "0". If the main motor M3 has been turned off and the counter DCNT3 is "0", then there is no document to be discharged so that the discharge motor M4 is turned off at SS5-5-5 and the status H is reset to "0" at SS5-5-6.

If the main motor M3 has been turned on, or if the counter DCNT3 is not "0" even with the main motor M3 off (a state that the document is being discharged), then it is decided at SS5-5-7 whether or not the discharge sensor SE3 is at the OFF EDGE. If the discharge sensor SE3 is at the OFF EDGE, i.e., if the rear end of the document has passed the detection point of the discharge sensor SE3, then the discharge motor M4 is changed to low-speed drive at SS5-5-8, and the timer T301 is set at SS5-5-9. Further, the status H is set to "2" at SS5-5-10.

Figure 92:
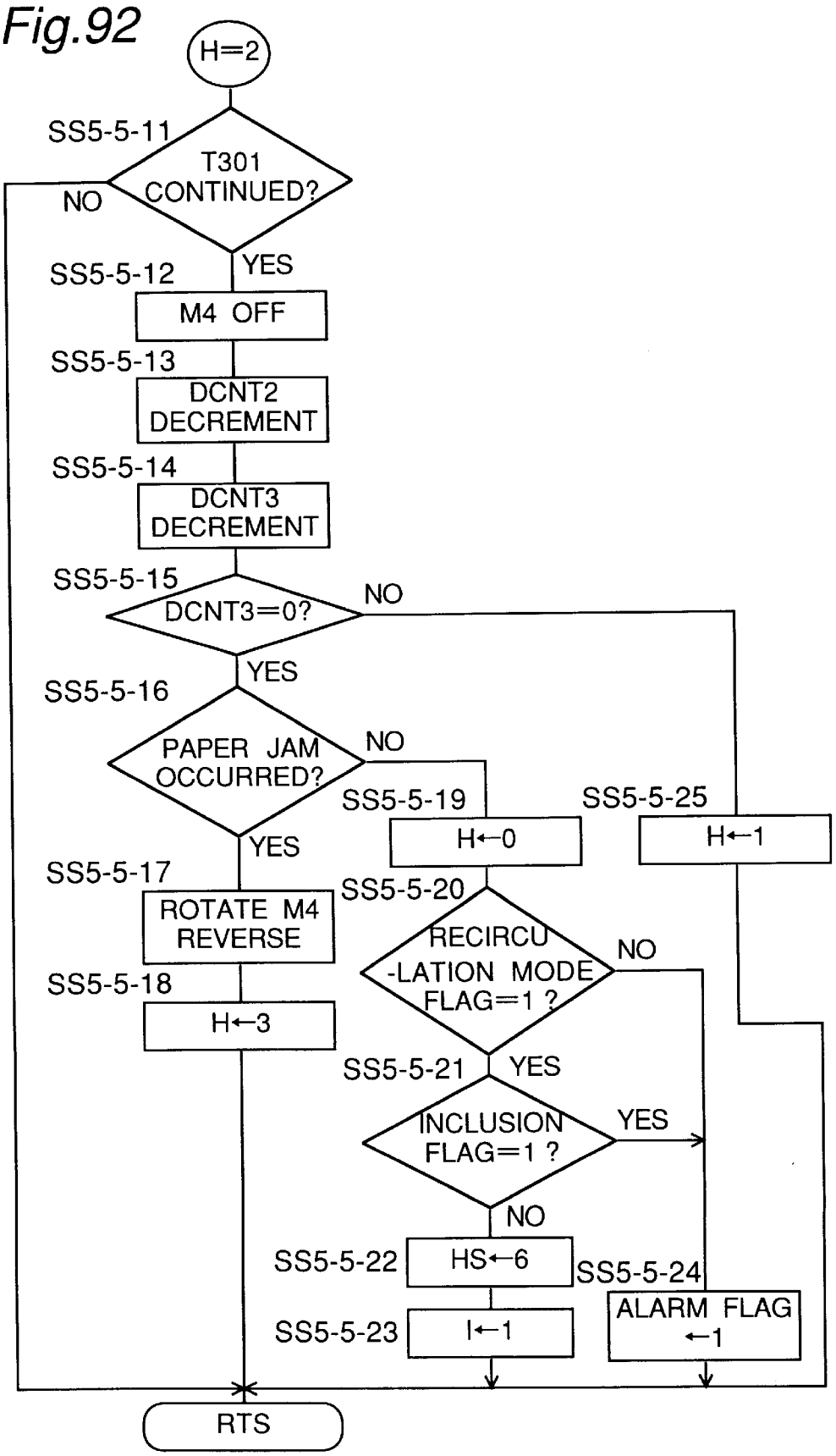
FIG. 92 is a flow chart showing a subroutine for paper discharge subsequent to FIG. 90.
Figure 115:
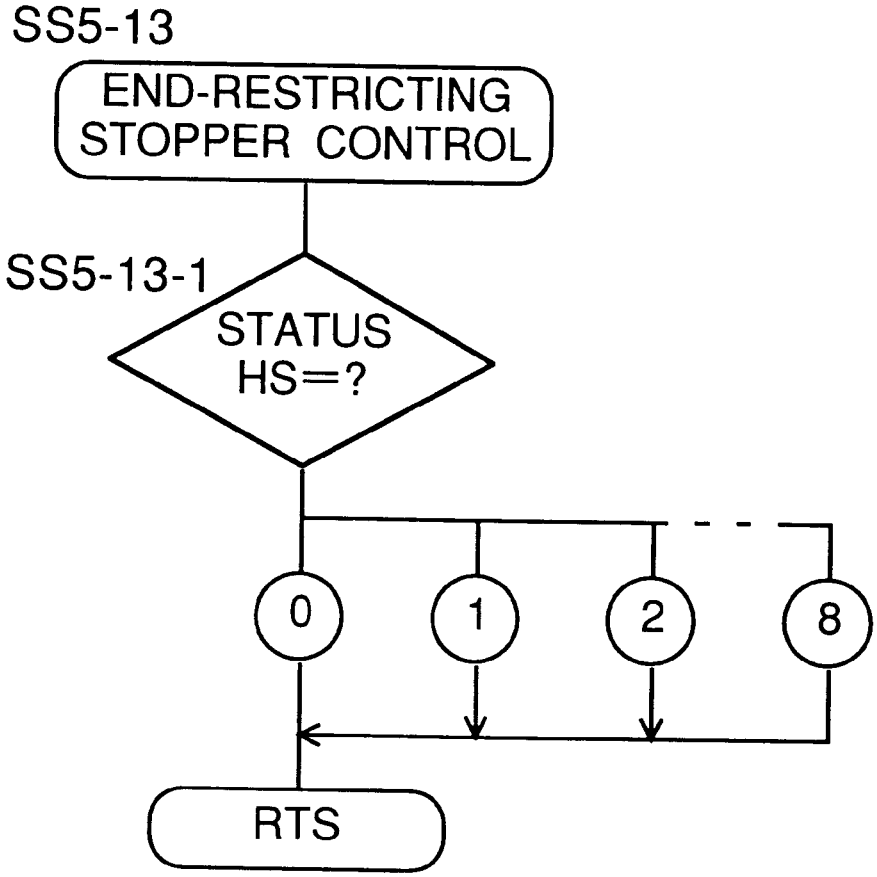
FIG. 115 is a flow chart showing a subroutine for end-restricting stopper control in the CPU 2.

In the case where the status H is "2", as shown in FIG. 92, if it is confirmed at SS5-5-11 that the timer T301 has completed the count, the discharge motor M4 is turned off at SS5-5-12. The counter DCNT2 is decremented at SS5-5-13 and the counter DCNT3 is decremented at SS5-5-14. Subsequently, it is decided at SS5-5-15 whether or not the counter DCNT3 is "0". If the counter DCNT3 is "0", i.e., if there are no document present within the ADF, it is decided at SS5-5-16 whether or not a paper jam has occurred. If a paper jam has occurred, the discharge motor M4 is rotated reverse at SS5-5-17 and the status H is set to "3" at SS5-5-18. If no paper jam has occurred, the status H is set to "0" at SS5-5-19 and the state of the recirculation mode flag is decided at SS5-5-20. If the recirculation mode flag has been decided at SS5-5-20 to be "1", i.e. when all of the document have fed from the feed port 61 and discharged to complete a round and the next round will be executed, the state of an inclusion flag is decided at SS5-5-21. The inclusion flag is a flag that is set to "1" when a different size of the document is included in the document copied at the routine of FIG. 98 as described hereinafter. If the inclusion flag has been decided at SS5-5-21 to be "0", i.e. when it has been decided that all of the document were same size, in order to execute the next round of copy, the status HS is set to "6" at SS5-5-22. And the status I is set to "1" at SS5-5-23. Thereby, the stopper 174, which has been positioned at recirculation position by the processing of the end-restricting stopper control of FIG. 115 as described hereinafter, is commenced to move the withdrawal position. Then, the document discharged by the refeed lever 274 is moved to the feed port 61 for the copying at the next round. If the recirculation mode flag has been decided at SS5-5-20 to be "0", or even with the recirculation mode flag being "1", if the inclusion flag is "1" at SS5-5-21, then the alarm flag is set to "1" at SS5-5-24. That is, in the case that a different size of the document is included in the document to be copied, the status I is not set to "1". Thereby, the movement of the refeed lever 274 to the direction of the feed port 61 is prevented so that the discharged document is never moved toward the feed port 61. If the counter DCNT2 is not "0" at SS5-5-15, i.e., if there is some document left within the ADF, the status H is set to "0" at SS5-5-25 and the discharging operation is continued.

Figure 93:
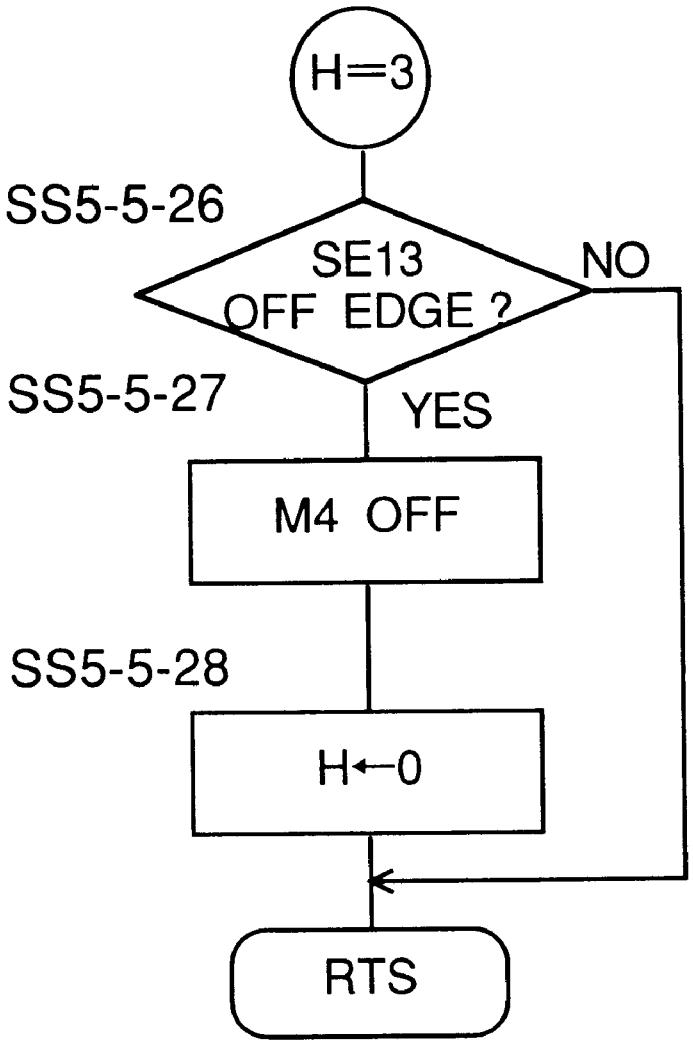
FIG. 93 is a flow chart showing a subroutine for paper discharge subsequent to FIG. 90.

In the case where the status H is "3", as shown in FIG. 93, if the document-move-prevent-lever home sensor SE13 has detected an OFF EDGE at SS5-5-26, the discharge motor M4 is turned off at SS5-5-27 and the status H is set to "0" at SS5-5-28.

<Count>

Figure 94:
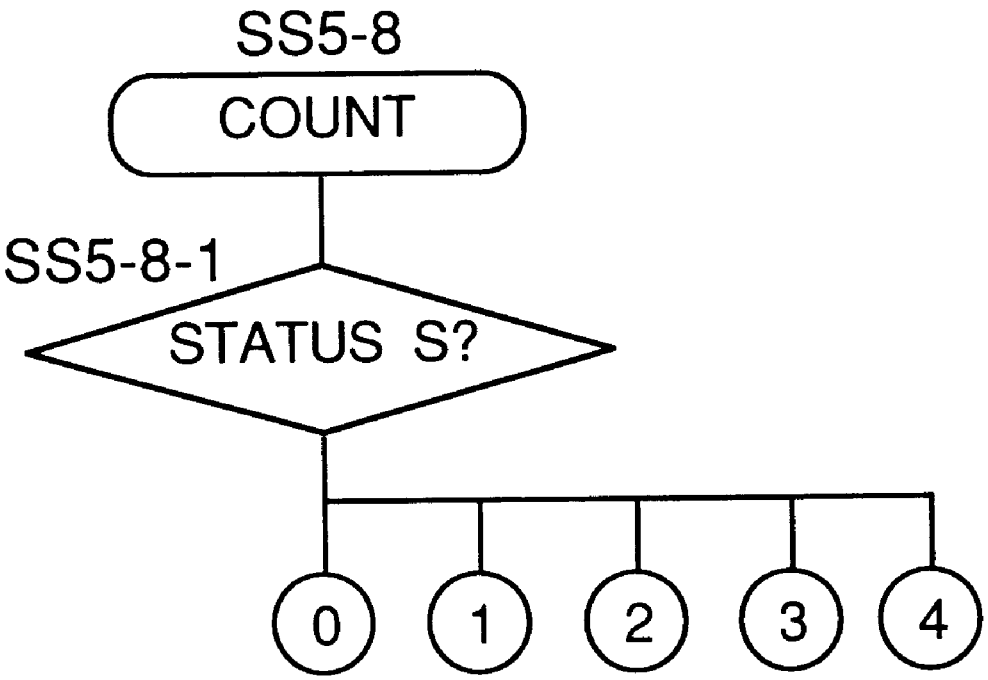
FIG. 94 is a flow chart showing a subroutine for count in the CPU 2.
Figure 95:
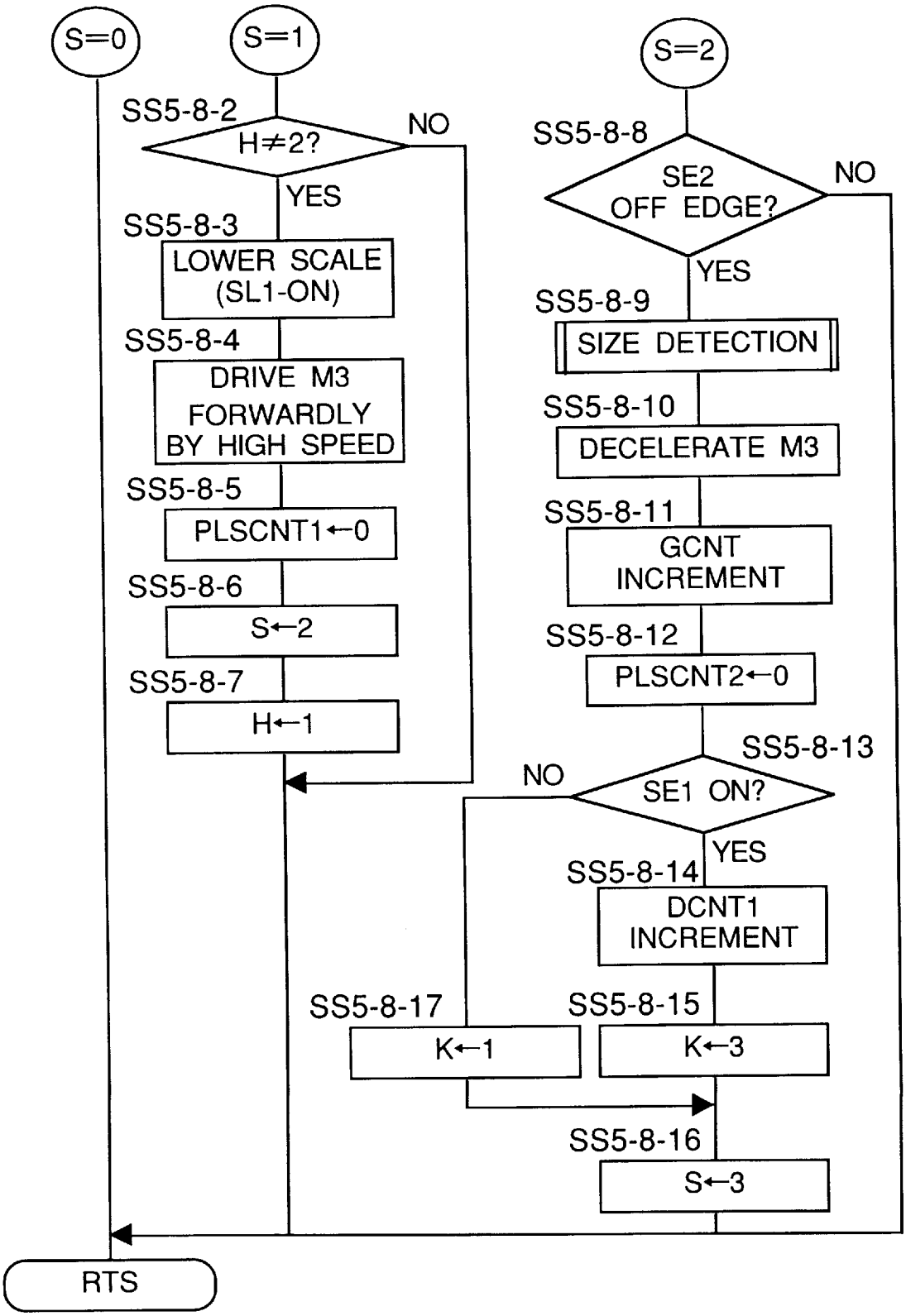
FIG. 95 is a flow chart showing a subroutine for count subsequent to FIG. 94.
Figure 96:
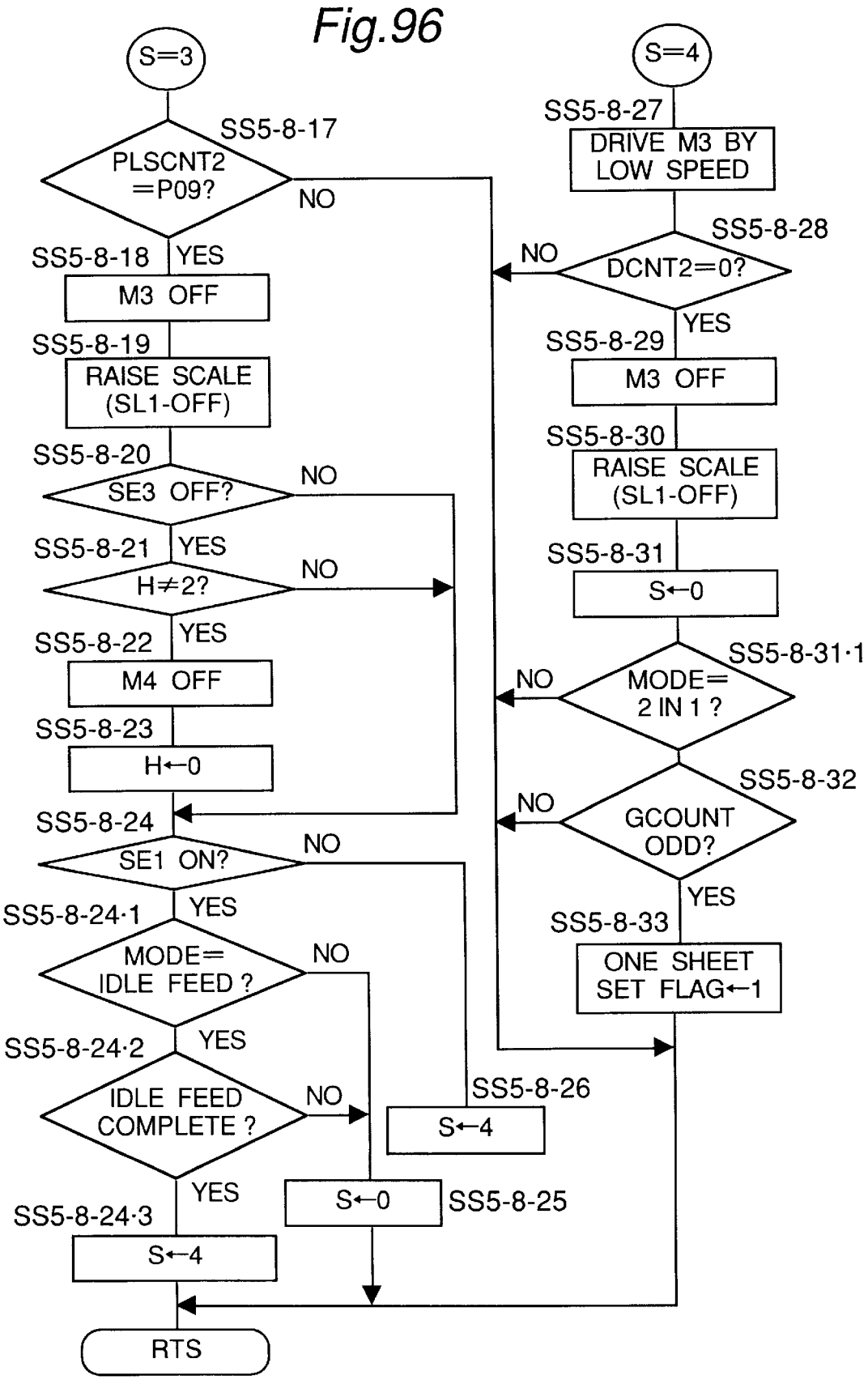
FIG. 96 is a flow chart showing a subroutine for count subsequent to FIG. 94.

FIGS. 94 to 96 show a count subroutine to be executed at SS5-8. In this subroutine in conjunction with a counted paper-discharge and move subroutine as will be explained in succession, the document is circulated around so that the number of document sheets is automatically counted and moved to the feed port. In this subroutine, as shown in FIG. 94, the status S is checked at SS5-8-1 and the following operations are executed based on the resulting values "0" to "4".

As shown in FIG. 95, if the status S is "0", nothing is processed. If the status S is "1" (completion of paper feed), it is confirmed at SS5-8-2 that the discharge status H is not "2", i.e., that the discharge motor M4 has not been reduced in speed. Then, the solenoid SL1 is turned on at SS5-8-3 so that the scale 125 is moved down, and the main motor M3 is rotated forward at high speed at SS5-8-4. As a result, the document is fed from the register rollers 89 onto the document glass 29. Further, the pulse counter PLSCNT1 is reset to "0" at SS5-8-5, the status S is set to "2" at SS5-8-6, and the status H is set to "1" at SS5-8-7.

If the status S is "2", the register sensor SE2 is confirmed at SS5-8-8 to be at the OFF EDGE (if the rear end of the document has passed the detection point of the register sensor SE2), the document size is detected at SS5-8-9. Subsequently, the main motor M3 is reduced in speed at SS5-8-10, the counter GCNT for counting the number of document sheets is incremented at SS5-8-11, and the pulse counter PLSCNT2 is reset to "0" at SS5-8-12. Further, it is decided at SS5-8-13 whether or not the empty sensor SE1 is on. If the empty sensor SE1 is on, the counter DCNT1 is incremented at SS5-8-14 for feeding the succeeding document, the feed status K is set to "3" at SS5-8-15, and the status S is set to "3" at SS5-8-16. If the empty sensor SE1 has been turned off, then there is no document left on the tray 60 so that the feed status K is set to "1" at SS5-8-17 and the status S is set to "3" at SS5-8-16.

As shown in FIG. 96, if the status S is "3", it is confirmed at SS5-8-17 that the pulse counter PLSCNT2 has completed the count of the pulse P09, and then the main motor M3 is turned off at SS5-8-18. The pulse P09 is intended to temporarily stop the document on the document glass 29, and it corresponds to a number of pulses with which the main motor is driven from when the rear end of the document is detected by the register sensor SE2 until when it passes by at least the nip portion of the register rollers 89. By such control, the processing time in the count mode can be reduced.

Next, the solenoid SL1 is turned off at SS5-8-19 so that the scale 125 is moved up. Thereafter, it is decided at SS5-8-20 whether or not the discharge sensor SE3 is off, and at SS5-8-21 whether the discharge status H is not "2". If the sensor SE3 is off and if the status H is not "2" (if the document has not been discharged), then the discharge motor M4 is turned off at SS5-8-22, and the status H is reset to "0" at SS5-8-23. Then, it is decided at SS5-8-24 whether the empty sensor SE1 is on or off. If the empty sensor SE1 is on and the current mode is not the idle feed mode at SS5-8-24.1, or if, even with the idle feed mode, it has been decided at SS5-8-24.1 that the idle feed has not been completed, then the status S is reset to "0" at SS5-8-25 for awaiting the completion of the feed of the succeeding document. If the current mode is the idle feed mode and moreover it has been completed, the status S is set to "4". If the empty sensor SE1 is off, then the status S is set to "4" at SS5-8-26. Also, if the discharge sensor SE3 has been turned on or if the status H is "2" even with the discharge sensor SE3 off, then the operations of SS5-8-24 to -26 are processed.

If the status S is "4", then all the document sheets have already been fed out onto the document glass 29, where the main motor M3 is driven into low-speed rotation at SS5-8-27. Then, it is confirmed at SS5-8-28 that the counter DCNT2 is "0", i.e., that there are no longer document sheets left on the document glass 29. The main motor M3 is turned off at SS5-8-29, the solenoid SL1 is turned off at SS5-8-30 so that the scale 125 is moved up, and the status S is reset to "0" at SS5-8-31. Subsequently, if the current mode is the two-in-one mode at SS5-8-31 and it is decided at SS5-8-32 that the counter GCOUNT, i.e. the number of document sheets, is an odd number, then the one-sheet set flag is set to "1" at SS5-8-33.

<Counted Paper Discharge>

Figure 97:
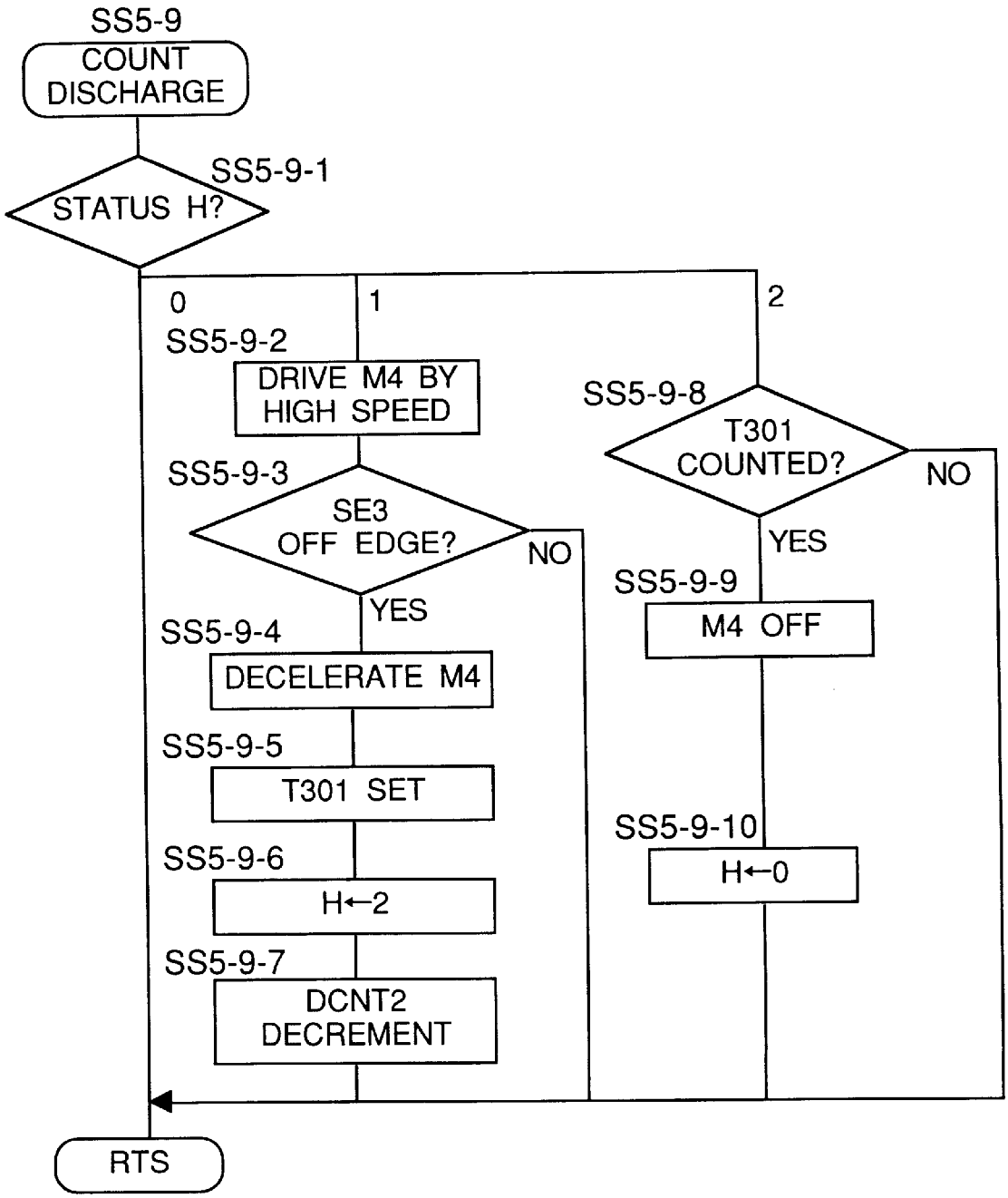
FIG. 97 is a flow chart showing a subroutine for counted paper discharge in the CPU 2.

FIG. 97 shows a counted paper-discharge subroutine to be executed at SS5-9. In this subroutine, the discharge status H is checked at SS5-9-1, and the following operations are executed based on the resulting values "0", "1", and "2". If the status H is "0", nothing is processed. If the status H is "1" (when the document starts to be conveyed by the main motor M3 rotating forward), the discharge motor M4 is driven into high-speed rotation at SS5-9-2. As a result, the reverse roller 141 and the discharge roller 145 start to rotate, so that the document is fed to the tray 60. Next, if the discharge sensor SE3 is confirmed at SS5-9-3 to be at the OFF EDGE (if the rear end of the document has passed the detection point of the discharge sensor SE3), the discharge motor M4 is reduced in speed at SS5-9-4. Further, the timer T301 is set at SS5-9-5, the status H is set to "2" at SS5-9-6, and the counter DCNT2 is decremented at SS5-9-7.

If the status H is "2", it is confirmed at SS5-9-8 that the timer T301 has completed the count. Then, the discharge motor M4 is turned off at SS5-9-9, and the status H is reset to "0" at SS5-9-10.

<Size Detection>

Figure 98:
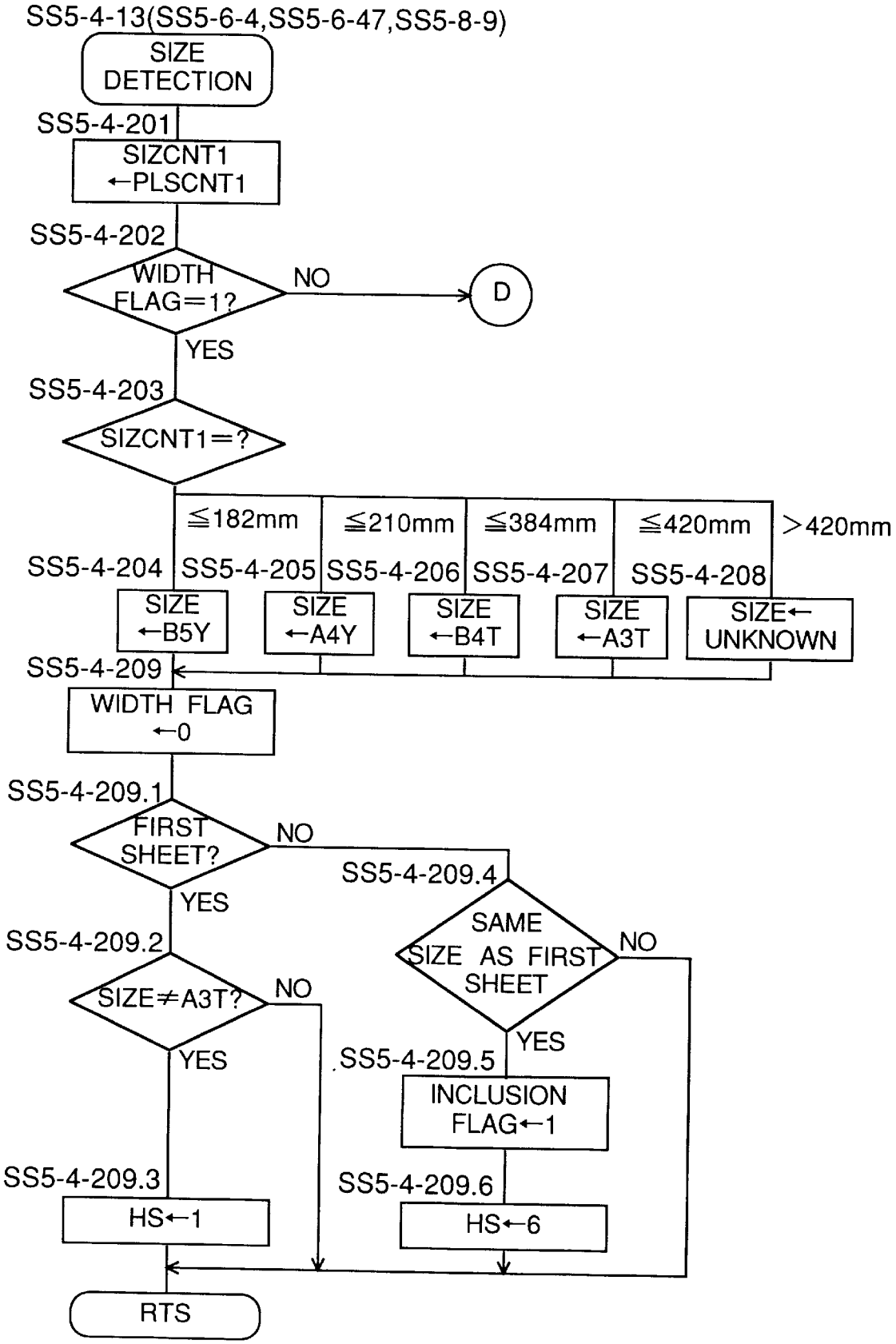
FIG. 98 is a flow chart showing a subroutine for size detection in the CPU 2.

FIG. 98 shows a size detection subroutine executed at SS5-4-13, SS5-6-4, SS5-8-9, and SS5-10-6. In this example, the pulse count of the pulse counter PLSCNT1 is stored into the counter SIZCNT1 for use of size detection at SS5-4-201. The pulse counter PLSCNT1 counts the number of forward-rotation drive pulses of the main motor M3, and its value corresponds to the length of the document. Next, it is decided at SS5-4-202 whether or not the width flag is "1." The width flag is set by the width sensor SE10 turning on and off, and the width sensor SE10 is turned on by a document having a width dimension larger than B5 transverse, in which case the width flag is set to "1". The document size is set by a combination of a value of the SIZCNT1 and a width flag. In the figure, T denotes the transverse feed while L denotes the longitudinal feed.

More specifically, if the width flag is "1", the value of the SIZCNT1 is checked at SS5-4-203. Then, if the resulting value corresponds to 182 mm, the SIZE is set to B5 transverse at SS5-4-204. Subsequently, specified sizes are similarly set according to values of the SIZCNT1 at SS5-4-205 to SS5-4-207. Further, if the document is longer than 420 mm, the size is decided as unknown at SS5-4-208. After this process, the width flag is reset to "0" at SS5-4-209.

Next, it is decided at SS5-4-209.1 whether or not the document is the first sheet. If the document is the first sheet, after confirmation at SS5-4-209.2 that SIZE is other than A3T, the status HS is set to "1" at SS5-4-209.3. Also, if the document is not the first sheet, it is decided at SS5-4-209.4 whether or not the document is the same size as the first sheet. If the document is not the same size, the inclusion flag is set to "1" at SS5-4-209.5 and the status HS is set to "6" at SS5-4-209.6. Thereby, in the process at SS5-13-19 of FIG. 117—SS5-13-23 of FIG. 118 as described hereinafter, the document discharge stopper 174 positioned at the restricting position is moved to the withdrawal position.

Figure 99:
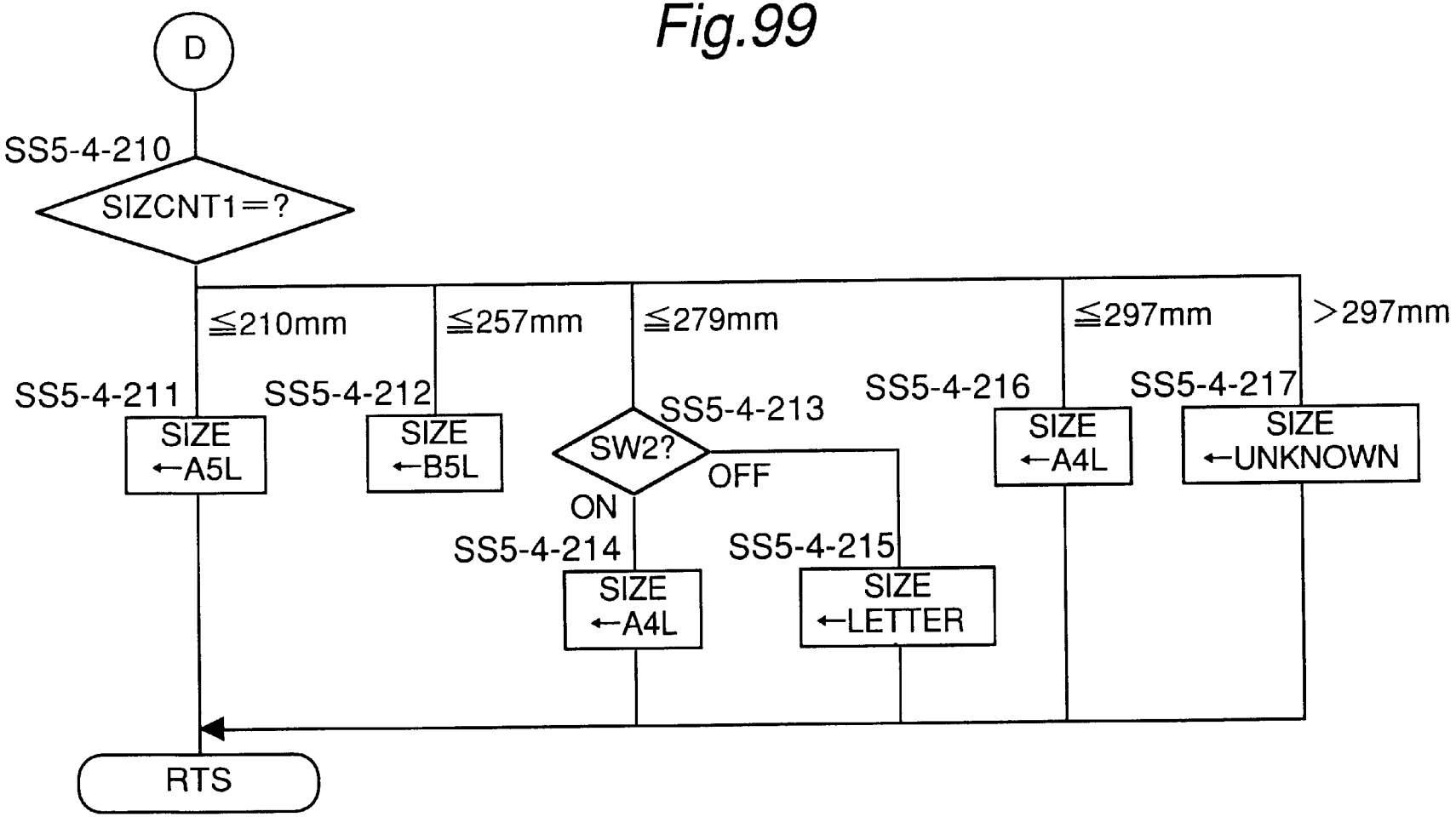
FIG. 99 is a flow chart showing a subroutine for size detection subsequent to FIG. 98.
Figure 100:
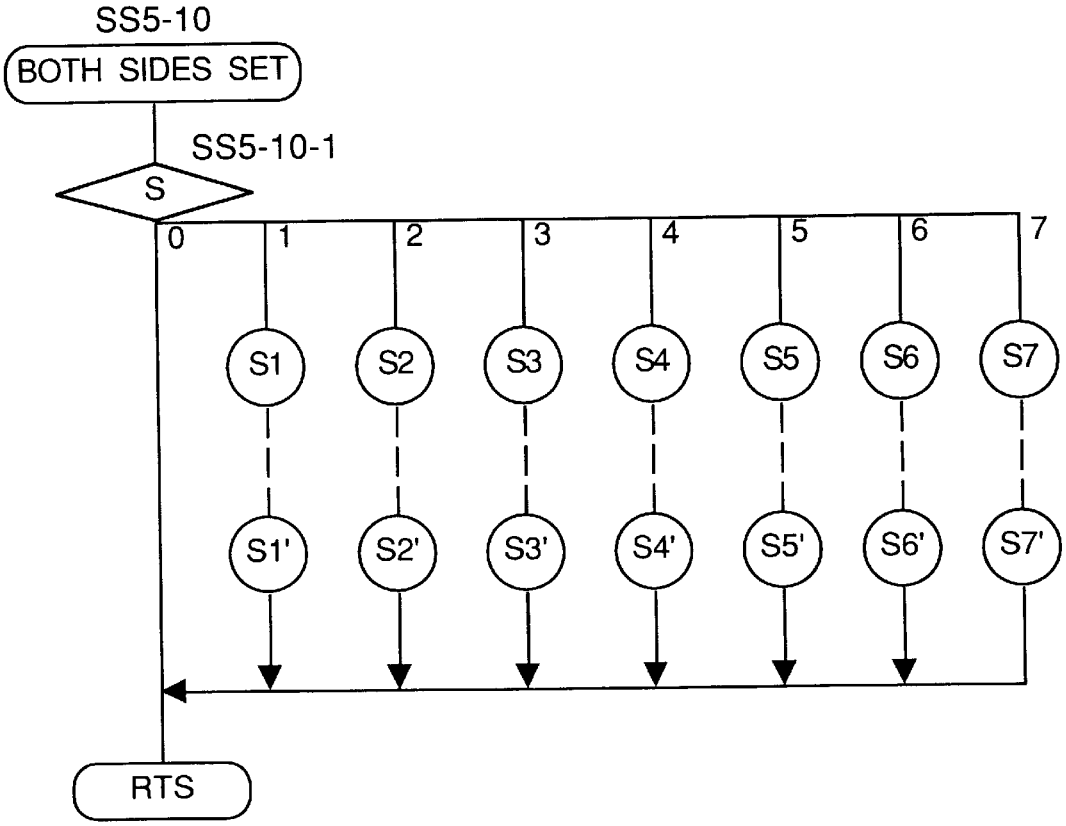
FIG. 100 is a flow chart showing a subroutine for double-side setting in the CPU 2.

Meanwhile, as shown in FIG. 99, if the width flag is "0", the value of the SIZCNT1 is checked at SS5-4-210 and specified document sizes are set to the SIZE at SS5-4-211 to SS5-4-217 according to the resulting values. In addition, if the document is shorter than 297 mm, it is decided at SS5-4-213 whether or not the switch SW2 has been turned on. If it has been turned on, the size is set to "A4T" at SS5-4-214; if it has not been turned on, the size is set to "Letter T" at SS5-4-215. Besides, in the two-in-one mode, each detected size is doubled when it is set. It is noted that the steps of SS5-4-213 and -214 are other embodiments of the steps of S8-4 and following in FIG. 46.

<Double-Side Set>

FIGS. 100 through 107 show a subroutine for processing the document feed in the double-side mode. First, the status "S" is decided at SS5-10-1, and the subroutine is branched into "0" through "7" according to the resulting values.

Figure 101:
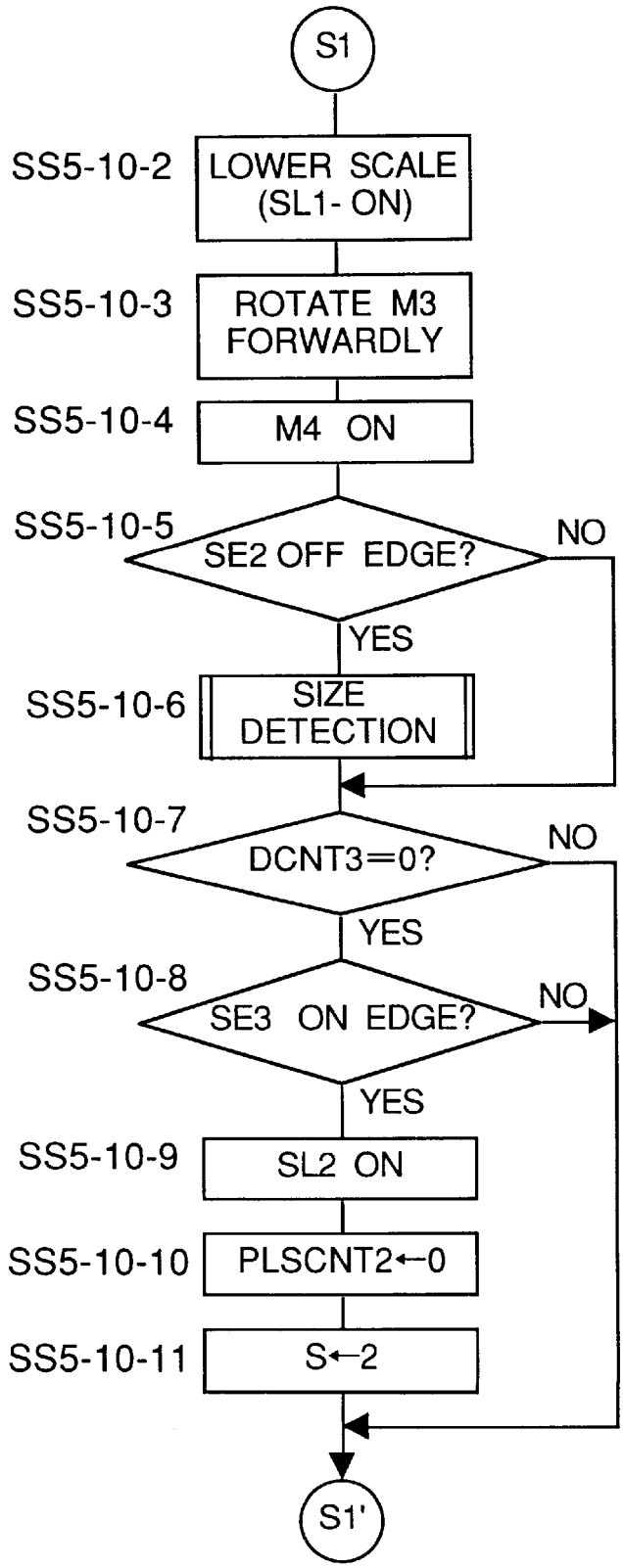
FIG. 101 is a flow chart showing a subroutine for double-side setting subsequent to FIG. 100.

If the status S is "0", nothing is processed. As shown in FIG. 101, if the status S is "1", then the solenoid SL1 is turned on at SS5-10-2 so that the scale 125 is moved down, the main motor M3 is rotated forward at SS5-10-3 so that the document is conveyed along the document glass 29, and the discharge motor M4 is driven at SS5-10-4. Next, the OFF EDGE of the register sensor SE2 is detected at SS5-10-5. If the OFF EDGE, or the rear end of the document, is detected, the document size is detected from signals of the sensors SE2 and SE10 at SS5-10-6. Subsequently, it is decided at SS5-10-7 whether or not the number-of-document-sheets counter DCNT3 is "0". This number-of-document-sheets counter is a counter that counts the number of document sheets to be discharged, and is set to "0" when the rear surface of the first document sheet is set and when its front surface is set. Also, when the rear surface of the second and following document sheets is set, the counter changes from "1" to "0" as the preceding document is discharged. Then, if the number-of-document-sheets counter DCNT3 is decided to be "0", the ON EDGE of the discharge sensor SE3 is detected at SS5-10-8. As the ON EDGE is detected, the solenoid SL2 is turned on at SS5-10-9 so that the switching claw 144 is operated to form a reversal path, and the document is again conveyed toward the document glass 29. Also, the pulse counter PLSCNT2 is reset to "0" at SS5-10-10, where the count is started therewith. The status S is set to "2" at SS5-10-11.

Figure 102:
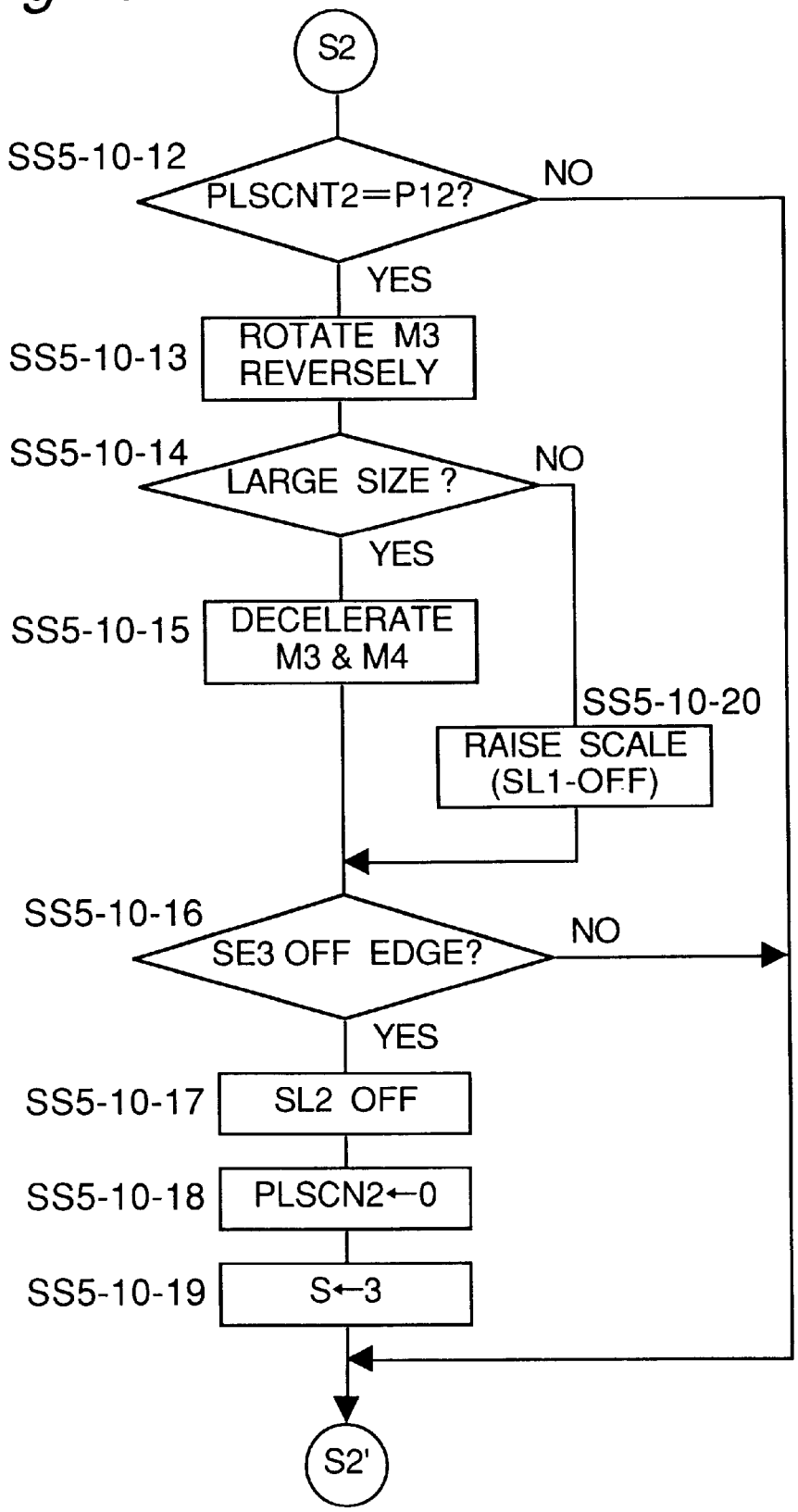
FIG. 102 is a flow chart showing a subroutine for double-side setting subsequent to FIG. 100.

If the status S is "2", it is decided at SS5-10-12 whether or not the pulse counter PLSCNT2 has reached P12, i.e., whether or not the front end of the document that had passed the discharge sensor SE3 has passed through the reversal path and reached to intermediately before the conveyor belt 123, as shown in FIG. 102. Then, immediately before the front end of the document reaches the conveyor belt 123, the main motor M3 is rotated reverse at SS5-10-13. Also, it is decided at SS5-10-14 whether or not the document is large size. If the document is large size, the main motors M3 and the discharge motor M4 are reduced in speed. In this connection, a large-size document may be pinched between the conveyor belt 123 and the document glass 29 at both the front end and the rear end, resulting in an increased load. In such a case, the main motors M3 and the discharge M4 are switched to low speed so that the stepping motors can be protected from stepping out and that paper-running noise can be reduced. In this case, similar functions and advantages can be obtained also when the scale 125 is held lowered below the upper surface of the document glass 29. Meanwhile, when the document is not large size, the solenoid SL1 is turned off at SS5-10-20 so that the scale 125 is moved up, with a view to eliminating the possibility that the front end of the document may interfere with an end face of the glass, which would lead to a paper jam, as well as to preparing for the document front-end restriction. Next, the OFF EDGE of the sensor SE3 is detected at SS5-10-16, where if it is confirmed that the rear end of the document has passed the switching claw 144, the solenoid SL2 is turned off at SS5-10-17 so that the switching claw 144 is operated, whereby the document conveying path is switched to the path which leads to the document-discharge tray 60. Further, the pulse counter PLSCNT2 is reset to "0" at SS5-10-18, and the status S is set to "3" at SS5-10-19.

Figure 103:
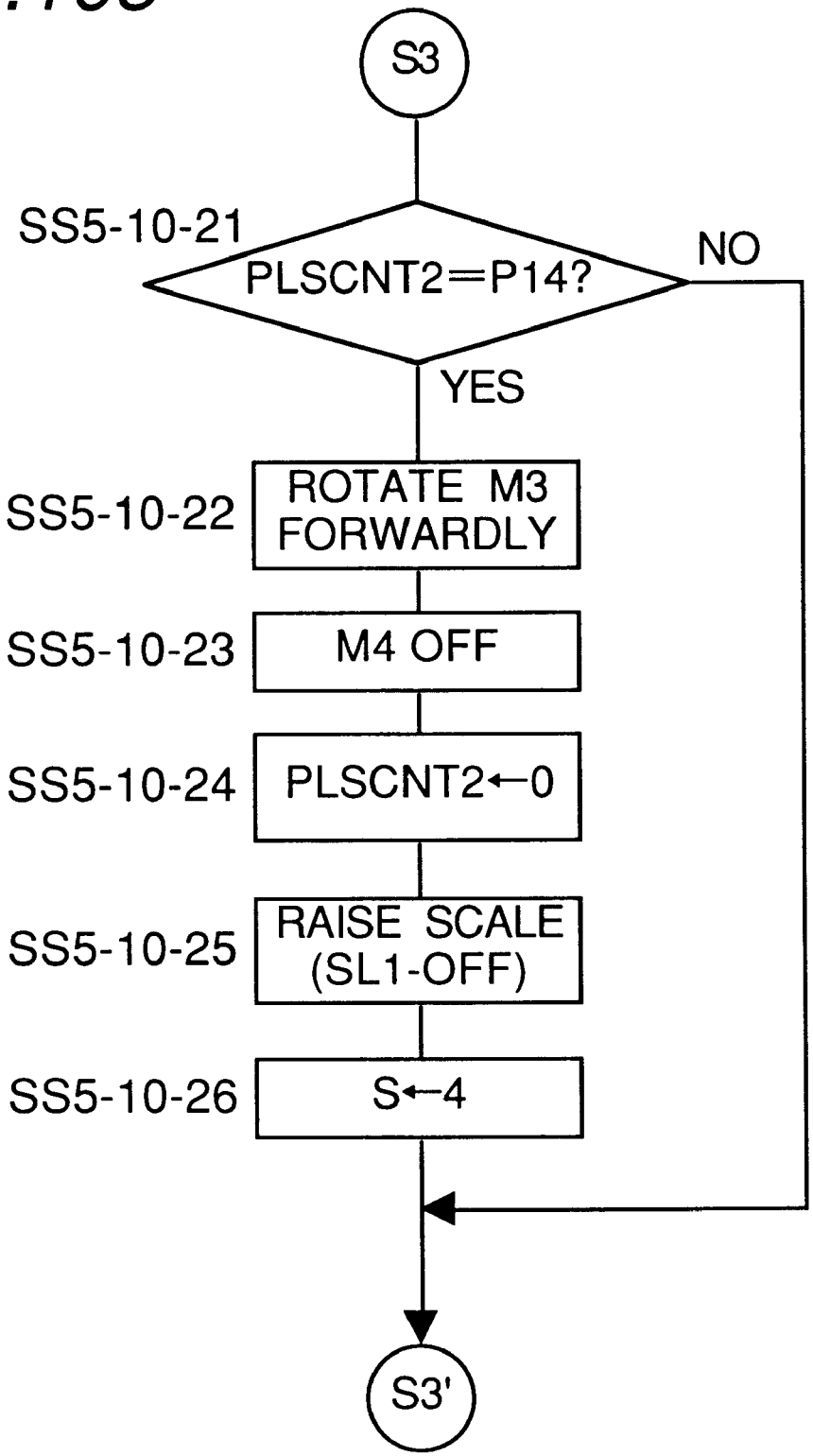
FIG. 103 is a flow chart showing a subroutine for double-side setting subsequent to FIG. 100.

As shown in FIG. 103, if the status S is "3", it is confirmed whether or not the pulse counter PLSCNT2 has reached P14, i.e., whether or not the document has moved fully onto the document glass 29 with the rear end of the document moved to a position 20 to 30 mm away from the scale 125. Then, when the pulse counter PLSCNT2 has reached P14, the main motor M3 is switched to forward rotation at SS5-10-22. By this operation, the document is conveyed on the document glass 29 toward the scale 125. Also, the discharge motor M4 is turned off at SS5-10-23. Next, the pulse counter PLSCNT2 is reset to "0" at SS5-10-24, and the solenoid SL1 is turned off at SS5-10-25 so that the scale 125 is moved up, thus providing for the front-end restriction of the document. Finally, the status S is set to "4" at SS5-10-26.

Figure 104:
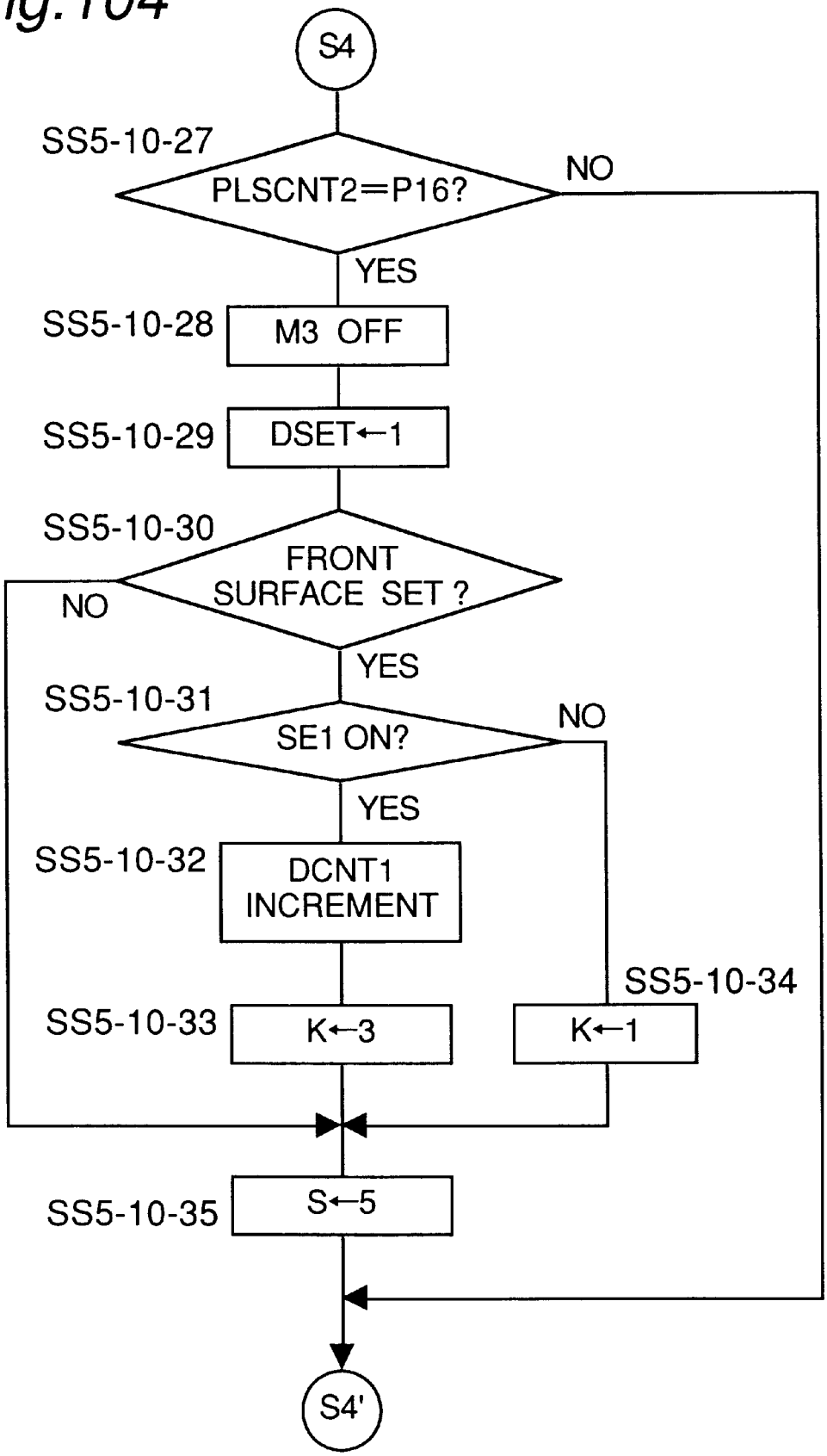
FIG. 104 is a flow chart showing a subroutine for double-side setting subsequent to FIG. 100.

As shown in FIG. 104, if the status S is "4", it is decided at SS5-10-27 whether or not the pulse counter PLSCNT2 is P16, i.e., whether or not the document has been conveyed until an end portion of the document on the scale 125 side is restricted by the scale 125. Then, if the pulse counter PLSCNT2 has reached P16, the main motor M3 is turned off at SS5-10-28, and the DSET is set to "1" at SS5-10-29 so that the pickup roller is returned to the home position. Further, it is decided at SS5-10-30 whether the front surface of the document is set into a copying state or the rear surface of the document is set into a copying state. At this step, if the front surface of the document is set into a copying state, it is detected at SS5-10-31 whether or not there is a succeeding document sheet on the document tray 60. If there is, the document counter DCNT1 is set to "1" at SS5-10-32 and thereafter the status K is set to "3" at SS5-10-33, whereby the succeeding document is fed. If there is no succeeding document, the status K is set to "1" at SS5-10-34 and the status S is set to "5" at SS5-10-35. In addition, if it is decided at SS5-10-30 that the rear surface of the document is set into a copying state, the status S is set to "5" at SS5-10-35 without executing the operations of SS5-10-31 to -34.

Figure 105:
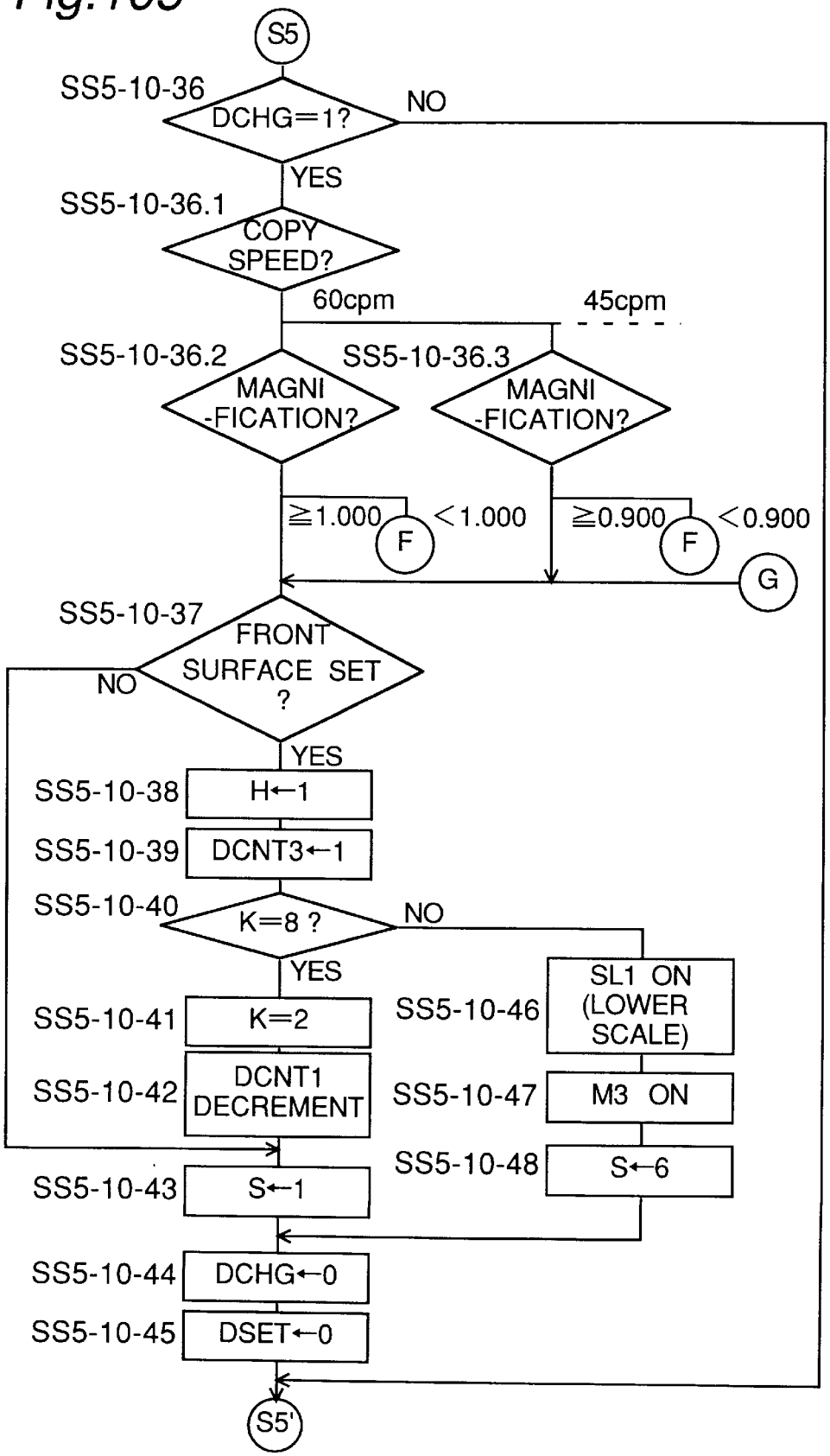
FIG. 105 is a flow chart showing a subroutine for double-side setting subsequent to FIG. 100.

As shown in FIG. 105, if the status S is "5", it is decided at SS5-10-36 whether or not the document-replacement request signal DCGH is set to "1" in the copying machine main body 1. The following operations are executed only when the DCHG is "1". If the flag DCHG is "1", the copy speed is checked at SS5-10-36.1, and the magnification is checked for each speed at SS5-10-36.2 and SS5-10-36.3. If the copy speed is 60 cpm and the magnification is not less than 1, or if the copy speed is 45 cpm and the magnification is not less than 0.9, then the following operations are executed.

It is decided at SS5-10-37 whether or not the document is completely set into a front-surface copying state. Subsequently, if the DCHG is set to "1", requesting a document replacement, and if the document is set into a front-surface copying state, then a paper-discharge control counter H is set to "1" at SS5-10-38 and the counter DCNT3 for the number of document sheets to be discharged is set to "1" at SS5-10-39. Further, it is decided at SS5-10-40 whether or not the status K is set to "8", i.e., whether or not the succeeding document is set into a first-out feeding state. If the succeeding document is in the first-out feeding state, then the status K is changed to "2" at SS5-10-42, and the counter DCNT1 is decremented at SS5-10-42. Also, the status S is set to "1" at SS5-10-43, the DCHG is set to "0" at SS5-10-44, and the DSET is set to "0" at SS5-10-45. Meanwhile, if the status K is decided at SS5-10-40 not to be "8", then the solenoid SL1 is turned on so that the scale 125 is moved down, and the main motor M3 is driven at SS5-10-47 so that the document on the document glass 29 is discharged to the discharge section. Further, the status S is set to "6" at SS5-10-48, so that the operation enters the discharge process of the final document sheet, and the DCHG is set to "0" at SS5-10-44 and the DSET is set to "0" at SS5-10-45. If it is decided at SS5-10-37 that the document is set in a rear-surface copying state, then the operations of SS5-10-43 to -45 are executed.

Figure 106:
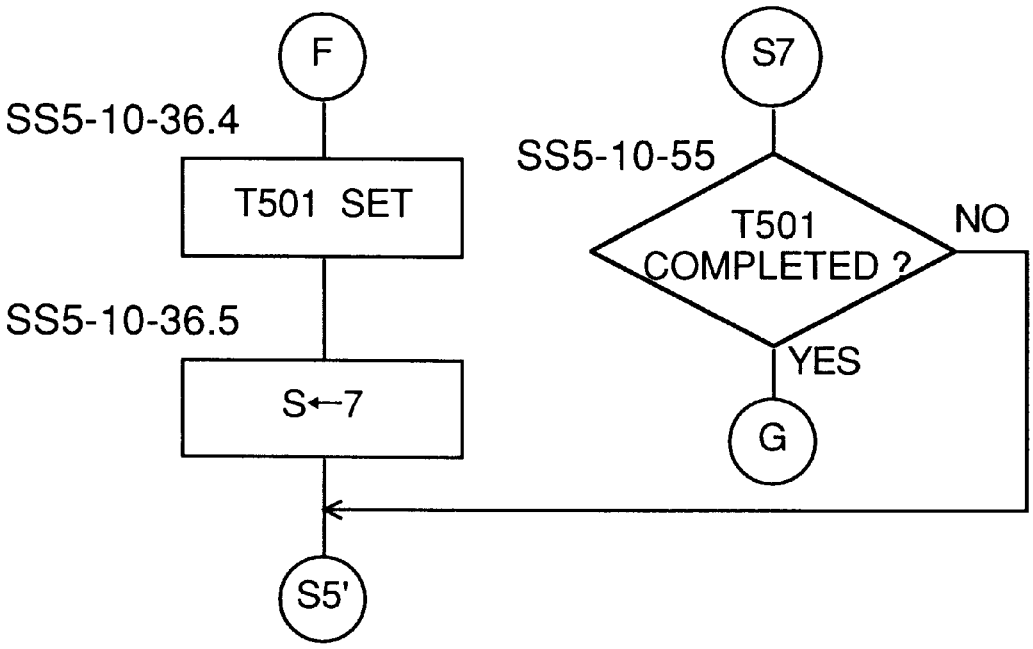
FIG. 106 is a flow chart showing a subroutine for double-side setting subsequent to FIGS. 100 and 105.

As a result of confirmation of the copy speed and the magnification at SS5-10-36.1 to SS5-10-36.3, if the copy speed is 60 cpm and the magnification is less than 1 or if the copy speed is 45 cpm and the magnification is less than 0.9, then the timer T503 is set at SS5-10-36.4, the status S is set to "7" at SS5-10-36.5, and the program returns, as shown in FIG. 106. The timer T503 is purposed to provide timing from an end of scan to a start of document replacement.

In the case where the status S is "7", as shown in FIG. 106, if the T501 has completed at SS5-10-55, the above-mentioned steps of SS5-10-36 to SS5-10-48 are processed.

Figure 107:
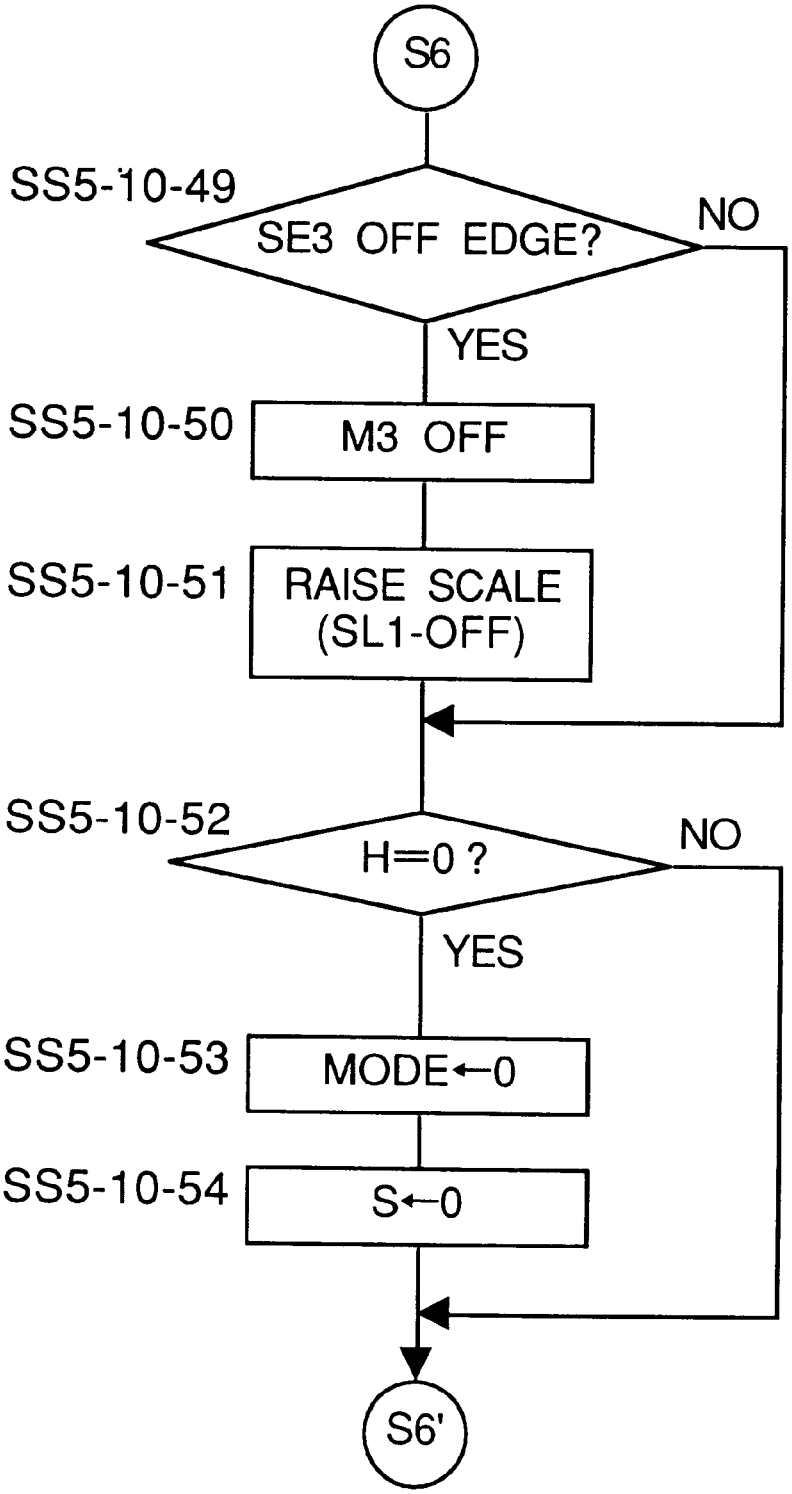
FIG. 107 is a flow chart showing a subroutine for double-side setting subsequent to FIG. 100.
Figure 108:
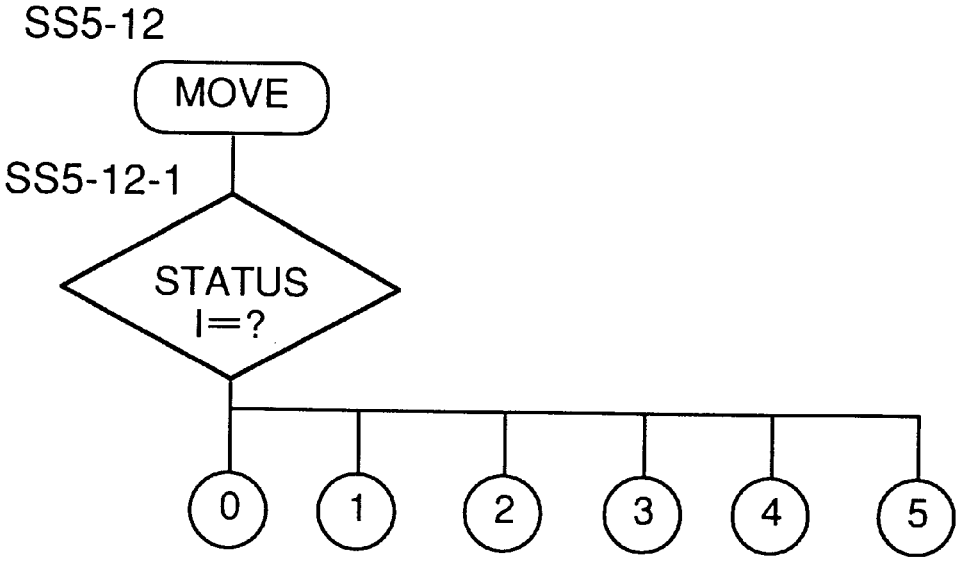
FIG. 108 is a flow chart showing a subroutine for move in the CPU 2.

As shown in FIG. 107, if the status S is "6", the OFF EDGE of the discharge sensor SE3, i.e., a document rear-end detection signal, is detected at SS5-10-49. If the OFF EDGE has been detected, whereby it is confirmed that the rear end of the document has passed the discharge sensor SE3, then the main motor M3 is turned off at SS5-10-50, and the solenoid SL1 is turned off at SS5-10-51 so that the scale 125 is moved up. Next, it is decided at SS5-10-52 whether or not the discharge control counter H is "0", i.e., whether or not the discharge of the document has been completed. Then, if the discharge has been completed, the MODE is set to "0" at SS5-10-53, and the status S is set to "0" at SS5-10-54, thereby setting the standby state.

<Move>

FIGS. 108 through 114 show a subroutine for processing the move at SS5-12. First the status I is decided at SS5-12-1, and the subroutine is branched into processes of "0" to "5" according to the resulting values.

Figure 109:
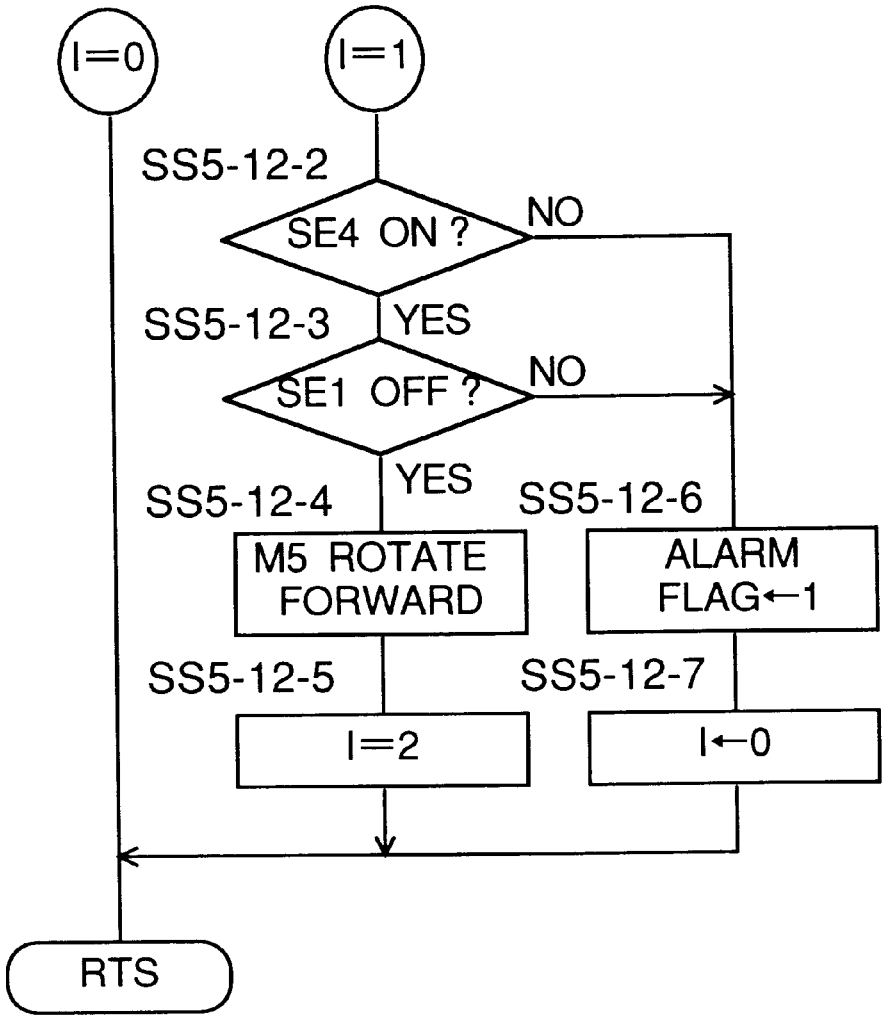
FIG. 109 is a flow chart showing a subroutine for move subsequent to FIG. 108.

As shown in FIG. 109, if the status I is "0", it is decided at SS5-12-2 and SS5-12-3 whether or not the on-discharge-tray sensor SE4 has been turned on, and whether or not the empty sensor SE1 has been turned off, respectively. If the on-discharge-tray sensor SE4 has been turned on and the empty sensor SE1 has been turned off, then all the document sheets have been once fed and discharged. Thus, the document moving motor M5 is rotated forward at SS5-12-4 to move the refeed lever 274 to the feed direction and the status I is set to "2" at SS5-12-5. If the on-discharge-tray sensor SE4 has been turned off, the discharged document sheets have been taken out, so that the alarm flag is set to "1" at SS5-12-6 and the status I is set to "0" at SS5-12-7. If the empty sensor SE1 has been turned on even with the on-discharge-tray sensor SE4 on, there are document sheets left in the feed port, so that the alarm flag is set to "1" at SS5-12-6 and the status I is set to "0" at SS5-12-7.

Figure 110:
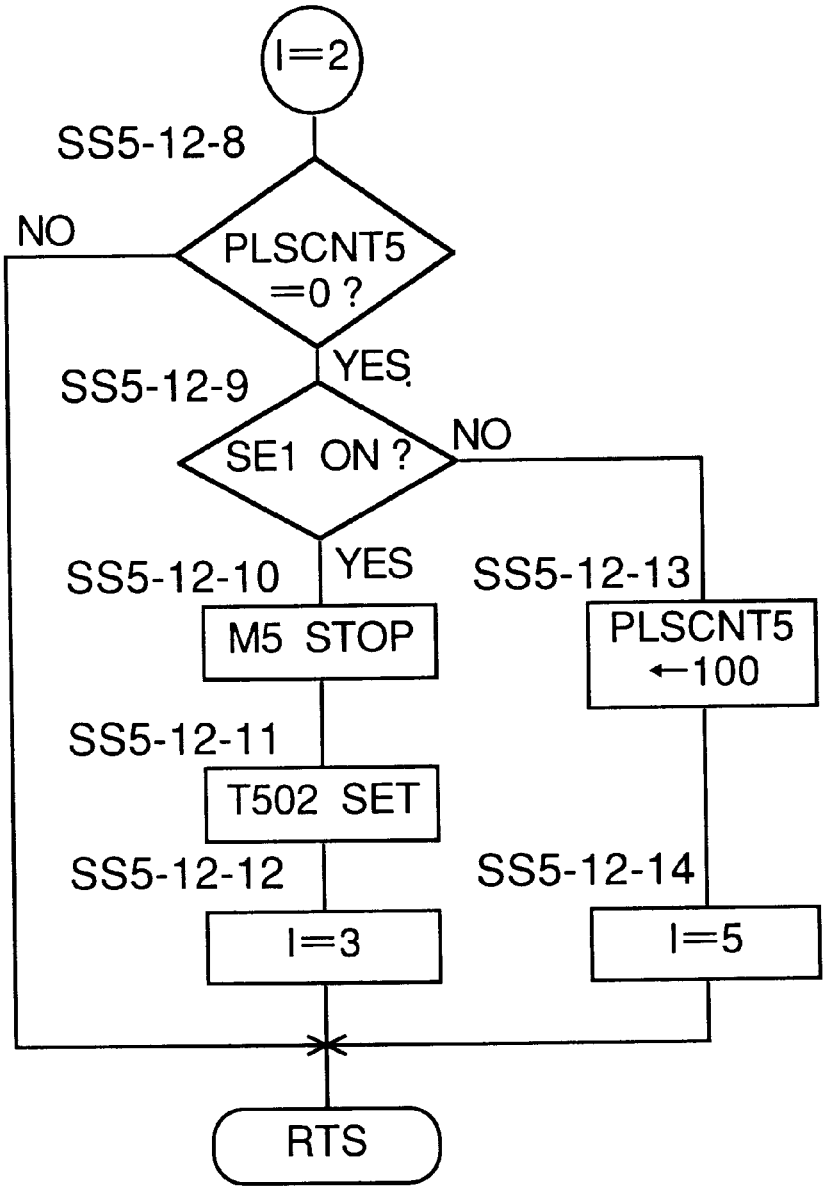
FIG. 110 is a flow chart showing a subroutine for move subsequent to FIG. 108.

If the status I is "2", it is decided at SS5-12-8 whether or not the pulse counter PLSCNT5 is "0" and, only when it is "0", the following operations are executed, as shown in FIG. 110. It is decided at SS5-12-9 whether or not the empty sensor SE1 has been turned on. If it is turned on, i.e. when the discharged document have been moved to the feed port 61 by the refeed lever 274, the document moving motor M5 is stopped at SS5-12-10, the timer T502 is set at SS5-12-11, and the status I is set to "3" at SS5-12-12. If the empty sensor SE1 has been turned off, in order to continue the movement of the redeed lever 274, the pulse counter PLSCNT5 is set to "100" at SS5-12-13 and the status I is set to "5" at SS5-12-14.

Figure 111:
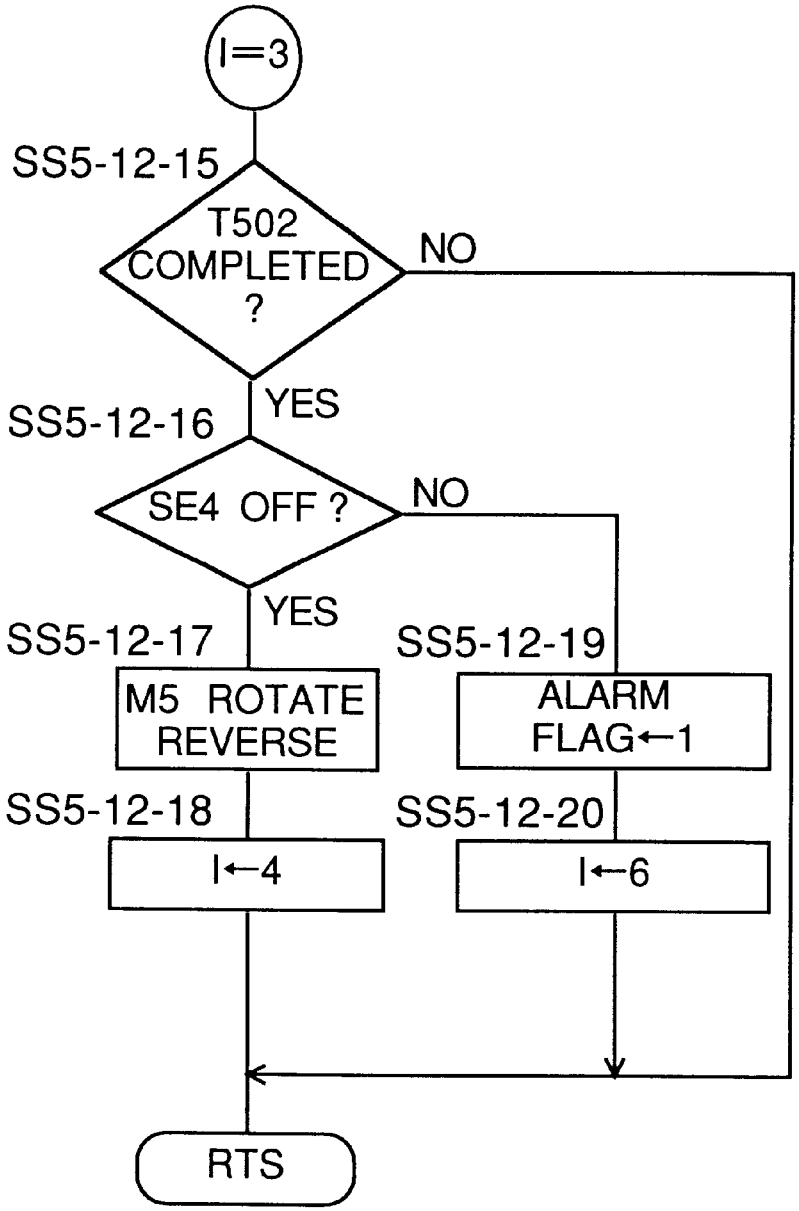
FIG. 111 is a flow chart showing a subroutine for move subsequent to FIG. 108.

If the status I is "3", it is decided at SS5-12-15 whether or not the timer T503 has completed the count and, only when it has completed, the following operations are executed, as shown in FIG. 111. It is decided at SS5-12-16 whether or not the on-discharge-tray sensor SE4 has been turned off. If the on-discharge-tray sensor SE4 has been turned off, the document moving motor M5 is rotated reverse at SS5-12-17 to move the refeed lever 274 to the direction of the discharge port 62. Then, the status I is set to "4" at SS5-12-18. If the on-discharge-tray sensor SE4 has been turned on, the alarm flag is set to "1" at SS5-12-19 and the status I is set to "6" at SS5-12-20.

Figure 112:
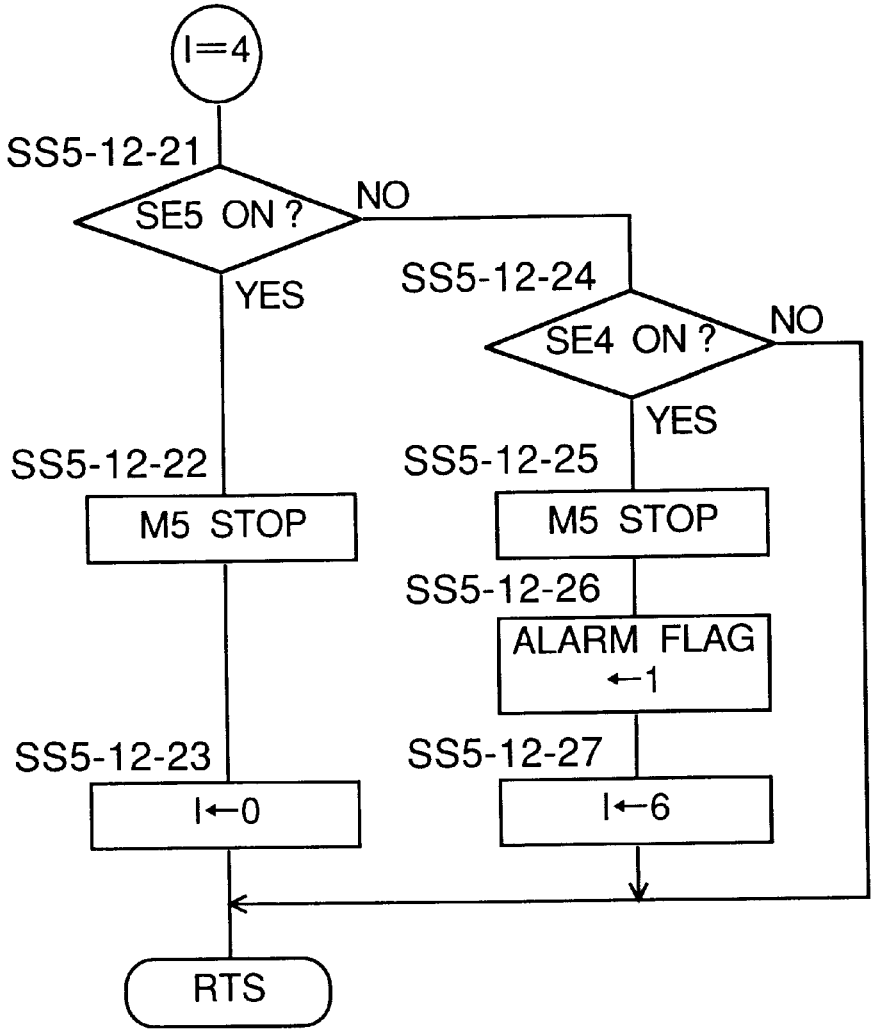
FIG. 112 is a flow chart showing a subroutine for move subsequent to FIG. 108.

If the status I is "4", it is decided at SS5-12-21 whether or not the refeed-lever home sensor SE5 has been turned on, as shown in FIG. 112. If the document-moving-lever home sensor SE5 has been turned on and is in the home position, then the document moving motor M5 is stopped at SS5-12-22 and the status I is set to "0" at SS5-12-23. If the refeed-lever home sensor SE5 has been turned on and is not in the home position, then it is decided at SS5-12-24 whether or not the on-discharge-tray sensor SE4 has been turned on. If it has been turned on, the document has been placed on the document tray so that the document moving motor M5 is stopped at SS5-12-25, the alarm flag is set to "1" at SS5-12-26, and the status I is set to "6" at SS5-12-27.

Figure 113:
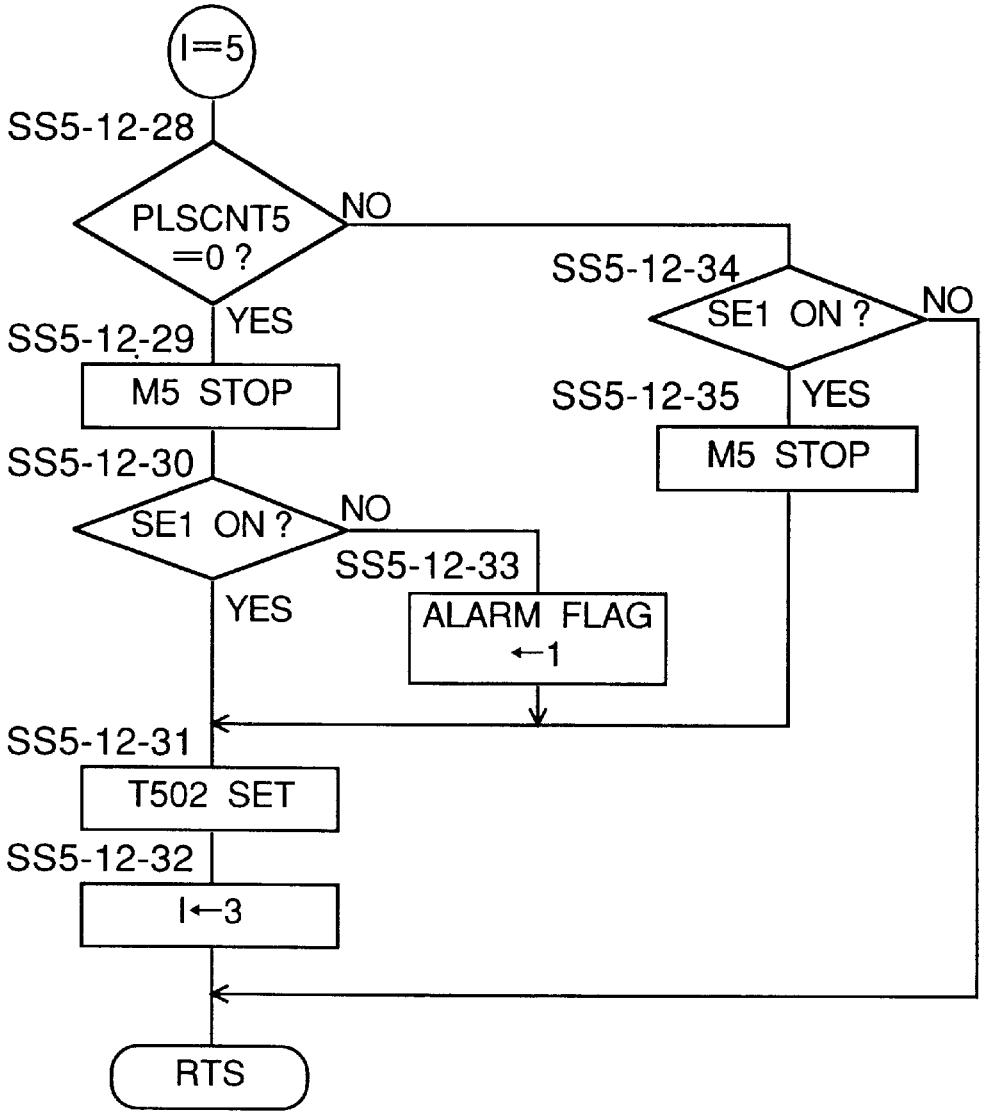
FIG. 113 is a flow chart showing a subroutine for move subsequent to FIG. 108.

If the status I is "5", it is decided at SS5-12-28 whether or not the pulse counter PLSCNT5 is "0" as shown in FIG. 113. If the pulse counter PLSCNT5 is "0", i.e. when the quantity of 100 minutes of movement added at the previous process of SS-12-13 of FIG. 110 has been finished, then the document moving motor M5 is stopped at SS5-12-29. Then, it is decided at SS5-12-30 whether or not the empty sensor SE1 has been turned on.

If it has been turned on, the timer T502 is set at SS5-12-31. If not, i.e. when the document which can be moved to the feed port 61 by the refeed lever and detected by the empty sensor SE1 if normally operated have not been detected, the alarm flag is set to "1" at SS5-12-33. Thereafter, the timer T502 is set at SS5-12-31 and the status I is set to "3" at SS5-12-32. Also, if the PLSCNT5 is not "0" at SS5-12-28, then it is decided at SS5-12-34 whether or not the empty sensor SE1 has been turned on. Only when it has been turned on, the document moving motor M5 is stopped at SS5-12-35, the timer T502 is set at SS5-12-31, and the status I is set to "3" at SS5-12-32.

Figure 114:
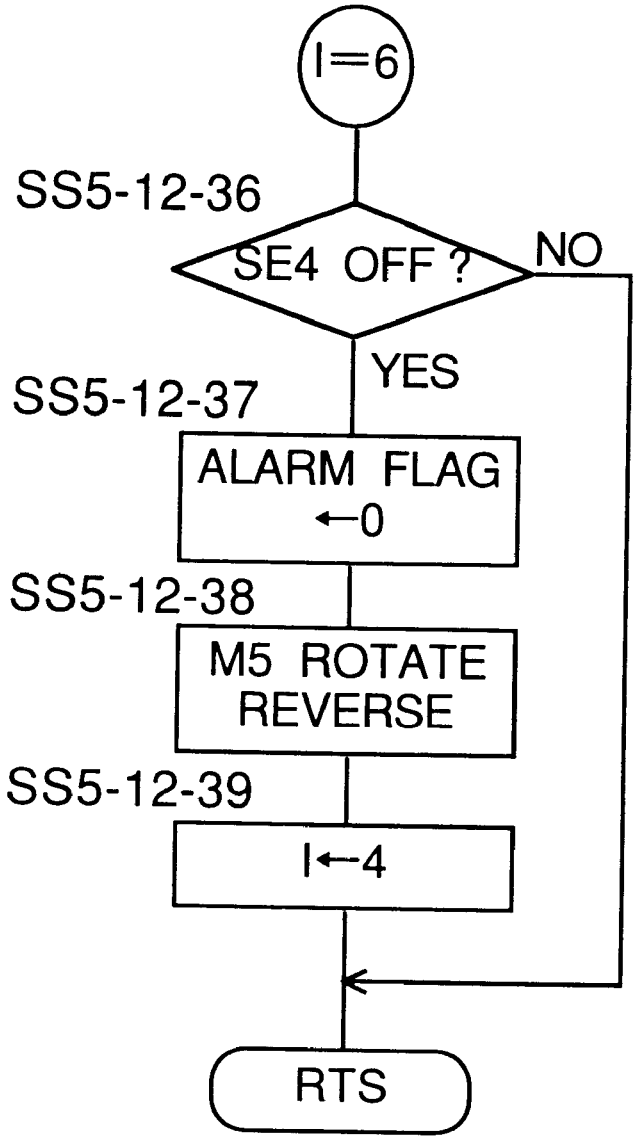
FIG. 114 is a flow chart showing a subroutine for move subsequent to FIG. 108.

If the status I is "6", it is decided at SS5-12-36 whether or not the on-discharge-tray sensor SE4 has been turned off as shown in FIG. 114. Only when it has been turned off, the following operations are processed. The alarm flag is set to "0" at SS5-12-37, the document moving motor M5 is rotated reverse at SS5-12-38, and the status I is set to "4" at SS5-12-39.

<End-Restricting Stopper Control>

FIGS. 115 through 122 show a subroutine for processing the end-restricting stopper control at SS5-13. First the status "HS" is decided at SS5-13-1 and the subroutine is branched into processes of "0" to "8" according to the resulting values.

Figure 116:
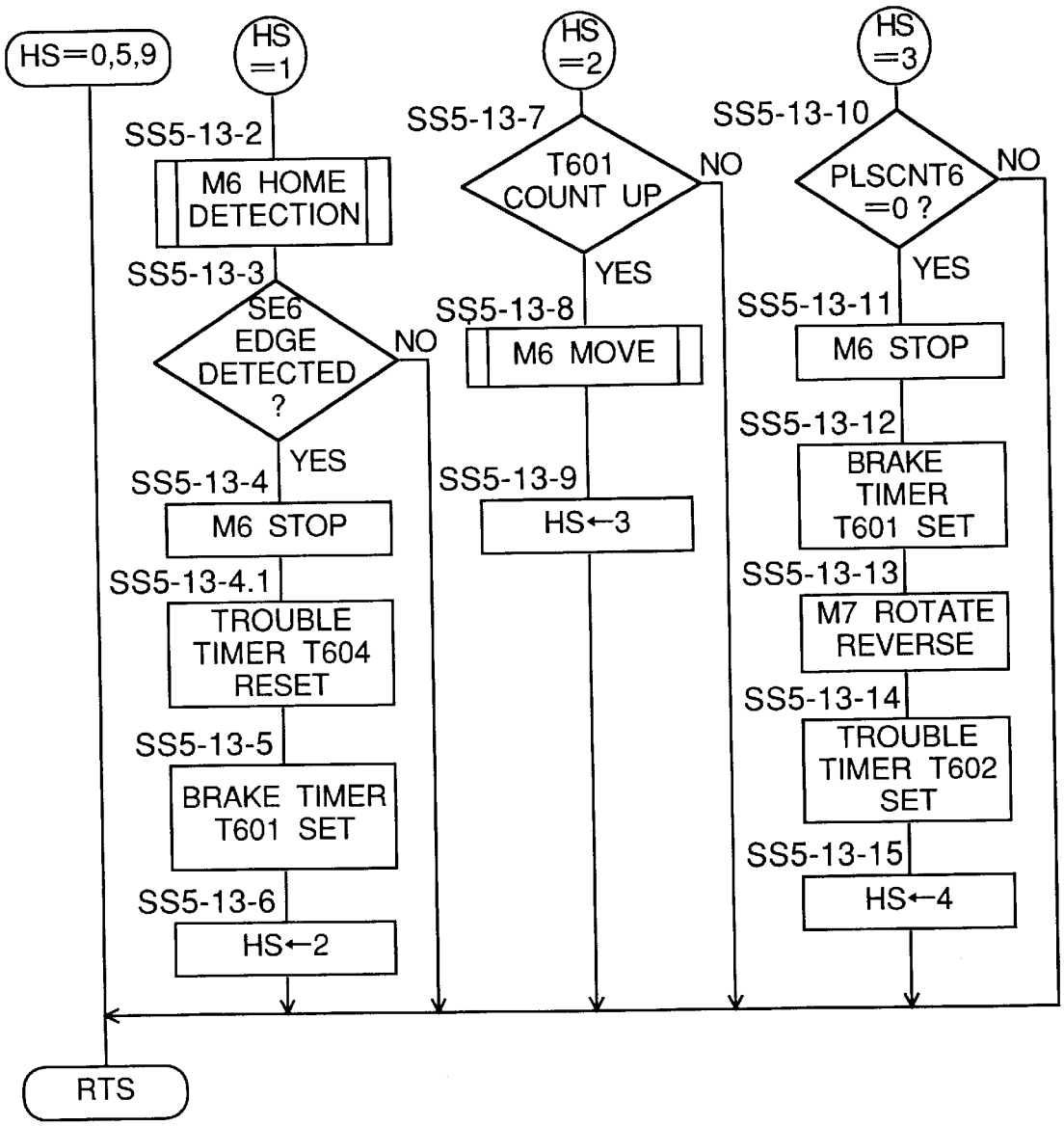
FIG. 116 is a flow chart showing a subroutine for end-restricting stopper control subsequent to FIG. 115.

As shown in FIG. 116, if the status HS is "0", nothing is processed. If the status HS is "1", the home detection subroutine for the FD alignment motor M6 is executed at SS5-13-2 to move the second slider 193 of the drive mechanism of the discharge document stopper 174 to the home sensor. It is decided at SS5-13-3 whether or not the FD alignment sensor SE6 has detected the edge, and only when it has detected the edge, i.e. when the second slider 193 has moved to the home position has completely stopped, the following operations are executed. That is, the FD alignment motor M6 is stopped at SS5-13-4, the trouble timer T604 is reset at SS5-13-4.1, the brake timer T601 is set at SS5-13-5, and the status HS is set to "2" at SS5-13-6.

If the status HS is "2", it is decided at SS5-13-7 whether or not the timer T601 has counted up. Only when it has counted up and the second slider 193 moved to the home position has completely stopped, the moving process of the FD alignment motor M6 is executed at SS5-13-8 and the status HS is set to "3" at SS5-13-9. In the subroutine SS-13-7, as described in detail hereinafter, in accordance with the size of the document discharged on the document tray 60, drive amount and direction of the FD alignment motor M6 are set to commence to drive the FD alignment motor M6 and move the first slider 191.

If the status HS is "3", it is decided at SS5-13-10 whether or not the PLSCNT6 is "0". Only when it is "0", i.e. when the drive corresponding to the drive pulse set at SS-13-8 has been finished, the FD alignment motor M6 is stopped at SS5-13-11. Thereby, any one of the pressing members 213 opposes to the drive pin 196 which corresponds to the stopper 174 according to the document size. The brake timer T601 is set at SS5-13-12, the CD alignment motor M7 is rotated reverse at SS5-13-13, the trouble timer T602 is set at SS5-13-14, and the status HS is set to "4" at SS5-13-15. The reverse rotation of the CD alignment motor M7 causes the second slider 193 to commence to move to the right direction in FIG. 24 from the home position.

Figure 117:
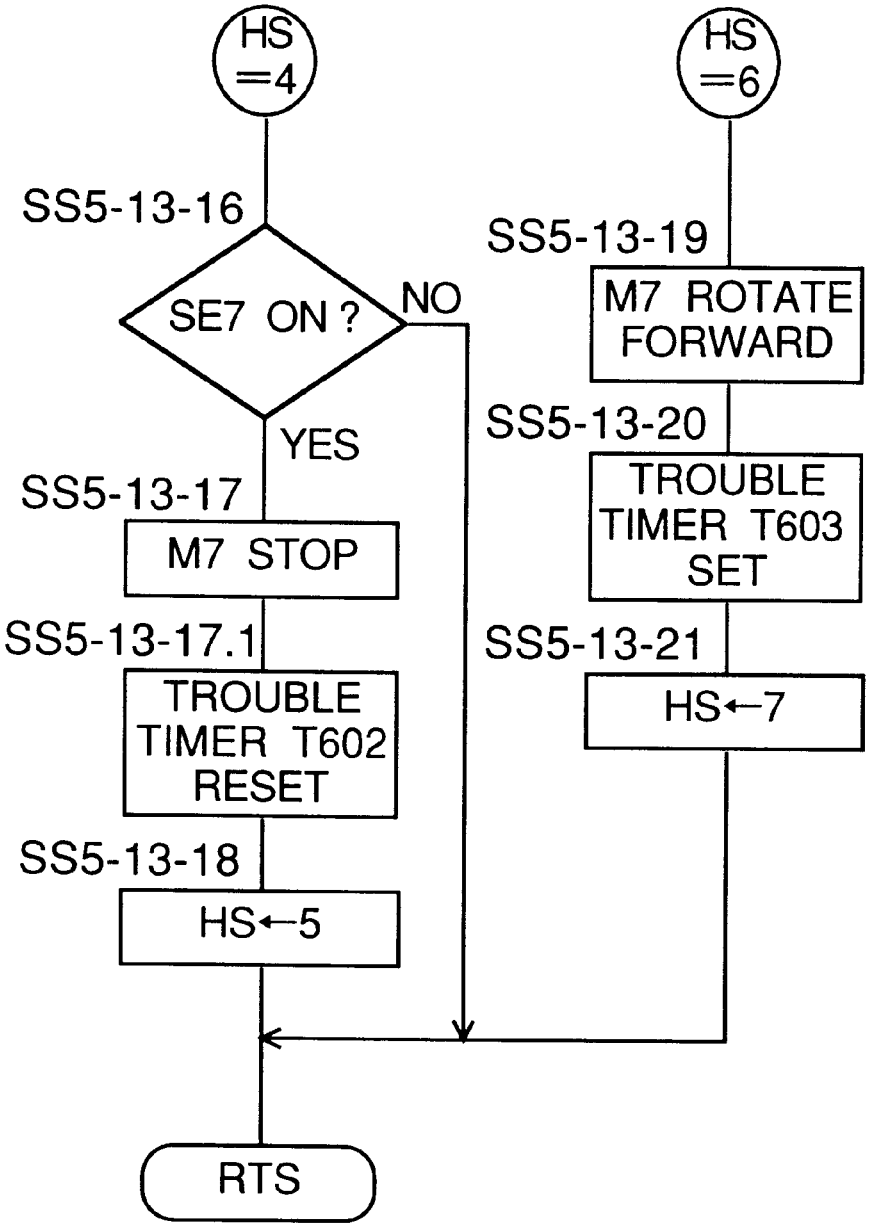
FIG. 117 is a flow chart showing a subroutine for end-restricting stopper control subsequent to FIG. 115.

As shown in FIG. 117, if the status HS is "4", it is decided at SS5-13-16 whether or not the CD1 alignment sensor SE7 has been turned on. Only when it has been turned on, i.e. when the movement of the second slider 193 which had commenced to move at above SS-13-13 has been completed, the CD alignment motor M7 is stopped at SS5-13-17. Thereby, the stopper 174 corresponding to the document size has completed to move to the restricting position. The trouble timer T602 is reset at SS5-13-17.1, and the status HS is set to "4" at SS5-13-18.

If the status HS is "5", nothing is processed. If the status HS is "6", the CD alignment motor M7 is rotated forward at SS5-13-19 to commence to move the stopper 174 positioned at the restriction position toward the withdrawal position. The trouble timer T603 is set at SS5-13-20, and the status HS is set to "7" at SS5-13-21.

Figure 118:
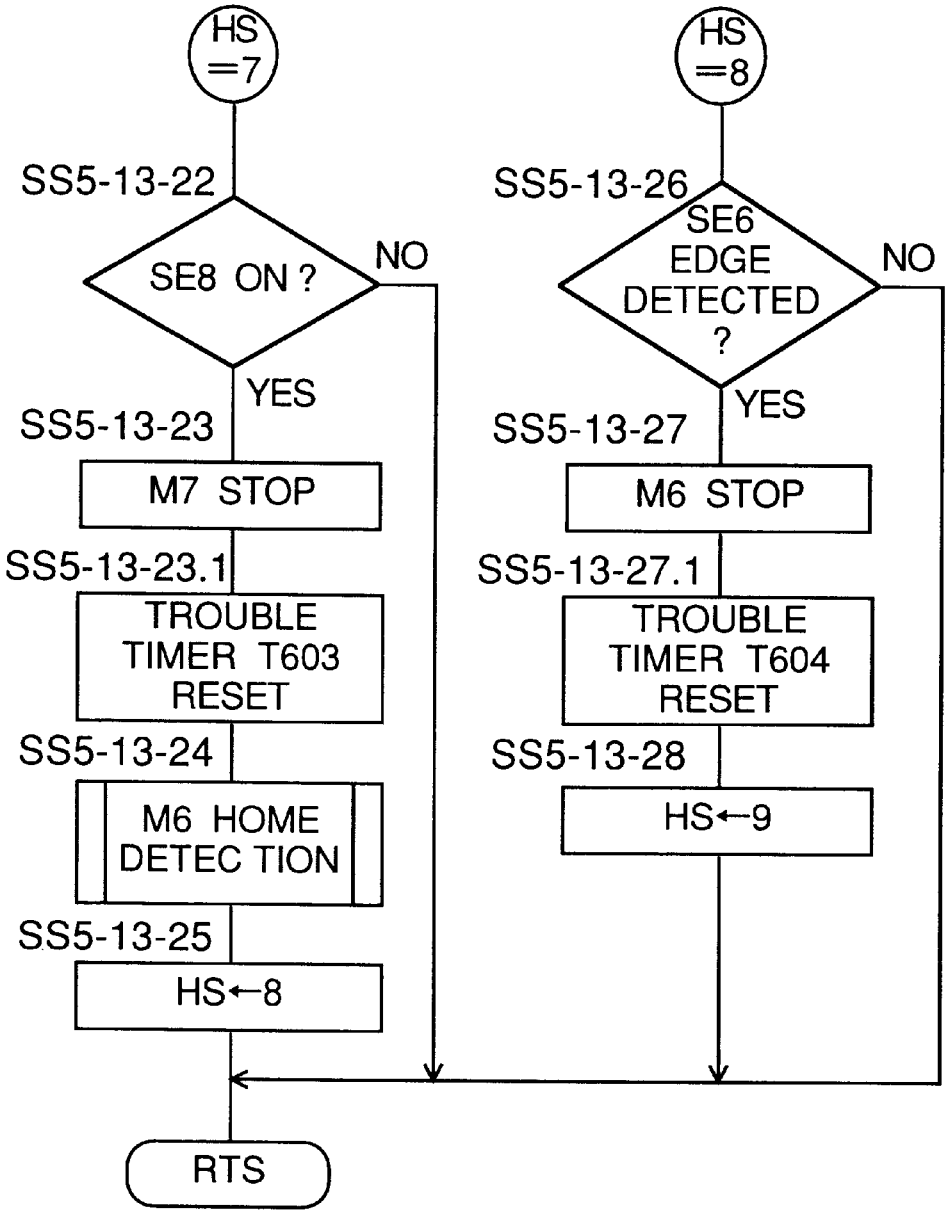
FIG. 118 is a flow chart showing a subroutine for end-restricting stopper control subsequent to FIG. 115.

As shown in FIG. 118, if the status HS is "7", it is decided at SS5-13-22 whether or not the CD2 alignment sensor SE8 has been turned on. Only when it has been turned on, i.e. when the completion of the movement of the discharged document stopper 174 to the withdrawal position has been detected, the CD alignment motor M7 is stopped at SS5-13-23. The trouble timer T603 is reset at SS5-13-23.1, the M6 home detection subroutine is executed at SS5-13-24 to move the second slider 193 of the drive mechanism of the discharged document stopper 174 to the home position. Then, the status HS is set to "8" at SS5-13-25.

If the status HS is "8", it is decided at SS5-13-26 whether or not the FD alignment sensor SE6 has been turned on. Only when it has been turned on, the FD alignment motor M6 is stopped at SS5-13-27, the trouble timer T604 is reset at SS5-13-27.1, and the status HS is set to "9" at SS5-13-28.

Figure 119:
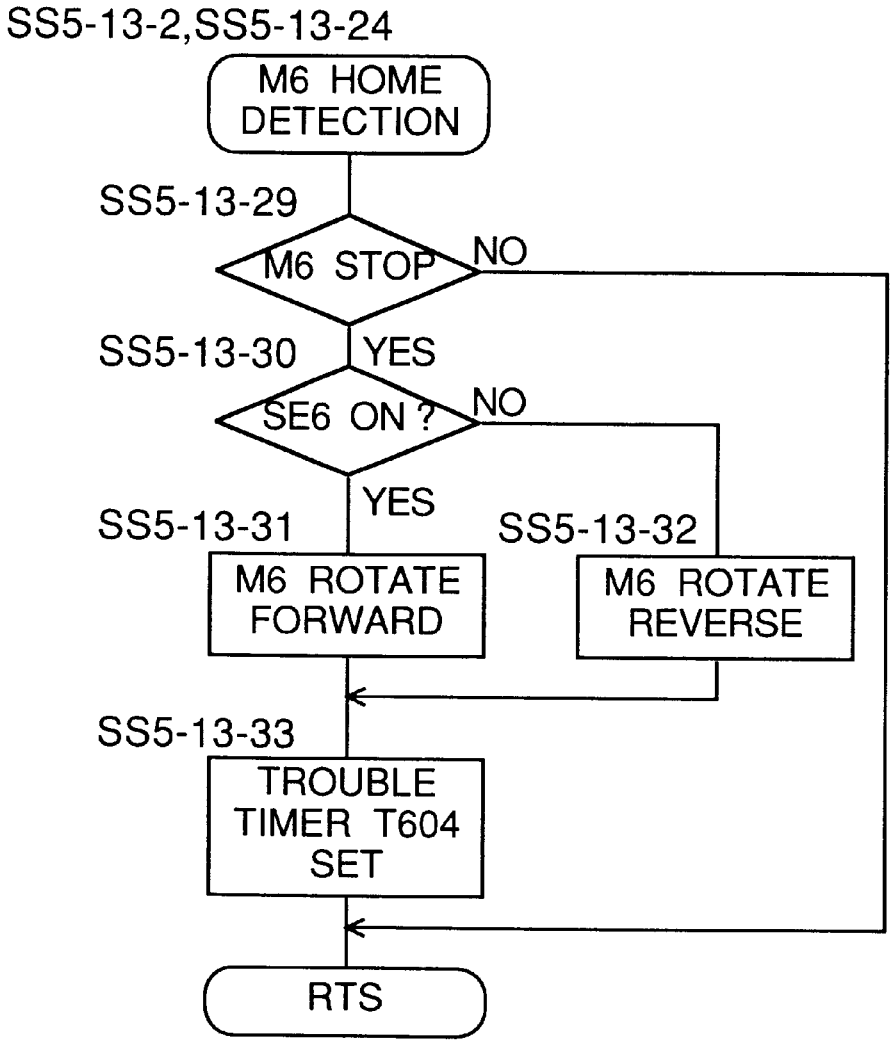
FIG. 119 is a flow chart showing a subroutine for M6 home detection.

FIG. 119 shows a M6 home detection subroutine at SS5-13-2 and SS5-13-24. It is decided at SS5-13-29 whether or not the FD alignment motor M6 has been stopped. Only when it has been stopped, the following operations are executed. It is decided at SS5-13-30 whether or not the FD alignment sensor SE6 has been turned on. If it has been turned on, the FD alignment motor is rotated forward at SS5-13-31; if not, the FD alignment motor is rotated reverse at SS5-13-32. Then, the trouble timer T604 is set at SS5-13-33.

Figure 120:
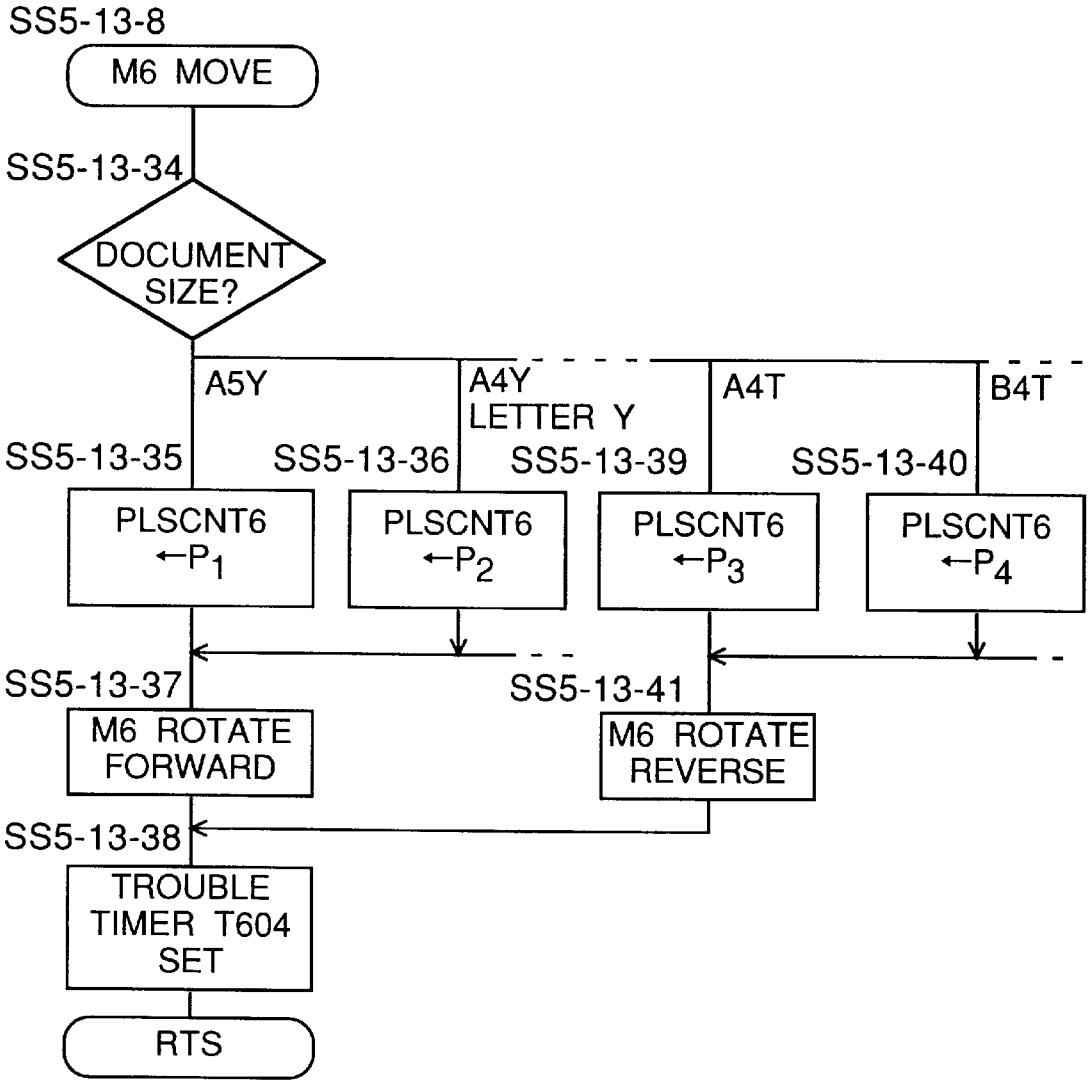

FIG. 120 shows a M6 move subroutine at SS5-13-8. The document size is discriminated at SS5-13-34. If the document size is A5Y, then the pulse counter PLSCNT6 is set to P1 at SS5-13-35; if the document size is A4Y, letter Y, then the pulse counter PLSCNT6 is set to "2" at SS5-13-36, the FD alignment motor is rotated forward at SS5-13-37, and the trouble timer T601 is set at SS5-13-38. Also, if the document size is A4T, then the pulse counter PLSCNT6 is set to P3 at SS5-13-39; if the document size is B4T, then the pulse counter PLSCNT6 is set to "4" at SS5-13-40, the FD alignment motor is rotated reverse at SS5-13-41, and the trouble timer T604 is set at SS5-13-38.

Figure 121:
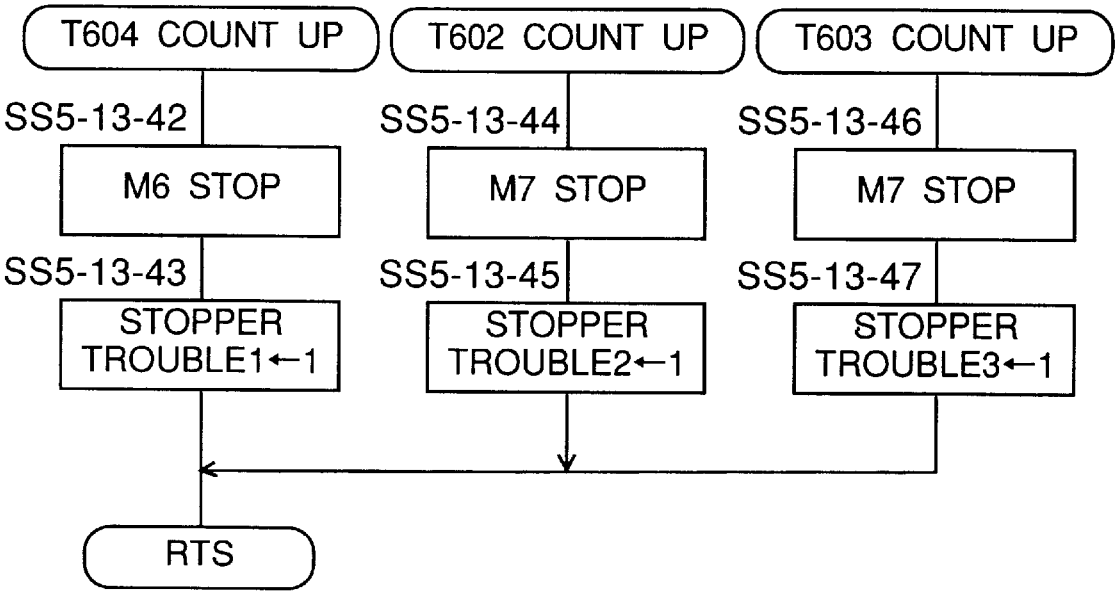

FIG. 121 shows count-up processes of the trouble timer T604 set at SS5-13-33 and SS5-13-38, the trouble timer T602 set at SS5-13-14 and the trouble timer T603 set at SS5-13-20. In the count-up process of the trouble timer T604, the FD alignment motor M6 is stopped at SS5-13-42, and a stopper trouble 1 is set to "1" at SS5-13-43. In the count-up process of the trouble timer T602, the CD alignment motor M7 is stopped at SS5-13-44, and a stopper trouble 2 is set to "1" at SS5-13-45. In the count-up process of the trouble timer T603, the CD alignment motor M7 is stopped at SS5-13-46, and a stopper trouble 3 is set to "1" at SS5-13-43.

By the process as described above, the count up of each timer which cannot counted up if normally operated is detected so that the abnormality of the document discharge stopper 174 is detected. If the abnormality is detected, the drive of the motor is stropped to prohibit the use and operation of the ADF2.

<Document Move Prevent Control>

Figure 122:
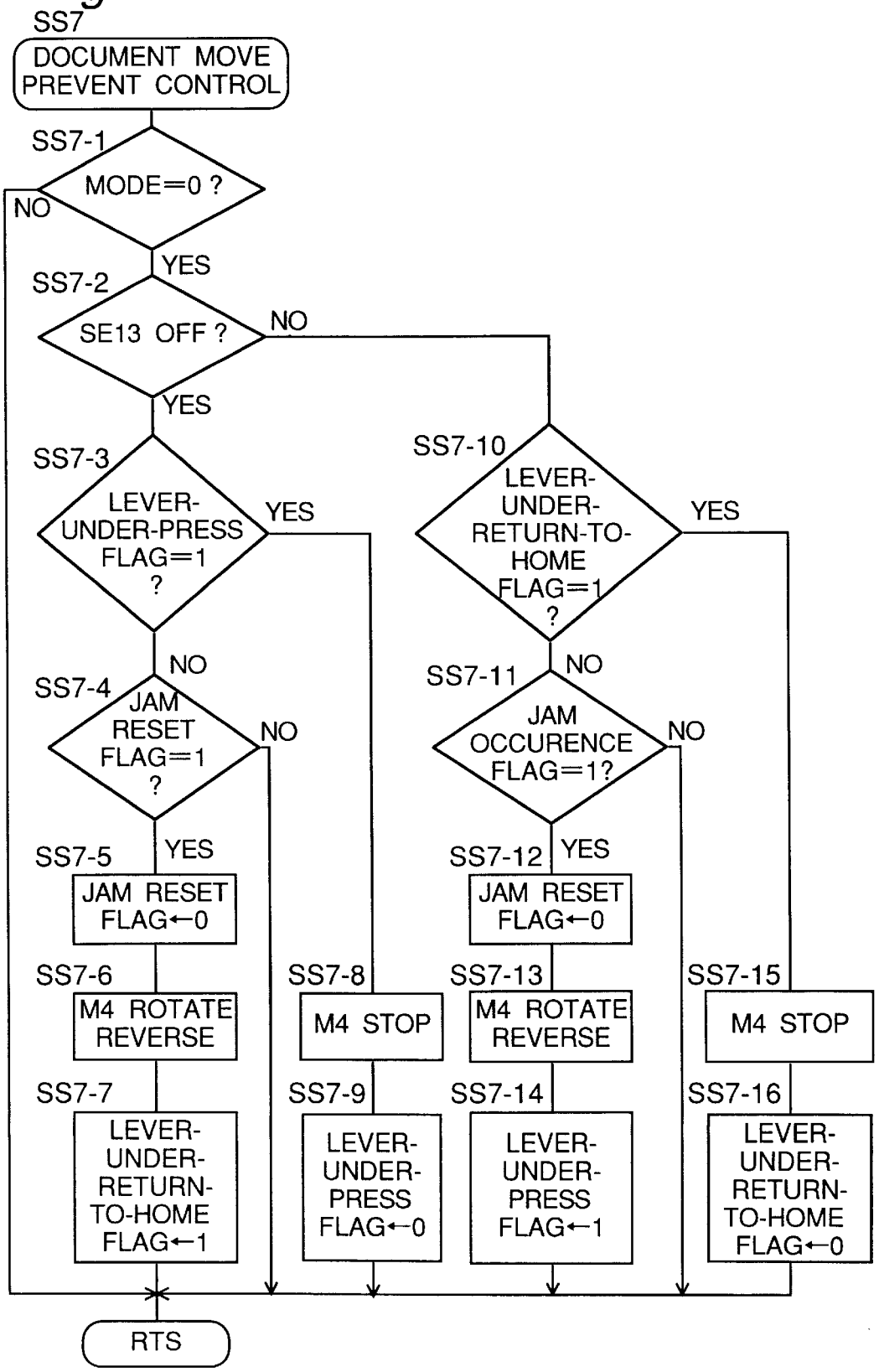

FIG. 122 shows a document-move-prevent control subroutine to be executed at SS7. It is decided at SS7-1 whether or not the MODE is "0", i.e., whether or not the ADF is on standby. Then, only when the MODE is "0", the following operations are executed. It is decided at SS7-2 whether or not a document-move-prevent-lever home sensor SE13 has been turned off. If the document-move-prevent-lever home sensor SE13 has been turned off, it is decided at SS7-3 and SS7-4 whether or not a lever-under-press flag is "1" and whether or not a JAM reset flag is "1", respectively. If the lever-under-press flag is not "1" and the JAM reset flag is "1", then the JAM reset flag is set to "0" at SS7-5, the discharge lever M4 is rotated reverse at SS7-6, and a lever-under-return-to-home flag is set to "1" at SS7-7. If the lever-under-press flag is not "1" and the JAM reset flag is not "1" either, then nothing is processed. If the lever-under-press flag is "1", the discharge lever M4 is stopped at SS7-8 and thereafter the lever-under-press flag is set to "0" at SS7-9

If the document-move-prevent-lever home sensor SE13 has been turned on, it is decided at SS7-10 and SS7-11 whether or not the lever-under-return-to-home flag is "1", and whether or not the JAM occurrence flag is "1", respectively. If the lever-under-return-to-home flag is not "1" and the JAM occurrence flag is "1", then the JAM occurrence flag is set to "0" at SS7-12, the discharge motor M4 is rotated reverse at SS7-13, and the lever-under-press flag is set to "1" at SS7-14. If the lever-under-return-to-home flag is not "1" and the JAM occurrence flag is not "1" either, then nothing is processed. If the lever-under-return-to-home flag is "1", the discharge motor M4 is stopped at SS7-15 and thereafter the lever-under-return-to-home flag is set to "0" at SS7-16.

What is claimed is:

1. A sheet conveying apparatus for conveying a sheet in recirculation, comprising:

a feed tray on which a plurality of sheets are set;

a feed mechanism for feeding the plurality of sheets set on the feed tray one by one;

a recirculation conveying mechanism for conveying a sheet fed by the feed mechanism to return it to the feed tray, the recirculation conveying mechanism including a discharge tray on which the plurality of sheets are temporally discharged and accumulated and a moving mechanism for moving the sheets accumulated on the discharge tray to the feed tray;

a feed sensor detecting whether or not any sheets are present on the feed tray; and a controller which moves the sheets discharged on the discharge tray to the feed tray by the moving mechanism when all sheets on the feed tray are fed and the feed sensor detects that no sheets are on the feed tray, wherein the moving mechanism includes a refeed lever which protrudes from the discharge tray and which is movable in the sheet conveying direction and the opposite direction thereof, whereby the sheets discharged on the discharge tray are moved to the feed tray with the refeed lever moved in the sheet conveying direction, wherein the feed tray and discharge tray have a continuous common surface, and wherein, in the case of allowing the sheets to recirculate, the sheets discharged on the discharge tray are pushed by the refeed lever and moved to the feed tray along the common surface, and wherein, in the case of allowing the sheets not to recirculate, the sheets discharged on the discharged tray are pushed by the refeed lever and moved to an intermediate position on the common surface between the discharge tray and the feed tray.

2. A sheet conveying apparatus for conveying a sheet in recirculation, comprising:

a feed tray on which a plurality of sheets are set;

a feed mechanism for feeding the plurality of sheets set on the feed tray one by one;

a recirculation conveying mechanism for conveying a sheet fed by the feed mechanism to return it to the feed tray, the recirculation conveying mechanism including a discharge tray on which the plurality of sheets are temporally discharged and accumulated and a moving mechanism for moving the sheets accumulated on the discharge tray to the feed tray;

a feed sensor detecting whether or not any sheets are present on the feed tray;

a controller which moves the sheets discharged on the discharge tray to the feed tray by the moving mechanism when all sheets on the feed tray are fed and the feed sensor detects that no sheets are on the feed tray; and a discharge sensor detecting whether or not any discharged sheets are present on the discharge tray, wherein the controller prohibits the movement of the sheets by the moving mechanism in the case where the discharge sensor detects that no discharged sheets are present on the discharge tray even if the feed sensor detects that no sheets are present on the feed tray.

3. A sheet conveying apparatus for conveying a sheet in recirculation, comprising;

a feed tray on which a plurality of sheets are set;

a feed mechanism for feeding the plurality of sheets set on the feed tray one by one;

a recirculation conveying mechanism for conveying a sheet fed by the feed mechanism to return it to the feed tray, the recirculation conveying mechanism including a discharge tray on which the plurality of sheets are temporally discharged and accumulated and a moving mechanism for moving the sheets accumulated on the discharge tray to the feed tray;

a feed sensor detecting whether or not any sheets are present on the feed tray; and a controller which moves the sheets discharged on the discharge tray to the feed tray by the moving mechanism when all sheets on the feed tray are fed and the feed sensor detects that no sheets are on the feed tray, wherein the moving mechanism includes a refeed lever which protrudes from the discharge tray and which is movable in the sheet conveying direction and the opposite direction thereof, whereby the sheets discharged on the discharge tray are moved to the feed tray with the refeed lever moved in the sheet conveying direction, and wherein the controller stops the movement of the refeed lever in the sheet conveying direction to return it in the opposite direction in the case where the feed sensor detects the presence of the sheets during the movement of the discharged sheets by the moving mechanism.

4. The sheet conveying apparatus according to claim 3, wherein the controller moves the discharged sheets a further predetermined distance in the case where the feed sensor does not detect the presence of the sheets even if the discharged sheets are moved a predetermined distance corresponding to the sheet size by the refeed lever.

5. The sheet conveying apparatus according to claim 4, wherein the controller stops the movement of the sheets by the refeed lever in the case where the feed sensor does not detect the presence of the sheets even if the discharged sheets are moved the further predetermined distance by the refeed lever.

6. A copying machine for executing copying of a document, comprising a document conveying apparatus for conveying the document to a copying position and circulating the document, and an image forming apparatus for copying the document conveyed to the copying position by the document conveying apparatus, the document conveying apparatus comprising:

a feed tray on which a plurality of documents are set;

a feed mechanism for feeding the plurality of documents set on the feed tray one by one;

a recirculation conveying mechanism for conveying a document fed by the feed mechanism to the copying position and for returning it to the feed tray, the recirculation conveying mechanism including a discharge tray on which the plurality of documents are temporally discharged and accumulated and a moving mechanism for moving the documents accumulated on the discharge tray to the feed tray;

a feed sensor detecting whether or not any documents are present on the feed tray; and a controller which moves the documents discharged on the discharge tray to the feed tray by the moving mechanism when all documents on the feed tray are fed and the feed sensor detects that no documents are present on the feed tray, wherein the moving mechanism includes a refeed lever which protrudes from the discharge tray and which is movable in the document conveying direction and the opposite direction thereof, whereby the documents discharged on the discharge tray are moved to the feed tray with the refeed lever moved in the document conveying direction, wherein the feed tray and discharge tray have a continuous common surface, and wherein, in the case of allowing the documents to recirculate, the documents discharged on the discharge tray are pushed by the refeed lever and moved to the feed tray along the common surface, and wherein, in the case of allowing the documents not to recirculate, the documents discharged on the discharged tray are pushed by the refeed lever and moved to an intermediate position on the common surface between the discharge tray and the feed tray.

7. A copying machine for executing copying of a document, comprising a document conveying apparatus for conveying the document to a copying position and circulating the document, and an image forming apparatus for copying the document conveyed to the copying position by the document conveying apparatus, the document conveying apparatus comprising:

a feed tray on which a plurality of documents are set;

a feed mechanism for feeding the plurality of documents set on the feed tray one by one;

a recirculation conveying mechanism for conveying a document fed by the feed mechanism to the copying position and for returning it to the feed tray, the recirculation conveying mechanism including a discharge tray on which the plurality of documents are temporally discharged and accumulated and a moving mechanism for moving the documents accumulated on the discharge tray to the feed tray;

a feed sensor detecting whether or not any documents are present on the feed tray;

a controller which moves the documents discharged on the discharge tray to the feed tray by the moving mechanism when all documents on the feed tray are fed and the feed sensor detects that no documents are present on the feed tray; and a discharge sensor detecting whether or not any discharged documents are present on the discharge tray, wherein the controller prohibits the movement of the documents by the moving mechanism in the case where the discharge sensor detects that no discharged documents are present on the discharge tray even if the feed sensor detects that no documents are present on the feed tray.

8. A copying machine for executing copying of a document, comprising a document conveying apparatus for conveying the document to a copying position and circulating the document, and an image forming apparatus for copying the document conveyed to the copying position by the document conveying apparatus, the document conveying apparatus comprising:

a feed tray on which a plurality of documents are set;

a feed mechanism for feeding the plurality of documents set on the feed tray one by one;

a recirculation conveying mechanism for conveying a document fed by the feed mechanism to the copying position and for returning it to the feed tray, the recirculation conveying mechanism including a discharge tray on which the plurality of documents are temporally discharged and accumulated and a moving mechanism for moving the documents accumulated on the discharge tray to the feed tray;

a feed sensor detecting whether or not any documents are present on the feed tray; and a controller which moves the documents discharged on the discharge tray to the feed tray by the moving mechanism when all documents on the feed tray are fed and the feed sensor detects that no documents are present on the feed tray, wherein the controller stops the movement of the refeed lever in the document conveying direction to return it in the opposite direction in the case where the feed sensor detects presence of the documents during the movement of the refeed lever by the moving mechanism.

9. The copying machine according to claim 8, wherein the controller stops the movement of the refeed lever by the movement mechanism in the case where the feed sensor does not detect the presence of the documents even if the refeed lever is moved a predetermined distance by the moving mechanism.

10. A sheet conveying apparatus for conveying a sheet in recirculation, comprising:

a feed tray on which a plurality of sheets are set;

a feed mechanism for feeding the plurality of sheets set on the feed tray one by one;

a recirculation conveying mechanism for conveying a sheet fed by the feed mechanism to return it to the feed tray, the recirculation conveying mechanism including a discharge tray on which the plurality of sheets are temporally discharged and accumulated and a moving mechanism for moving the sheets accumulated on the discharge tray to the feed tray; and a controller which decides whether or not all of the plurality of sheets fed by the feed mechanism are the same size, and which, if they are the same size, moves the plurality of sheets to the feed tray by the moving mechanism, and if they are not the same size, prohibits the movement of the sheets to the feed tray by the moving mechanism.

11. The sheet conveying apparatus according to claim 10, further comprising a warning means which gives a warning in the case where all of the plurality of sheets fed by the feed mechanism are not the same size.

12. The sheet conveying apparatus according to claim 11, wherein the controller cancels the warning condition to put the sheet conveying apparatus in a standby condition in the case where all of the plurality of sheets are fed.

* * * * *